US005825472A

United States Patent [19]

Araki et al.

[11] Patent Number: 5,825,472

[45] Date of Patent: Oct. 20, 1998

[54] PHOTOSENSITIVE DRUM, PROCESS CARTRIDGE AND IMAGE FORMING APPARATUS

[75] Inventors: Ryuji Araki; Yoshinori Sugiura, both of Kawasaki; Hideshi Kawaguchi, Yokohama; Hiroaki Miyake, Kawaguchi; Yoshiya Nomura, Tokyo; Kenji Matsuda, Yokohama; Kouji Miura, Sagamihara, all of Japan

[73] Assignee: Canon Kabushiki Kaisha, Tokyo, Japan

[21] Appl. No.: 684,627

[22] Filed: Jul. 22, 1996

Related U.S. Application Data

[63] Continuation of Ser. No. 235,421, Apr. 28, 1994, abandoned.

[30] Foreign Application Priority Data

Apr. 28, 1993 [JP] Japan ..... 5-123115

[51] Int. Cl.[6] ..... G03G 15/00

[52] U.S. Cl. ..... 355/200; 355/210

[58] Field of Search ..... 355/200, 210, 355/211, 260; 74/665 F, 665 GA, 665 GD, 412 R, 421 R

[56] References Cited

U.S. PATENT DOCUMENTS

| | | | |
|---|---|---|---|
| 3,733,921 | 5/1973 | Carveth | 74/439 |
| 4,244,288 | 1/1981 | Harasina | 101/93.02 |
| 4,829,336 | 5/1989 | Kanemitsu et al. . | |
| 4,931,834 | 6/1990 | Suga | 355/200 |
| 4,967,239 | 10/1990 | Sakakura | 355/211 X |
| 5,047,803 | 9/1991 | Kanoto | 355/211 |
| 5,126,800 | 6/1992 | Shishido et al. . | |
| 5,132,728 | 7/1992 | Suzaki et al. | 355/200 |
| 5,210,574 | 5/1993 | Kita | 355/211 |
| 5,272,506 | 12/1993 | Goto et al. | 355/219 |
| 5,298,941 | 3/1994 | Tenpaku | 355/200 |
| 5,321,469 | 6/1994 | Ahn | 355/211 |
| 5,331,372 | 7/1994 | Tsuda et al. | 355/200 |

FOREIGN PATENT DOCUMENTS

| | | |
|---|---|---|
| 0314536 | 5/1989 | European Pat. Off. . |
| 0443461A2 | 8/1991 | European Pat. Off. . |
| 0577404A1 | 1/1994 | European Pat. Off. . |
| 0622696 | 11/1994 | European Pat. Off. . |
| 0622699 | 11/1994 | European Pat. Off. . |
| 0632342 | 1/1995 | European Pat. Off. . |
| 58-115452 | 7/1983 | Japan . |
| 58-176046 | 10/1983 | Japan . |
| 4-319629 | 11/1992 | Japan . |
| 4-280266 | 10/1995 | Japan . |

*Primary Examiner*—S andra L. Brase

*Attorney, Agent, or Firm*—Fitzpatrick, Cella, Harper & Scinto

[57] ABSTRACT

A photosensitive drum usable with an image forming apparatus includes a cylindrical member having a photosensitive material at its surface; and juxtaposed helical gear and spur gear at a longitudinal end of the cylindrical member.

114 Claims, 74 Drawing Sheets

| TEST Nos. | BLADE CONTACT PRESSURE (gf/cm) | AVE. PARTICLE SIZE (μm) | CLEANABILITY | CHARGEABILITY | DRUM STATE |
|---|---|---|---|---|---|
| 1 | 15 | 9 | ○ | ○ | ○ |
| 2 | 15 | 7 | × | × | ○ |
| 3 | 20 | 7 | △ | △ | ○ |
| 4 | 20 | 4 | △ | △ | ○ |
| 5 | 25 | 7 | ○ | ○ | ○ |
| 6 | 25 | 5 | ○ | ○ | ○ |
| 7 | 25 | 4 | ○ | ○ | ○ |
| 8 | 60 | 7 | ○ | ○ | △ |
| 9 | 60 | 4 | ○ | ○ | △ |
| 10 | 65 | 7 | ○ | ○ | × |
| 11 | 65 | 4 | ○ | ○ | × |

FIG. 36

PHOTOSENSITIVE DRUM, PROCESS CARTRIDGE AND IMAGE FORMING APPARATUS

This application is a continuation application of application Ser. No. 08/235,421, filed Apr. 28, 1994, now abandoned.

FIELD OF THE INVENTION AND RELATED ART

The present invention relates to a photosensitive drum usable for image formation in an image forming apparatus, a process cartridge detachably mountable relative to an image forming apparatus and including the photosensitive drum, and an image forming apparatus.

The image forming apparatus may be in the form of a laser beam printer, an LED printer, an electrophotographic copying machine, a facsimile machine, a wordprocessor or the like.

In a transfer type electrophotographic copying machine or electrophotographic printer as examples of conventional image forming apparatus, a toner image is formed on a photosensitive drum through known processes including charging, image exposure, development or the like on the photosensitive drum, and the image is transferred onto a recording material such as transfer sheet, and thereafter, residual toner remaining on the photosensitive drum is removed by a cleaner.

In such an image forming apparatus, a photosensitive drum and at least one of a charger, a developing device, a cleaner or other process means are unified for the purpose of downsizing and easy maintenance, and the unit is made detachably mountable relative to the image forming apparatus (process cartridge). This is disclosed for example, in U.S. Pat. Nos. 3,985,436, 4,500,195, 4,540,268 and 4,627,701. As described in U.S. Pat. No. 4,829,335, having been assigned to the assignee of the application, a helical gear is mounted to a longitudinal end of the photosensitive member. According to this proposal, when driving through the helical gear is effected, a thrust force is produced, and the force is usable for correct positioning of the photosensitive member in the thrust direction, and therefore, the proposal is practically significantly effective.

U.S. Pat. No. 5,126,800 which has been assigned to the assignee of this application, proposes that an image bearing member is provided with first and second drive transmitting portions according to this invention, and by a selective engagement between the first and second transmitting portions and a third drive transmitting portion of a developer carrying member, the rotational speed of the developer carrying member is selectively changeable despite the common image bearing member. For this reason, this invention is practically effective.

The present invention is concerned with a further development.

SUMMARY OF THE INVENTION

An object of the present invention is to provide a photosensitive drum, a process cartridge and an image forming apparatus in which when the photosensitive drum is mounted to a frame of a process cartridge or a frame of the image forming apparatus or the like, and in which a plurality of drive trains capable of correctly transmitting the driving force as desired, can be constituted.

It is another object of the present invention to provide a photosensitive drum, a process cartridge and an image forming apparatus and a manufacturing method thereof in which the operativity during the manufacturing operation is improved.

It is another object of the present invention to provide a photosensitive drum, a process cartridge and an image forming apparatus and a manufacturing method thereof in which an assembling operativity is improved.

It is a yet further object of the present invention to provide a photosensitive drum, a process cartridge and an image forming apparatus and a manufacturing method in which a gear is downsized, the number of parts is reduced, and the manufacturing cost is reduced, and still, pitch non-uniformity of the gear is avoided.

According to an aspect of the present invention, the use is made of both a helical gear and a spur gear. Accordingly, when the photosensitive drum is mounted to a frame of a process cartridge or a frame of an image forming apparatus or the like, a plurality of drive transmission trains which are capable of correctly transmitting the driving force, are provided.

According to another aspect of the present invention, the helical gear and the spur gear are juxtaposed at a longitudinal end of a cylindrical member, and the operativity at the time of assembling the photosensitive drum is improved. This is because, when the gear is mounted to the cylindrical member, it can be mounted at one end.

According to a further aspect of the present invention, the operativity is improved when the photosensitive drum is mounted to a frame of the process cartridge or a frame of the image bearing member. This is because when the gear is mounted on one end of the cylindrical member, the operator can easily determine the mounting direction on the basis of the position of the gear.

These and other objects, features and advantages of the present invention will become more apparent upon a consideration of the following description of the preferred embodiments of the present invention taken in conjunction with the accompanying drawings.

BRIEF DESCRIPTION OF DRAWINGS

FIG. 36 is a table showing the relation between the blade pressure and average particle diameter of the toner.

DESCRIPTION OF THE PREFERRED EMBODIMENTS

Embodiment 1

Referring to drawings, a process cartridge according to the first embodiment of the present invention, and an image forming apparatus comprising such a process cartridge will be described in more concrete terms.

{General Description of Process Cartridge and Image Forming Apparatus Comprising Process Cartridge}

Figure 1:
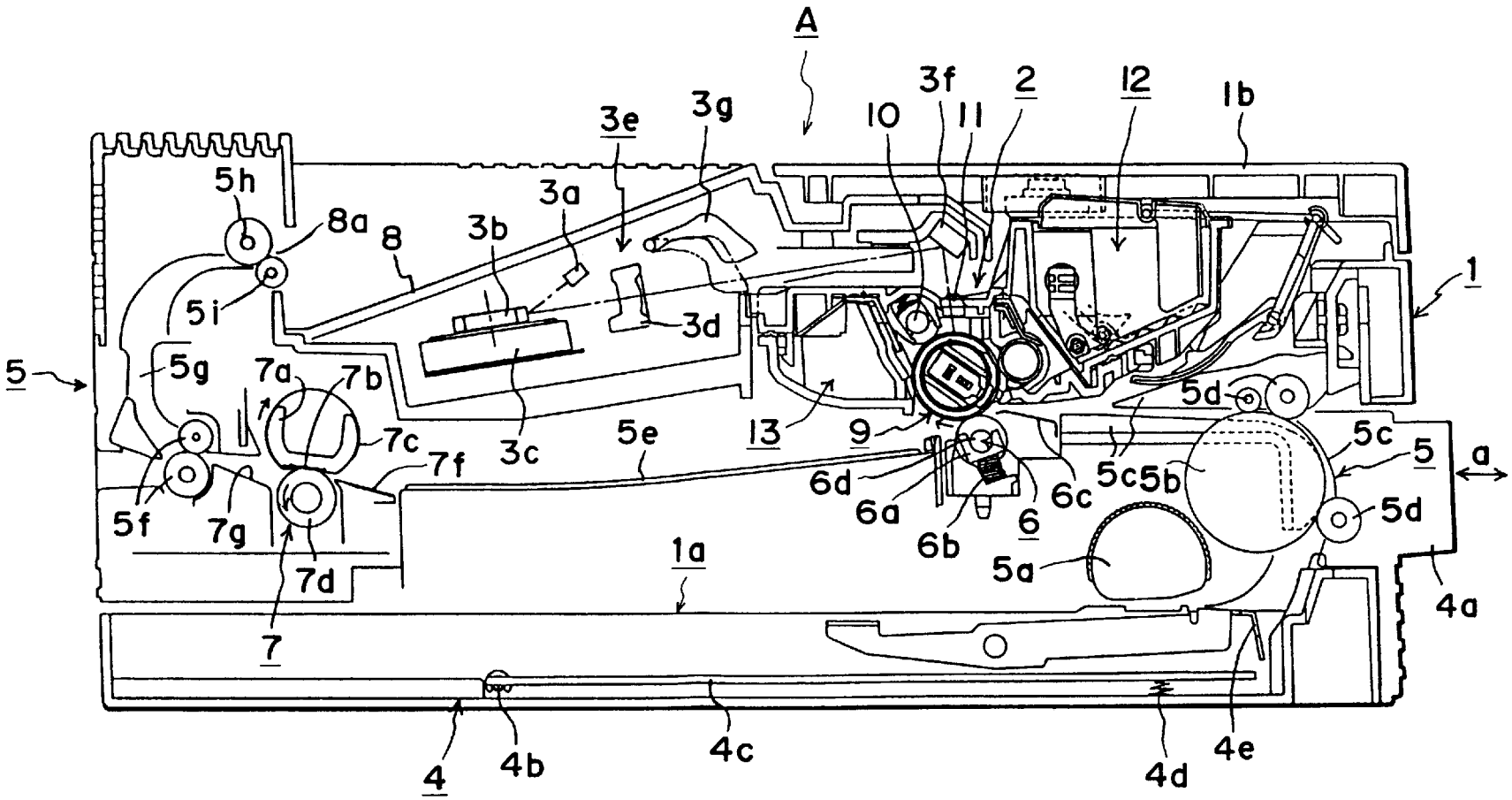
FIG. 1 is a sectional view of a laser printer, an exemplary mode of an image forming apparatus, showing its general structure containing a process cartridge.
Figure 2:
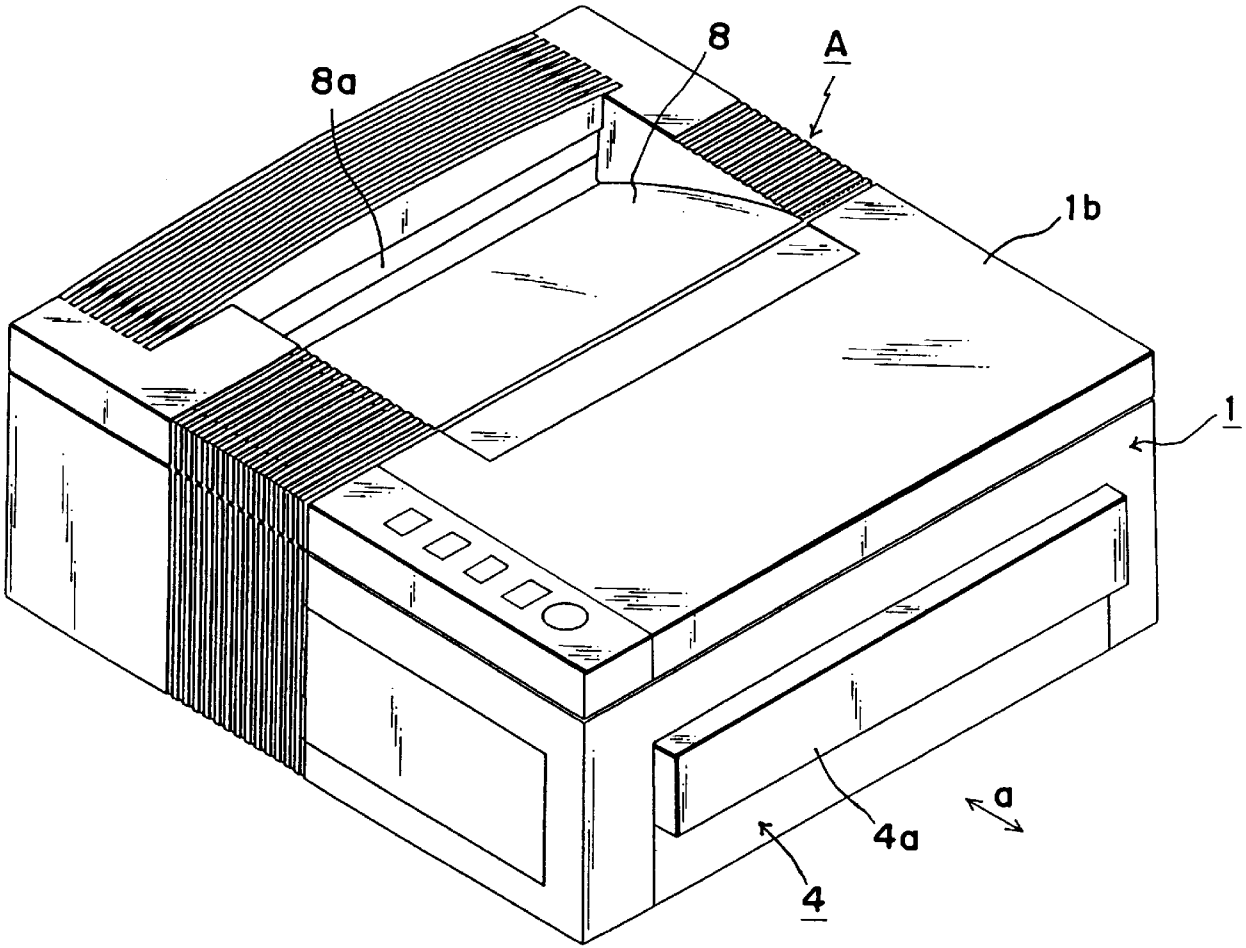
FIG. 2 is oblique external view of a laser printer.

First, the overall structure of the image forming apparatus will be described. FIG. 1 is a sectional view of a laser printer comprising a process cartridge, illustrating its general structure. FIG. 2 is an oblique external view of such a laser printer.

Referring to FIG. 1, this image forming apparatus A comprises an exchangeable process cartridge B, which is disposed in a cartridge installation space 2 within a main assembly 1 of the apparatus. The process cartridge B comprises an image bearing member and at least one processing means. Within the apparatus main assembly 1, an optical system 3 is disposed in the upper portion, and a cassette 4 is disposed in a cassette installation space 1*a* located at the bottom. The optical system 3 projects the light beam carrying the imaging information provided by an external apparatus or the like, onto the image bearing member within the process cartridge B, and the cassette 4 holds the recording medium. The recording medium within the cassette 4 is dispensed one by one by a recording medium conveying means 5. Also within the apparatus main assembly 1, a transferring means 6 is disposed so as to face the image bearing member of the installed process cartridge B. The transferring means transfers an image, which is formed on the image bearing member and developed by a developer (hereinafter, toner), onto the recording medium. On the downstream side of the transferring means 6 relative to the direction in which the recording medium is conveyed, a fixing means 7 is disposed, which fixes the toner image having been transferred onto the recording medium. The recording medium on which the toner image has been fixed is discharged by the conveying means 5, out into a discharge tray 8 located at the upper portion of the apparatus.

{Image Forming Apparatus}

Next, the structure of the image forming apparatus A will be described with regard to the optical system 3, recording medium conveying means, transferring means 6, and fixing means 7, in this order.

(Optical System)

The optical system projects the light beam carrying the imaging information provided by the external apparatus or the like, onto the image bearing member. As shown in FIG. 1, it comprises a scanner unit 3*e* and a mirror 3*f*, which are disposed in the apparatus main assembly 1, wherein the scanner unit 3*e* comprises a laser diode 3*a*, a polygon mirror 3*b*, a scanner motor 3*c*, and an image forming lens 3*d*.

When an imaging signal is sent in by an external equipment such as a computer or word processor, the laser diode 3*a* emits light in response to the imaging signal, and the emitted light is projected as the imaging beam to the polygon mirror 3*b*, which is being rotated at a high speed by the scanner motor 3*c*. The imaging beam reflected by the polygon mirror 3*b* is projected through the image forming lens 3*d* and is reflected by the mirror 3*f* onto the image bearing member, exposing selectively the surface of the image bearing member. As a result, a latent image according to the imaging information is formed on the image bearing member.

In this embodiment, the scanner unit 3*e* is slightly inclined upward so that the light beam transmitted through the image forming leans 3*d* is projected slightly upward toward the mirror 3*f*. The scanner unit 3*e* which is the projecting means of the laser beam is provided with a laser shutter 3*g* which takes a closed position (position indicated by a double dot chain line in FIG. 1) at which it blocks the laser beam passage to prevent the laser beam from being unintentionally leaked, and a opened position (the position indicated by the solid line in the figure) to which it retracts from the closed position to unblock the laser beam passage when the scanner is in use.

(Recording Medium Conveying Means)

The recording medium feeding means 5 feeds one by one the recording medium contained in the cassette 4 to an image forming station, and also, to the discharge tray 8 through the fixing means 7. The cassette 4 is placed in a manner so as to extend across substantially the entire length of the bottom portion of the apparatus main assembly 1. It can be pushed into or pulled out of the cassette installation space 1*a* of the apparatus main assembly 1, by a handle 4*a*, from the front side of the apparatus main assembly 1, in the direction indicated by an arrow a. The cassette 4 comprises a load plate 4*c* being pressed upward by a spring 4*d* in a manner so as to pivot about a shaft 4*b*. As the recording medium is mounted on this load plate 4*c*, the leading end of the recording medium, relative to the direction in which the recording medium is conveyed, comes in-contact with a separating claw 4*e*.

After the cassette 4 is installed, the recording medium in the cassette 4 is separated one by one from the top and is conveyed out of the cassette 4, by a rotating pickup roller 5*a*. The recording medium conveyed out of the cassette 4 is further conveyed through a first reversing sheet path comprising a reversing roller 5*b*, a guide 5*c*, roller 5*d* and the like, to be delivered to the image forming station. Then, the recording medium is fed into a pressure nip formed by the image bearing member and the transferring roller 6 in the image forming station. In this pressure nip, the toner image having been formed on the surface of the image bearing member is transferred onto the recording medium. The recording medium having received the toner image is guided by a cover guide 5*e* and is delivered to the fixing means 7, where the toner image is fixed on the recording medium. After passing through the fixing means 7, the recording medium is delivered by way of a relay roller 5*f* to a bow-shaped second reversing path 5*g*. While passing through this second reversing path 5*g*, the recording medium is again reversed, and is discharged by a pair of rollers 5*h* and 5*i* from a discharge opening 8*a*, into the discharge tray 8 disposed above the scanner unit 3*e* and the installed process cartridge B.

The recording medium conveyance path in this embodiment has the so-called S-shape made up by the first and second reversing paths. This arrangement not only makes it possible to reduce the space occupied by this apparatus, but also, accumulates the recording medium in the discharge tray 8, in the normal numerical order, with its image carrying surface facing downward.

(Transferring Means)

The transferring means 6 transfers the toner image formed on the image bearing member in the image forming station, onto the recording medium. The transferring means 6 of this embodiment comprises a transferring roller 6, as shown in FIG. 1. The transferring roller 6 presses the recording medium onto the image bearing member of the installed process cartridge B. With the recording medium being pressed upon the image bearing member, a voltage having the polarity opposite to that of the toner image is applied to the transferring roller 6, whereby the toner image on the image bearing member is transferred onto the recording medium.

The transferring roller 6 is supported by a bearing 6*a* loaded with the pressure from a spring 6*b*, whereby it is pressed upon the image bearing member. On the upstream side of the transferring roller 6, relative to the recording medium conveyance direction, there is a guide member 6*c*, which stabilizes the recording medium as the recording medium enters into the nip between the image bearing member and the transferring roller 6, and at the same time, shields the surface of the transferring roller 6 to prevent the toner from being scattered. After being passed through the nip between the image bearing member and transferring roller 6, the recording medium is conveyed in the downward direction, holding an angle of approximately 20 degrees, relative to the horizontal direction, so that it can be surely separated from the image bearing member.

(Fixing Means)

The fixing means 7 fixes the toner image, which has been transferred onto the recording medium by the voltage application to the transferring roller 6. Its structure is as shown in FIG. 1. In the fixing means 7, a reference numeral 7*a* designates a heat resistant film guide member shaped like a trough, the cross section of which forms a substantial semicircle. On the under side surface of this guide member 7*a*, a low thermal capacity ceramic heater 7*b* of a flat plate shape is disposed, extending along the approximate longitudinal center line. Further, around the guide member 7*a*, a cylindrical (endless) thin film 7*c* of heat resistant resin is loosely fitted. This film 7*c* comprises three layers: an approximately 50 $\mu$m thick polyimide base film, an approximately 4 $\mu$m thick primer layer, and an approximately 10 $\mu$m fluorine coat layer. The base layer material has a high tensile strength and it is thick enough to withstand the stress or wear inflicted upon the film. This primer layer is made of a mixture of PTFE, PFA, and carbon; therefore, it is electrically conductive.

Also on the under side of the guide member 7*a*, a pressure roller 7*d* is disposed in contact with he ceramic heater 7*b*, with constant pressure provided by a spring (not shown), and the film 7*c* being interposed. In other words, the ceramic heater 7*b* and pressure roller 7*d* form a fixing nip, with the film 7*c* being interposed. The pressure roller 7*d* comprises a metallic core and soft silicone rubber, and the silicone rubber is fluorine coated on its peripheral surface.

The ceramic heater 7*b* generates heat when supplied with electricity, and is controlled to keep a predetermined fixing temperature, by a temperature control system of a central control portion. The pressure roller 7*d* is rotated counterclockwise as indicated by an arrow in FIG. 1, at a predetermined peripheral velocity. As the pressure roller 7*d* is rotatively driven, the cylindrical film 7*c* is clockwise rotated at a predetermined peripheral velocity around the film guide member 7*a* as indicated by the arrow mark in FIG. 1, by the friction between the roller 7*d* and film 7*c*, through the fixing nip, remaining tightly in contact with and sliding on the downward facing surface of the ceramic heater 7*b*.

After undergoing the image transfer process, the recording medium is delivered to the fixing means 7, where it is guided by an entrance guide 7*f* into the fixing nip formed between the temperature controlled ceramic heater 7*b* and pressure roller 7*d*. In the fixing nip, the recording medium is fed between the cylindrical film 7*c* which is being rotatively driven, and pressure roller 7*d*, and is passed through the nip together with the film in a manner of being laminated together, remaining tightly pressed upon the downward facing surface of the ceramic heater 7*b*, with the film 7*c* being interposed.

While passing through the fixing nip, the unfixed toner image on the recording medium receives, through the film 7*c*, the heat from the ceramic heater 7*b*, whereby the toner image is thermally fixed on the recording medium. After coming out of the fixing nip, the recording medium is separated from the surface of rotating film 7*c*, is guided by an exit guide 7*g*, is further conveyed by the relay roller 5*f*, is passed through the second reversing sheet path 5*g*, and is discharged into the discharge tray 8 by the discharging roller pair 5*h* and 5*i*.

(Process Cartridge)

Figure 3:
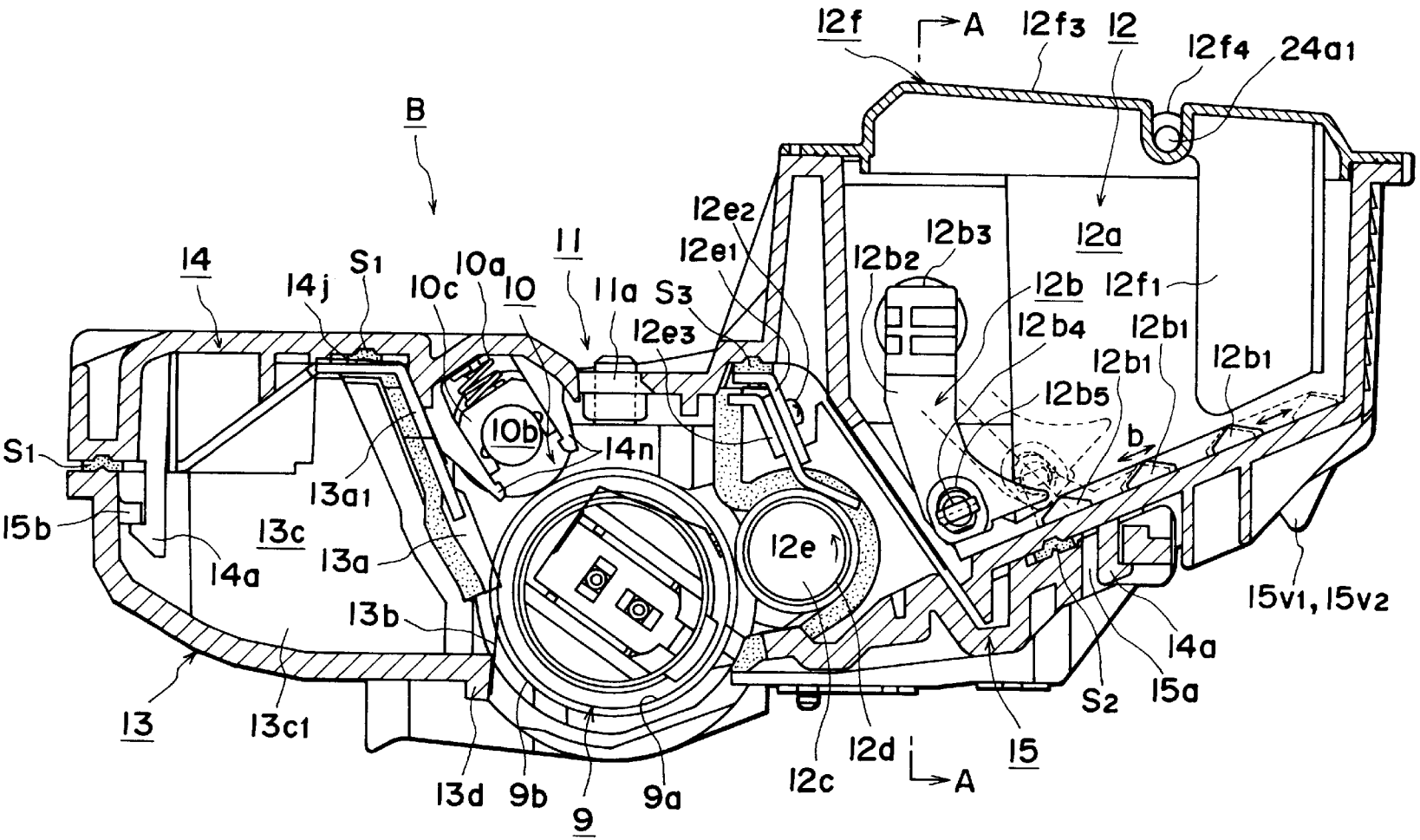
FIG. 3 is a sectional view of the process cartridge illustrated in FIG. 1.
Figure 4:
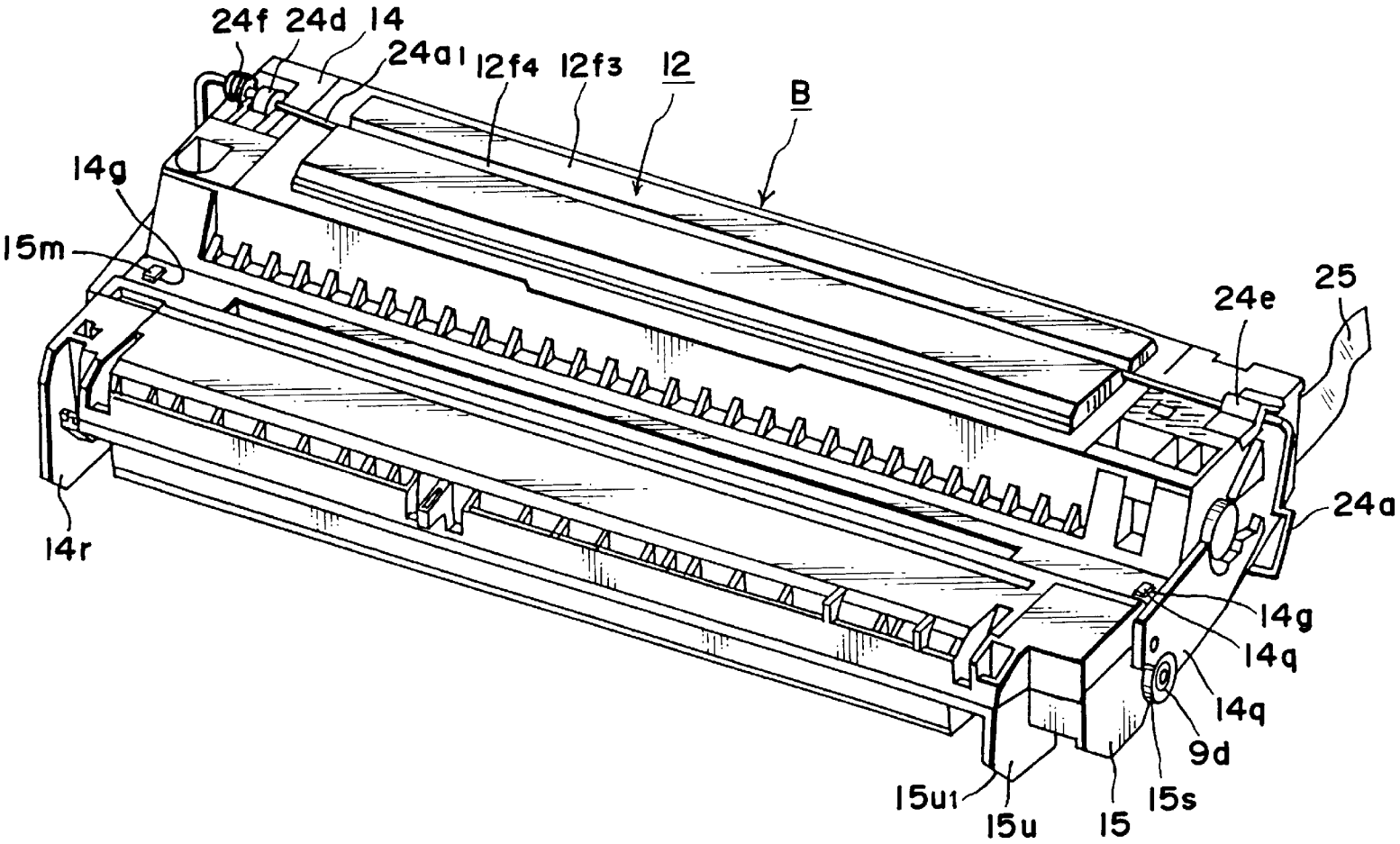
FIG. 4 is an oblique external view of the process cartridge.
Figure 5:
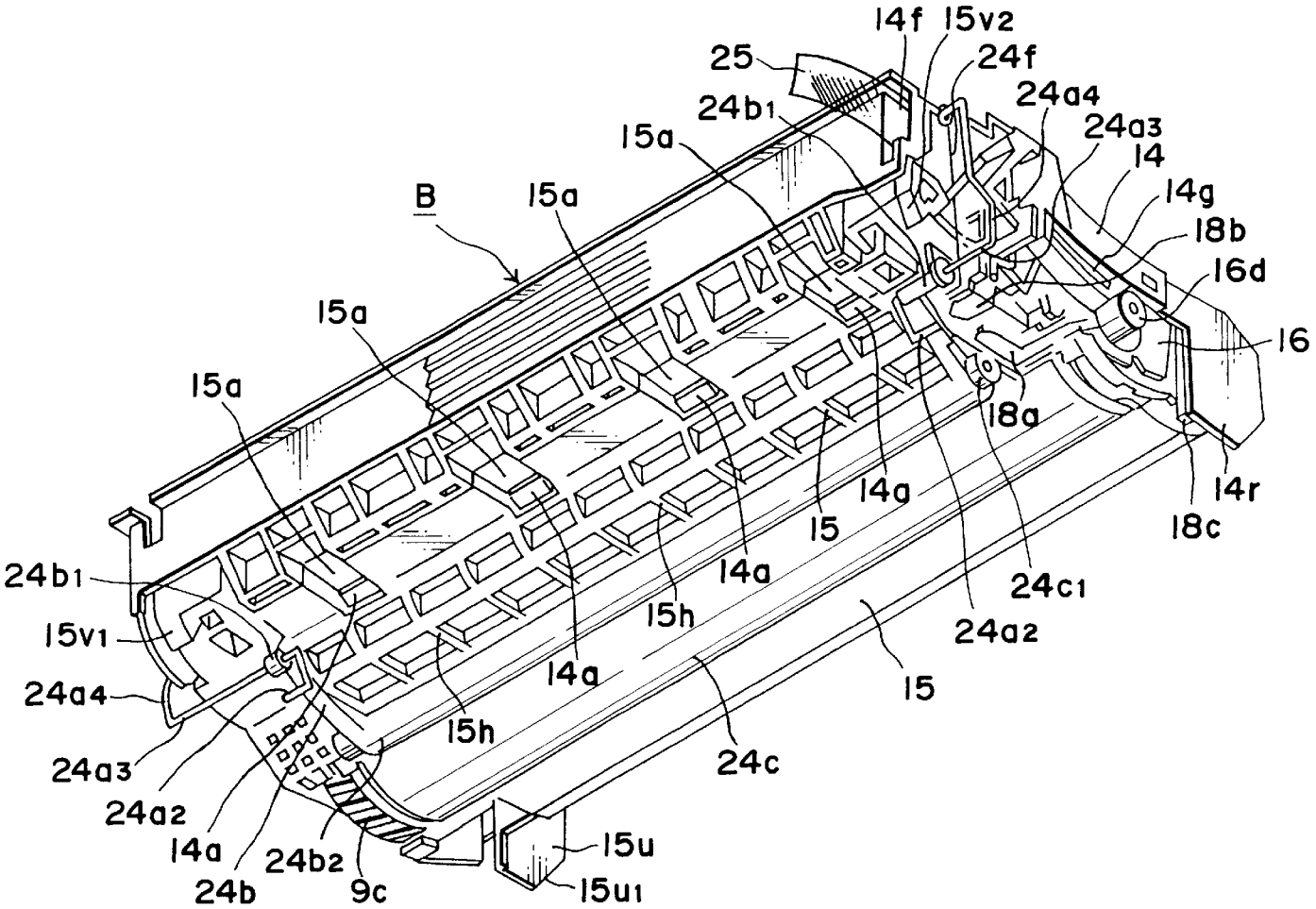
FIG. 5 is an oblique external view of the process cartridge, as seen from the bottom side.
Figure 6:
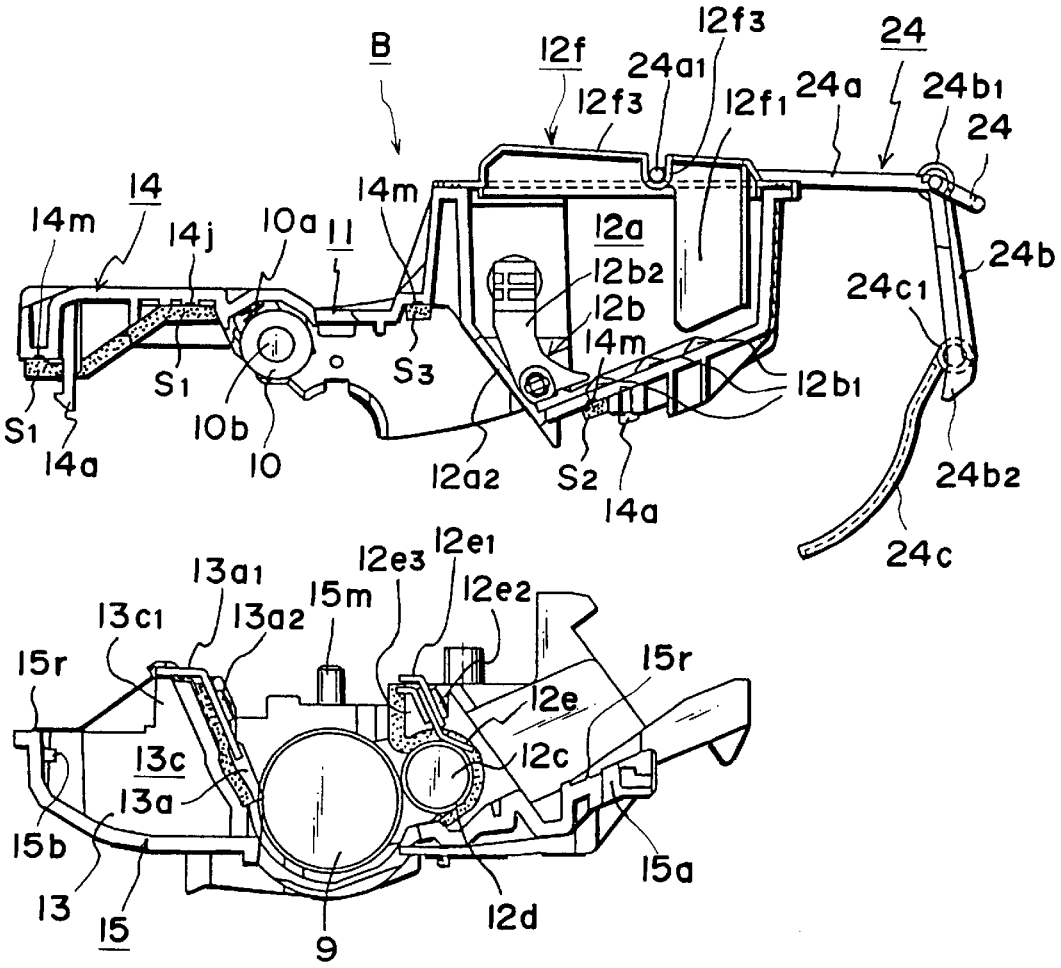
FIG. 6 is a sectional view of the process cartridge, being separated into the top and bottom frames.
Figure 7:
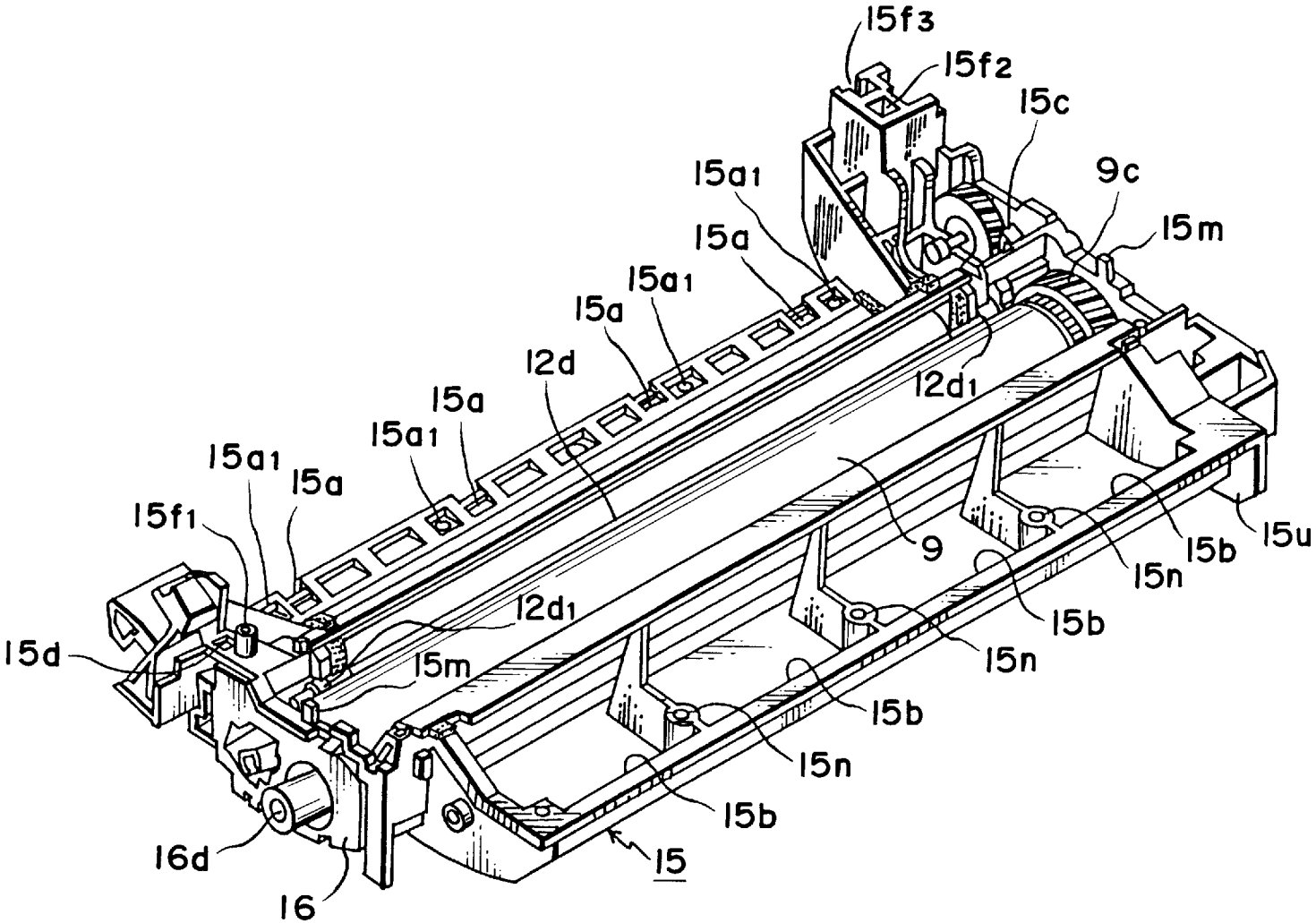
FIG. 7 is an oblique internal view of the bottom frame.
Figure 8:
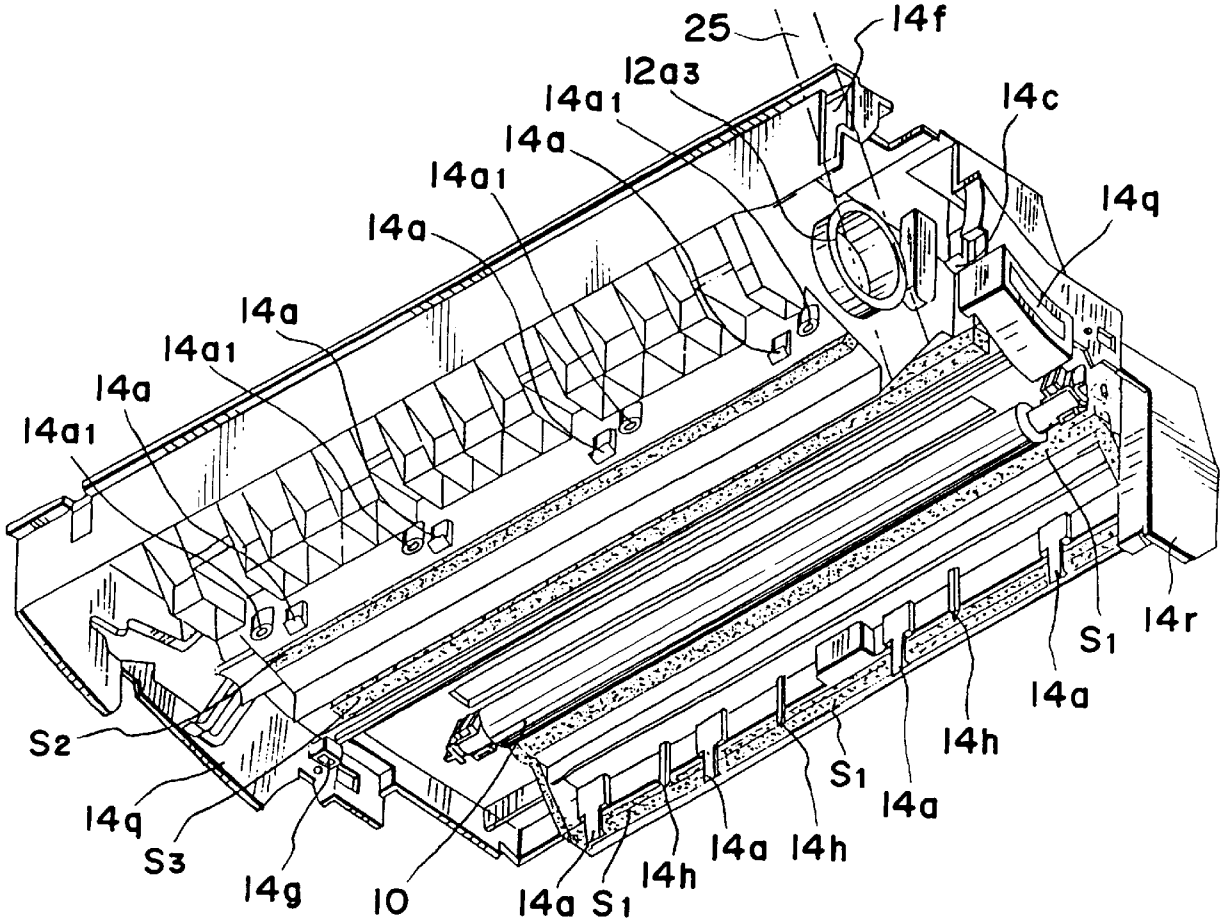
FIG. 8 is an oblique internal view of the top frame.

Next, the structures of the various portions of the process cartridge B to be installed in the image forming apparatus A will be described. FIG. 3 is a sectional view of the process cartridge, showing its structure. FIG. 4 is an oblique external view of the process cartridge. FIG. 5 is an oblique external view of the process cartridge, as seen with the bottom side facing upward. FIG. 6 is a sectional view of the process cartridge which has been separated into top and bottom portions. FIG. 7 is an oblique internal view of the bottom half of the cartridge. FIG. 8 is an oblique internal view of the top half.

This process cartridge B comprises an image bearing member and at least one processing means. As for the processing means, there are, for example, a charging means for charging the surface of the image bearing member, a developing means for forming a toner image on the image bearing means, and a cleaning means for cleaning the residual toner from the image bearing member surface, or the like. The process cartridge B of this embodiment comprises a electrophotographic photosensitive drum 9 as the image bearing member, a charging member 10, a developing means 12 containing the toner (developer), and cleaning member 13, wherein the photosensitive drum 9 is surrounded by the rest of the processing means as shown in FIGS. 1 and 3. These processing means are integrally contained in a housing made up of the top and bottom frame members 14 and 15, forming thereby an exchangeable cartridge which can be installed into or taken out of the apparatus main assembly 1.

In the top frame member 14, the charging means 10, an exposing means 11, and the toner storage of the developing means 12 are contained, as shown in FIGS. 6 and 8, and in the bottom frame member 15, the photosensitive drum 9, the developing sleeve of the developing means 12, and the cleaning means 13 are contained as shown in FIGS. 6 and 7. Next, the structures of the various portions of the process cartridge B will be described in detail, with reference to the photosensitive drum 9, charging means 10, exposing means 11, developing means 12, and cleaning means 13, in this order.

(Photosensitive Drum)

<Structure of Photosensitive Drum)

The photosensitive drum 9 of this embodiment is 24 mm in external diameter and comprises an electrically conductive base member 9*a* made of a cylindrical piece approximately 0.8 mm thick aluminum, and an organic semiconductor (OPC) coated as the photosensitive layer on the peripheral surface of the electrically conductive base member 9*a*. The photosensitive drum 9 is rotated for an image forming operation by the driving force transmitted to a flange gear affixed to one end of the drum 9, from an unshown driving motor, wherein the other end of the drum 9 is open. This open end of the drum 9 is supported by a bearing 16*a* of a bearing member 16.

<Flange Gear>

The flange gear comprises two gears, a helical gear 9*c*1 disposed on the outward side and a spur gear 9*c*2 disposed on the inward side, and is fixed to the left end (driving side) of the photosensitive drum 9, relative to the direction in which the recording medium is conveyed. This flange gear 9*c* is integrally molded of plastic material by injection molding.

As to the material for the flange gear 9*c*, polyacetal having slippery properties is used in this embodiment, but ordinary polyacetal or fluorinated polycarbonate may be used.

With regard to the flange gear 9*c*, the helical gear 9*c*1 on the outward side and spur gear 9*c*2 on the inward side have different diameters, and in the case of this embodiment, the diameter of the helical gear 9*c*1 on the outer side is formed larger than that of the spur gear 9*c*2 on the inner side. Also, the helical gear 9*c*1 is wider and has a larger number of teeth than the spur gear 9*c*2; therefore, even when a heavy load is imparted on the flange gear 9*c*, the driving force from the main assembly can be reliably transmitted to rotate the photosensitive drum 9, and also, to stably rotate the gear engaged with this gear 9*c*, by transmitting a large driving force.

The spur gear 9*c*2 is engageable with a gear provided in the main assembly to transmit the driving force for rotating the transfer roller.

Given below are data of the exemplary gears. However, the present invention is not limited to the examples.

(1) External diameter of helical gear 9*c*1 (z1): approx. 28.9 mm (2) External diameter of spur gear 9*c*2 (z2): approx. 26.1 mm (3) Tooth width of helical gear 9*c*1 (z3): approx. 7.7 mm (4) Tooth width of spur gear 9*c*2 (z4): approx. 4.3 mm (5) Number of teeth of helical gear 9*c*1 (z5): 33

(6) Number of teeth of spur gear 9*c*2 (z6): 30

(7) Module of helical gear 9*c*1 (z7): 0.8

(8) Module of helical gear 9*c*2 (z8): 0.8

(9) Helix angle and direction of helical gear 9*c*1: right, 14.6°

As stated hereinbefore, the flange gear 9*c* comprises two gears 9*c*1 and 9*c*2 disposed side by side and is made of plastic material by injection molding, having been hollowed out below the tooth bottom; therefore, the flange gear 9*c* is weak against a force exerted in the radial direction, being likely to be deformed by the load imparted upon it as the driving force is transmitted.

Therefore, in order to prevent this deformation, a reinforcement member 9*c*4 is press-fitted in a hollowed portion 9*c*3 of the flange gear 9*c*. The reinforcement member 9*c*3 is preferred to be press-fitted into the hollowed portion 9*c*3 at the outer periphery as well as the inner periphery. According to a test conducted by this inventor, the press-fitting degree was preferred to be set in a range of 0–50 $\mu$m. This is because the gear tip circle diameter expands, or a like problem occurs, when the press-fitting condition is larger than the one in the aforementioned range, and also, because a condition less than the one in the aforementioned range is not so effective for increasing the gear strength.

It has been confirmed by a test that the pitch irregularity, which appears in the image corresponding to the pitch of the drum gear (flange gear 9*c*), can be eliminated by press-fitting the reinforcement member 9*c*4 in the hollowed portion 9*c*3 of the flange gear 9*c*.

Next, as to the means for affixing the flange gear 9*c* to the photosensitive drum 9, the photosensitive drum 9 and flange 9*c* are connected by crimping the edge of the photosensitive drum 9*a* at a portion 9*a*1 (two locations) onto a groove 9*c*5 of the flange gear 9*c* by a special tool. In this embodiment, the crimping is done at two locations, but the number of crimping locations is not limited to two. The essential thing is that the two components must be fixed to each other firmly enough to overcome the load imparted upon the flange gear 9*c*. By adopting this fixing means, the prior fixing means, which has been rather unreliable because of the use of glue, can be replaced by the more reliable mechanical fixing means.

<Ground Contact for Drum>

Figure 9:
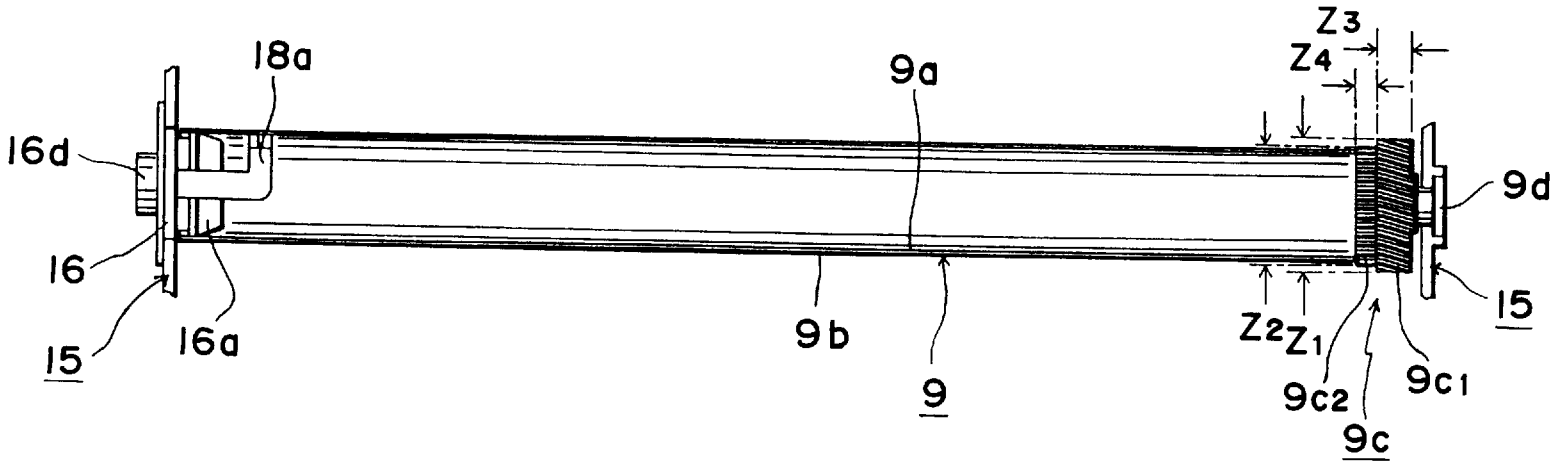
FIG. 9 is a sectional view of a photosensitive drum.

Referring to FIG. 9, the photosensitive drum 9 of this embodiment is grounded by placing an electrically conductive ground contact 18*a* in contact with the internal peripheral surface of the drum 9. This ground contact 18*a* is disposed so as to contact the photosensitive drum 9 on the upper internal surface and on the side opposite to where the flange gear 9*c* is attached.

Figure 11:
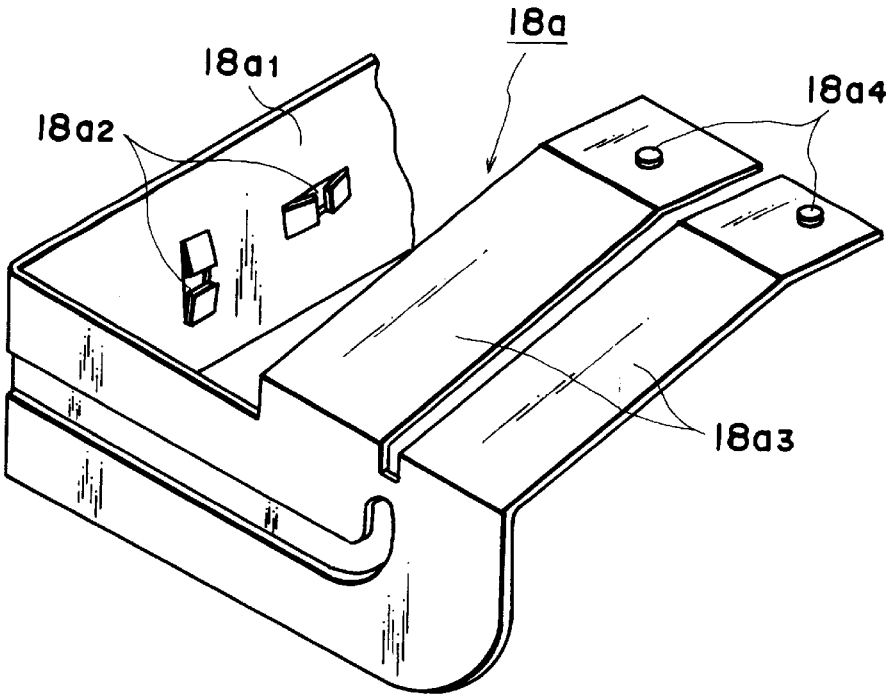
FIG. 11 is an oblique view of a drum ground contact.

The ground contact 18*a* is made of electrically conductive material such as stainless steel spring material, phosphor bronze spring material, or the like, and is attached to a bearing member 16 which rotatably supports the photosensitive drum 9, on the side by which the drum is not driven. More specifically describing its structure, referring to FIG. 11, holes 18*a*2 are cut through a base 18*a*1 for press-fitting around a boss provided on the bearing member 16. The base extends into two arms 18*a*3, at the end of each of which a semispherical projection is provided. These projections are disposed at different locations of their arms and project toward the back side of FIG. 11.

As the bearing member 16 is attached to the photosensitive drum 9, the projections 18*a*4 of this ground contact 18*a* are pressed upon the internal surface of the photosensitive member 9 by the elastic force of the arms 18*a*3. Having two or more locations (two in this embodiment) where contact is made with the photosensitive drum 9, the reliability of the ground contact 18*a* is improved, and also, the formation of the semispherical projections 18*a*4 as the actual contact points further stabilizes the contact between the photosensitive drum 9 and the contact point 18*a*.

Figure 12:
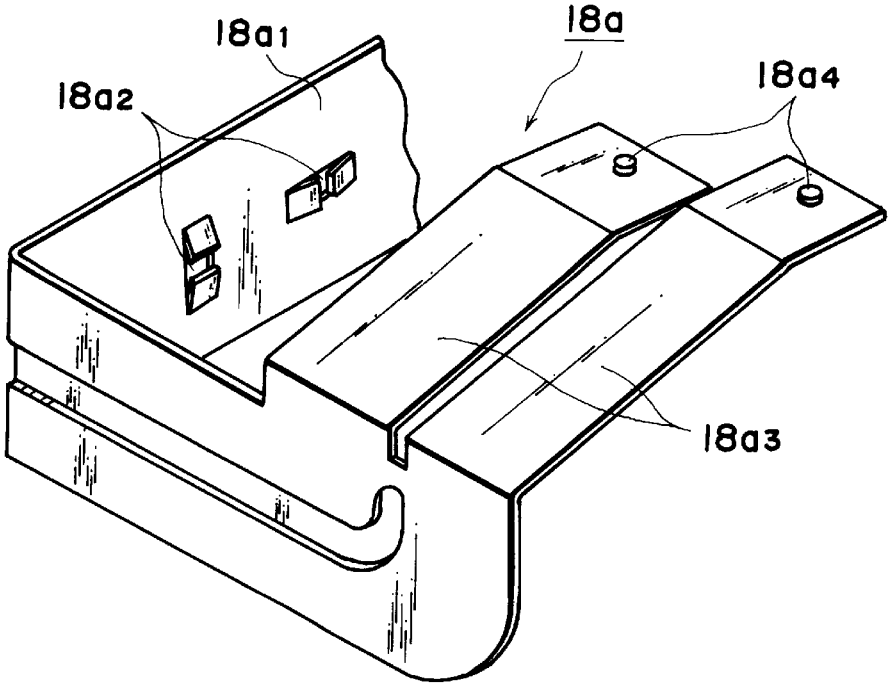
FIG. 12 is an oblique view of a drum ground contact.

In the case of the ground contact 18*a* described in the foregoing, the lengths of the arms 18*a*3 are the same and only the locations of the semispherical projections 18*a*4 are different, but instead, the lengths of the arms 18*a*3 of the ground contact 18*a* may be changed as shown in FIG. 12. This arrangement causes the contact points between the semispherical projections 18*a*4 and photosensitive drum 9 to be displaced from each other in the circumferential direction; therefore, even when a small imperfection or the like extends on the internal surface of the photosensitive drum 9, in the longitudinal direction of the drum 9, it does not happen that both semispherical projections 18*a*4 ride on the imperfection at the same time. As a result, the photosensitive drum 9 is even more reliably grounded. However, in the case of the latter arrangement, the difference in arm length causes the amount of arm deformation to be different between two arms 18*a*3, thereby causing the contact pressure to be different between the two contact points where the projections 18*a*4 make contact with the internal surface of the photosensitive drum 9, but this can be easily corrected by differentiating the bending angle between the arms 18*a*3.

Figure 13:
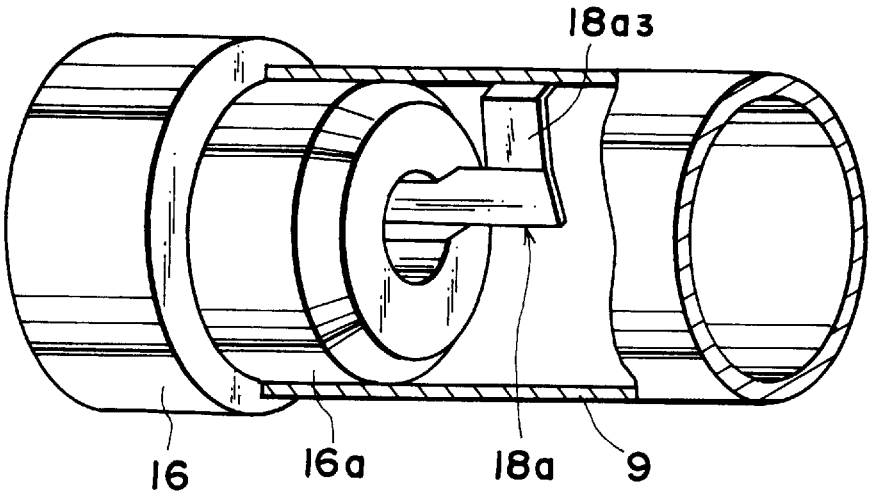
FIG. 13 is a partial cutaway view of the end portion of the photosensitive drum, showing an embodiment comprising a drum ground contact with no branch arm.
Figure 14:
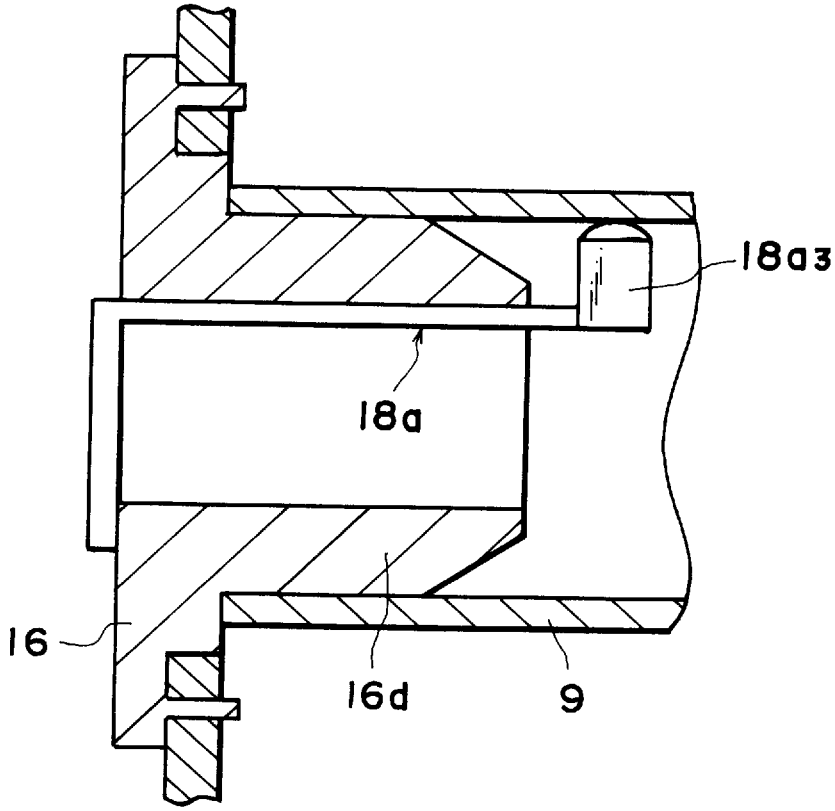
FIG. 14 is a sectional view of the embodiment comprising the drum ground contact with no branch arm.

As described in the foregoing, the ground contact 18*a* of this embodiment has two arms 18*a*3, but the number of arms 18*a*3 may be three or more, or just one (no branching) as shown in FIGS. 13 and 14, as long as the ground contact 18*a* reliably makes contact with the photosensitive drum 9. Further, a ground contact 18*a* which does not have such a semispherical projection or projections as described in the foregoing may be used.

When the contact pressure with which the ground contact 18*a* contacts the internal surface of the photosensitive drum 9 is too weak, the semispherical projection 18*a*4 cannot follow microscopic irregularities on the internal surface of the photosensitive drum, which is likely to cause contact failure, and which is likely to generate noises by vibrating the arm 18*a*3. In order to prevent this contact failure and vibration noise, the contact pressure must be increased, but unless the contact pressure is properly increased, the internal surface of the drum is scarred by the semispherical projection 18*a*4 while the image forming apparatus is operated for an extended period of time. Then, as the semispherical projection 18*a*4 rides on the thus created scars, vibration is generated, which sometimes affects the contact failure or vibration noise.

Taking these factors into consideration, the contact pressure between the internal surface of the photosensitive drum 9 and the drum grounding contact 18*a* is preferred to be set in a range of 10–200 g. According to a test conducted by this inventor, when the contact pressure was 10 g or less, contact failure was likely to occur as the photosensitive drum 9 rotated, generating electromagnetic waves which interfered with other electronic apparatuses, and when the image forming apparatus was used for an extended period of time with a contact pressure of 200 g or higher, the internal surface of the photosensitive drum 9 was scarred where the ground contact 8*a* slid, which is likely to cause strange noises or contact failure as the photosensitive drum 9 rotates.

There are cases in which, because of the internal surface condition of the photosensitive drum 9, noise or the like cannot be completely eliminated. Nevertheless, the scarring or contact failure can be more surely prevented by applying electrically conductive grease to the internal surface of the drum, on the areas where the ground contact 18*a* slides.

As for the contact location where the ground contact 18*a* contacts the internal surface of the photosensitive drum 9, it is preferred on the upper side (substantially diametrically opposed from the transfer roller 6) of the internal surface of the drum 9, as shown in FIG. 3. This is because, as the photosensitive drum 9 is driven, it is imparted with a force directed toward the transferring roller 6 and this force is likely to be displaced by the amount of tolerance (or wear) toward the transferring roller 6. Therefore, the contact between two components becomes more reliable by disposing the ground contact 18*a* so as to contact the upper side of the internal surface of the drum.

<Drum Axle>

Figure 15:
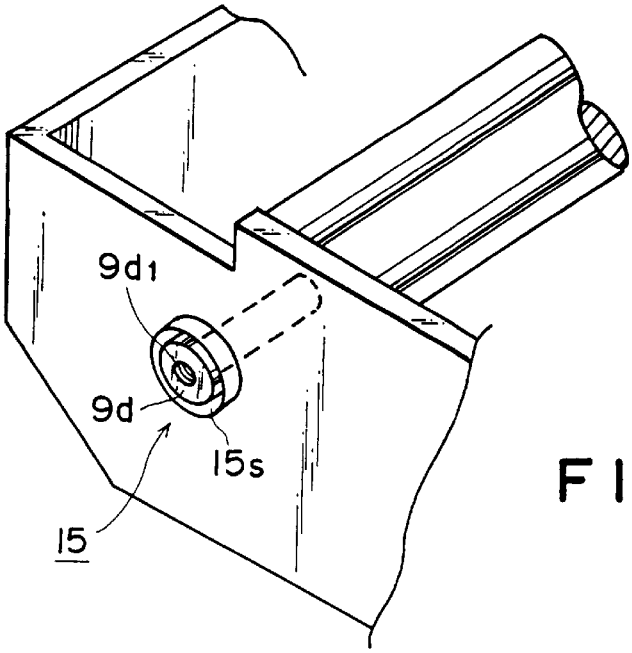
FIG. 15 is an enlarged oblique view of the area adjacent to a drum axle.

Referring to FIG. 9, the photosensitive drum 9 is rotatably supported by a metallic drum axle 9*d* on the driven side and by a bearing 16*a* of the bearing member 16 on the non-driven side. Next, referring to FIG. 15, the drum axle 9*d* is press-fitted in the axle hole 15*s* cut in the bottom frame 15 which houses the photosensitive drum 9, with a press-fitting condition of no more than 47 $\mu$m, and then, is inserted in the axle hole of the flange gear 9*c* affixed to the end of the photosensitive drum 9, rotatably supporting the drum 9. By press-fitting the drum axle 9*d* into the axle hole 15*s* of the bottom frame 15, the drum 9 can be supported without using a machine screw for affixing the drum axle 9*d* to the bottom frame 15. Therefore, this arrangement has the advantages that it does not happen that the bottom frame 15 becomes unrecyclable because the machine screw hole for affixing the drum axle has become too large, and also, that the tolerance of the drum axle 9*d* can be reduced to permit the photosensitive drum 9 to be more smoothly rotated in order to produce more precise images, that is, high quality images.

On one of the end surfaces of the drum axle 9*d* (surface exposed outward the process cartridge B), a screw hole 9*d*1 is drilled, which makes it easier to remove the press-fitted drum axle 9*d* when the process cartridge B is taken apart during the recycling. The material for the drum axle 9*d* may be either metal or plastic. The screw hole 9*d*1 has a female thread, is drilled in parallel to the orientation of the axle 9*d*, and is positioned approximately at the center of the end surface of the axle 9*d*.

Figure 16A:
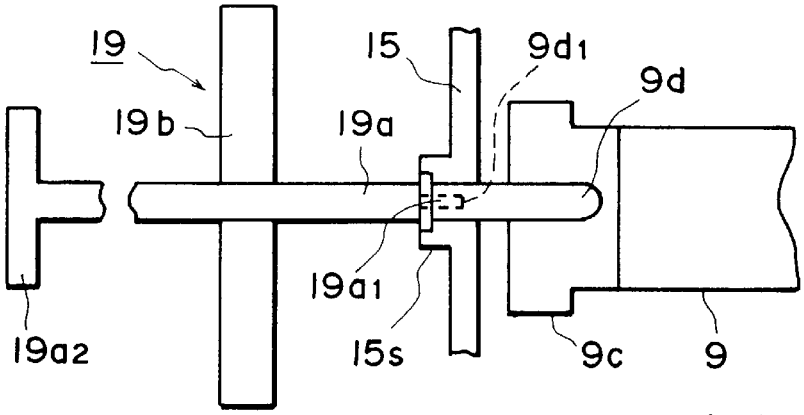
FIGS. 16(*a*) and 16(*b*) are schematic depictions of an operation for extracting a drum axle from the frame.
Figure 16B:
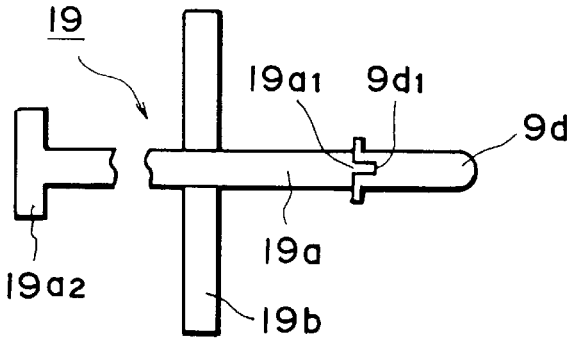

Referring to FIGS. 16(*a*) and 16(*b*), an example of an operation for extracting the drum axle 9*d* from the bottom frame 15 will be described. An extracting tool 19 for extracting the drum axle 9*d* comprises a shaft 19*a* having an external diameter of approximately 4 mm, a weight 19*b* having an external diameter of approximately 40 mm and a thickness of approximately 10 mm, and a stopper 19*a*2 having an external diameter of approximately 10 mm, wherein the shaft 19*a* is threaded at one end 19*a*1, is passed through the center hole cut in the weight 19*b*, and is affixed to the stopper 19*a*2 at the other end. By screwing the threaded portion 19*a*1 of this extracting tool 19 into the screw hole 9*d*1 of the drum axle 9*d* having been press-fitted in the bottom frame 15, and then, thrusting several times the weight 19*b* against the stopper 19*a*2, the drum axle 9*d* can be easily extracted from the bottom frame 15. The threaded portion 19*a*1 is cut as the male thread so that it can be screwed into the screw hole 9*d*1 with the female thread.

In this embodiment, the screw hole to be used when the cartridge is disassembled during the recycling is described, referring to a case in which the screw hole is drilled in the drum axle, which is press-fitted into the hole of the cartridge frame. The hole drilling is not limited to this case alone; instead, such a hole may be drilled in other members to be press-fitted, so that they can be easily extracted.

(Charging Means)

<Structure of Charging Means>

The charging means is for charging the surface of the photosensitive drum 9. In this embodiment, the so-called contact charging method such as the one disclosed in Japanese Laid-Open Patent Application No. 149669/1988 is employed. More specifically, referring to FIG. 3, a charging roller 10 is rotatably within the top frame 14 by a sliding bearing 10*c*. This charging roller 10 comprises a metallic roller shaft 10*b* (electrically conductive metallic core made of steel, SUS, or like material), an elastic rubber layer (made of EPDM, NBR, or like material) laminated on the roller shaft 10*b*, and a carbon-dispersed urethane rubber layer laminated over the elastic rubber layer, or it comprises a metallic roller shaft 10*b* and a carbon-dispersed, foamed urethane rubber layer coated on the roller shaft 10*b*.

Figure 17A:
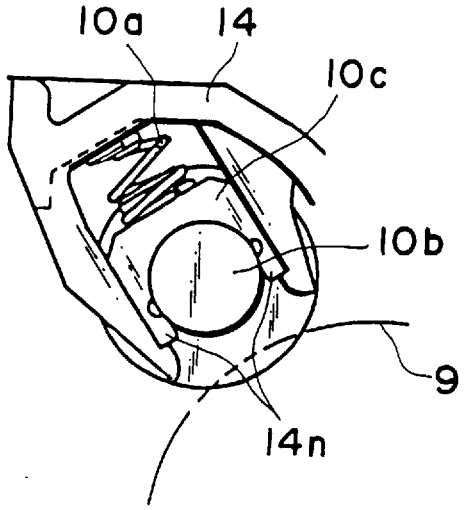
FIGS. 17(*a*) and 17(*b*) are enlarged side views of a charging roller and adjacent essential components.
Figure 17B:
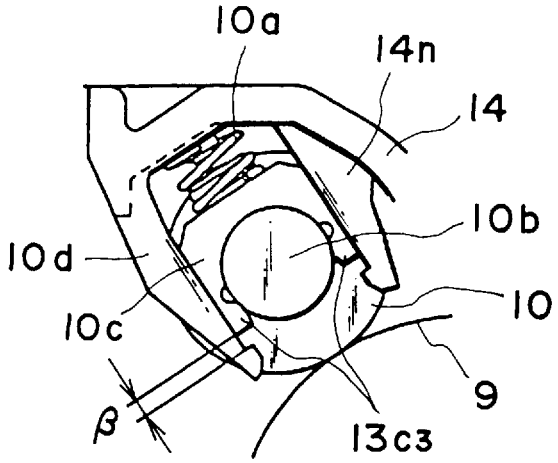

The slide bearing 10*c* rotatably supporting the roller shaft 10*b* of the charging roller 10 is held by a slide bearing guide claw 14*n* in such a manner that it is allowed to slide slightly toward the photosensitive drum 9 (FIG. 17(*b*)) without dropping out (FIG. 17(*a*)). Further, the slide bearing 10*c* rotatably supporting the roller shaft 10*b* is pressed by a spring 10*a* toward the photosensitive drum 9, whereby the charging roller 10 remains in contact with the surface of the photosensitive drum 9.

<Sliding Distance of Charging Roller>

As described in the foregoing, the charging roller 10 is in contact with the surface of the photosensitive drum 9, whereby it rotates following the rotation of the drum 9 as the drum 9 is driven. When the photosensitive drum 9 is driven by a force transmitted from an unshown driving motor, the drum 9 is forced toward the transferring roller. In other words, the photosensitive drum 9 is slightly displaced in a direction away from the charging roller 10. More specifically, the photosensitive drum 9 is displaced more at the non-driven side than at the driven side, though by an extremely small amount. When this occurs, the amount of distance by which the charging roller 10 slides in the radial direction toward the photosensitive drum 9 sometimes fails to keep in pace with the amount of distance by which the photosensitive drum 9 is displaced, thereby causing the photosensitive drum 9 and charging roller 10 to be separated.

Therefore, in this embodiment, the distance that is allowed for the charging roller 10 to slide toward the photosensitive drum 9 in the radial direction is set up to be larger compared to that for the prior one. Further, the sliding amount of the charging roller 10 in the radial direction is differently set between its longitudinal right and left sides; more specifically, the sliding distance for the sliding bearing 10*c* at the non-driven side (power supply side) is set up to be larger than that at the driven side (non-power supply side). In this embodiment, referring to FIGS. 17(*a*) and 17(*b*), the sliding amount β for each sliding bearing 10*c* for the charging roller 10 is set up to be approximately 1.5 mm on the non-driven side, and approximately 1.0 mm on the driven side. Further, in this embodiment, the sliding amount β for each sliding bearing 10*c* on the driven or non-driven side is set by changing, that is, by shortening, the distance between the mid point to a butting surface 10*c*3. In other words, when the charging roller 10 is installed in the top frame 14, the permissible amount of movement of the charging roller 10 in a direction (radial direction) perpendicular to the longitudinal axis of the charging roller 10 is differently selected between one side and the other side of the charging roller 10.

<Sliding Bearing>

The charging roller 10 and photosensitive drum 9 are more or less angularly disposed with respect to each other because of the tolerance of related components including the components such as the top frame in which they are installed. Therefore, when the photosensitive drum rotates, the charging roller 10, the rotation of which is slaved to that of the photosensitive drum 9, is subjected to a thrust directed in the axial direction, being thereby pushed to one side; therefore, the roller shaft 10*b* sometimes abuts against the side of the top frame 14, whereby the abutted portion is shaved by friction. Also, during the shipment of the cartridge, the roller shaft 10*b* of the charging roller 10 abuts, the side wall of the top frame 14 because of the vibration or the like, whereby the abutted portion is sometimes scarred. When these incidents occur, the roller shaft 10*b* of the charging roller 10 occasionally hangs up at the shaved or scarred portion, which breaks the contact between the charging roller 10 and photosensitive drum 9. As a result, defective images are produced. Further, the cartridge frames having been shaved or scarred may not be recyclable.

Figure 18:
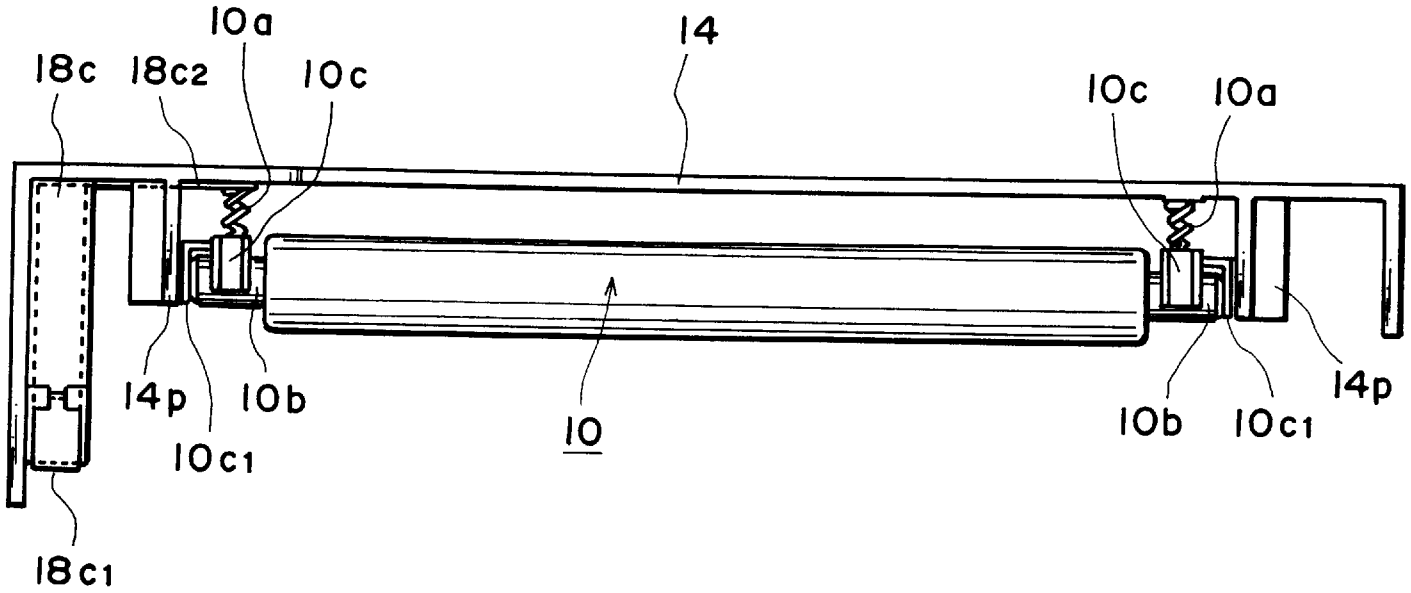
FIG. 18 is an enlarged front view of a charging roller and adjacent essential components.
Figure 19A:
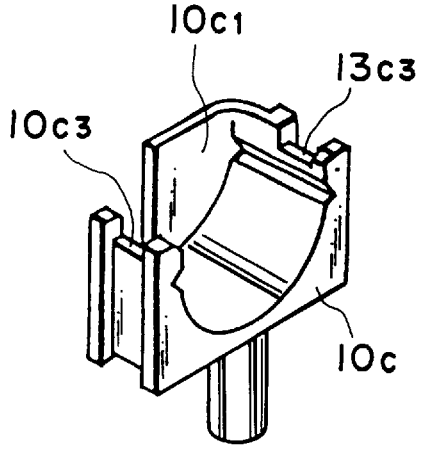
FIGS. 19(*a*) and 19(*b*) are oblique views of a charging roller bearing.
Figure 19B:
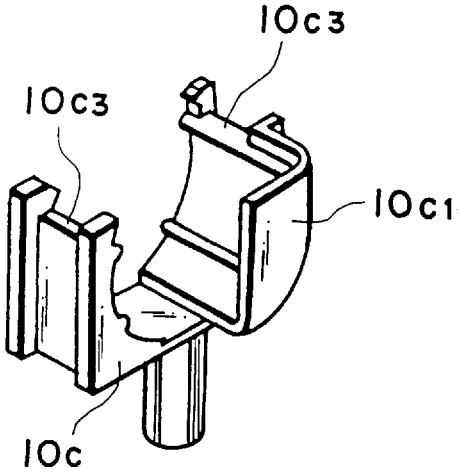

Therefore, in order to simplify the process for correcting the defects of the cartridge frames during manufacturing or recycling, a thrust regulating means for regulating the force directed in the axial direction of the charging roller 10 is integrally formed with the sliding bearing 10*c* which rotatably supports the roller shaft 10*b*, instead of being disposed in the top frame 14. In other words, a stopper 10*c*1 raked like a key is integrally formed, as the thrust regulating means, with each of the sliding bearings 10*c*, as shown in FIGS. 18 and 19(*a*) and 19(*b*). In this embodiment, the sliding bearing 10*c* on the power supply side (FIG. 19(*b*)) is formed of electrically conductive resin material containing a large amount of carbon filler, and the one on the non-power supply side (FIG. 19(*a*)) is formed of electrically non-conductive material such as polyacetal (POM).

Further, in order to prevent the slide guide claw 14*n* and sliding bearing 10*c* from being damaged when the process cartridge is dropped, or in a like situation, and the claw 14 and bearing 10*c* are subjected to a force in the thrust direction much larger than that to which the charging roller 9 is subjected when the photosensitive drum 9 is driven, pendent members 14*p* projecting downward from the top frame 14 are provided on the outward sides of the sliding bearings 10*c*, relative to the thrust direction.

All that is necessary for assembling the charging roller 10 into the top frame 14 is to, first, make the sliding bearing guide claw 14 support the sliding bearing 10*c*, with the spring 10*a* being interposed, and then, fit the roller shaft 10*b* of the charging roller 10 into the sliding bearing 10*c*. As this top frame 14 is combined with the bottom frame 15, the charging roller 10 comes to be pressed upon the photosensitive drum 9, as shown in FIG. 3.

<Voltage Applied to Charging Roller>

During the image forming operation, the surface of the photosensitive drum 9 is uniformly charged by applying to the charging roller 10 being rotated by the rotation of the photosensitive drum 9, an oscillating voltage composed by superposing an AC voltage on a DC voltage.

To describe more precisely the voltage applied to the charging roller, the voltage applied to the charging roller 10 may be a pure DC voltage, but in order to charge uniformly the photosensitive drum 9, it is preferred to apply an oscillating voltage composed by superposing an AC voltage on a DC voltage. More preferably, the charge uniformity can be enhanced by applying to the charging roller 9 an oscillating voltage generated by superposing an AC voltage, having a peak-to-peak voltage more than twice the charge start voltage at which the charging starts when a pure DC voltage is applied, on a DC voltage (Japanese Laid-Open Patent No. 149669/1988). Here, an oscillating voltage means generates a voltage, the value of which periodically changes in relation to time, and preferably has a peak-to-peak voltage more than twice the charge start voltage at which the surface of the photosensitive drum begins to be charged when a pure DC voltage is applied. Its waveform is not limited to a sine waveform; instead, it may be in the form of a rectangular waveform, a triangular waveform, or a pulse waveform. However, from the standpoint of charging noise, a sine waveform which does not contain high frequency components is preferable. The oscillating voltage also includes a voltage having a rectangular waveform formed by periodically turning on and off a DC power source, or a like voltage.

<Power Supply Path to Charging Roller>

Next, a power supply path to the charging roller 10 will be described. Referring to FIG. 18, one end portion 18*c*1 of an electrically conductive charge bias contact 18*c* is pressed upon an electrically conductive charge bias contact pin on the apparatus main assembly side, wherein the other end of this charge bias contact 18*c* contacts a spring 10*a*. The spring 10*a* is in contact with the sliding bearing 10*c* rotatably supporting one end (power supply side) of the roller shaft 10*b*. The power is supplied from the power source on the apparatus main assembly side to the charging roller 9, through a path established in the above described manner.

As described hereinbefore, the sliding bearing 10*c* on the power supply side of the charging roller 10 is formed of the electrically conductive resin material containing a large amount of carbon filler; therefore, the charge bias can be reliably applied through the power supply path described in the foregoing.

(Exposing Means)

An exposing means 11 exposes the surface of the photosensitive drum 9 having been uniformly charged by the charging roller 10, with a light beam from an optical system 3. As shown in FIGS. 1 to 3, the top frame 14 is provided with an opening 11*a* for allowing the laser beam reflected by the mirror 3*f* to be projected onto the photosensitive drum 9.

(Developing Means)

<Structure of Developing Means>

Referring to FIG. 3, the developing means 12 for forming the toner image with use of the magnetic toner has the toner storage 12*a* for storing the toner, and in the toner storage 12*a*, a toner feeding mechanism 12*b* for feeding out the toner is provided. The toner fed out from the toner storage 12*a* forms a thin toner layer on the surface of a developing sleeve 12*d* containing a roller magnet having multiple magnetic poles as the developing sleeve 12*d* is rotated in the direction indicated by an arrow in the figure. While the toner layer is formed on the developing sleeve 12*d*, the toner is triboelectrically charged by the friction between the toner and the developing sleeve 12*d* as well as developing blade 12*e*, for developing the electrostatic latent image on the photosensitive drum 9. The developing blade 12*e* for regulating the thickness of the toner layer is attached to the bottom frame 15 so as to be held down on the surface of the developing sleeve 12*d* with a predetermined pressure.

<Developing Blade>

As for the construction of the developing blade, a plate-shaped blade cut out of flexible material, such as polyurethane or silicone rubber is pasted to a supporting member 12*e*1 made of metallic plate, and the supporting member 12*e*1 is affixed, with a screw 12*e*2, on the attachment mount of the bottom frame 15, being precisely positioned so that the developing blade 12*e* rubs the developing sleeve with a predetermined pressure.

<Toner Feeding Mechanism>

Referring to FIG. 13, the magnetic toner feeding mechanism 12*b* feeds the toner as an arm 12*b*2 is swung back and forth about the shaft 12*b*3, and thereby, a feeding member 12*b*1 connected to the arm 12*b*2 is moved back and forth in the direction indicated by an arrow B along the bottom surface of the toner storage 12*b*1.

The feeding member 12*b*1, arm 12*b*2, and shaft 12*b*3 are made of polypropylene (PP), acrylobutadiene tyrene (ABS), high impact polystyrene (HIPS), or the like material, wherein the arm 12*b*2 and shaft 12*b*3 are integrally formed.

The feeding member 12*b*1 is a rod-like member, having a substantially triangular cross section, and is extended in a direction parallel to the rotational axis of the photosensitive drum 9. Several of the feeding members 12*b*1 are connected together to form an integral component for sweeping the entire bottom surface of the toner storage 12*a*.

Figure 20:
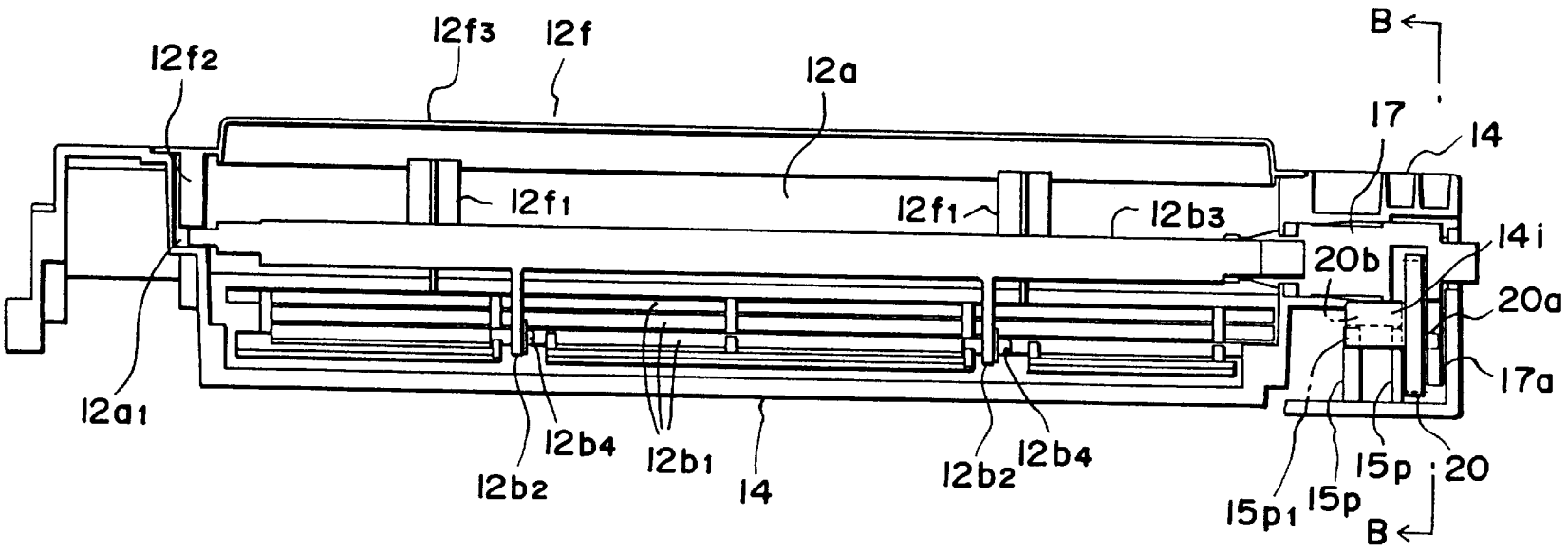
FIG. 20 is a sectional view of the process cartridge, at a line A—A in FIG. 3.

The shaft 12*b*3 is integrally formed with a pair of arm members 12*b*2, with each arm member 12*b*2 projecting downward from the shaft 12*b*3, at a location a certain distance away in the longitudinal direction of the shaft 12*b*3 from the respective side wall of the toner storage 12*a* (FIG. 20). In this embodiment, the arm members 12*b*2 are disposed no less than 15 mm away from the respective side walls of the toner storage 12*a* so that the toner in the toner storage 12*a* is not going to be compacted in the narrow spaces between the side walls and arm members 12*b*2. Further, when the toner storage 12*a* is entirely filled with the toner, the toner resistance against the toner feeding member 12*b*1 or arm member 12*b*2 is large, and the shaft 12*b*3 is sometimes twisted by the resistance, but by narrowing the distance between the arm members 12*b*2, the twist of the shaft 12*b*2 is reduced.

One end of the shaft 12*b*3 about which the arm members 12*b*2 swing passes through the side wall of the toner storage 12*a* and is connected to a rotatably supported transmission member 17, and the other end is also rotatably supported by the bottom portion of a U-shape groove 12*a*1 within the toner storage 12*a*, being at the same time prevented by a rib 12*f*2 of the cover member 12*f* from being lifted (FIG. 20). The transmission member 17 is constructed so as to be engaged with a transmitting means for transmitting a driving force when the process cartridge B is installed in the image forming apparatus A. The transmitting means 17 transmits the driving force for swinging the arm member 12b2 about the shaft 12b3 by a predetermined angle. This transmitting means 17 will be described later.

The feeding members 12b1 and arm member 12b2 are connected by rotatably engaging a pair of projections 12b4, provided apart from each other on one of the feeding members 12b1 at respective locations in the longitudinal direction of the feeding member 12b1, into an elongated hole 12b5 cut in the arm member 12b2. Though not illustrated, the structure described above may be constructed by forming integrally the feeding member and the arm member so that the connecting points can be bent with little resistance.

Having such a structure as described in the foregoing, as the arm member 12b2 is swung by a predetermined angle during the image forming operation, the feeding member 12b1 is oscillated in the direction indicated by the arrow b along the bottom surface of the tone storage 12a, as illustrated by a solid line and a broken line in FIG. 3, whereby the toner stored near the bottom of the toner storage 12a is conveyed toward the developing sleeve 12d. At this time, since the cross section of the feeding member 12b1 has a substantially triangular shape, the toner is conveyed as if being gently scraped by the angled surface of the feeding member 12b1.

Therefore, the magnetic toner is likely to be neither compacted near the developing sleeve 12d by being excessively conveyed, nor to run short by being insufficiently conveyed. As a result, the toner layer formed on the surface of the developing sleeve is not going to easily deteriorate.

<Cover Member>

The upper opening portion of the toner storage 12a is covered with a cover member 12f welded to the opening portion. On the internal surface of the top plate of the cover member 12f, downward projections 12f1 are provided as shown in FIG. 3. The distance between the bottom end of the downward projection 12f1 and bottom surface of the toner storage 12a is set to be slightly larger than the height of the triangular cross section of the tone feeding member 12b1. Therefore, as the feeding member 12b1 is lifted away from the bottom surface of the toner storage 12a, its movement is regulated by the downward projections 12f1. As a result, the toner feeding member 12b1 is floating up and down between the bottom surface of the toner storage 12a and downward projections 12f1, and is thereby prevented from being excessively lifted.

<Driving Force Transmitting means>

Figure 21:
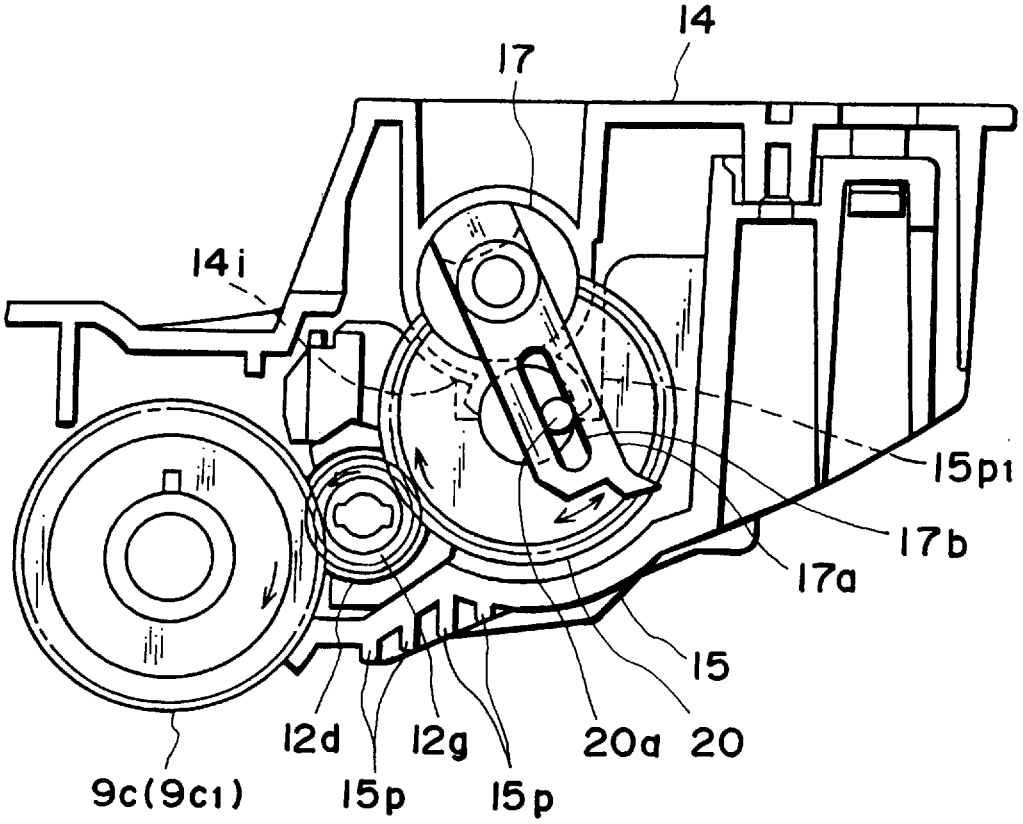
FIG. 21 is a sectional view of the process cartridge, at a line B—B in FIG. 3.

Next, a driving force transmitting means for transmitting the driving force to the toner feeding mechanism 12b will be described. FIG. 20 is a sectional view of the process cartridge B shown in FIG. 3, showing the section at a line A—A. FIG. 21 is also a sectional view of the same process cartridge, showing in this case the cross section at a line B—B.

Referring to FIG. 20, one end of the shaft 12b3 which is the fulcrum of the toner feeding mechanism 12b is passed through the side wall of the toner storage 12a of the top frame 14 and is connected to the rotatably supported transmission member 17. The transmission member 17 is made of resin material, such as polyacetal (POM) or polyamide, which excels in slippery properties, and is attached to the top frame member 14 by a so-called snap-fit, in such a manner that it can freely rotate about the rotational axis of the shaft 12b3.

As for the driving force transmitting means, as shown in FIG. 21, the helical gear 9c1 of the flange gear 9c attached to one end of the photosensitive drum 9 is engaged with the sleeve gear 12g of the developing sleeve 12d; the sleeve gear 12g is engaged with a stirring gear 20 provided with a boss 20a, which is integrally formed with the stirring gear 20 and is disposed on the side surface of the stirring gear 20, a predetermined distance away from the rotational center of the stirring gear 20; the boss 20a is engaged with the elongated hole cut in the arm member 17a of the transmitting member 17. With this structural arrangement in place, as the flange gear 9c rotates in the direction indicated by an arrow in the figure, the stirring gear 20 is rotated through the sleeve gear 12g in the direction indicated by an arrow in the figure, whereby the transmission member 17 is swung back and forth by the boss 20a of the stirring gear 20 in the direction indicated by an arrow in the figure, transmitting the driving force to the shaft 12b3, connected to the transmission member 17, and finally, the toner feeding mechanism 12b is driven.

<Positioning of Stirring Gear>

The positioning of the rotational axis of the stirring gear 20 is dependent on how an axle 20b of the stirring gear 20 is fitted into a U-shape groove 15p1 of a rib 15p formed on the bottom frame 15. Therefore, all that is needed to improve the accuracy of engagement between the stirring gear 20 and sleeve gear 12g is to form precisely the bottom frame 15. The upper side of the axle 20b of the stirring gear 20 is regulated by a concave guide 14i provided below the through hole cut in the top frame 14 which rotatably supports the transmission member 17. Therefore, as the top and bottom frames 14 and 15 are combined, the stirring gear 20 is rotatably supported and its position is fixed. By having such an arrangement, it becomes unnecessary to prepare a through hole for rotatably supporting the stirring gear 20, thereby improving the strength of the cartridge frame.

<Developing Sleeve>

Next, the developing sleeve 12d on which the toner layer is formed will be described. The developing sleeve 12d and photosensitive drum 9 are disposed to face each other with a micro-gap (approximately 200 μm–300 μm) between them. In this embodiment, in order to effect this micro-gap, a contact ring 12d1 having an external diameter larger, by the above described micro-gap, than that of the developing sleeve 12d, is fitted on the developing sleeve 12d, toward each axial end of the developing sleeve 12d, outside the range where the toner layer is formed, so that the ring 12d1 comes in contact with the photosensitive drum, outside the range where the latent image is formed.

Figure 22:
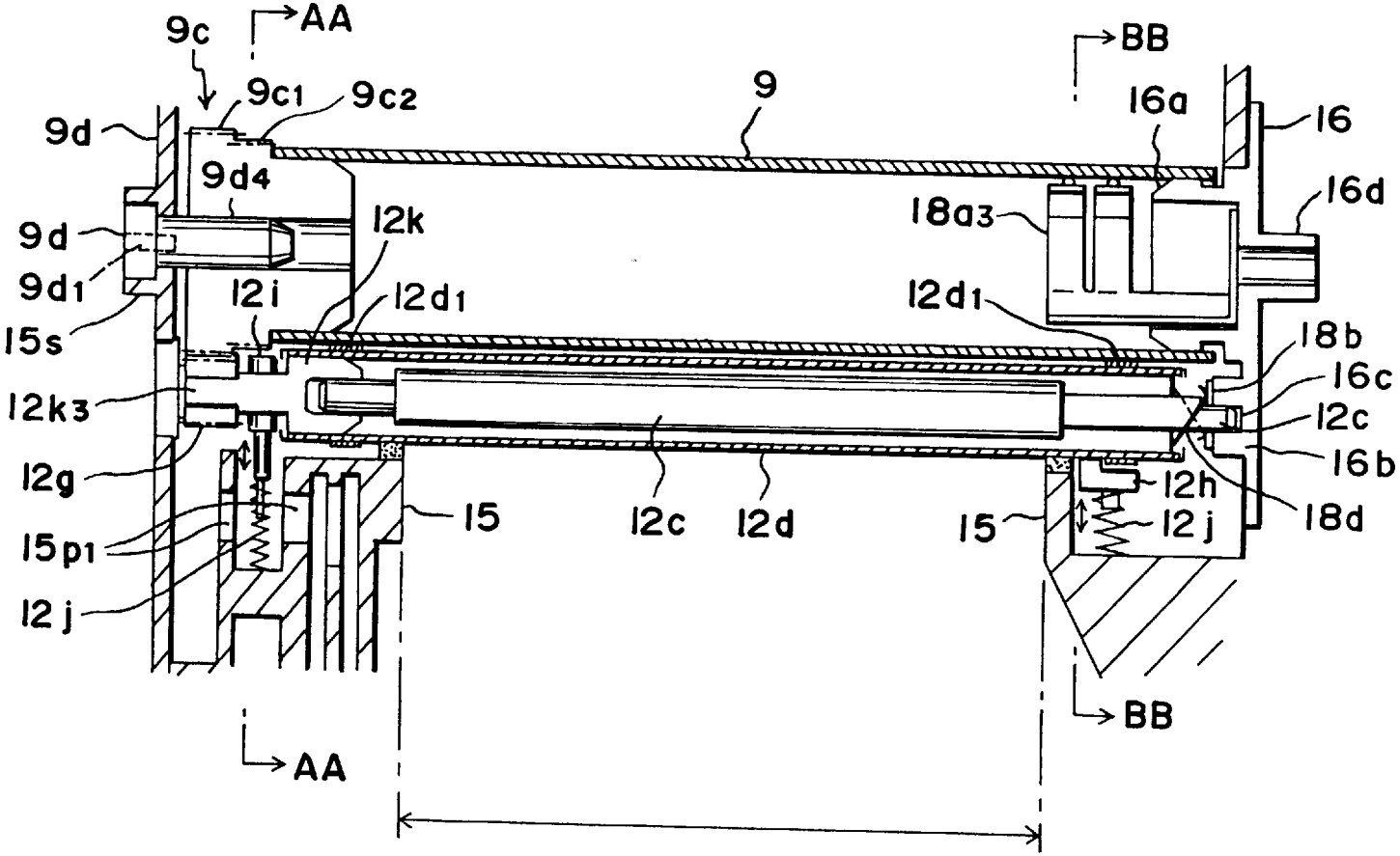
FIG. 22 depicts the positional relation between the photosensitive drum and developing sleeve, and of a method for pressing the developing sleeve.
Figure 23A:
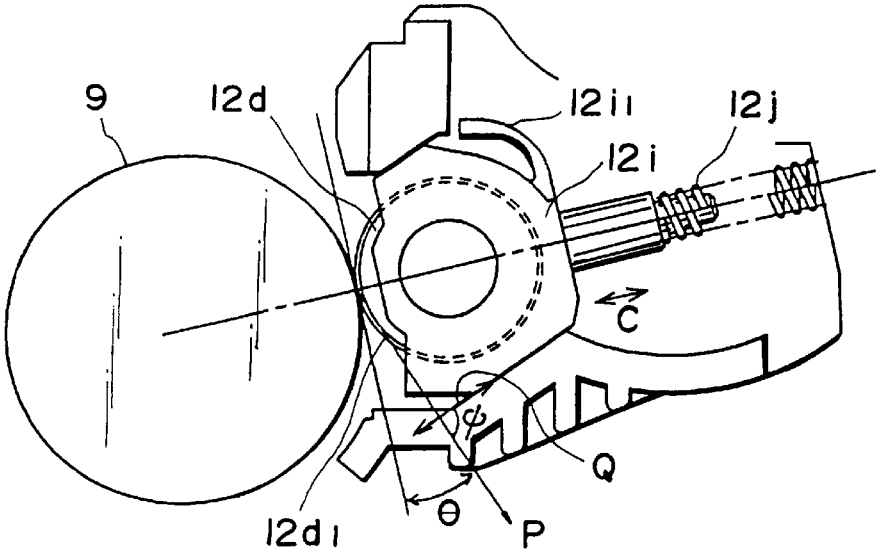
FIGS. 23(*a*) and (*b*) are a cross-sectional view taken along a line AA—AA and a cross-sectional view taken along a line BB—BB, in FIG. 22, respectively.
Figure 23B:
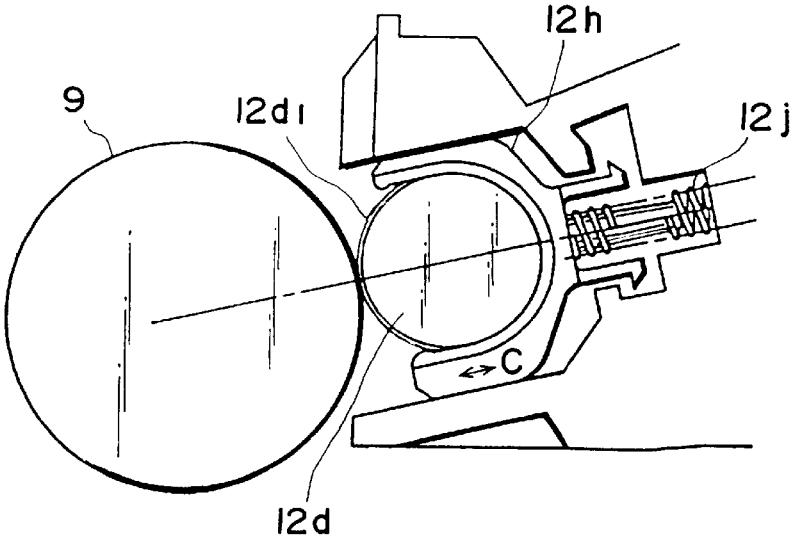

Here, the positional relation between the photosensitive drum 9 and developing sleeve 12d will be described. FIG. 22 is a longitudinal section for depicting the positional relation between the photosensitive drum 9 and developing sleeve 12d and for depicting a method for giving pressure to the developing sleeve 12d. FIG. 23(*a*) is a cross-section view taken along a line AA—AA in FIG. 22, and FIG. 23(*b*) is a cross-section view taken along a line BB—BB in FIG. 22.

As shown in FIG. 22, the developing sleeve 12d on which the toner layer is formed and the photosensitive drum 9 are positioned to face each other with the micro-gap (approximately 200 μm–400 μm) between them. At this time, one end of the photosensitive drum 9 is rotatably supported by a drum axle 9d which is press-fitted in a shaft hole 15s of the bottom frame 15 and then, is fitted through the shaft hole of the flange gear 9c attached to one end of the photosensitive drum 9, and the other end is also rotatably supported by the bearing 16a of the bearing member 16 fitted fixedly in the same bottom frame 15. The developing sleeve 12d is fitted with the contact ring 12d1 having an external diameter larger by the above described micro-gap, toward each axial end of the developing sleeve 12*d*, outside the range where the toner layer is formed, so that the ring 12*d*1 comes in contact with the photosensitive drum, outside the range where the latent image is formed.

The developing sleeve 12*d* is rotatably supported by sleeve bearings 12*h* and 12*i* positioned toward respective axial ends, wherein the sleeve bearing 12*h* on one side (non-driven side) is located, relative to the axial direction, outside the toner layer formation range but inside the contact ring 12*d*1, and the sleeve bearing 12*i* on the other side (driven side) is located outside the toner layer formation range as well as outside of the contact ring 12*d*1. These sleeve bearings 12*h* and 12*i* are so attached to the bottom frame 15 that they can slightly slide in the direction indicated by an arrow in FIG. 22. To the projections projecting from the sleeve bearings 12*h* and 12*i*, a pressure spring 12*j* is attached, being compressed against the wall of the bottom frame 15 and generating thereby, the pressure for pressing the developing sleeve 12*d* toward the photosensitive drum 9. By the arrangement described in the foregoing, the contact ring 12*d*1 can remain in contact with the photosensitive drum 9, maintaining reliably, the gap between the developing sleeve 12*d* and photosensitive drum 9, and also, the driving force can be reliably transmitted to the sleeve gear 12*g* of the developing sleeve 12*d*, which is engaged with the flange gear 9*c* and its helical gear 9*c*1.

<Sliding Amount of Developing Sleeve>

Figure 24:
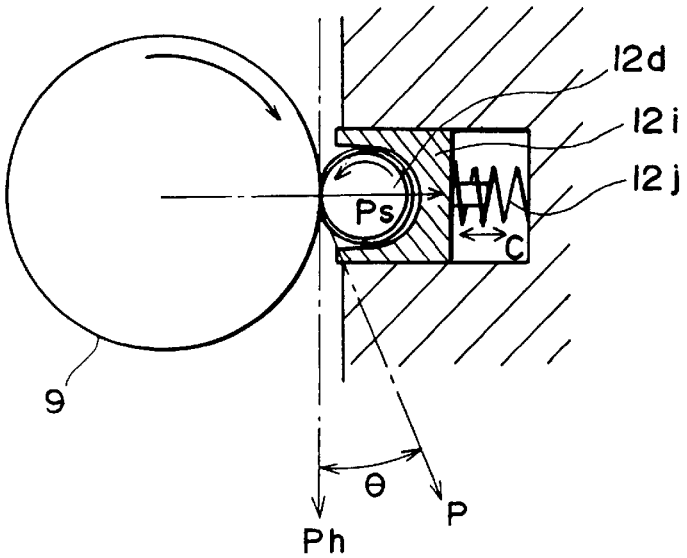
FIG. 24 depicts how a conventional sleeve bearing slides.

Referring to FIG. 24, the direction in which the sleeve bearing 12*h* and 12*i* can slide will be described. To describe it, first, on the driving side of the developing sleeve, when the driving force is transmitted from the driving motor provided on the apparatus main assembly side to the helical gear 9*c*1 of the flange gear 9*c*, and then, from the helical gear 9*c*1 to the sleeve gear 12*g*, the operating pressure is directed away from the tangential line of the intermeshing pitch circle of the helical gear 9*c*1 intermeshing pitch circle of the sleeve gear 12*g*, by the operating pressure angle (20° in this embodiment). Therefore, the operating pressure is directed as indicated by an arrow P in FIG. 24 ($\theta \approx 20°$). With the structural arrangement described hereinbefore, this operational pressure P is divided into a component Ps and a component Ph, which are parallel to and perpendicular to the sliding direction of the sleeve bearing 12*h*, respectively. When the sleeve bearing 12*h* is slid in a direction parallel to the straight line connecting the rotational center of the photosensitive drum 9 and that of the developing sleeve 12*b*, the components Ps parallel to the sliding direction are away from the photosensitive drum 9, as shown in FIG. 24. Therefore, the gap between the photosensitive drum 9 and developing sleeve 12*d* tends to be easily changed by the operational pressure between the helical gear 9*c*1 of the flange gear 9*c* and sleeve gear 12*g*, whereby the toner on the developing sleeve 12*d* tends to fail to move properly onto the photosensitive drum 9. This may be liable to cause deterioration of development performance.

Because of the reasons described in the foregoing, in this embodiment, how the driving force is transmitted from the helical gear 9*c*1 of the flange gear 9*c* to the sleeve gear 12*g* is taken into consideration, and as shown in FIG. 23(*a*), the direction in which the sleeve bearing 12*i* on the driven side of the developing sleeve 12*d* (side where the sleeve gear 12*g* is attached) is allowed to slide is aimed as shown by an arrow Q in FIG. 23(*a*). In other words, an angle $\psi$, which is formed by the direction of the operating pressure P between the helical gear 9*c*1 of the flange gear 9*c* and the sleeve gear 12*g* and by the slidable direction (arrow Q direction) of the driven side sleeve bearing 12*i*, is set to an angle slightly larger (approximately 92° in this embodiment) than 90°. By this structural arrangement, the horizontal component Ps of the operating pressure P is reduced to substantially zero; in this embodiment, the component Ps works to force slightly the developing sleeve 12*d* toward the photosensitive drum 9. In such a case, the pressure imparted on the developing sleeve 12*d* by the compression spring 12*j* is increased by an amount a of spring pressure to keep constant the gap between the photosensitive drum 9 and developing sleeve 12*d*, so that a proper developing operation can be carried out.

Next, the sliding direction of the sleeve bearing 12*h* on the non-driven side of the developing sleeve 12*d* (side where the sleeve gear 12*g* is not attached) will be described. Being different from the case on the driven side, the non-driven side is not subjected to the external force; therefore, the sliding direction of the sleeve bearing 12*h* is made substantially parallel to the straight line connecting the centers of the photosensitive drum 9 and developing sleeve 12*d*, as shown in FIG. 23(*b*).

As described in the foregoing, in this embodiment, when the developing sleeve 12*d* is directly pressed upon the photosensitive drum 9, the positional relation between the developing sleeve 12*d* and photosensitive drum 9 can be always kept proper by differentiating the direction in which the developing sleeve 12*d* is pressured, between on the driven side and on the non-driven side; therefore, a proper developing operation can be carried out.

Further, the slidable direction of the sleeve bearing 12*i* on the driving side may be made substantially parallel to the straight line connecting the centers of the photosensitive drum 9 and developing sleeve 12*d*, in the same manner as that of sleeve bearing 12*h* on the non-driven side. More specifically, in this embodiment, since on the driven side, the sliding direction component Ps of the operating pressure P between the flange gear 9*c* and sleeve gear 12*g* works to force the developing sleeve 12*d* to move away from the photosensitive drum 9, all that is needed is to increase the pressure of the compression spring 12*j* on the driven side by the amount equivalent to the component Ps, compared to that on the non-driven side, so that the developing sleeve 12*d* can be pressed to counter the component Ps. In other words, when the relation between a pressure P1 imparted upon the non-driven side of the developing sleeve 12*d* by the compression spring 12*j* and a pressure P2 generated by the compression spring 12*j* on the driven side is selected to satisfy an equation: P2=P1+Ps, the developing sleeve 12*d* always receives a proper pressure, guaranteeing the proper gap between the developing sleeve 12*d* and photosensitive drum 9.

<Stopper Projection for Sleeve Bearing>

On the upper portion of the sleeve bearing 12*i* on the driven side of the developing sleeve 12*d*, a stopper projection 12*i*1 for preventing the sleeve bearing 12*i* from sliding out is provided, so that the developing sleeve 12*d* is prevented from being ejected out by compression spring 12*j* when the developing sleeve 12*d* is assembled into the apparatus. Since, as described hereinbefore, the pressuring direction of the compression spring 12*j* and sliding direction of the sleeve bearing 12*i* are different, a rotational moment in the clockwise direction of FIG. 23 is generated by the force of the compression spring 12*j* when the developing sleeve 12*b* is assembled; therefore, the stopper projection 12*i*1 is located at the upper portion of the sleeve bearing 12*i* to counter this force.

<Frame Strength on Driving Member Side>

When the driving force is transmitted to the sleeve gear 12*g*, the sleeve gear 12*g* is subjected to a downward force (direction indicated by an arrow P in FIG. 23(*a*)), whereby the bottom frame 15 is subjected to this force through the sleeve bearing 12*i*; therefore, there is the liability that the bottom frame 15 is deformed on the driving member side. To eliminate such a liability, the following structure is provided in this embodiment.

To begin with, the bottom frame 15 is molded in such a manner that the side wall for supporting the drum shaft 9*d* of the photosensitive drum 9 and the side wall for supporting the driven side of the developing sleeve 12*d* are connected as a single piece as shown in FIG. 7, and the driving member portion of the bottom frame 15 forms substantially a box shape (right side portion in FIG. 7), dispersing thereby, the pressure imparted on the driving member portion of the bottom frame 15. Second, the strength of the frame portion, molded in substantially a box shape, has been increased by providing a large number of ribs 15*p* as shown in FIG. 21 on the bottom surface (surface subjected to the aforementioned downward force). Third, the influence of the aforementioned downward force exerted upon the bottom frame 15 through the sleeve bearing 12*i* is reduced by disposing the sleeve bearing 12*i* closer to the side wall of the bottom frame 15 than the sleeve bearing 12*h* on the other side.

By making the structural arrangement as described in the foregoing, the frame strength of the driving member portion of the bottom frame 15, in particular the portion corresponding to the driven side of the driving means 12, can be increased. In this embodiment, all three methods are employed, but it is needless to say that each method can be effective on its own.

<Connection of Sleeve Gear to Developing Sleeve>

Figure 25A:
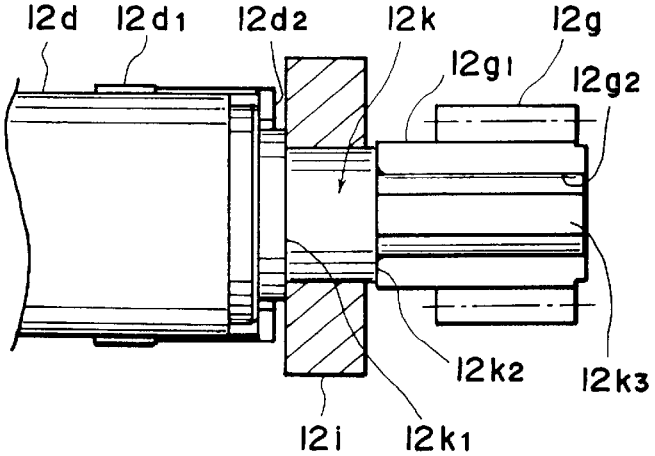
FIGS. 25(*a*) and 25(*b*) depict the engagement between the developing sleeve and sleeve gear.
Figure 25B:
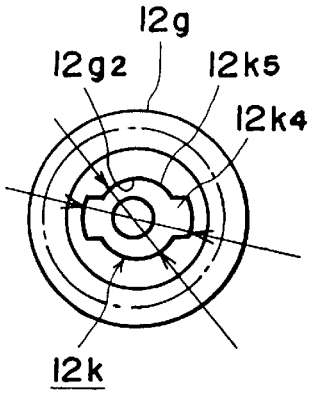
Figure 26:
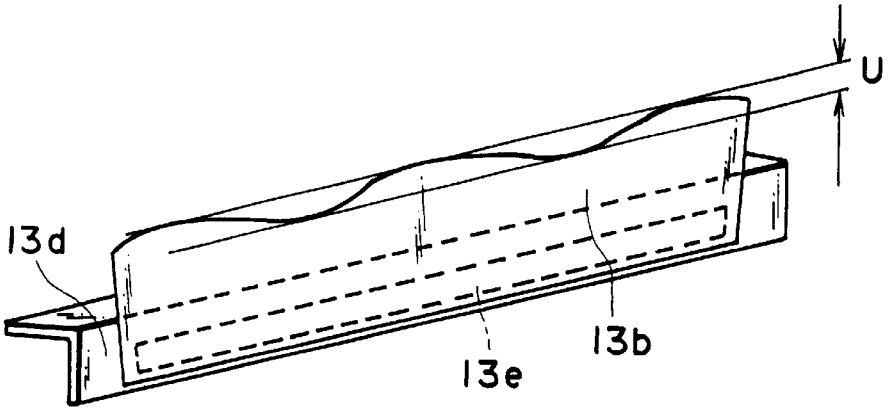
FIG. 26 is an oblique view of the tip wave of a receptor sheet.

Next, a method for connecting the sleeve gear 12*g* to the developing sleeve 12*d* will be described. FIG. 25 is a schematic drawing for depicting how the developing sleeve 12*d* and sleeve gear 12*g* are connected. Referring to FIG. 25(*a*), a sleeve flange 12*k* is fixedly fitted in one end (driven side) of the cylindrical developing sleeve 12*d* having an external diameter of 12 mm, by gluing, crimping, press-fitting, or the like. This sleeve flange 12*k* comprises three diameter-differentiated (stepped) portions: a portion 12*k*1 having an external diameter smaller than an internal diameter of a gate portion 12*d*2 of the contact ring 12*d*1, a portion 12*k*2 having an external diameter smaller than an external diameter of the portion 12*k*1 and being rotatably supported by the sleeve bearing 12*i*, and a fitting portion 12*k*3 provided with peaks and valleys to be fitted into the sleeve gear 12*g*.

The length by which the diameter-differentiated portion 12*k*1 of the sleeve flange 12*k* projects is larger than the thickness of the gate portion 12*d*2 of the contact ring 12*d*1; therefore, even after the developing sleeve 12*d* moves in the thrust direction, the sleeve bearing 12*i* does not rub on the contact ring 12*d*1. The diameter of the engagement of the portion 12*k*2 at which the sleeve flange 12*k* is rotatably supported by the sleeve bearing 12*i* is approximately 6 mm–8 mm.

The fitting portion 12*k*3 with peaks and valleys to be fitted into the sleeve gear 12*g* has an external diameter smaller by one step than the external diameter of the diameter-differentiated 12*k*2, and comprises two different portions: valley portions 12*k*5 with a smaller circumferential diameter of 4 mm 5 mm, and peak portions 12*k*4 with a larger circumferential diameter than that of the valley portion 12*k*5, projecting thereby from the valley portion 12*k*5. The projection height of the peak portion 12*k*4 is approximately 0.7 mm and its width is approximately 2.0 mm, and the circumference D of the peak portion 12*k*4 and circumference d of the valley portion 12*k*5 are concentric. The sleeve flange 12*k* and sleeve gear 12 are adjustably fitted (H-js fitting), wherein the valley portion 12*k*5 of the fitting portion 12*k*3 is selected as the location for center-matching and tightening; therefore, there is play at the location of the peak portion 12*k*4 of the fitting portion 12*k*3. Further, the sleeve gear 12*g* is provided with a fitting hole 12*g*2 to be engaged with the portion 12*k*3 of the sleeve flange 12*k*, and also, is provided with a boss portion 12*g*1, so that the length by which the portion 12*k*3 of the sleeve flange 12*k* is fitted into the sleeve gear 12*g* becomes larger than the gear tooth width. Therefore, the permissible driving force is increased.

As to the material for the sleeve flange 12*k*, aluminum alloy, or plastic material such as polyacetal (POM), polybutylene-terephthalate, (PBT), polyamide (PA), and the like can be used. As to the material for the sleeve gear 12*g*, plastic material such as polyacetal, (POM), polybutylene-terephthalate (PBT), polyamide (PA), fluorinated polycarbonate (PC), and the like can be used.

In this embodiment, two peak portions are provided on the portion 12*k*3 at which the sleeve flange 12*k* is fitted into the sleeve gear 12*g*, but the same effect can be obtained by providing three or four peak portions. In particular, when the sleeve gear 12*g* is manufactured of plastic by injection-molding, the thickness can be made more uniform by having four valleys; therefore, it becomes easier to improve the manufacturing accuracy. Further, the sleeve flange 12*k* is fitted into the sleeve gear 12*g* so as to make adjustable contact at the valley portion 12*k*5 of the fitting portion 12*k*3, but the adjustable contact may be made at the peak portion 12*k*4, providing play at the valley portion 12*k*5.

(Cleaning Means)

<Structure of Cleaning Means>

The cleaning means 13 is for removing the residual toner after the toner image on the photosensitive drum 9 has been transferred onto the recording medium by the transferring means 6. Referring to FIG. 3, this cleaning means 13 comprises a cleaning blade 13*a* for scraping off the residual toner on the photosensitive drum 9, a receptor sheet 13*b* for scooping away the scraped-off toner, being disposed below the cleaning blade 13*a* as well as being in contact with the surface of the photosensitive drum 9, and a waste toner storage 13*c* for storing the scooped-off waste toner.

<Receptor Sheet>

Here, how the receptor sheet 13*b* is attached will be described. This receptor sheet 13*b* is pasted on an attachment surface 13*d* provided on the waste toner storage 13*c*, with double-side adhesive tape. However, the waste toner storage 13*c* is formed by the bottom frame 15 and top frame 14 which are made of resin material, and its attachment surface 13*d* is not perfectly flat. Therefore, when the double sided adhesive tape 13*e* is pasted on the attachment surface 13*d* and the receptor sheet 13*b* is simply pasted on this double sided adhesive tape 13*e*, the tip (where it makes contact with the photosensitive drum 9) of the receptor sheet 13*b* sometimes becomes wavy as indicated by a reference code U. With the presence of the wave U at the tip of the receptor sheet 13*b*, the receptor sheet 13*b* does not tightly contact the surface of the photosensitive drum 9, thereby failing to reliably scoop off the toner scraped off by the cleaning blade 13*a*.

Therefore, it is conceivable to provide tension to the tip of the receptor sheet 13*b* in order to prevent the generation of the wave U. In other words, the appearance of the wave U can be prevented by pasting the receptor sheet 13*b* while the attachment surface 13*d* is elastically bent by-pulling downward the attachment surface 13*d* located at the bottom portion of the wast toner storage, with a pulling tool 21, and stopping pulling after pasting the receptor sheet 13*b*, so that the tension can be given to the tip of the receptor sheet 13*b* as the attachment surface 13*d* straightens itself due to the material elasticity.

However, in the process cartridge B having been being recently downsized, the size of the attachment surface 13*d* for the receptor sheet 13*b* also has become smaller. Therefore, when the receptor sheet 13*b* is pasted while the attachment surface 13*d* is bent, the receptor sheet 13*b* sticks out downward at both bottom ends 13*b*1, as shown in FIG. 17(*a*). When the receptor sheet 13*b* sticks out downward below the attachment surface 13*d*, the recording medium is liable to hang up at the protruding receptor sheet 13*b*.

Figure 27A:
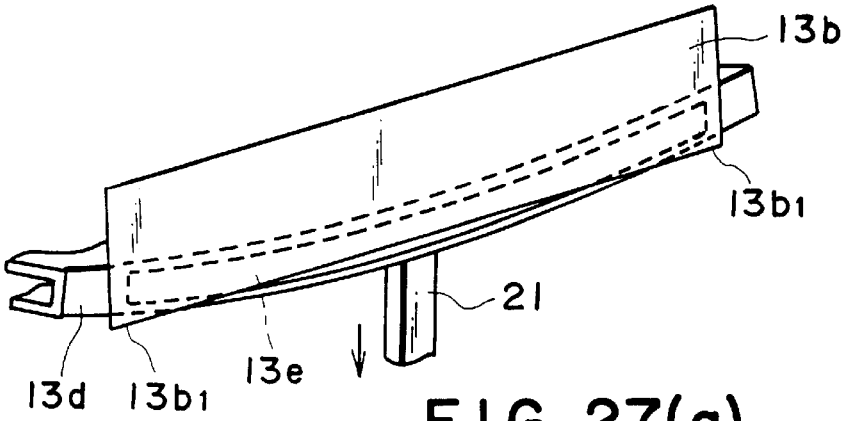
FIGS. 27 (*a*), 27(*b*) and 27(*c*) depict methods for pasting the receptor sheet.
Figure 27B:
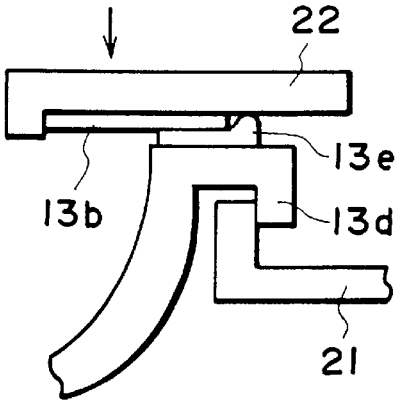
Figure 27C:
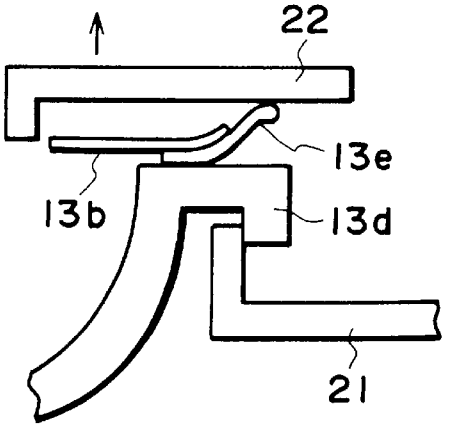

Further, when the receptor sheet 13*b* is pasted while the attachment surface 13*d* is bent, the double sided adhesive tape 13*e* sticks out downward from the bottom side of the receptor sheet 13*b*. Therefore, if, in this state, the receptor sheet 13*b* is pressed upon the double sided adhesive tape 13*e* by a pasting tool 22, the protruding portion of the tape 13*e* sticks to the pasting tool 22 as shown in FIG. 27(*b*), and when the pasting tool 22 is removed, the double sided adhesive tape 13*e* is peeled off the attachment surface 13*d*, and subsequently, the receptor sheet 13*b* is improperly attached.

Figure 28A:
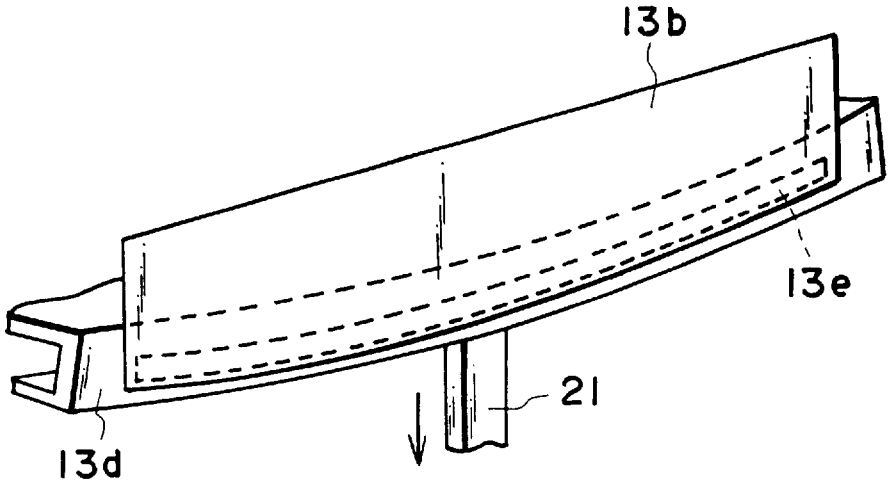
FIGS. 28(*a*) and 28(*b*) depict methods for pasting the receptor sheet.
Figure 28B:
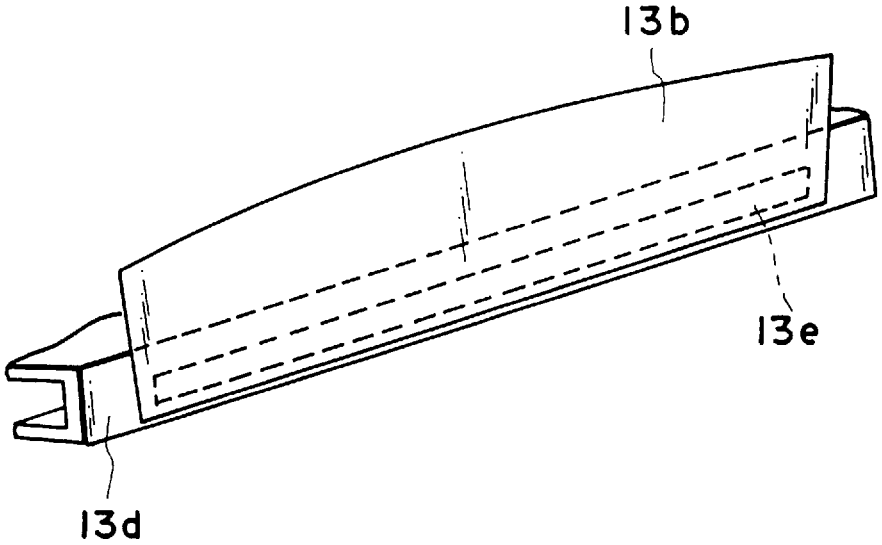

Therefore, in this embodiment, the bottom end shape of the receptor sheet 13*b* is made substantially the same as the shape into which the attachment surface 13*d* is bent as it is pulled by the pulling tool 21, as shown in FIG. 28(*a*). In other words, the receptor sheet 13*b* is made wider along the longitudinal middle portion than at both longitudinal ends. With this design, the bent double sided adhesive tape 13*e* is prevented from sticking out from the receptor sheet 13*b*. Further, when the pulling by the pulling tool 21 is stopped to allow the attachment surface 13*d* to straighten, and to thereby give tension to the upper end of the receptor sheet 13*b*, the bottom end of the receptor sheet 13*b* does not stick out from the bottom of the attachment surface 13*d*. Therefore, the improper attachment of the receptor sheet 13*b* or the resulting recording medium hang-up at the receptor sheet 13*b*, as described in the foregoing can be eliminated.

Figure 29:
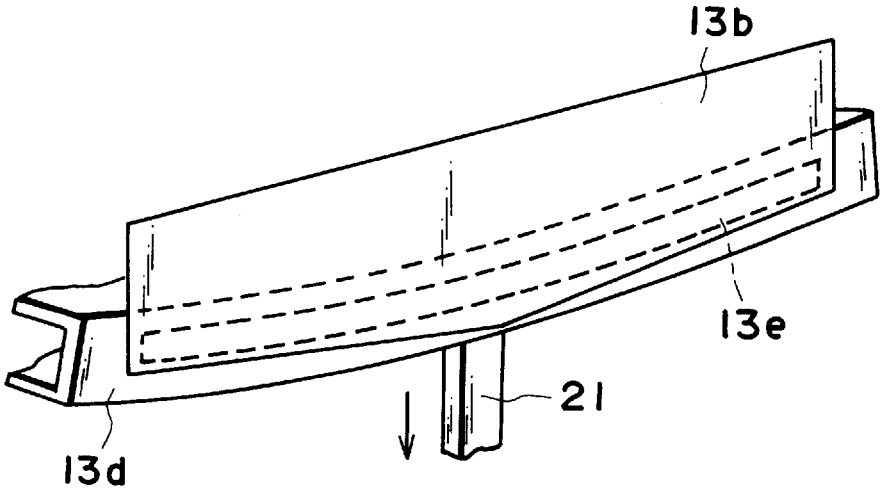
FIG. 29 is an oblique view of the receptor sheet.

Further, when the simplification of the processing of the receptor sheet 13*b*, the service life of the processing tools, or the like, is taken into consideration, the bottom end shape of the receptor sheet 13*b* is preferred to be linear. Therefore, a linear configuration as shown in FIG. 29 may be used for making the receptor sheet 13*b* wider toward the longitudinal center, following substantially the bottom end curvature of the receptor sheet 13*d*.

Figure 30:
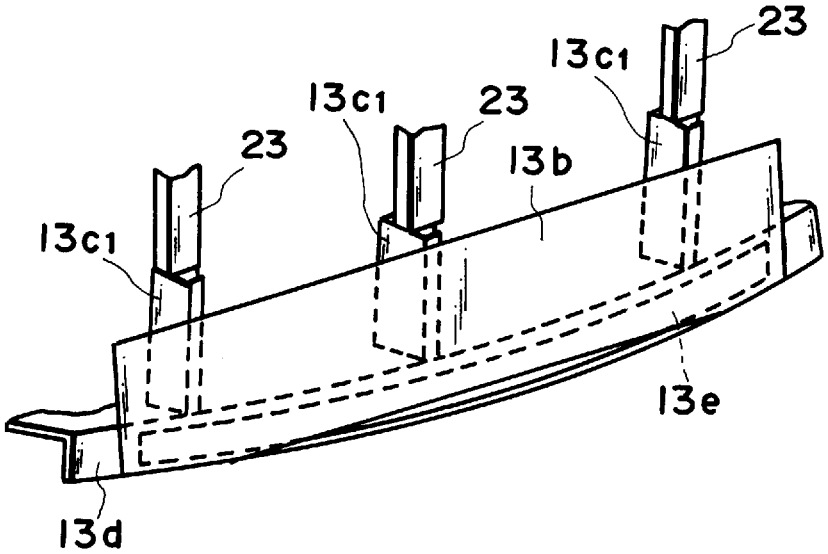
FIG. 30 depicts a method for pasting the receptor sheet.

Also, in this embodiment, in order to bend the attachment surface 13*d* for the receptor sheet 13*b*, the attachment surface 13*d* is pulled by the pulling tool 21, but it is needless to say that the attachment surface 13*d* for the receptor sheet 13*b* may be bent by pressing, with a pressing tool 23, the upper portions of partitioner plates 13*c*1 provided within the waste toner 13*c* formed integrally with the attachment surface 13*d* for the receptor sheet 13*b*, as shown in FIG. 30.

Also, in this embodiment, the receptor sheet attachment surface 13*d* is formed at the bottom portion of the waste toner storage 13*c*, but the same effect can be obtained by employing such a structure that the receptor sheet 13*b* is pasted on an attachment surface of a member made of material such as a metallic plate, different from that for the waste toner storage 13*c*, and such a metallic plate member is assembled into the waste toner storage 13*c*.

<Cleaning Blade>

Referring to FIG. 3, the cleaning blade 13*a* is made of elastic material, such as polyurethane rubber (JISA hardness: 60 degrees to 75 degrees), and is integrally fixed to a supporting member 13*a*1 made of metallic plate, such as cold-rolled steel plate. The supporting member 13*a*1 to which the cleaning blade 13*a* is affixed is attached, with screws or the like, to the cleaning blade mounting surface of the bottom frame 15 to which the photosensitive drum 9 is attached. The cleaning blade mounting surface of the bottom frame 15 is precisely formed so that when the supporting member 13*a*1 to which the cleaning blade 13*a* is affixed is mounted on it, the edge portion of the cleaning blade 13*a* is placed in contact with the photosensitive drum 9, with a predetermined precise contact pressure.

Since a primary charge bias, that is, a voltage generated by superposing an AC voltage on a DC voltage as described hereinbefore, is applied to the charging roller 10 of the process cartridge B, the photosensitive drum 9 is caused to oscillate microscopically by this AC component (approximately 2 $KV_{p-p}$). This microscopic oscillation of the photosensitive drum 9 is liable to trigger a so-called stick slip of the cleaning blade 13*a*, which causes vibrations. The vibration of the cleaning blade 13*a* due to the stick-slip is large, and this large vibration is transmitted, through the supporting member 13*a*1 to which the supporting member 13*a*1 is affixed, to the bottom frame 15 and further, to the top frame 14, whereby noises are sometimes generated.

Figure 31:
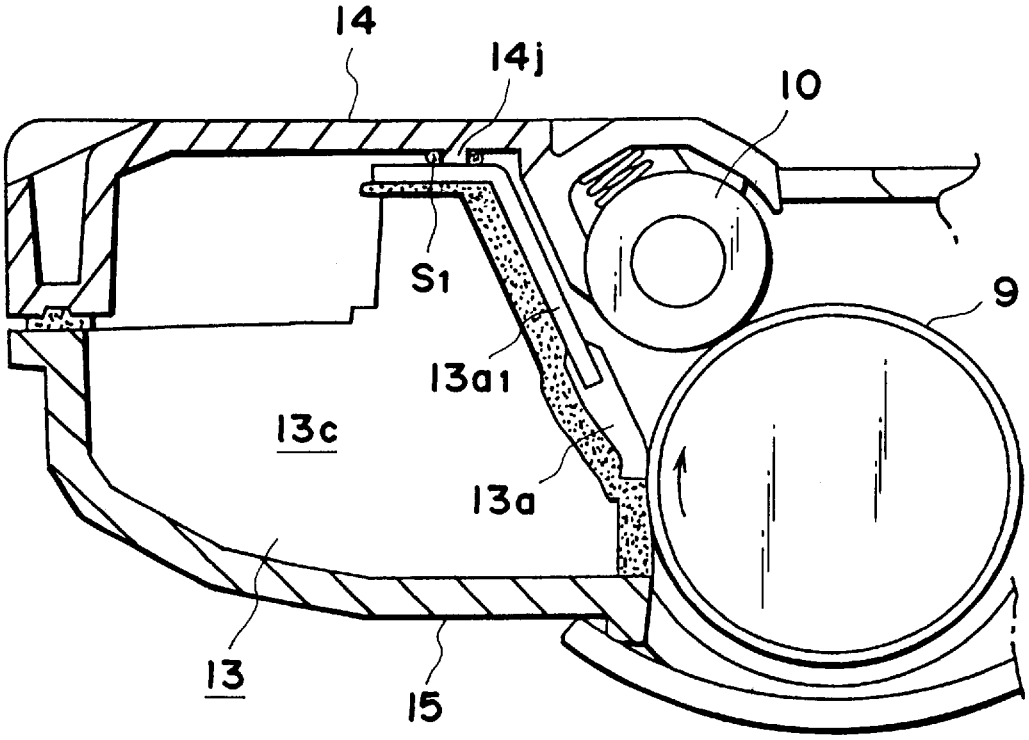
FIG. 31 depicts the state of contact between a cleaning blade supporting member and a rib provided on the top frame.
Figure 32A:
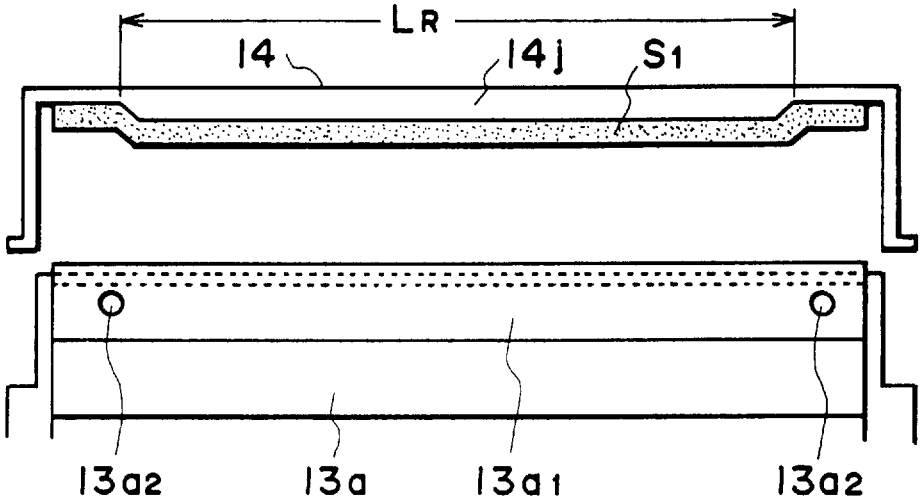
FIGS. 32(*a*) and 32(*b*) depict the state of contact between a cleaning blade supporting member and a rib provided on the top frame.
Figure 32B:
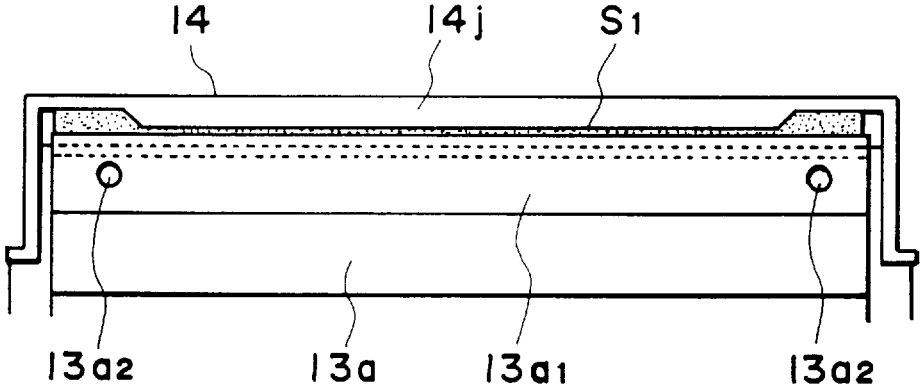

Therefore, in this embodiment, as a means for suppressing the noise caused by the vibration of the cleaning blade 13*a*, a rib 14*j* is provided at a predetermined location within the top frame 14 as shown in FIGS. 31 and 32, and this rib 14*j* abuts the upper surface of the supporting member 13*a*1 to which the cleaning blade 13*a* is affixed. Further, in order to prevent the waste toner from leaking out of the waste toner storage 13*c*, a seal member S1, made of foamed urethane or the like, is pasted to the rib 14*j*, is compressed between the rib 14*j* and supporting member 13*a*1. As a result, the vibration of the cleaning blade 13*a* is suppressed by the cooperation between the resiliency of the S1 and rib 14*j*, thereby preventing the noises related to the aforementioned vibration. As is evident from the above description, the supporting member 13*a*1 of the cleaning blade 13*a* is sandwiched by the top frame 14 and bottom frame 15, with S1 being interposed. In other words, the process cartridge B is assembled in the following manner: the cleaning blade 13*a* is mounted on the bottom frame 15 by attaching the supporting member 13*a*1 to the bottom frame 15 with screws, and then, the top frame 14 and bottom frame 15 are put together as if compressing the supporting member 13*a*1 between the top frame 14 and bottom frame 15.

As for the rib 14*j*, its height is selected to leave "zero" clearance between the upper surface of the supporting member 13*a*1, on which the rib 14*j* abuts, and internal surface of the top frame 14. Further, in this embodiment, the rib 14*j* is centered in the longitudinal direction of the cleaning blade 13*a*, and its length $L_R$ is made to be approximately 180 mm or more. As a result, the top frame 14 is bent by the reaction from the cleaning blade 13*a* by approximately 0.5 mm–1.0 mm, but this problem can be easily dealt with by designing this bending into the configuration of the top frame 14.

<Relation Between Average Toner Diameter and Blade Contact Pressure>

In recent years, image quality has been desired to be higher and higher, and accordingly, the toner diameter has been progressively reduced to satisfy this desire. In the past, toner having an average particle diameter of approximately 9 $\mu$m had been used, but in this embodiment, toner having an average particle diameter of approximately 7 $\mu$m is used.

Figure 33:
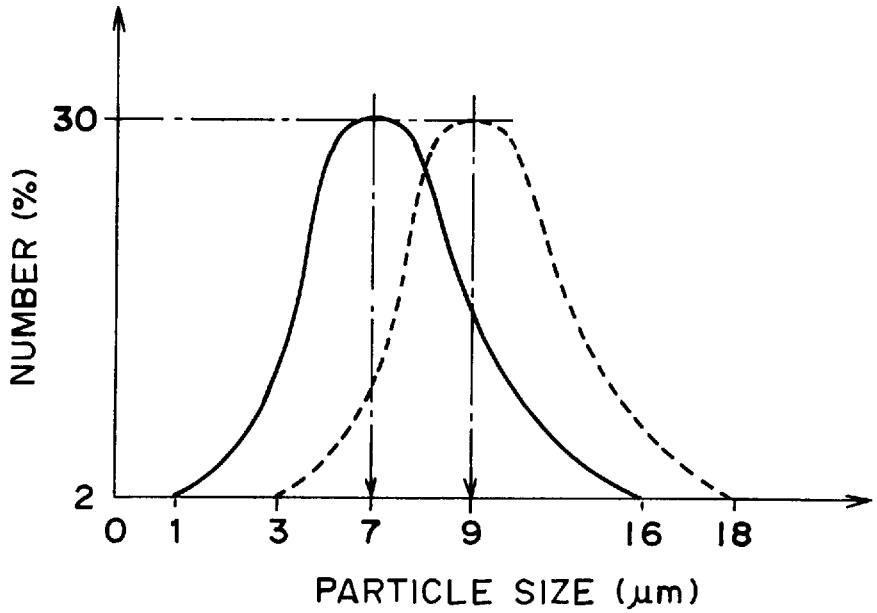
FIG. 33 is a normal distribution curve of average diameters of toner.

The normal distribution curve in FIG. 33 represents the toner particle size distribution of such toner. As is evident from FIG. 33, the more the toner particle size is reduced, the more the amount of the smaller toner particles increases. Therefore, the contact pressure with which the cleaning blade 13*a* contacts the photosensitive drum 9 must be increased in proportion to the degree of fineness of the toner particle; otherwise, the toner slips by the cleaning blade 13*a*, which is liable to cause a so-called cleaning failure. Further, the toner which has slipped by the cleaning blade 13*a* is liable to remain stuck on the surface of the photosensitive drum 9, being compacted by the charging roller 10 and fused on the drum surface, or is liable to adhere to the charging roller 10, thereby causing improper charging.

Therefore, in this embodiment, the contact pressure with which the cleaning blade 13*a* contacts the photosensitive drum 9 is increased as the toner particle size is reduced. Hereinafter, a description will be given of a method for measuring the contact pressure of the cleaning blade 13*a*, and the results of an endurance test conducted by the applicant of this patent, in which the cleaning performance, the charging characteristic, and the photosensitive drum condition were studied by making 5,000 copies under normal conditions while changing the blade pressure and toner particle diameter.

Figure 34:
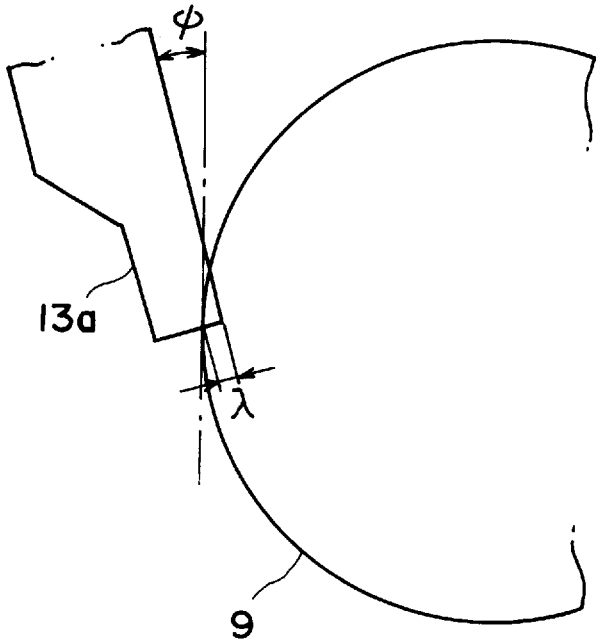
FIG. 34 depicts an amount of blade invasion and a blade setting angle.

First, referring to FIG. 34, the amount of intrusion $\lambda$ and setting angle $\psi$ of the cleaning blade 13*a* in relation to the photosensitive drum 9 will be described. The amount of blade intrusion $\lambda$ refers to an imaginary amount by which the tip of the cleaning blade 13*a* intrudes into the photosensitive drum 9 without deforming itself, and the approach angle $\psi$ refers to the angle formed by the cleaning blade 13*a* and the tangential line of the photosensitive drum 9 at the contact point between the tip of the cleaning blade 13*a* and the photosensitive drum 9.

With the definition given in the foregoing, the method for measuring the contact pressure of the blade will be described referring to FIG. 35. To begin with, a 1 cm wide piece is cut out of the cleaning blade 13*a* and is set on a blade mount 57 which is movable by a motor 56 in the direction indicated by an arrow, wherein this piece of cleaning means 13 is placed in contact with a load sensor 58, at a predetermined angle $\psi$ selected within a range of approximately 20°–25°. Then, the blade mount 57 is moved toward the load sensor by the amount equivalent to the desired amount of intrusion $\lambda$, and the value detected by the load sensor is amplified by an amplifier 59 to be read through a voltmeter 60. The voltage thus read is converted to the linear load per centimeter by substitution with the linear load per unit voltage, prepared in advance. The value thus obtained is the blade contact pressure.

The applicant of the present patent conducted an endurance test, using the blade contact pressure measuring method described in the foregoing, in which the cleaning performance, the charging characteristic, and the photosensitive drum condition were studied by making 5,000 copies under normal conditions while varying the blade contact pressure and toner particle diameter. The results are given in FIG. 36. During the test, in order to stabilize the charging characteristic, a superposed voltage of approximately 1 KV DC and approximately 2 KV AC voltage was applied to the charging roller. As for the developing system, it was a reversal development using a single component magnetic toner. The reversal development referred in this test is a development process in which a latent image is developed by toner having the same charge polarity as that of the voltage of the latent image. In the case of this embodiment, a latent image having the negative polarity was formed on the surface of the image bearing member charged by the contact charging means having been charged to the negative polarity, and was developed by the toner having been charged to the same negative polarity. The process speed was approximately 20 mm/sec–160 mm/sec.

Referring to FIG. 36, Test No. 1 represents a prior combination, in which the blade contact pressure was 15 gf/cm and toner, having an average particle diameter of photosensitive drum 9 $\mu$m, was used. As had been expected, the charging characteristic and the photosensitive drum condition were good since the cleaning performance was sufficient.

In Test No. 2, the blade contact pressure was 15 gf/cm and toner, having an average particle diameter of 7 $\mu$m, was used. The cleaning failure began after approximately 1,000 copies had been made, and thereafter, the charge failure began after approximately 1,000 and several hundred of copies had been made. In addition, the toner which slipped by the cleaning blade 13*a* was compacted and fused on the drum surface by the vibration generated by the superposed voltage applied to the charge roller 10.

In Test No. 3, the blade contact pressure was increased to 20 gf/cm and toner having an average particle diameter of 7 $\mu$m was used. The amount of the toner which slipped by the blade as described in the foregoing was reduced, but the cleaning performance was not sufficient. Therefore, the toner having slipped by the cleaning blade 13*a* was accumulated on the surface of the cleaning means 13, on the side in contact with the photosensitive drum 9, and after the 2,000th copy, the accumulated toner was carried off by the photosensitive drum 9 due to the deformation of blade tip, when the apparatus was started up. The carried-off toner adhered to the charging roller 10 and caused charge failure. However, the toner having adhered to the charging roller 10 was gradually removed while several copies were continuously made, and the charging performance was restored.

In Test No. 4, the blade contact pressure was kept at 20 gf/cm and toner, having an average particle diameter of 4 $\mu$m, was used. The results were substantially the same as those for Test No. 3.

In Test No. 5, the blade contact pressure was increased to 25 gf/cm and toner, having an average particle diameter of 7 $\mu$m, was used. The amount of slip-away toner was almost none, and therefore, almost no toner adhered to the cleaning means 13, on the side in contact with the photosensitive drum 9. Within the limit of this endurance test, which made 5,000 copies, toner did not slip by the cleaning means 13 when the apparatus was started up, and the so-called cleaning failure did not occur. As a result, the cleaning performance, the charge characteristic, as well as the photosensitive drum condition, were good.

In Test Nos. 6 and 7, the blade contact pressure was kept at 25 gf/cm, and toner, having an average particle diameter of 5 $\mu$m, and toner, having an average particle diameter of 4 $\mu$m, were used, respectively. The results were the same as those for Test No. 5, wherein the cleaning performance, the charge characteristic, as well as the photosensitive drum condition, were good.

In Test Nos. 8 and 10, the upper limit of the blade contact pressure was measured when toner, having an average particle diameter of 7 $\mu$m, was used. When the blade contact pressure was 60 gf/cm, there was no image related problem, but when the blade contact pressure was 65 gf/cm, the drum surface was substantially scarred, and after approximately 4,000th copies, streaks due to those scars appeared in the image.

In Test Nos. 9 and 11, the upper limit of the blade contact pressure was measured when toner, having an average particle diameter of 4 μm, was used. The results were the same as those for Test Nos. 8 and 10, wherein there was no image related problem when the blade contact pressure was 60 gf/cm, but when the blade contact pressure was 65 gf/cm, the drum surface was substantially scarred, and after approximately 4,000th copies, streaks due to those scars appeared in the image.

According to the results given in the foregoing, with toner having an average particle diameter of 7 μm or less, the blade contact pressure must be set up to be at least 20 gf/cm or higher, and in order to produce always satisfactory images by preventing more reliably, the cleaning failure, the blade contact pressure is preferred to be set within a range of 25 gf/cm–60 gf/cm. Taking these upper and lower limits into consideration, it is more preferable to set the blade contact pressure at approximately 36 gf/cm. Therefore, in this embodiment, the elastic cleaning blade 13*a* was mounted on the bottom frame 15 in such a manner that when the average particle diameter is in a range of 4 μm–7 μm, the cleaning blade 13*a* is placed in contact with the photosensitive drum 9, with a blade contact pressure in a range of 25 gf/cm–60 gf/cm.

(Top and Bottom Frames)

The top and bottom frames 14 and 15 which make up the housing of the process cartridge will be described. Referring to FIG. 6, on the bottom frame 15 side, the developing sleeve 12*d* constituting the developing means 12, developing blade 12*e*, and cleaning means 13 are disposed, in addition to the photosensitive drum 9. On the other hand, on the top frame 14 side, the charging roller 10, toner storage 12*a* constituting the developing means 12, and toner feeding mechanism 12*b* are disposed.

Figure 37:
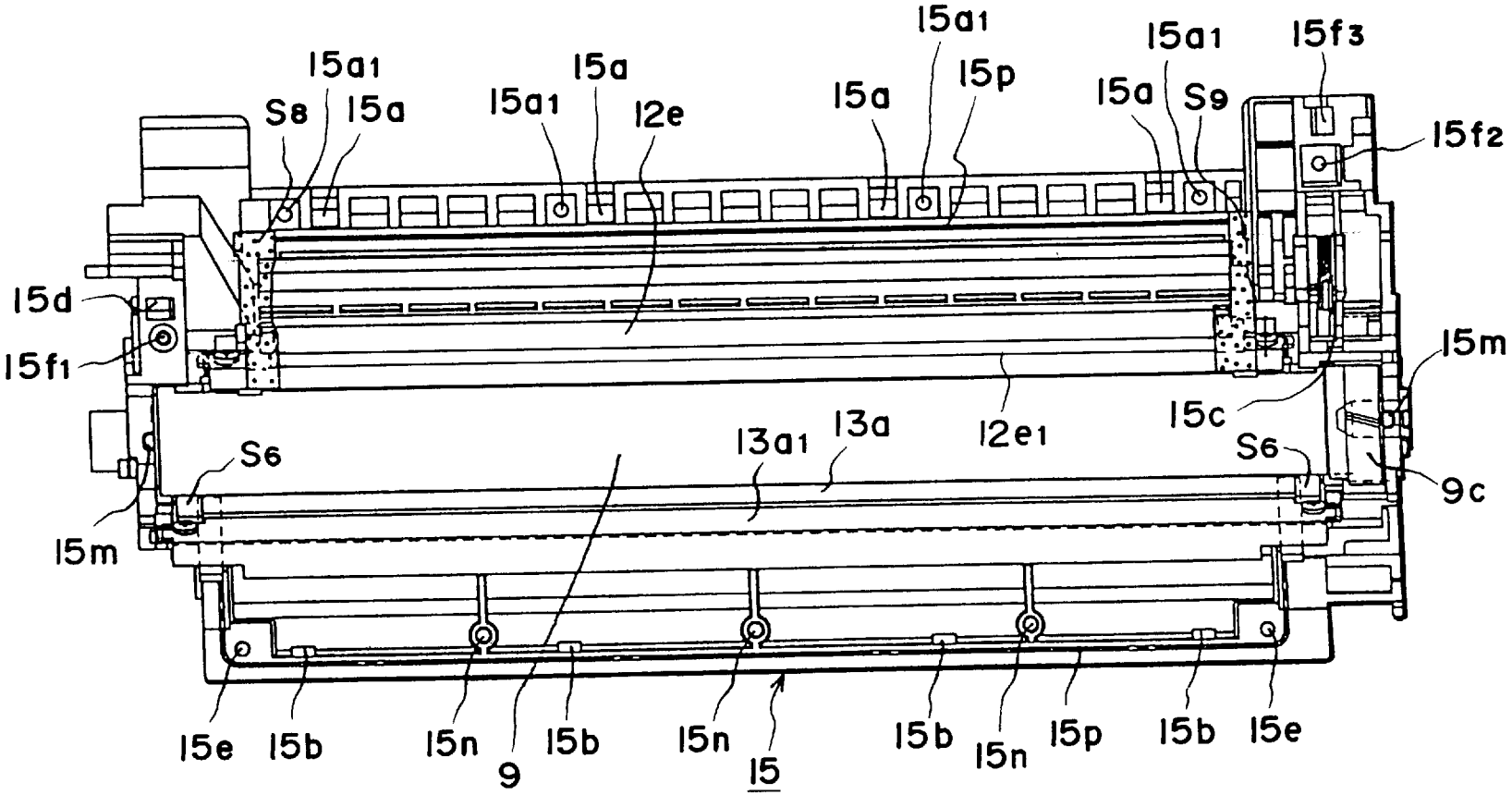
FIG. 37 is an internal plan view of the bottom frame.
Figure 38:
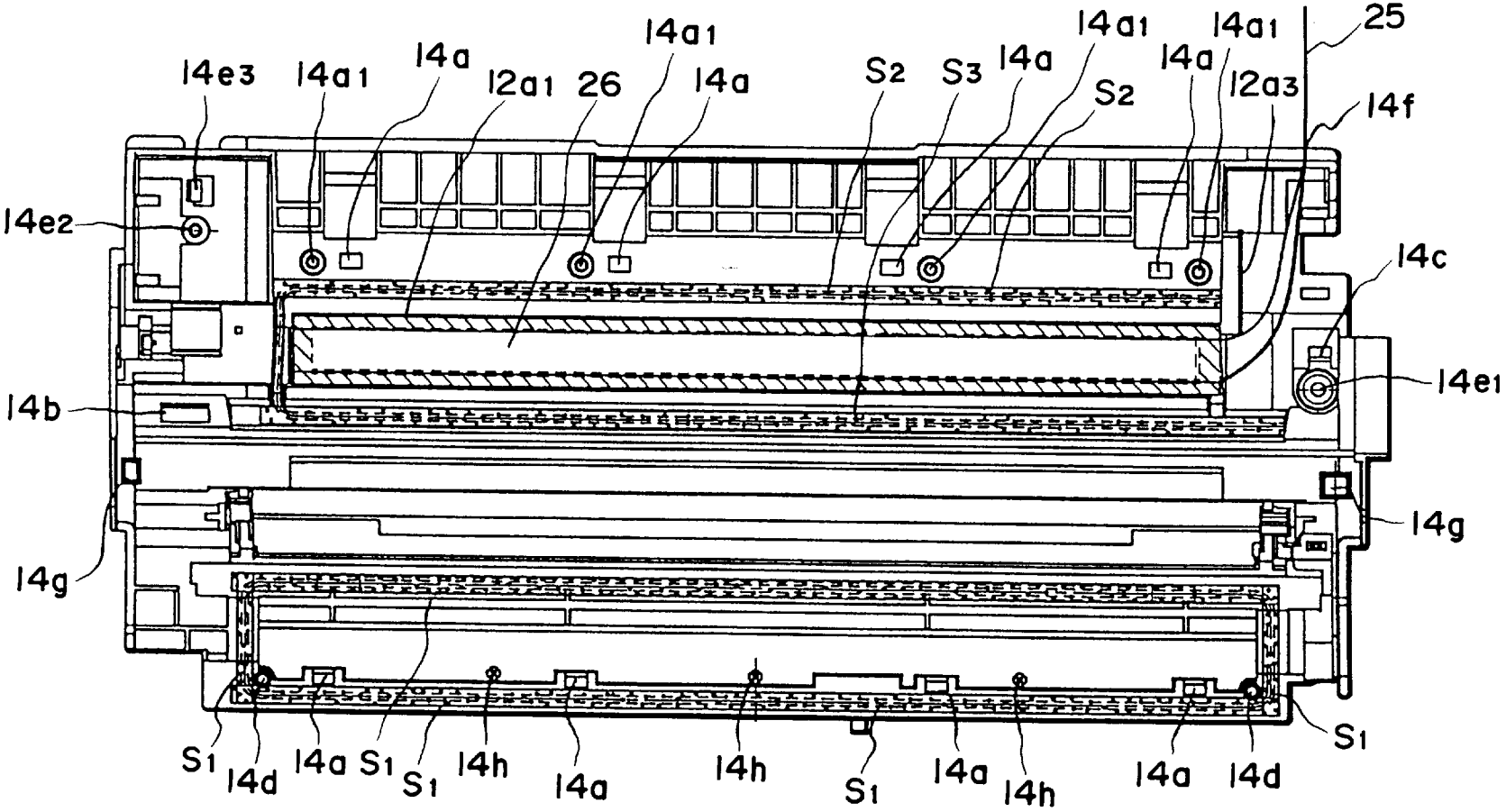
FIG. 38 is an internal plan view of the top frame.

Referring to FIGS. 8 and 38, in order to combine the top and bottom frames 14 and 15, four pairs of claws 14 are integrally formed with the top frame 14, with approximately equal intervals. Referring to FIGS. 7 and 37, the bottom frame 15 is provided with holes 15*a* and 15*b* formed integrally with the frame 15, for engaging with the claws 14*a*. Therefore, the top and bottom frames 14 and 15 are connected as the claws 14*a* are forcefully fitted into the engagement holes 15*a* and 15*b*, wherein the claw 14*a* and engagement holes 15*a* are elastically engaged and can be separated as needed. Further, in order to secure the connection, claws 15*c* and engagement holes 15*d* are provided toward both longitudinal ends of the bottom frame 15 as shown in FIGS. 7 and 37, and engagement holes 14*b* and 14*c* to engage with the engagement holes 15*d* and 15*e* are provided toward both longitudinal ends of the top frame 14 as shown in FIGS. 8 and 38. Referring again to FIGS. 7 and 37, positioning projections 15m are formed toward both longitudinal ends of the bottom frame 15, adjacent to where the photosensitive drum 9 is disposed. These projections 15*m* penetrate through holes 14*g* cut through the top frame 14 and stick out outward, as shown in FIG. 4, when the top frame 14 is connected.

When various members constituting the process cartridge B are separately assembled into the top and bottom frames 14 and 15 as described in the foregoing, members such as the developing sleeve 12, developing blade 12*e*, cleaning blade 13*a*, and the like, which are needed to be specifically positioned relative to the photosensitive drum 9, are disposed on the same frame side (in this embodiment, bottom frame 15), whereby each member can be precisely positioned, while simplifying the assembly process of the process cartridge B.

Further, the bottom frame 15 of this embodiment is provided with engagement concavities 15*n* disposed adjacent to one of its edges as shown in FIGS. 7 and 37, and the top frame 14 is provided with engagement projections 14*h* disposed adjacent to one of its edges, to engage with the concavities 15*n*, at respective approximate midpoints of the intervals of the claws 14*a*.

In addition, the bottom frame 15 of this embodiment is provided with a pair of engagement concavities 15*e*, an engagement projection 15*f*1, and an engagement concavity 15*f*2, which are disposed adjacent to each of respective corners of the frame as shown in FIGS. 7 and 37, and the top frame 14 is provided with a pair of engagement projections 14*d*, an engagement concavity 14*e*1, and an engagement projection 14*e*2, which are disposed adjacent to each of respective corners of the frame 14 as shown in FIGS. 8 and 38, to engage with the pair of engagement concavities 15*e*, engagement projection 15*f*1, and engagement concavity 15*f*2. Adjacent to the engagement concavity 15*f*2, an engagement hole 15*f*3 is provided, and adjacent to the engagement projection 14*e*2, an engagement claw 14*e*3 to engage with the engagement hole 15*f*3 is provided.

Therefore, when the upper and bottom frames 14 and 15 are put together, the engagement projections 14*h*, 14*d*, 14*e*2, and 15*f*1 are engaged with the engagement concavities 15*n*, 15*e*, 15*f*2, and 14*e*1, respectively, and further, the engagement claw 14*e*3 is engaged with the engagement hole 15*f*3, whereby both top and bottom frames 14 and 15 are firmly combined so that the combined top and bottom frames 14 and 15 will not shift from each other even when a twisting force is exerted upon them.

The engagement projections, the engagement concavities, the engagement claws, and the engagement holes may be disposed at different locations other than hose described in the foregoing as long as they can be situated so as to afford resistance to the twisting force exerted upon the upper and bottom frames 14 and 15.

Referring to FIG. 6, the top frame 14 is provided with a shutter mechanism 24 which protects the photosensitive drum 9 from the external light, dust, or the like, when the process cartridge B is out of the image forming apparatus A. The structural detail of this shutter mechanism 24 will be described later.

The bottom surface of the bottom frame 15 functions as a guide for conveying the recording medium. At this time, a more detailed description will be given as to the bottom surface of the bottom frame 15 which functions as the guide for conveying the recording medium.

Figure 39:
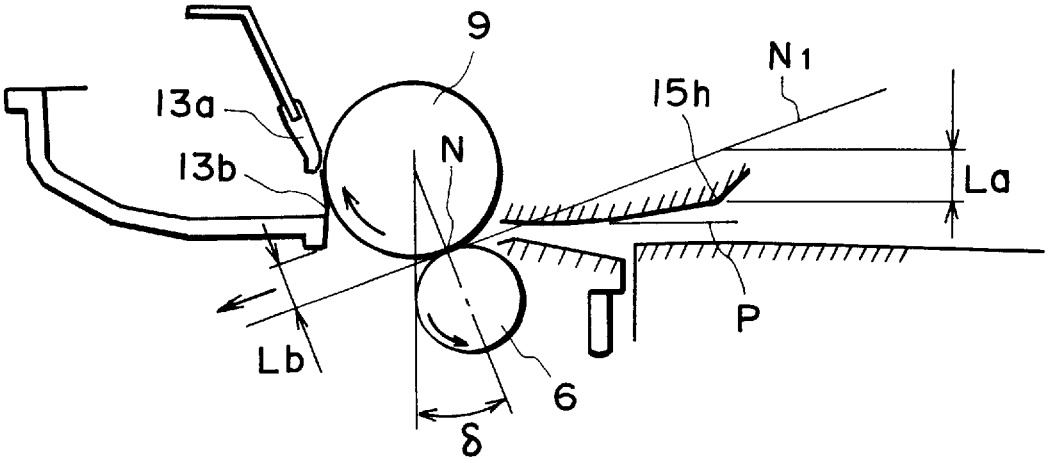
FIG. 39 depicts how the bottom surface of the bottom frame is used to guide a recording medium.

Referring to FIG. 39, a guide portion 15*h* of the bottom surface of the bottom frame 15, being on the upstream side of a nip N formed between the photosensitive drum 9 and the transferring roller 6, is situated to deflect the recording medium P by an amount La (La=5.0 mm–7.0 mm), in relation to the direction of a tangential line N1 at the position of the nip N. Since this guide portion 15*h* is a part of the bottom surface of the bottom frame 15, which is constructed so as to provide a space for the developing sleeve 12*b* and a space necessary for feeding the toner to the sleeve 12*b*, its configuration and position is affected by the position of the developing sleeve 13*d* or the like, which is determined for obtaining a proper developing condition; therefore, when an attempt is made to align this surface closer to the direction of the tangential line N1, the bottom frame 15 becomes thinner, creating a problem regarding the strength of the process cartridge B.

Below the bottom surface of the bottom frame 15, the location of the lower end 13*f* of the cleaning means 13, which is disposed on the downstream side relative to the direction in which the recording medium is conveyed, is determined by how the cleaning blade 13*a*, receptor sheet 13*b*, or the like are arranged in the cleaning means 13, and also, is selected to be a location having a distance of Lb (Lb=4.5 mm–8.0 mm) (approximately 6.2 mm in this embodiment) from the tangential line N, so that the lower end 13*f* does not interfere with the recording medium P. Further, in this embodiment, an angle δ in FIG. 39, which is the angle formed between the perpendicular from the rotational center of the photosensitive drum 9 and the line connecting the rotational centers of the photosensitive drum 9 and transferring roller 6, is set so as to satisfy: δ=10°–30° (approximately 20° in this embodiment.

(Shutter Mechanism)

In order to transfer the toner image onto the recording medium, the photosensitive drum 9 is made to face the transferring roller 6 through the opening 15*g* (FIG. 42) provided on the bottom frame 15. However, if the photosensitive drum 9 remains exposed when the process cartridge B is out of the image forming apparatus A, the photosensitive drum 9 deteriorated by being exposed to the external light, and also, dust may adhere to the photosensitive drum 9. Therefore, the process cartridge B is provided with the shutter mechanism 24 for protecting the otherwise exposed portion of the photosensitive drum 9 from external light, dust, or the like when the process cartridge is out of the image forming apparatus A. Hereinafter, the structure of the shutter mechanism will be described in detail referring to FIGS. 40–44.

<Structure of Shutter Mechanism>

Figure 40:
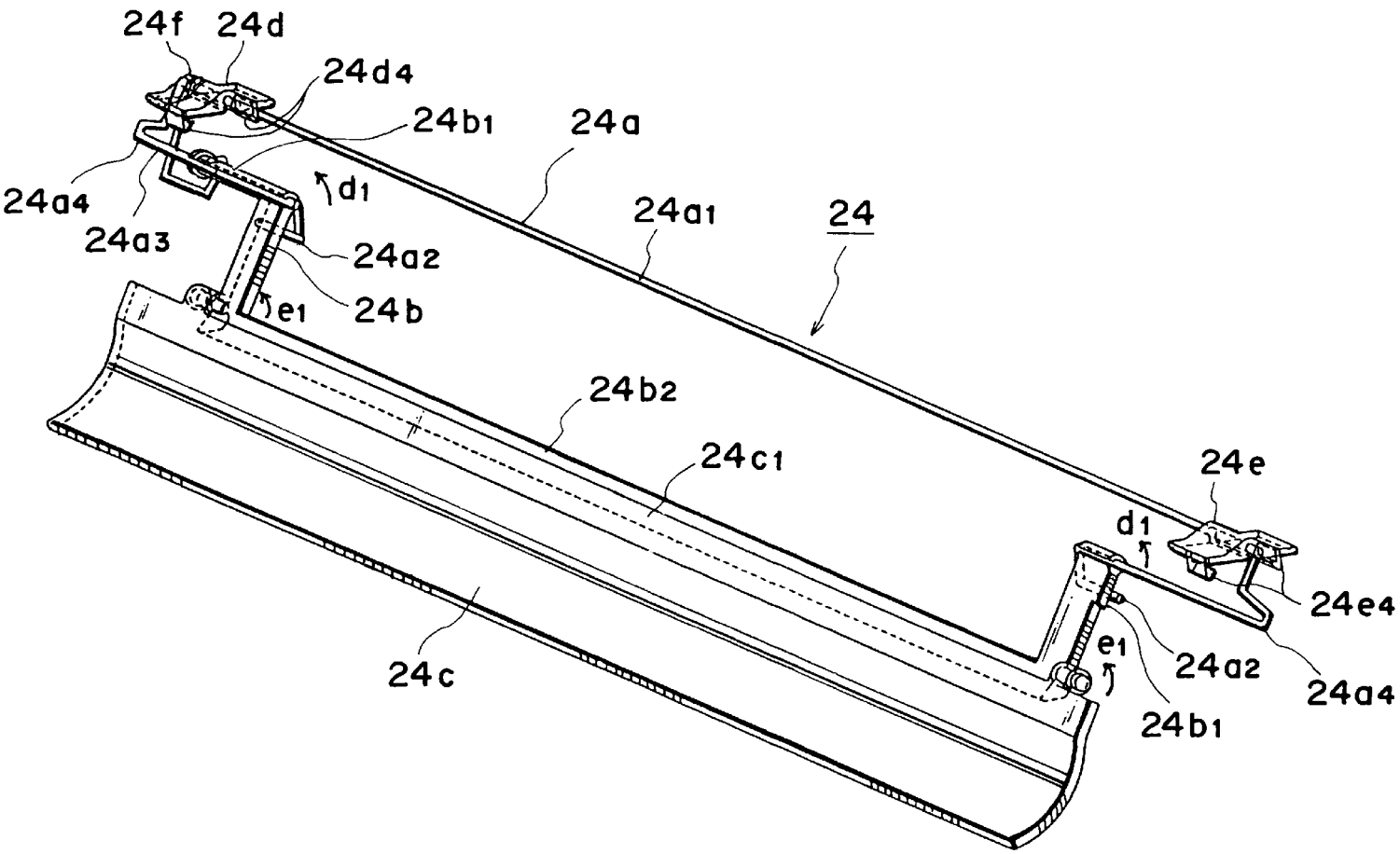
FIG. 40 is an oblique view of a shutter mechanism.

Referring to FIG. 40, the shutter mechanism 24 comprises a shutter arm 24*a*, a shutter linkage 24*b*, a shutter portion 24*c*, shaft retainers 24*d* and 24*e*, and a torsion spring 24*f*; and automatically opens or closes as the process cartridge B is installed into, or taken out of, the image forming apparatus A.

The shutter arm 24*a* is made of metallic material, and is rotatably held, at two points toward the ends, by retaining portions 24*d*1 and 24*e*1 (FIG. 43) of the shaft retainers 24*d* and 24*e*, as shown in FIG. 40. By this shutter arm 24*a*, the shutter linkage 24*b* is rotatably supported, wherein the rotationally central portion 24*b*1 of the shutter linkage 24*b* is regulated by a rotation regulating portion 24*a*2 of the shutter arm 24*a*, thereby preventing the shutter linkage from rotating more than a given angle in the direction indicated by an arrow d1. By the shutter linkage 24*b*, the shutter portion 24*c* is rotatably supported, wherein the rotationally central portion 24*c*1 of the shutter portion 24*c* is regulated by a rotation regulating portion 24*b*2 of the shutter linkage 24*b*, thereby preventing the shutter portion 24*b* from rotating more than a given angle in the direction indicated by an arrow e1.

Figure 41:
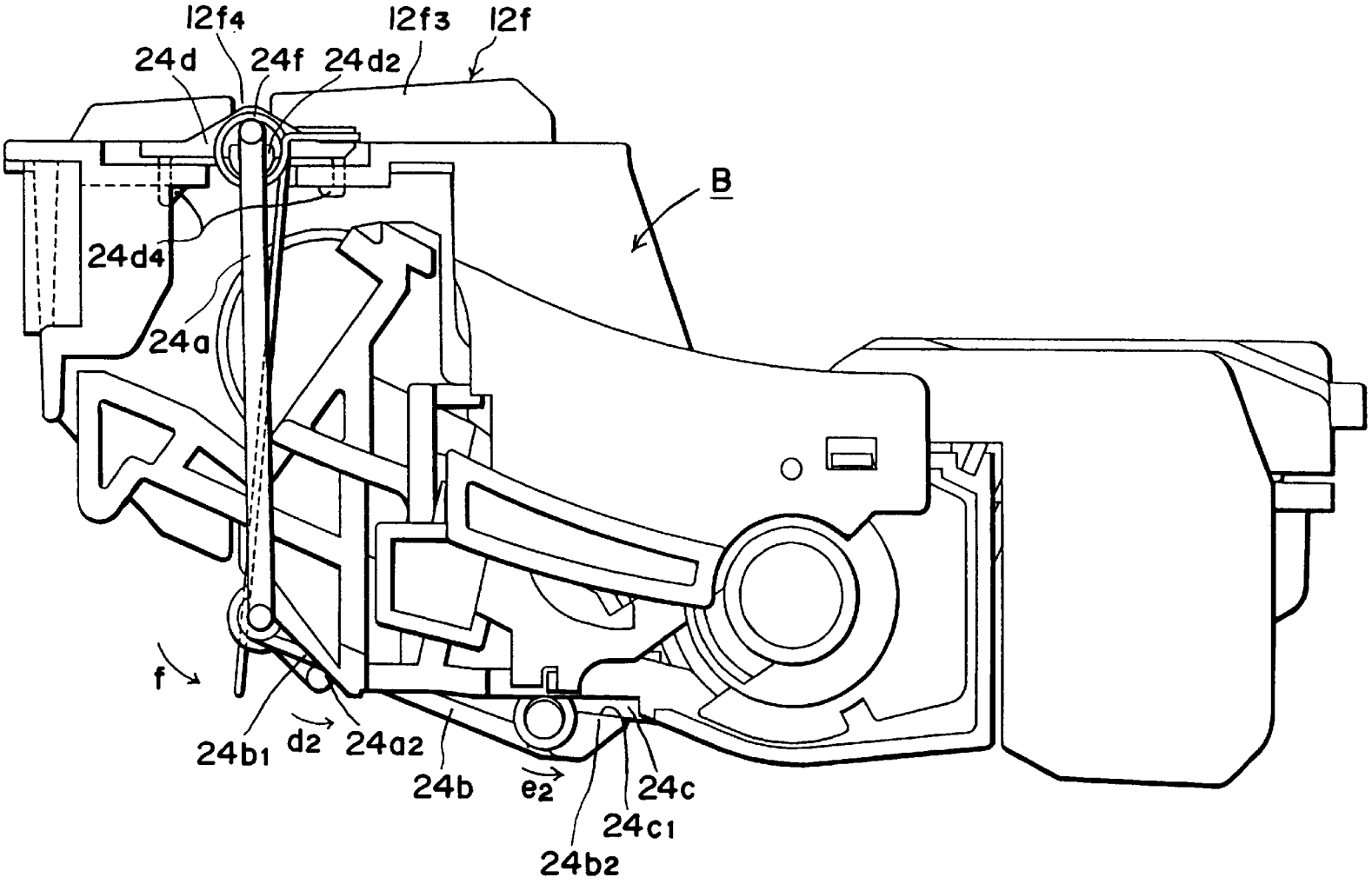
FIG. 41 is an external side view of the process cartridge.

The shaft retainer 24*d* holding rotatably one end of the shutter arm 24*a* is provided with a projection 24*d*2 (FIG. 43) projecting from the retaining portion 24*d*1, and in this projection, the torsion spring 24*f* is fitted. One end of the torsion spring 24*f* is placed in a groove 24*d*3 of the shaft retainer 24*d*, and the other end is rested on a supporting portion 24*a*3 of the shutter arm 24*a* which supports rotatably the shutter linkage 24*b*; therefore, the shutter arm 24*a* is provided with a rotational moment in the direction indicated by an arrow f as shown in FIG. 41. Being pressured by the force from the torsion spring 24*f*, the rotation regulating portion 24*a*2 of the shutter arm 24*a* regulates the shutter linkage 24*b* in the direction indicated by an arrow d2, and in turn, the rotation regulating portion 24*b*2 of the shutter linkage 24*b* regulates the shutter portion 24*c* in the direction indicated by an arrow e2, whereby the shutter mechanism 24 is completely shut, as shown in FIG. 41.

Figure 42:
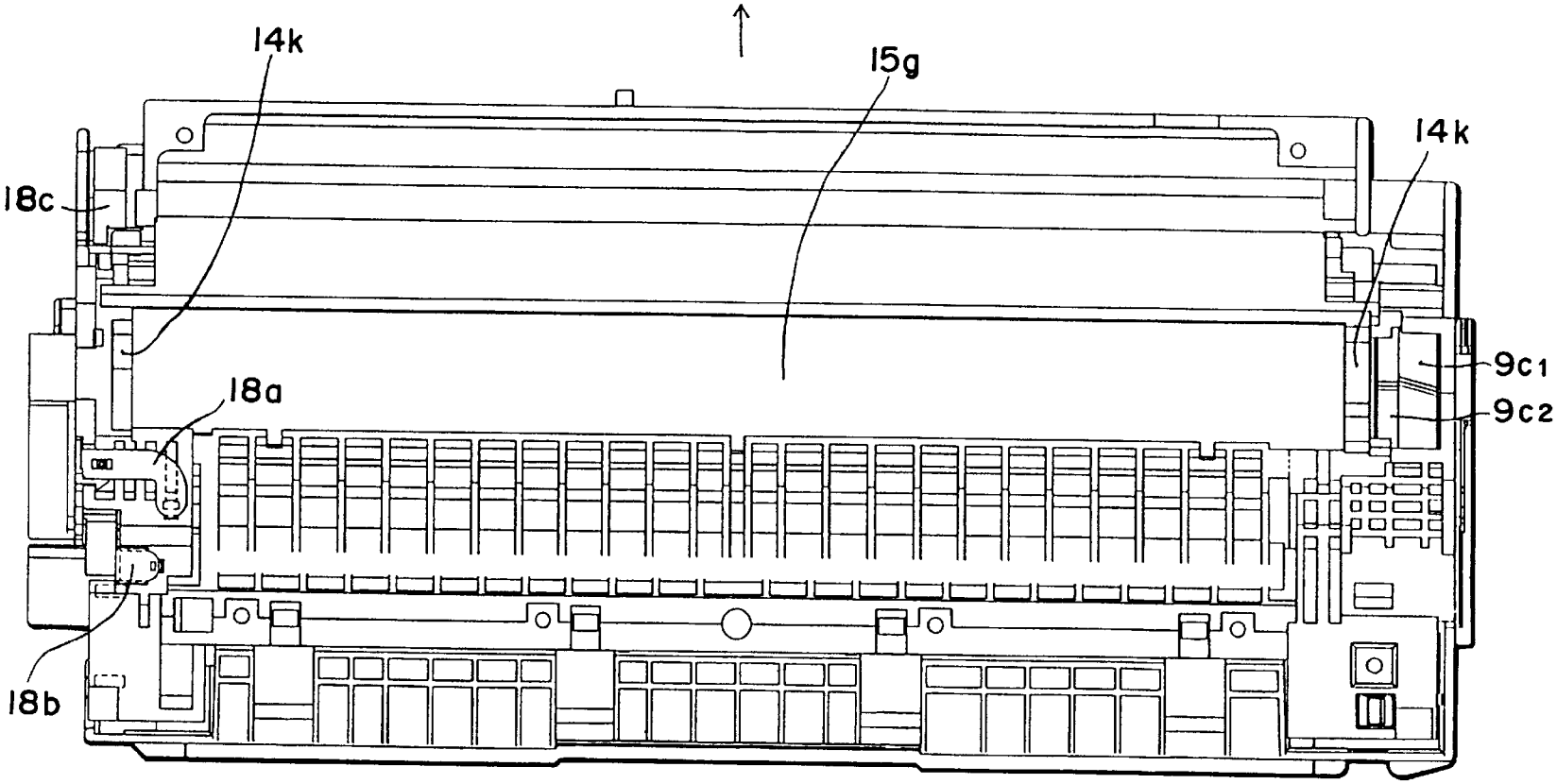
FIG. 42 is an external bottom view of the process cartridge.
Figure 43A:
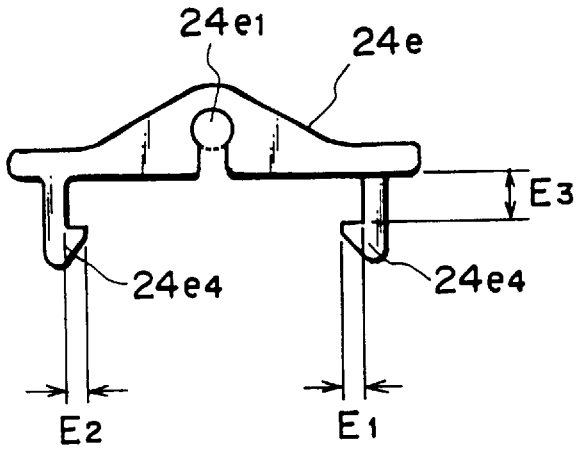
FIGS. 43(*a*) and (*b*) are a plan view of a shutter shaft retaining member, and an oblique view of the same, respectively.
Figure 43B:
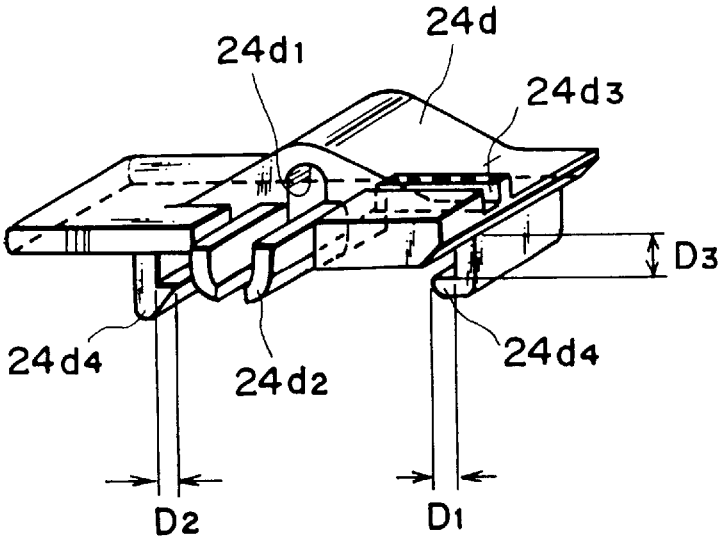

In this embodiment, the internal surface (surface facing the surface of the photosensitive drum 9) of the shutter portion 24*c* is molded to be slippery so that even when the shutter portion 24*c* and the photosensitive drum 9 make contact with each other while the shutter mechanism 24 is completely shut, the shutter portion 24*c* is prevented from damaging the surface of the photosensitive drum 9. Further, as shown in FIG. 42, a shutter supporting portion 14*k* is provided at each of the longitudinal ends of the drum opening 15*g* of the bottom frame 14. This shutter supporting portion 14*k* holds the shutter portion 24*c* so that the shutter portion 24*c* does not contact the surface of the photosensitive drum 9 when the shutter mechanism is completely shut.

Further, the shutter mechanism can be attached to, or removed from, the top frame 14. More specifically, the shaft retainers 24*d* and 24*e* which support the shaft portion 24*a*1 of the shutter arm 24*a* are provided with engagement claws 24*d*4 and 24*e*4, respectively, and the shutter mechanism 24 is attached to the top frame 14 by engaging these engagement claws 24*d*4 and 24*e*4 into engagement holes (not shown) provided on the top frame 14, at respective longitudinal ends of the upper surface on the development side.

<Engaging Amount of Engagement Claw of Shaft Retainer>

The shutter mechanism is structured so as to open or close as the process cartridge B is installed or removed, and the force exerted on the shaft retainers 24*d* and 24*e* which retain the shutter mechanism on the top frame 14 varies when the shutter mechanism 24 is opened or closed. Since only the shaft retainer 24*d* out of the pair of shaft retainers 24*d* and 24*e* is fitted with the torsion spring 24*f*, which pressures the shutter mechanism in the shutting direction, the force exerted on the shaft retainer 24*d* is larger than that exerted on the other shaft retainer 24*e*, which is not fitted with the torsion spring 24*f*; therefore, its deformation also is larger. As a result, when the engaging amount of the engagement claw 24*d*4 of the shaft retainer 24*d* is the same as that of the engagement claws 24*e*4 of the other shaft retainer 24*e*, the engagement claw 24d4 may disengage. Therefore, in this embodiment, the engaging amount of the engagement claw 24*d*4 of the shaft retainer 24*d* is made larger than the engaging amount of the engagement claws 24*e*4 of the shaft retainer 24*e*, so that the shaft retainer 24*d* does not easily disengage. More specifically, the engaging mount of the engagement claw 24*d*4 on one side of the shaft retainer 24*d* is made larger than that on the other side. In other words, while the shaft retainers 24*d* and 24*e* are arranged in the longitudinal direction of the top frame 14, the torsion spring 24*f* is provided on only one end, that is, on the shaft retainer 24*d*, and in case of this shaft retainer 24*d*, the engaging amount of the-engagement claw 24*d*4 on one side of the shaft retainer 24*d* is different from that on the other side, whereas in the case of the shaft retainer 24*e* where the torsion spring 24*f* is not provided, the engaging amount of the engagement claws 24*e*4 on one side is the same as that on the other side. Therefore, the amount of strength by which the shaft retainer 24*d* or 24*e* remain engaged with the top frame 14 is different between them.

Given below is an exemplary set of concrete values for the engaging amount of the engagement claws 24*d*4 and 24*e*4 in this embodiment. The choice is not limited to this example, and may be made as appropriate.

(1) Engaging amount of engagement claws 24*d*4 on one side of shaft retainer 24*d* (D1): approx. 1.0 mm (2) Engaging amount of engagement claws 24*d*4 on the other side of shaft retainer 24*d* (D2): approx. 1.1 mm (3) Arm length of engagement claw 24*d* of shaft retainer 24*d* (D3): approx. 2.8 mm (4) Engaging amount of engagement claws 24*e*4 on one side of shaft retainer 24*e* (E1): approx. 1.0 mm (5) Engaging amount of engagement claws 24*e*4 on the other side of shaft retainer 24*e* (E2): approx. 1.0 mm (6) Arm length of engagement claw 24*e*4 of shaft retainer 24*e* (E3): approx. 2.8 mm <Rotational Center of Shutter Mechanism>

Figure 44:
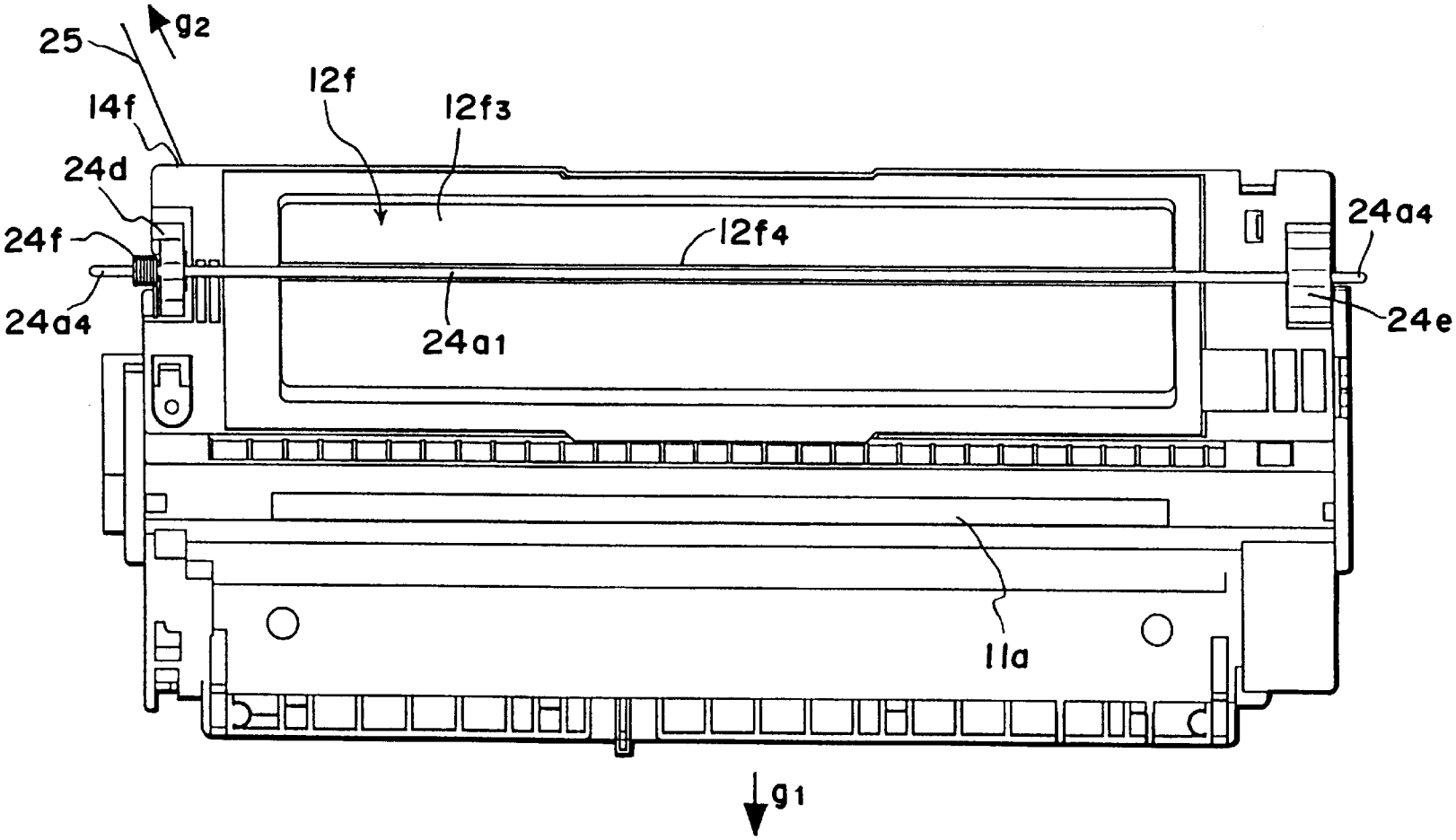
FIG. 44 is an external top view of the process cartridge.

In the shutter mechanism 24, the shaft portion 24*a*1 of the shutter arm 24*a*, which is the rotational axis of the shutter mechanism, extends in the longitudinal direction of the top frame 14, on the development side upper surface of the top frame 14; therefore, this shaft portion 24*a*1 is liable to be deformed or subjected to like damage by being pulled by a user's hand during the cartridge installation or in like situations. Further, referring to FIG. 42, in this embodiment, in order to increase the toner space in the toner storage 12*a*, a bulge 12*f*3 is provided on the cover member 12*f*. If the shaft portion 24*a*1 which is the rotational axis of the shutter mechanism is extended over and across the bulge 12*f*3, the rotational range of the shutter mechanism is increased. Therefore, in this embodiment, in order to prevent such an increase, the bulge 12*f*3 of the cover member 12*f* is provided with a groove 12*f*4 extending in its longitudinal direction, as shown in FIG. 44, and the shaft portion 24*a*1 extends through this groove 12*f*4, so that it does not stick out above the upper surface of the bulge 12*f*3 of the cover member 12*f*.

{Assembly of Process Cartridge}

Next, how the process cartridge having the structure described hereinbefore is assembled will be described in detail, referring to drawings.

(Assembly Involving bottom frame)

Figure 45:
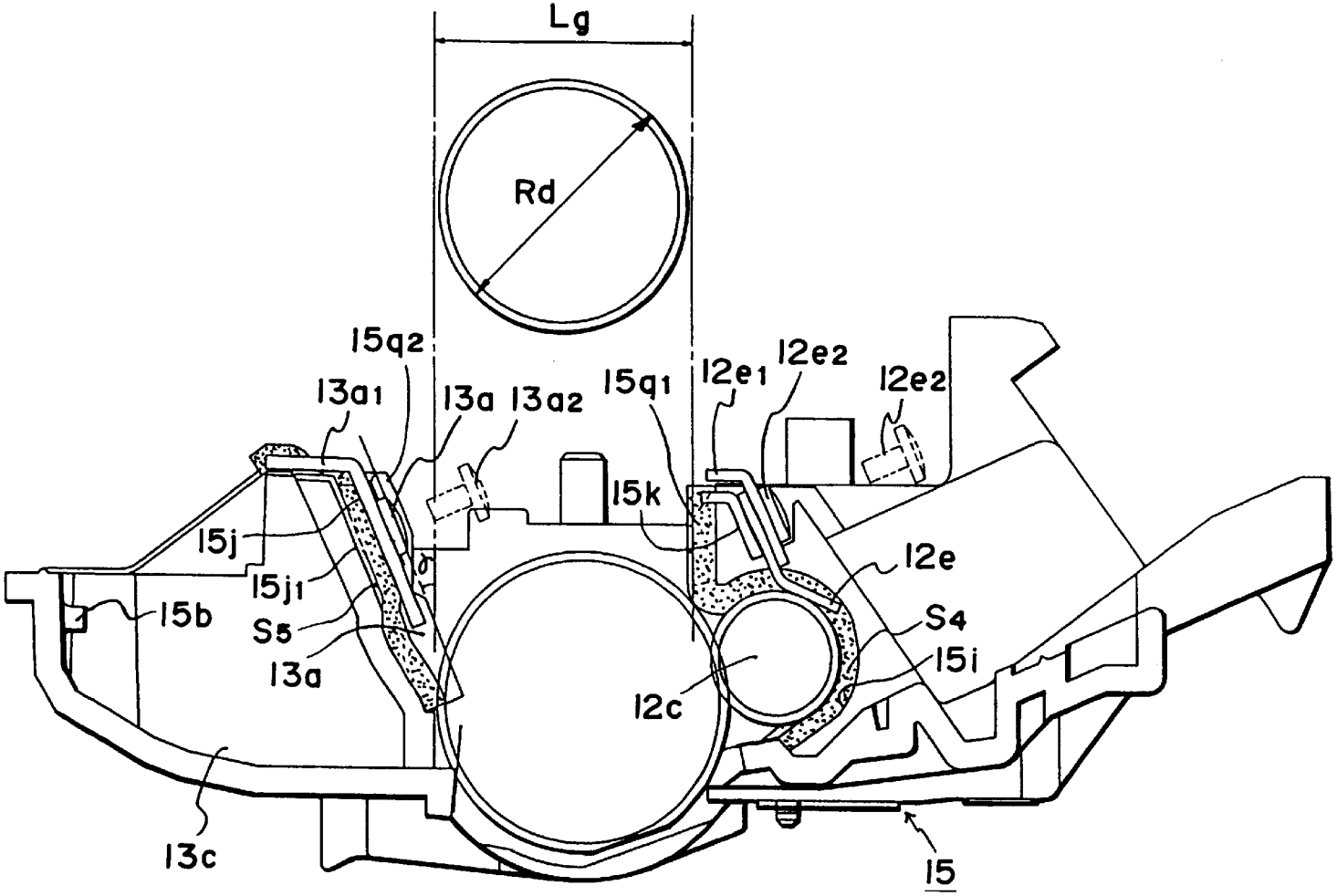
FIG. 45 depicts how the photosensitive drum is assembled in last.

Referring to FIG. 45, first, in the bottom frame 15, in order to prevent a toner leak, contoured seal members S4 made of foamed urethane or the like are pasted, with double sided adhesive tape, on a developing sleeve seal bering surface 15*i*, and a contoured seal member S5, made of the same material, is pasted in the same manner on a seat portion 15*j*1, which is located on the outward side of a cleaning blade mounting surface 15*j*, relative to the longitudinal direction of the bottom frame 15. In this embodiment, however, a felt material is used for the seal member S4 to be pasted on the developing sleeve seal bearing surface 15*i*, and foamed urethane is used for the seal member S5 to be pasted on the seat portion 15*j*1 located adjacent to the cleaning blade mounting surface 15*j*. The seal members S4 and S5 for preventing the toner leak do not need to be contoured. Instead, liquid material, which can solidify into elastomer, may be poured into concave portions formed where the seal members are to be seated in the frame.

Figure 46:
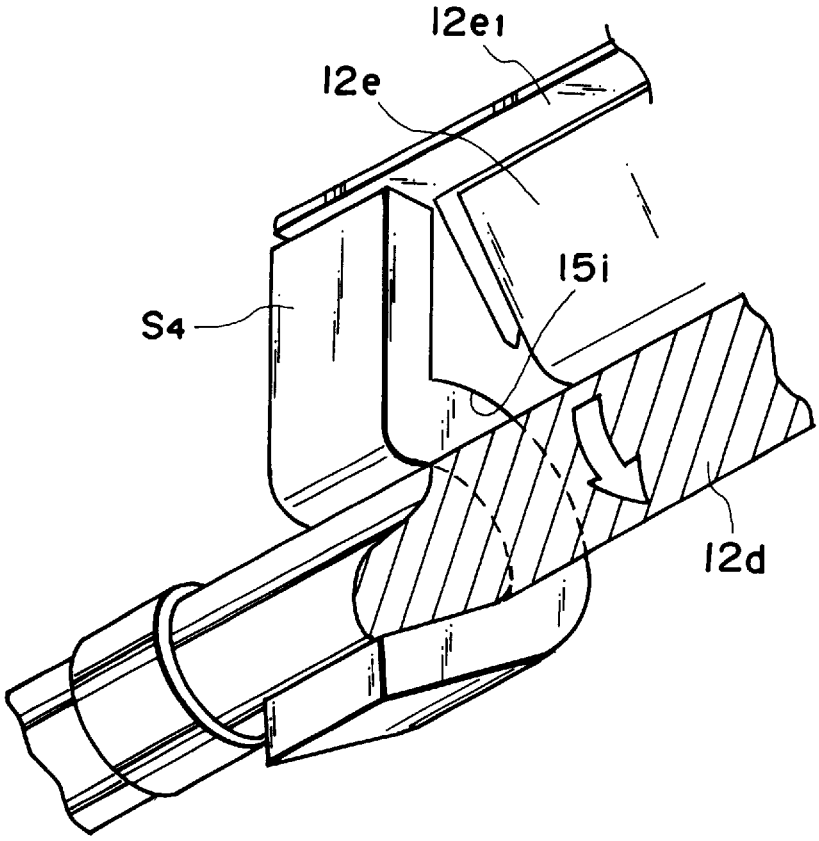
FIG. 46 depicts the toner adhesion to the end portions of the developing sleeve.
Figure 47:
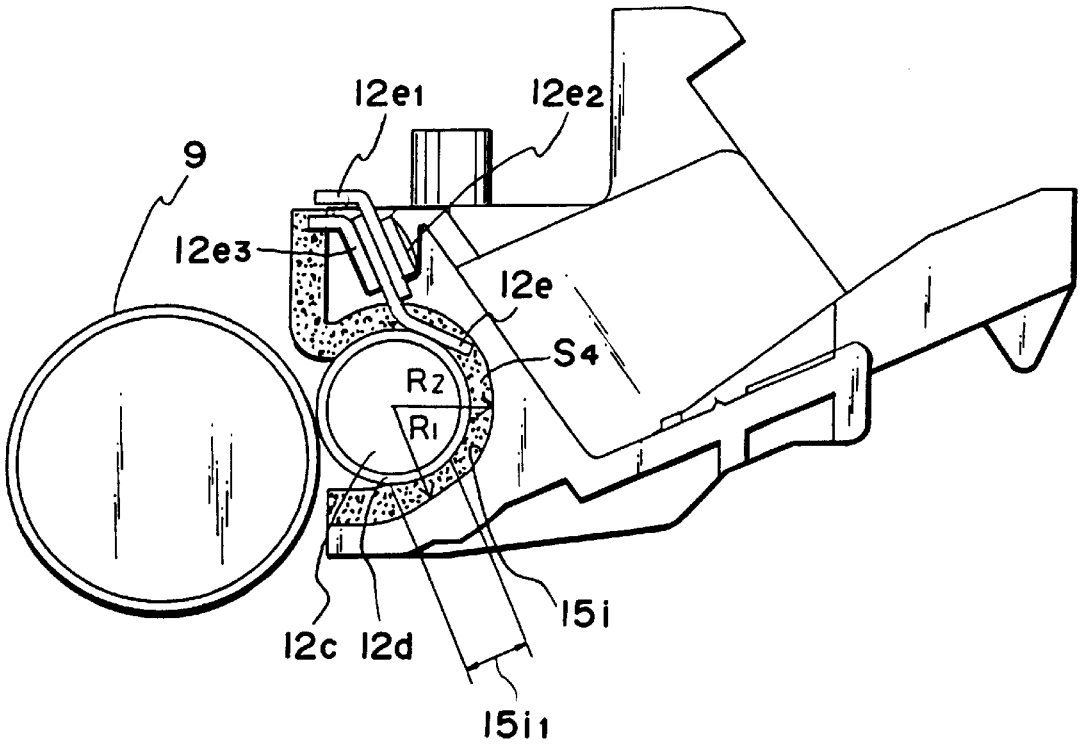
FIG. 47 depicts the molded shape of the developing sleeve mounting surface.

The developing sleeve 12*d* is installed in the bottom frame 15 in which the seal member S4 is pasted. As described in the foregoing, the toner leak from the ends of the developing sleeve 12*d* is prevented by the seal member S4, wherein as shown in FIG. 46, because of the relation between the rotational direction of the developing sleeve 12*d* (arrow direction in the drawing) and magnetic poles of the roller magnet 12*c* disposed within this sleeve, the toner adheres to the developing sleeve 12*d*, at the end portions of the developing sleeve 12*d*, that is, near the seal member S4, in a manner as indicated by the solidus in FIG. 46; therefore, the sealing performance of the seal member S4 is desirably highest at the bottom portion 15*i*1 shown in FIG. 47. Therefore, the sleeve seal bearing surface 15*i* of this embodiment is molded in such a manner that a radial distance from the center of the developing sleeve 12*d* to the bottom portion 15*i*1 of the sleeve seal bearing surface 15*i* becomes smaller than a radius R2 of the other portion. In other words, the radii between two radiuses R1 and R2 is: R1<R2. With this arrangement, when the developing sleeve 12*d* is mounted in the bottom frame 15 through the bearings 12*h* and 12*i*, the seal member S4 is compressed more along the bottom portions 15*i*1 than along the other portion, increasing the sealing pressure between the developing sleeve 12*d* and the bottom portion 15*i*1, that is, improving the sealing performance. The sleeve seal bearing surface 15*i* in this embodiment is so formed as to compress the seal member S4 approximately 0.4 mm more along the bottom portion 15*i*1 than along the other portion.

A blade supporting member 12*e*1 to which a developing blade 12*e* has been attached and the blade supporting member 13*a*1 to which the cleaning blade 13*a* has been attached are mounted, with screws 12*e*2 and 13*a*2, on corresponding blade mounting surface 15*k* and 15*j* of the bottom frame 15. At this time, in this embodiment, in order to allow the screws 12*e*2 and 13*a*2 to be inserted from the same direction as indicated by the broken lines in FIG. 45, the blade mounting surfaces 15*k* and 15*j* for the blade supporting members 12*e*1 and 13*a*1, respectively, are formed substantially in parallel. Therefore, when the process cartridges B are mass-produced, the developing blade 12*e* and cleaning blade 13*a* can be automatically and consecutively screwed by an automated machine or the like. With this arrangement, a space for a screw driver or the like is provided, whereby the assembly efficiency for both blades 12*e* and 13*a* can be increased, and further, the opening directions of the molds for forming the housing (frame) can be made the same, whereby the mold structure can be simplified to reduce the manufacturing cost.

In this embodiment, the bottom frame 15 is molded so that the angles of the developing blade mount bearing surface 15*k* and cleaning blade mount bearing surface 15*j*, relative to the perpendicular drawn in FIG. 45, become approximately 24° and 22°, respectively, both surfaces being substantially parallel to each other. Also, as described before, in order to screw consecutively both blades 12*e* and 13*a* with an automated machine or the like, the angles of both screw holes provided for screwing the developing blade 12*e* and cleaning blade 13*a* at the blade mounting surface 15*k* and 15*j* are made to be the same, that is, approximately 24° relative to the horizontal line drawn in FIG. 45, so that they can be drilled by a single slide.

Figure 48:
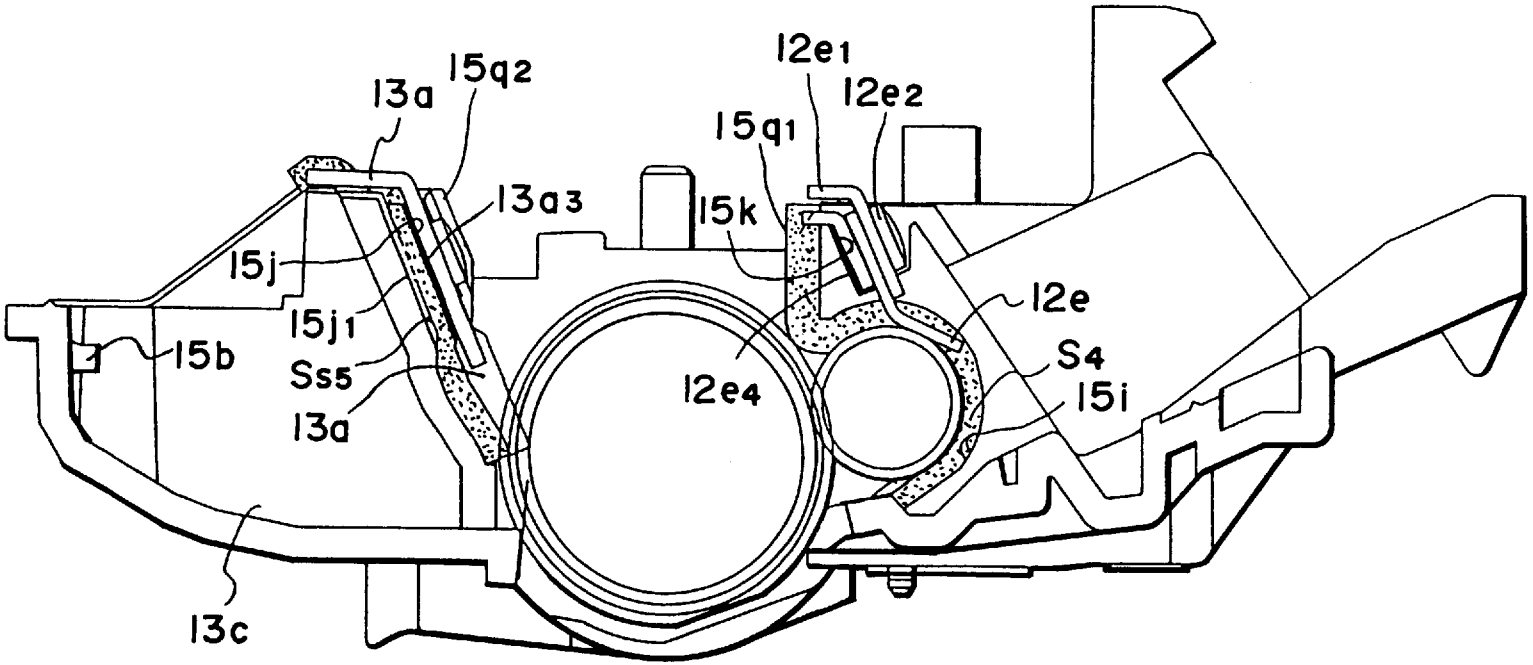
FIG. 48 is a sectional view of an embodiment in which a developing blade and a cleaning blade are pasted.

Instead of screwing, the developing blade 12*e* and cleaning blade 13*a* may be attached by gluing them on the bottom frame 15 with adhesives 12*e*4 and 13*a*3 as shown in FIG. 48. Even in such a case, by making such an arrangement that both blades 12*e* and 13*a* can be glued from the same direction, the developing blade 12*e* and cleaning blade 13*a* can be consecutively attached with an automated machine or the like, as when the screws are used.

<Seal at Cleaning Blade Ends>

Figure 49:
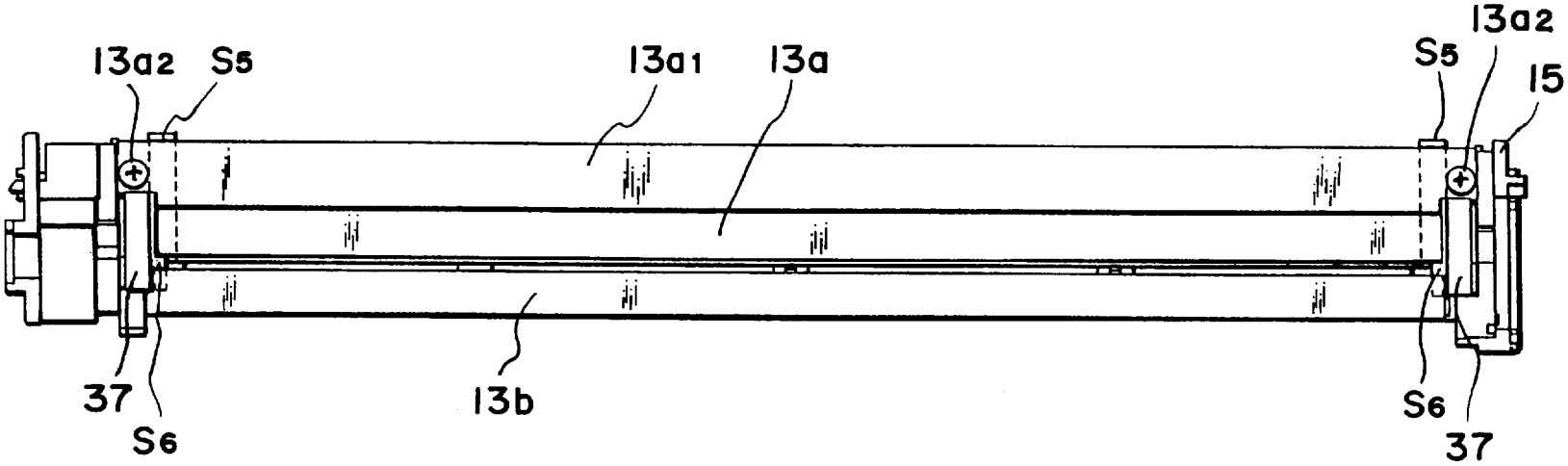
FIG. 49 is a plan view of seal members disposed at the end portions of the cleaning blade.

Further, a seal member S6 made of foamed polyurethane or the like is pasted to the bottom portion of the blade mounting surface 15*j*, as shown in FIG. 49, wherein the bottom portion corresponds to the end portion of the cleaning blade 13*a*. The seal S6 is a seal for preventing the toner, scraped off by the cleaning blade 13*a*, from traveling sideways on the blade 13*a* and leaking out of the blade end.

When a distance LS (FIG. 50) between the bottom edge of the seal member S6 and the contact area between the photosensitive drum 9 and seal member S6 is shortened (more specifically, less than 0.5 mm) by the downsizing of the process cartridge B, the seal member S6 is liable to be dragged by the photosensitive drum 9 due to the torque of the photosensitive drum 9 and vibrations, and further, it is liable to be peeled off after a long period of use. In this embodiment, therefore, a high density polyethylene sheet 37 is pasted on the seal member S6, to reduce the friction between the photosensitive drum 9 and seal member S6, as shown in FIG. 49.

Figure 51:
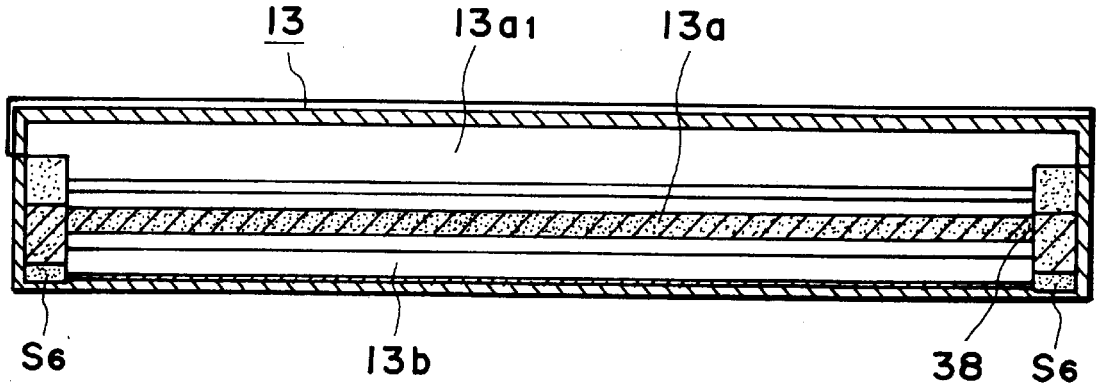
FIG. 51 depicts the condition of the lubricant coated on the seal members disposed at the end portions of the cleaning blade.

Also, on the cleaning blade 13*a*, a solid lubricant such as polyvinylidene fluoride (PVDF), fluorinated carbon, silicon particles or the like is coated, so that the torque increase which occurs because of the tight contact due to lack of the toner on the photosensitive drum 9 during the start-up period is prevented, wherein in this embodiment, the lubricant 38 is also coated on seal member S6 as shown in FIG. 51, whereby the friction between the drum end and seal member S6 is further reduced to prevent the dragging of the seal member S6.

<Seal at Developing Sleeve End>

Figure 52:
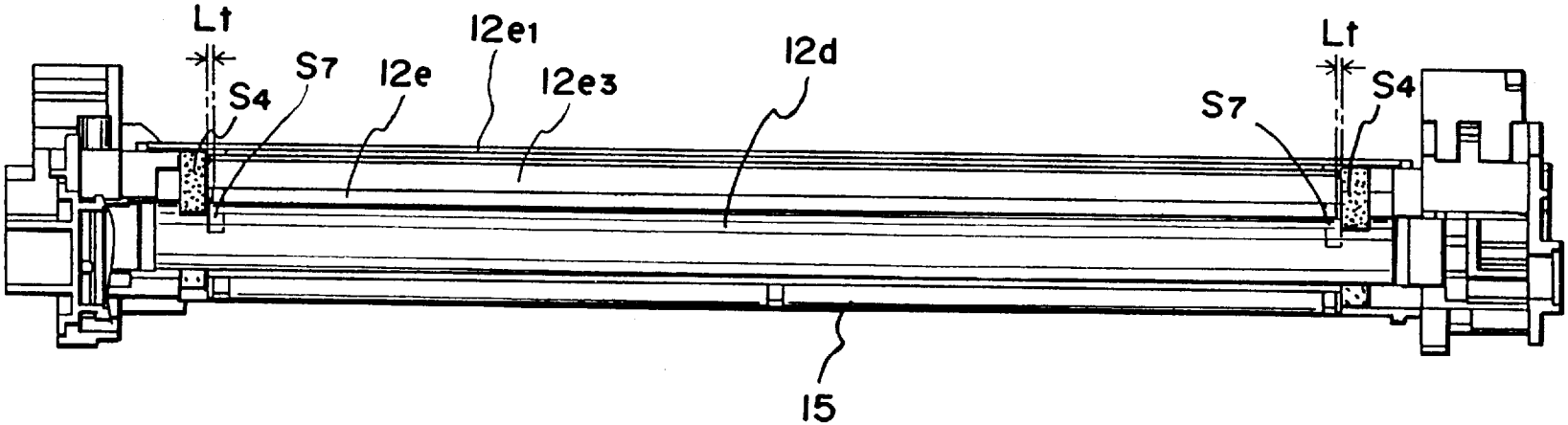
FIG. 52 is a plan view of the seal members disposed at the end portions of the developing blade.
Figure 53:
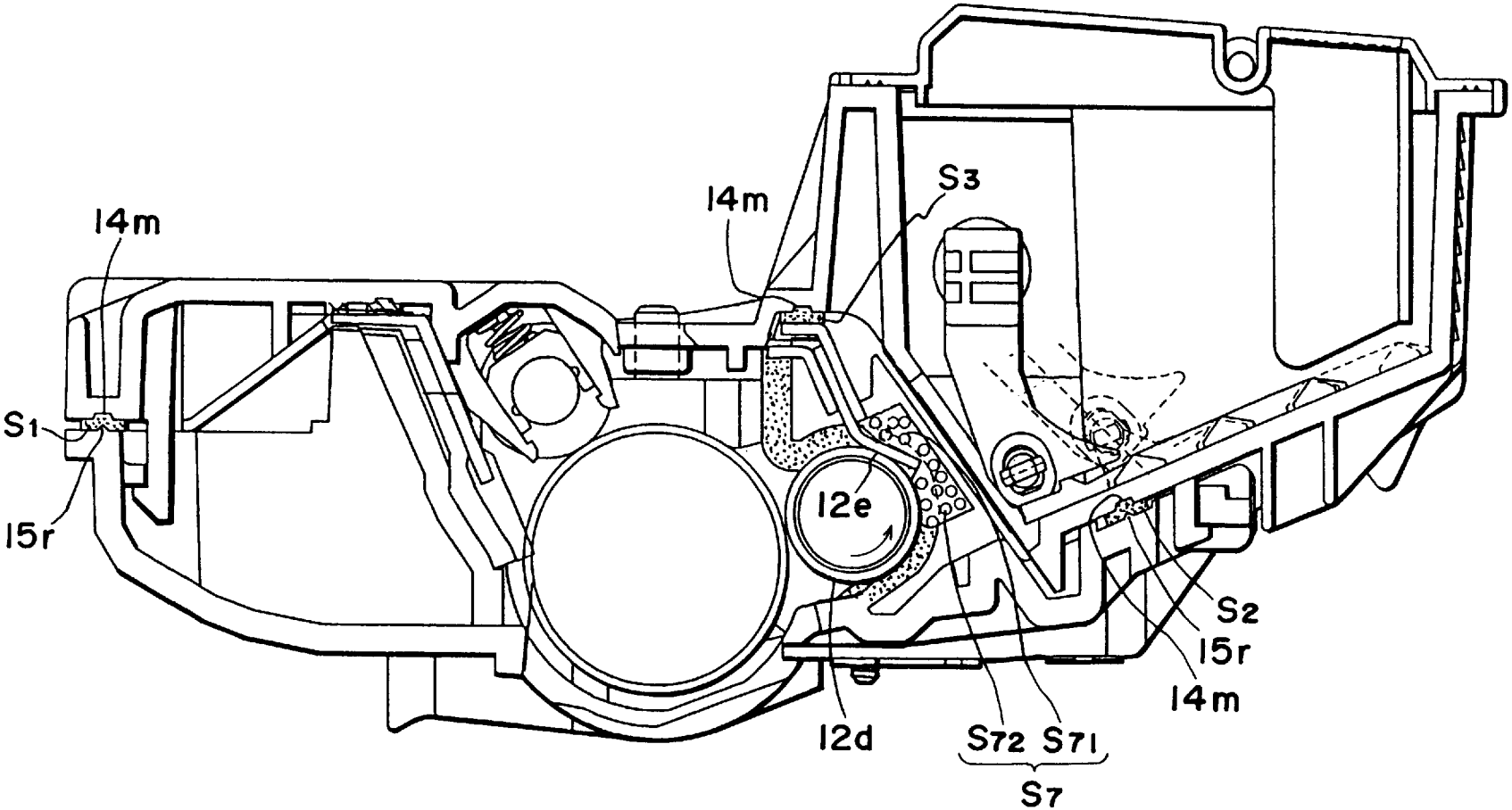
FIG. 53 depicts the shape of the seal member disposed at one end of the developing blade.

Referring to FIG. 52, in order to prevent the toner from leaking through a gap Lt created between the end portion of the developing blade 13 and the bottom frame 15 (end surface of the seal member S4 in FIG. 52) and at the same time, to scrape off the toner layer on the gap Lt portion of the developing sleeve 12*b*, a seal member 7 is provided at each end of the developing blade 12*e*. This seal member 7 is, as shown in FIG. 53, formed to accommodate the contour of the developing blade 12*e* being pressed on the developing sleeve 12*b*, so that the contact pressure with which the developing blade 12*e* is pressed upon the developing sleeve is not increased. By this arrangement, the seal member S7 prevents the toner leak, with its upper side portion S71, and scrapes off the toner on the end portion of the developing sleeve 12*d*, with the lower side portion S72.

Figure 54:
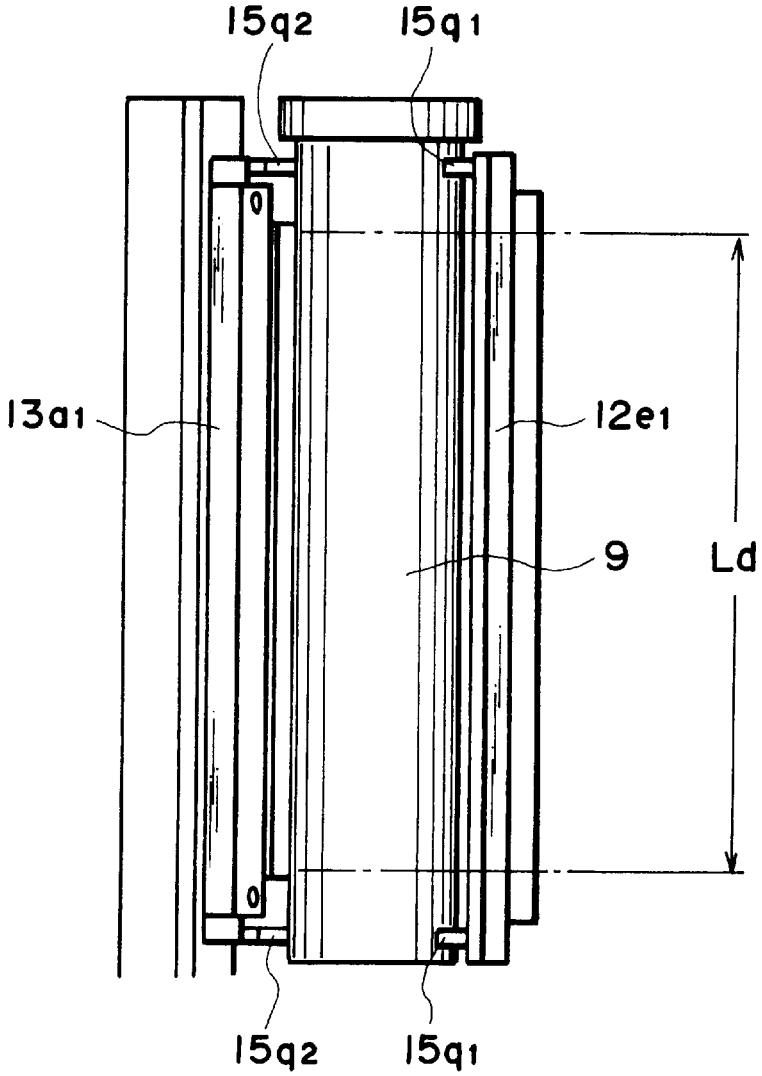
FIG. 54 is a schematic drawing for showing the locations where the guide members are attached when the photosensitive drum is assembled in the frame.

As described before, the photosensitive drum 9 is attached after the blades 12*e* and 13*a* are attached. Therefore, in this embodiment, as shown in FIG. 45, guide members 15*q*1 and 15*q*2 are provided in the bottom frame 15, and the guide member 15*q*1 is disposed on the developing blade supporting member 12*e*1, on the surface facing the photosensitive drum 9, and the guide member 15*q*2 is disposed on the cleaning blade supporting member 13*a*1, on the surface facing the photosensitive drum 9. Both of them are located outside the image forming range of the photosensitive drum 9, relative to the longitudinal direction of the photosensitive drum 9 (range Ld in FIG. 54). A distance Lg between the both guides 15*q*1 and 15*q*2 is set up to be larger than the external diameter Rd of the photosensitive drum 9.

Having such an arrangement, the photosensitive drum 9 can be attached last, with both end portions (portions outside the image forming range), relative to the longitudinal direction, being guided by the guide members 15*q*1 and 15*q*2, as shown in FIG. 45. In other words, the photosensitive drum 9 is rolled down into the bottom frame 15, with the blade 13*a* being slightly flexed, and the developing sleeve being slightly pushed aside.

When, instead of following the steps described in the foregoing, other members such as the blades 12*e* and 13*a* are assembled after the photosensitive drum 9 is placed first, there is a chance of damaging the surface of the photosensitive drum 9 while the blade 12*e* or 13*a* or the like is attached. Also, tests such as measuring the attachment locations of the developing blade 12*e* and cleaning blade 13*a* or their contact pressures on the photosensitive drum 9 cannot be conducted, which is inconvenient. Further, the lubricant for preventing the torque increase or blade peeling caused by the tight contact between the blade 12*e* and the developing sleeve 12*b* or between the blade 13*a* and the photosensitive drum 9, which occurs due to lack of the toner during the start-up period, must coat these elements before the both blades 12*e* and 13*a* are attached to the bottom frame 15, which is liable to create such a problematic inconvenience that the lubricant untimely falls off during the assembly process. However, this problematic inconvenience can-be eliminated by placing the photosensitive drum 9 last, as it is done in this embodiment.

As described in the foregoing, according to this embodiment, the tests, such as positional checking, can be conducted, with the developing means 12 and cleaning means 13 being attached to the frame, and further, the photosensitive drum 9 is prevented from being scarred or nicked on a image forming range during the photosensitive drum 9 installation. Further, the lubricant can be coated on the developing means 12 and cleaning means 13 after they are assembled into the frame; therefore, the lubricant is prevented from falling off, preventing effectively the torque increase caused by the tight contact between the developing blade 12*e* and developing sleeve 12*d* or between the cleaning blade 13*a* and photosensitive drum 9.

Figure 55:
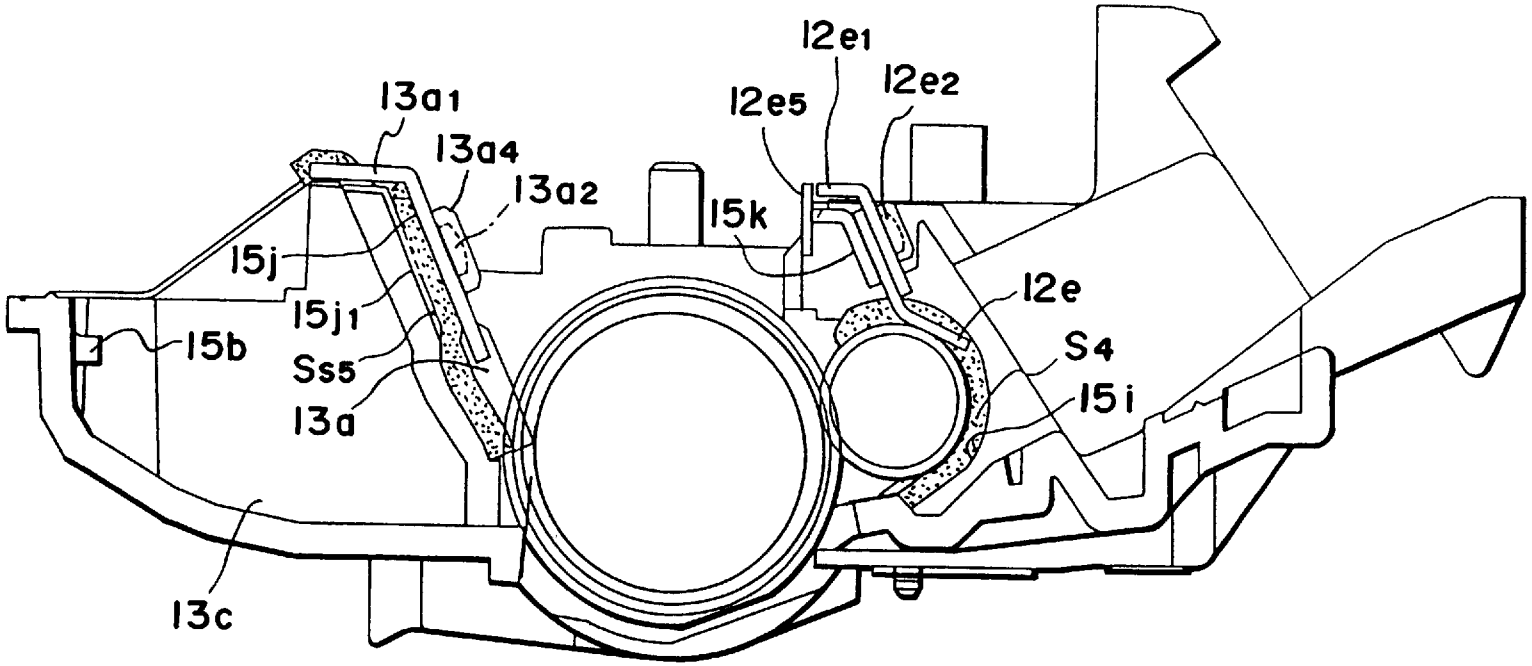
FIG. 55 is a sectional view of a drum guide member disposed at one end of the blade supporting member.

Also, in this embodiment, the drum guide members 15*q*1 and 15*q*2 are provided on the bottom frame 15, wherein they may be integrally formed with the bottom frame 15 or provided as separate members. Instead of such an arrangement, however, projections 12*e*5 and 13*a*4 may be provided on the blade supporting members 12*e*1 and 13*a*1, respectively, at both their ends, relative to their longitudinal direction, outside the image forming range of the photosensitive drum 9, as shown in FIG. 55, to be used as the guides when the photosensitive drum 9 is installed in the bottom frame 15, wherein they may be integrally formed with the blade supporting members 12*e*1 and 13*a*1, respectively, or may be provided as separate members.

<Mounting of Photosensitive Drum Insertion>

Figure 56A:
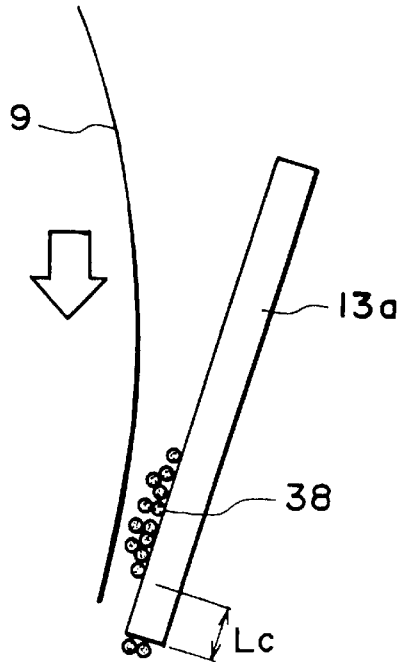
FIGS. 56(*a*) and 56(*b*) schematically depict lubricant at the contact surface between the cleaning blade and photosensitive drum.
Figure 56B:
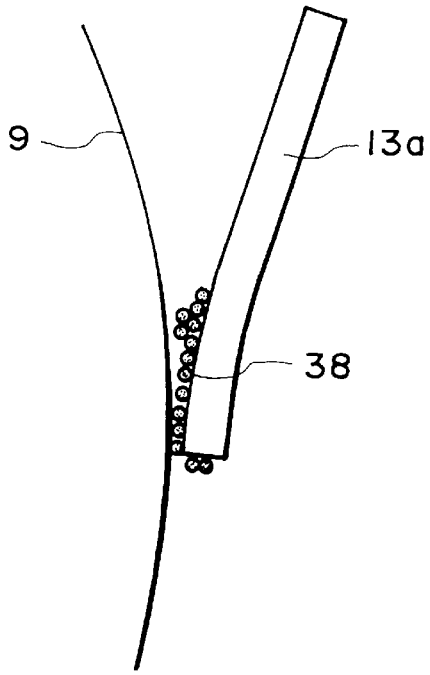

In this embodiment, the photosensitive drum 9 is inserted in the direction which forms a predetermined angle γ relative to the contact surface of the cleaning blade 13*a* as shown in FIG. 45. This is because there is an area Lc at the edge of the free end of the blade 13*a*, where a surface several tens of microns wide, is left uncoated with the lubricant when viewed microscopically, as shown in FIG. 56(*a*), even through it looks uniformly covered with the lubricant, including the edge, when macroscopically observed.

Therefore, the photosensitive drum 9 is installed in the aforementioned manner, whereby after the photosensitive drum 9 contacts the cleaning blade 13*a*, the lubricant 38 on the blade 13*a* is dragged as the photosensitive drum 9 invades, and is dispersed as far as the Lc which has not been coated with the lubricant 38. As a result, by the time the drum 9 is completely installed, the lubricant 38 is going to be present over the entire contact surface between the drum 9 and blade 13*a*.

As described in the foregoing, the drum 9 is installed in the direction which forms a predetermined angle γ relative to the contact surface of the blade 13. However, according to a test conducted by this inventor, it is evident, generally speaking, that when the rubber hardness of the blade 13*a* is 60° or more and at the same time the amount of invasion is 0.5 mm or more, or when the contact pressure between the blade 13*a* and the drum 9 is 15 gf/cm or more, the aforementioned effect can be obtained if the approach angle γ of the drum 9 is 45° or less relative to the contact surface of the blade 13*a*. In this embodiment, the drum 9 is installed holding an angle γ of approximately 22°.

<Installation of Drum Axle and Bearing Members>

Figure 57:
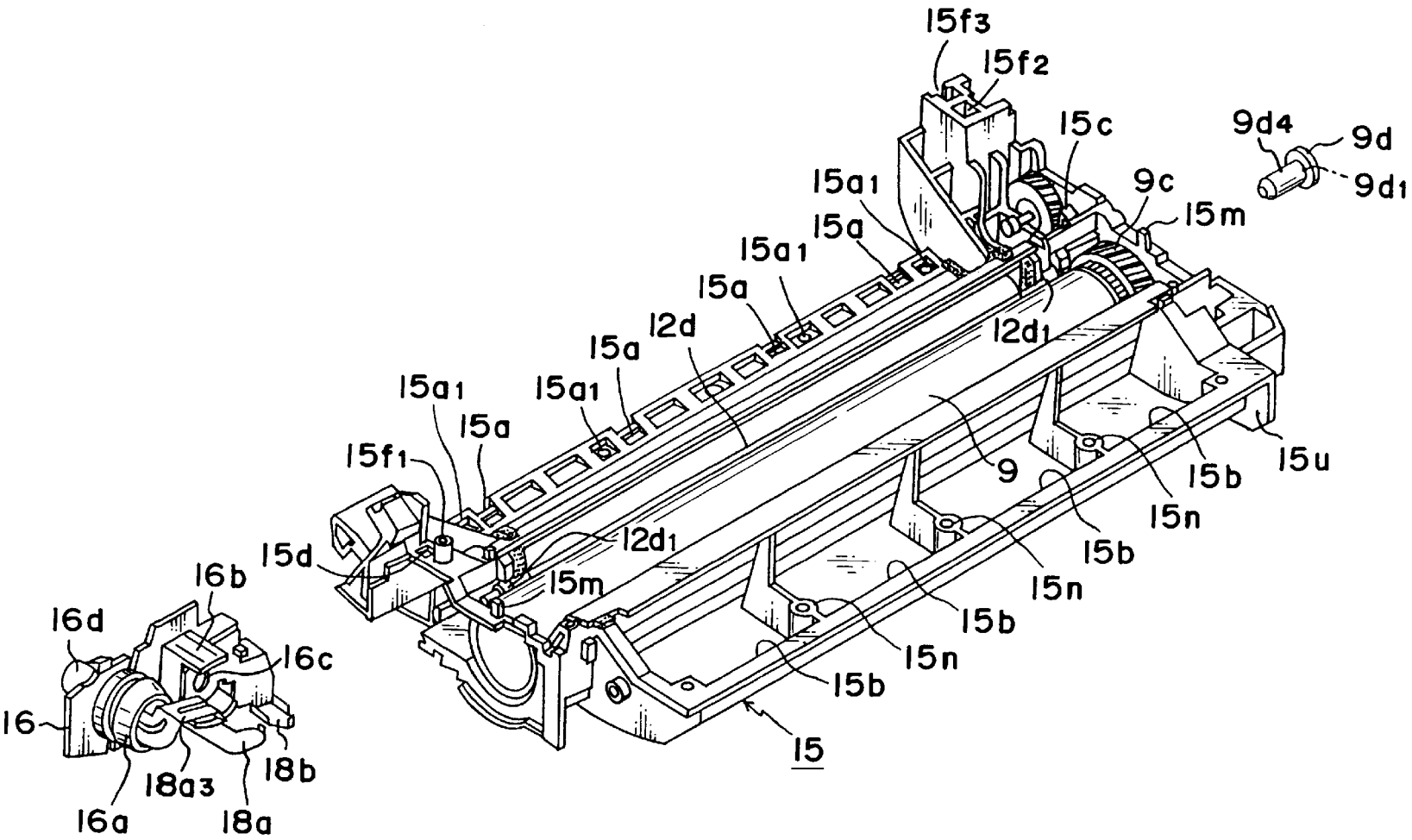
FIG. 57 depicts how the photosensitive drum bearing and the developing sleeve bearing are attached to the frame.

After the developing sleeve 12*b*, developing blade 12*e*, and cleaning blade 13*a* have been assembled into the bottom frame 15 in a manner as described hereinbefore, a drum axle 9*d* having a supporting member 9*d*4, and a bearing member 16 are attached to respective ends of the photosensitive drum 9, as depicted by the oblique drawing in FIG. 57 and the sectional drawing in FIG. 22, whereby the photosensitive drum 9 is rotatably mounted in the bottom frame 15. The bearing member 16 is made of a material such as polyacetal having slippery properties, and comprises a drum axle bearing portion 16*a* to be fitted into the photosensitive drum 9, sleeve bearing portions 16*b*, and D-cut bore portion 16*c* into which an axle end of a D-cut magnet 12*c* is fitted, wherein the three portions are integrally formed.

Figure 10A:
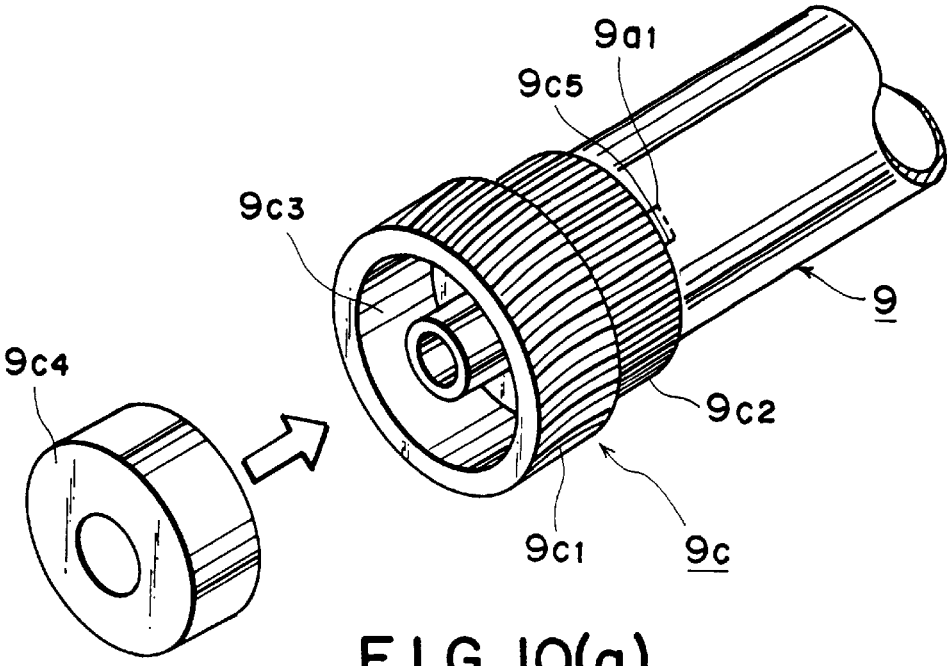
FIGS. 10(*a*) and 10(*b*) depict the flange gear portion attached to one of the end portions of the photosensitive drum.
Figure 10B:
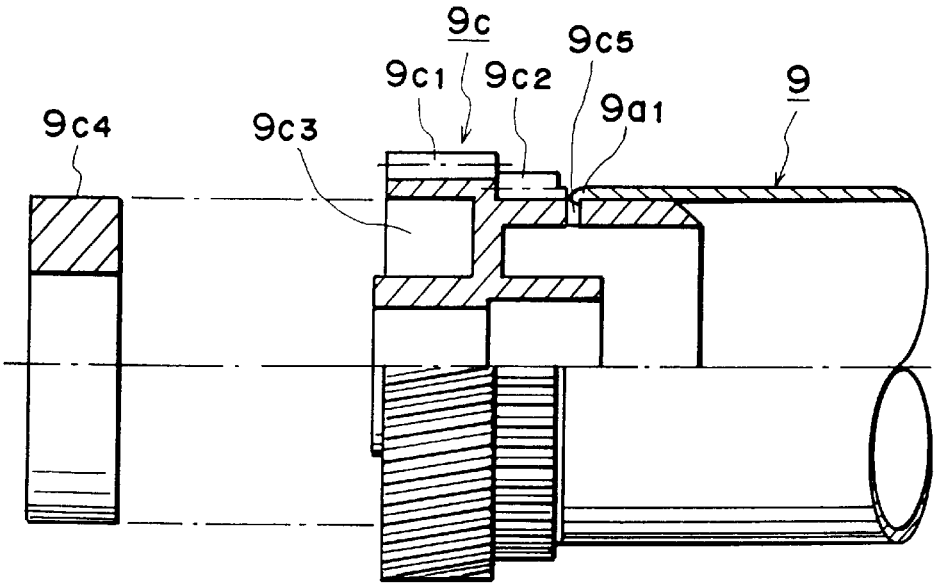

Therefore, the photosensitive drum 9 and magnet 12*c* are supported by bearings as the bearing portion 16*a* is fitted into the end of the cylindrical photosensitive drum 9; the end portion of the magnet is fitted into the D-cut bore portion 16*c*; and the axle bearing member 16 is fixedly fitted into the side wall of the bottom frame 15. Referring to FIG. 57, an electrically conductive ground contact 18*a* is attached to the bearing member 16, and the ground contact 18*a* comes in contact with an electrically conductive (aluminum) base member 9*a* of the photosensitive drum 9 as the bearing member 16 is fitted into the photosensitive drum 9 (FIGS. 10(*a*) and 10(*b*)). Further, the bearing member 16 is provided with a bias voltage contact 18*b*, which comes in contact with an electrically conductive member 18*d* as the bearing member 16 is attached to the developing sleeve 12*b*, wherein the bias voltage contact is in contact with the internal surface of the developing sleeve 12*b*.

Since the photosensitive drum 9 and magnet 12*c* are supported by a single-piece bearing member 16 as described in the foregoing, the positional accuracy is improved for both components 9 and 12, and further, the component count is reduced, whereby not only the assembly process can be simplified but also the manufacturing cost can be lowered.

Further, since the positions of the photosensitive drum 9 and magnet 12*c* are fixed with the use of a single component, the photosensitive drum 9 and magnet 12*c* can be more precisely positioned; therefore, the magnetic force can be uniformly exerted on the surface of the photosensitive drum 9, which in turn make it possible to create smooth, precise, and vivid images.

Further, by providing the bearing member 16 with the drum ground contact 18*a* for grounding the photosensitive drum 9, and the developing bias contact 18*b* for applying the bias to the developing sleeve 12*d*, the components are effectively downsized, and subsequently, the process cartridge B itself can be effectively downsized.

Further, the bearing member is provided with a portion to be supported for fixing the position of the process cartridge B within the apparatus main assembly when the process cartridge B is installed in the image forming apparatus; therefore, the process cartridge B can be accurately positioned in the apparatus main assembly.

Referring to FIG. 22, the bearing member 16 is also provided with the drum axle 16*d*, that is, a cylindrical, outward projection. When the process cartridge B is installed in the apparatus main assembly A, this axle portion 16*d* and the axle hole portion 15*s* of the bottom frame 15, to which the drum axle 9*d* of the other end is fitted as will be described later, rest in U-shaped groove portions 2*a*1 of a cartridge accommodating portion 2, whereby the position of the cartridge B is fixed. Since the position of the process cartridge B is fixed by the axle hole portion 15*s*, which directly bears the photosensitive drum 9, and the axle portion 16*d*, the process cartridge B can be more precisely positioned without being affected by the processing accuracy for other components or the assembly tolerance.

Also referring to FIG. 22, the other end of the magnet 12*c* is fitted in the concave portion of the sleeve flange 12*k*, wherein the external diameter of the magnet 12*c* is formed to be slightly smaller than the internal diameter of the concavity. Therefore, the magnet 12*c* is held so as to afford play, on the sleeve flange 12*k* side, whereby the magnet is held by its bottom side because of its own weight, is or slightly displaced toward the blade supporting member 12*e*1 by its own magnetic force, since the blade supporting member 12*e*1 is made of magnetic metallic plate, such as zinc plated steel plate.

By allowing the presence of play between the sleeve flange 12*k* and magnet 12*c*, the frictional torque between the magnet 12*c* and rotatably sliding sleeve flange 12*k* can be reduced, which in turn can reduce the torque of the process cartridge itself.

(Installation into Top frame)

Figure 58:
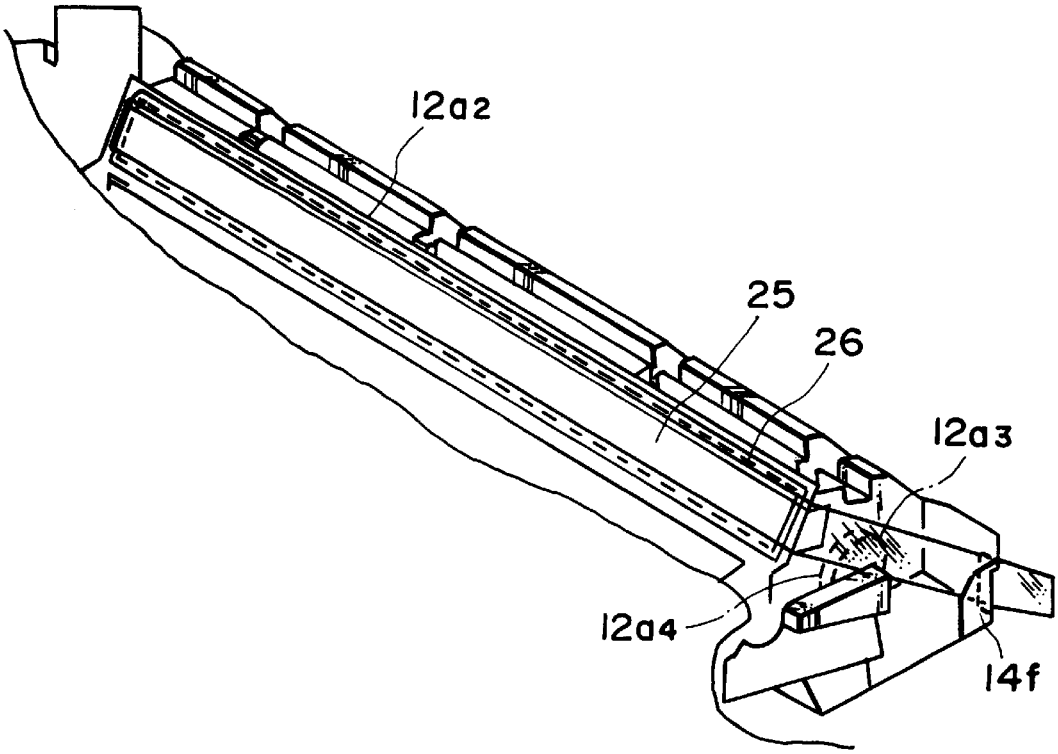
FIG. 58 depicts how a cover film having a tear tape is pasted over a toner storage opening.

On the other hand, in the top frame 14, the sliding bearing 10*c* is attached, as described before, first, to the bearing slide guide claw 14*n* through the spring 10*a*, and the charging roller 10 is rotatably attached to the sliding bearing 10*c*. Further, the toner feeding mechanism 12*b* is attached within the toner storage 12*a*; a cover film 26 having a tear tape 25, shown in FIG. 58, is pasted to the opening 12*a*2, through which the toner is fed out of this toner storage 12*a* to the developing sleeve 12*b*, in order to close the opening 12*a*2; the cover member 12*f* is welded; the toner is filled in the toner storage 12*a*; and then, the toner storage 12*a* is sealed. Next, the shutter mechanism 24 is attached to the top frame 14, on the upper surface of the development side, so that the shutter can be freely opened or closed. As stated before, this shutter mechanism 24 is attached by placing its shaft portion 24*a*1 in the groove 12*f*4 of the cover member 12*f*, and then, holding down the longitudinal end portions of the shaft portion 24*a*1 with the shaft retainers 24*d* and 24*e* (FIG. 44).

<Tear Tape>

The tear tape 25 (made of, for example, polyethyleneterephthalate or polyethylene) provided on the cover film 26, pasted over the opening 12*a*2 of the toner storage 12*a* extends, as shown in FIG. 58, from one of the longitudinal ends of the opening 12*a*2 (right end in FIG. 58) to the other end (left end in FIG. 58), and there, it is folded back to stick out through the opening 14*f*, a gap formed at the rear end of the top frame 14. The opening 14*f* is located so that the tear tape 25 faces an operator when the process cartridge B is installed into the apparatus main assembly A; therefore, it comes into the visual field of the operator, being likely to be easily noticed (FIG. 44). Further, its visibility may be improved by making the color of the tear tape 25 more conspicuous against the color of the frames 14 and 15, for example, by selecting while, yellow, or orange color if the frame color is black.

Further, in order to improve the operability for the operator, the pulling direction (direction of an arrow g2) of the tear tape is made to be substantially opposite to the direction (direction of an arrow g1) in which the process cartridge B is installed into the apparatus main assembly A. With this arrangement, the operator can install the process cartridge B into the apparatus main assembly A, without switching hands, by holding the process cartridge B, for example, with his left hand, and pulling out the tear tape 25 with his right hand, toward himself. Also, even after the operator has installed the process cartridge B into the image forming apparatus A, without remembering to pull out the tear tape, the operator can pull out the tear tape 25 without switching hands after taking out the process cartridge B from the image forming apparatus A.

When a fresh process cartridge B is used, it is installed into the image forming apparatus A after the tear tape 25, sticking out of the opening 14*f*, has been pulled out to peel off the cover film 26 pasted over the opening 12*a*2 of the toner storage 12*a*, so that the toner within the toner storage 12*a* is allowed to move toward the developing sleeve 12*d*.

(Seal Member to Be Placed between Top and Bottom Frames)

Next, the seal member to be pasted at the joint between the top frame 14 and bottom frame 15 will be described. Referring to FIGS. 37 and 38, a seal member is pasted at the joint between the top frame 14 and bottom frame 15. On the top frame 14, seal members S1, S2, and S3 are pasted, and on the bottom frame 15, seal members S8 and S9 are pasted. The toner leak through the joint between the upper and bottom frames 14 and 15 is prevented by these seal members. In this embodiment, the one which prevents the toner from leaking through the upper and bottom frames 14 and 15, on the cleaning means side, is the seal member S1, and the ones which prevent the toner from leaking through the joint between the frames 14 and 15, on the developing means side, are the seal members S2, S3, S8, and S9.

<Grooves and Ribs Located at Joint between Top and Bottom Frames>

As described in the foregoing, the seal members are pasted at the joint surfaces between the top frame 14 and bottom frame 15 to prevent the toner from leaking out of the process cartridge, wherein, as shown in FIG. 6, the seal bearing surface of the top frame 14, on which the seal members S1, S2, and S3 are pasted, is provided with a groove 14*m*, and the surface of the top frame 15 which corresponds to the seal members S1, S2, and S3 is provided with a triangular rib 15*r*. Therefore, when the upper and bottom frames 14 and 15 are put together, the seal members S1, S2, and S3 are compressed to form a wave pattern as shown in FIG. 53, whereby the sealing performances of the seal members at the joint between the top and bottom frames 14 and 15 are improved. In this case, since the seal members are only locally compressed, the reactions from the seal members hardly increase; therefore, the force combining the top and bottom frames 14 and 15 is not reduced. As stated in the foregoing, when the top and bottom frames 14 and 15 are put together, with the seal members S1, S2, and S3 being interposed, during the assembly process of the process cartridge B, the top and bottom frames 14 and 15 are joined in such a manner that the seal members S1, S2, and S3 are locally compressed.

Further, when the pressure is exerted on the toner within the process cartridge because of external factors (for example, vibrations or impacts), the pressurized toner may invade into the joint between the top and bottom frames 14 and 15, where the seal members S1, S2, and S3 are interposed. However, the advance of the toner is obstructed by the presence of the triangular ribs 15*r* and the reaction from the seal members S1, S2, and S3 being locally compressed by the triangular ribs 15*r*; therefore, the toner does not leak out of the joint between the top and bottom frames 14 and 15.

In this embodiment, foamed urethane such as MOLTPLANE (trade name) is used as the material for the seal members S1, S2, and S3, but liquid material which solidifies into an elastomer may be injected into the aforementioned groove 14*m*, so that it forms itself into the seal member.

As for the configuration of the projection, its section does not need to be triangular as long as it is a shape capable of compressing locally the seal members. Also, the groove provided on the seal member bearing surface does not need to be present. Just for the record, in this embodiment, the thickness of the seal member is approximately 3 mm, and the seal member is compressed to a thickness of approximately 1 mm, wherein the height of the projection is approximately 0.5 mm.

<Hardness of Seal Member>

Among the seal members S1, S2, and S3 pasted on the joint surfaces between the top and bottom frames 14 and 15, the seal members S2 and S3 placed on the developing means side are harder than the seal member S1 placed on the cleaning means side. This is because the process cartridge B is flexed more on the developing means side than on the cleaning means side, in the longitudinal direction. In this embodiment, sealing material equivalent to Mesh 60 (#60) is used for the seal member S1 on the cleaning means side, and sealing material equivalent to Mesh 120 (#120) is used for the seal members S2 and S3 on the developing means side. As for the thicknesses of the seal members S1, S2, and S3, those having a thickness of approximately 3 mm are used and the necessary sealing performance is obtained by compressing these seal members to a thickness of approximately 1 mm as the top and bottom frames 14 and 15 are combined. These values are the optimum ones when both the sealing performance and the force combining the top and bottom frames 14 and 15 are taken into consideration.

<Convex side contact of tear tape>

Figure 59:
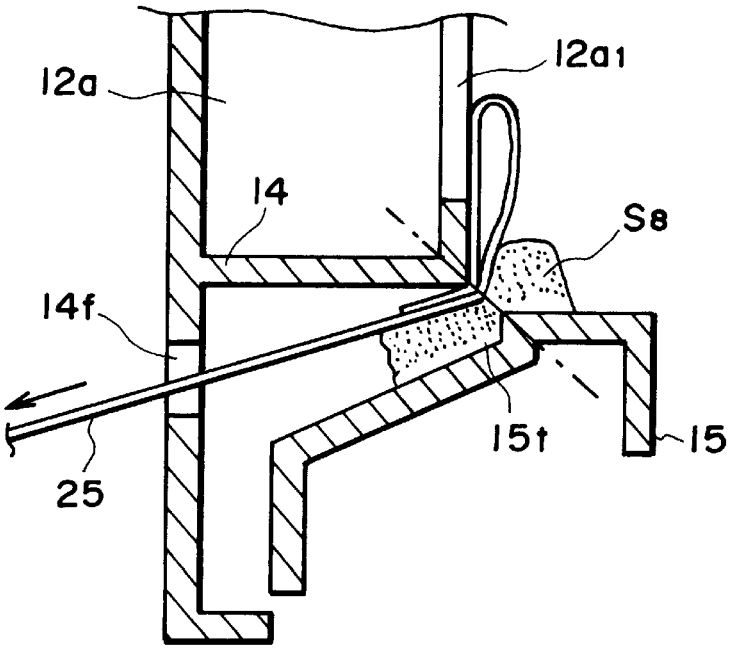
FIG. 59 is an enlarged sectional view of the seal member pasted to the area through which the tear tape is pulled out.

As described hereinbefore, the seal member S8 and S9 are pasted on the bottom frame 15, at both longitudinal ends, on the developing means side. Out of two seal members S8 and S9, the seal member S8, being located on the side from which the tear tape 25 is pulled out, is pasted on the bent surface 15*t* of the bottom frame 15, starting from within the cartridge, following precisely the contour of the bent surface across the joint between the top and bottom frames 14 and 15 (the position indicated by a broken line in FIG. 59) and covering a wide area. With such an arrangement, when the operator pulls out the tear tape from the process cartridge B, the tear tape 25 is pulled out of the cartridge B, between the top frame 4 and its the counterpart portion of the seal member S8 pasted wide on the bent surface 15*t*. Therefore, the tear tape 25 always makes contact with the sealing member S8 at its convex side, thus preventing the seal member S3 from being peeled off as well as reducing the force needed to pull it out.

In other words, the tear tape 25 comes in contact with the arced portion of the bent seal member S8 and does not contact the edge portion of the seal member S8; therefore, the tear tape 25 does not peel off the seal member S8 when pulled out. Further, since the direction in which the tear tape 25 is pulled is made different from the longitudinal direction of the surface on which the tear tape 25 is pasted, the tear tape 25 does not come in contact with the edge of the elastic seal member S8 when pulled out. As is evident from the above description, according to the present invention, the tear tape 25 for sealing the opening 12*a*2 can be removably attached over the opening 12*a*2, so that it does not contact the edge of the seal member S8 when pulled out.

The top and bottom frames 14 and 15, into which various components have been assembled as described hereinbefore, are combined by engaging the engagement claws and engagement holes, and the like pairs, to complete the assembly process of the process cartridge B. Here, referring to FIG. 60(*a*), a description is provided as to a shipment line. After various components have been assembled into the bottom frame 15, the assembled bottom frame 15 is inspected (for example, the positional relation between the photosensitive drum 9 and developing sleeve 12d). Then, this bottom frame 15 is put together with the top frame 14 into which the charging roller 10 and the like have been assembled, thereby finishing the process cartridge B, and this finished cartridge B is shipped out after being subjected to a general inspection. It is a simple line.

{Structure for Installing Process Cartridge}

How the process cartridge B is installed into the image forming apparatus A will be described, referring to drawings.

(Process Cartridge Installation Guide)

Figure 61:
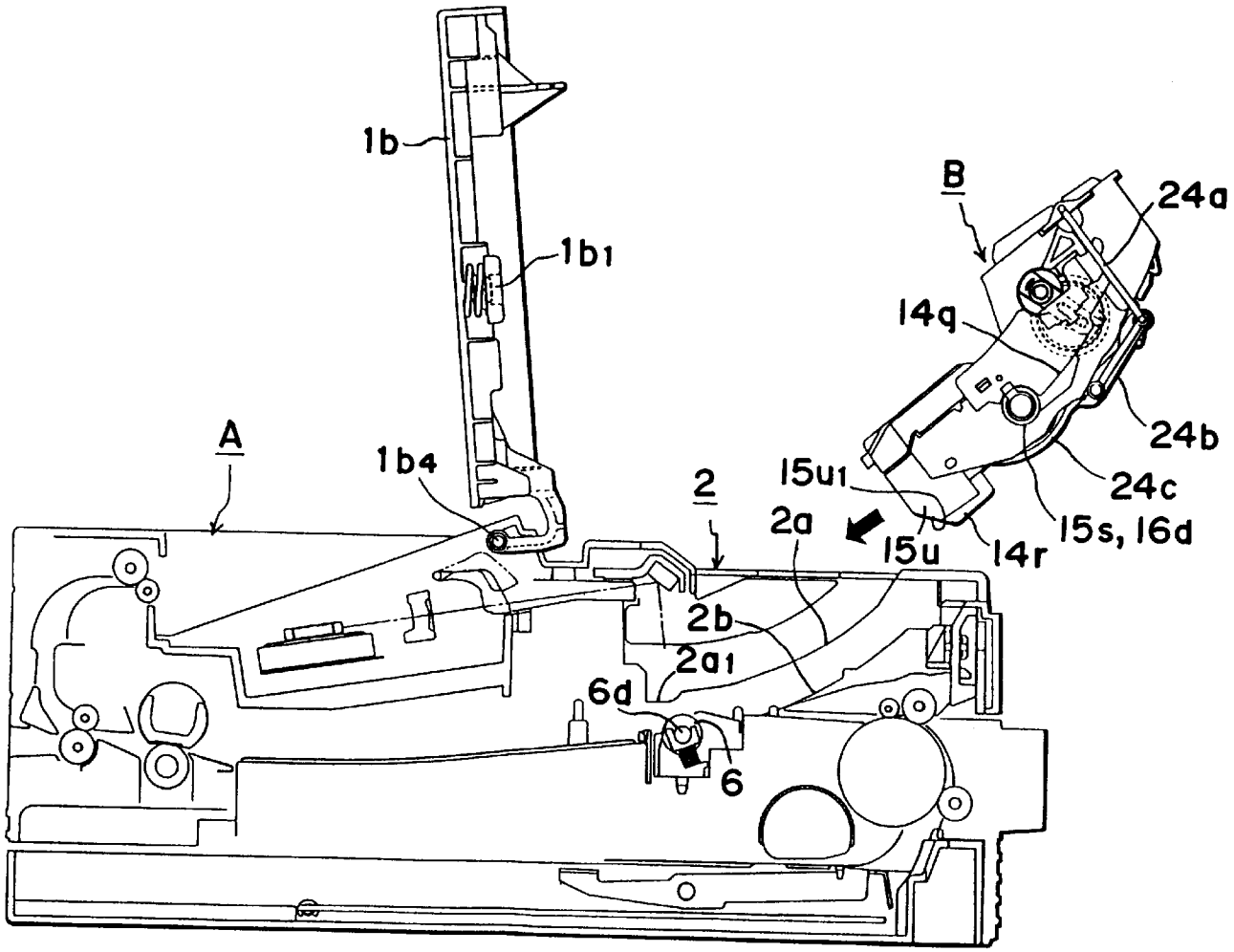
FIG. 61 depicts how the process cartridge is installed in the image forming apparatus.
Figure 62:
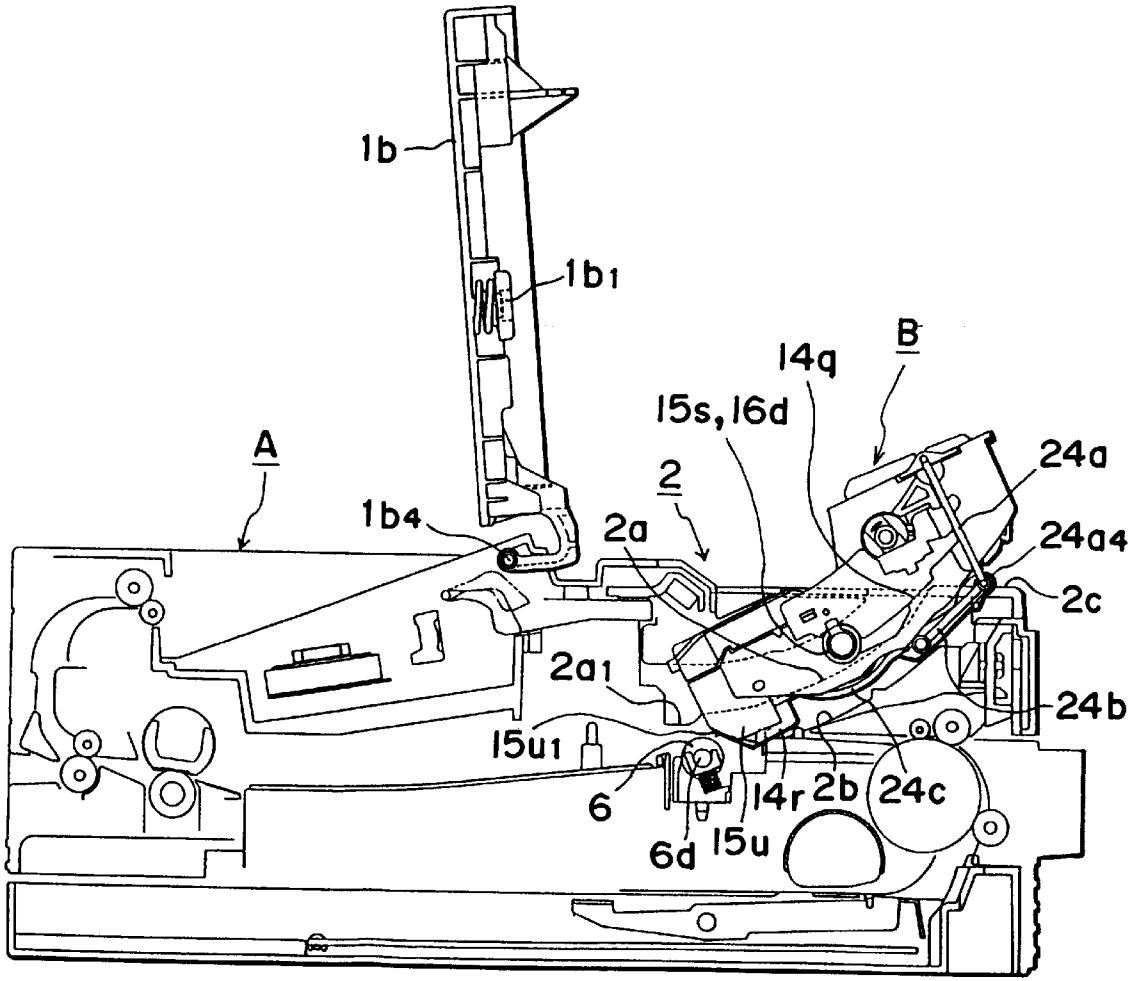
FIG. 62 depicts how the process cartridge is installed in the image forming apparatus.

When the process cartridge B is installed into the image forming apparatus A, a top lid 1*b* is rotatably opened about an axis 1*b*4 positioned at the top portion of the apparatus main assembly 1, and the process cartridge B is inserted into the cartridge installation space 2 provided within the apparatus main assembly 1, from the direction indicated by an arrow in FIG. 61. At this time, the process cartridge B is installed, being guided as shown in FIG. 62, wherein the axle hole portion 15*s* and axle portion 16*d* of the bearing member 16, which project from respective longitudinal side surfaces of the process cartridge B, and a first engaging portion 14*q*, which extends from the axle hole portion 15*s* and axle portion 16*d*, diagonally upward toward the tail end (right side in FIG. 62), relative to the cartridge installing direction, are guided by a first guide portion 2*a* provided on both inward surfaces of the installation space 2, and wherein second engaging portions 15*u* and 14*r*, provided on both longitudinal side surfaces of the process cartridge B, at the bottom-forward portion relative to the installing direction, are guided by a second guide portion 2*b* provided on both inward surfaces of the installation space 2.

The second engaging portion 15*u*, which is a projection, is disposed on the same side as the flange gear 9*c* provided on the photosensitive drum 9. Also, the second engaging portion 15*u* projects by approximately 2.7 mm from the cleaning means 13 side of the bottom frame 15, in a direction perpendicular to the axis of the photosensitive drum 9 (forward direction relative to the process cartridge B installing direction), wherein the cleaning means 13 is disposed in parallel to the axis of the photosensitive drum 9. Moreover, the engaging portion 15*u* is plate-shaped, having a tapered portion 15*u*1 toward the bottom (FIGS. 4 and 5). Further, the engaging portion 15*u* projects further downward by approximately 6 mm from the bottom surface of the cleaning means side of the bottom frame 15.

When, during the installation of the process cartridge B, an attempt is made to push the process cartridge B down and forward into the image forming apparatus A, in such a manner as for the process cartridge B to pivot about the axle hole portion 15*s* and axle portion 16*d* (counterclockwise direction), the process cartridge B does not go down because the second engaging portions 15*u* and 14*r* are in contact with the second guide portion 2*b*. On the contrary, when another attempt is made to push the process cartridge B down and rearward in a manner so as for the process cartridge B to pivot about the axle hole portion 15*s* and axle portion 16*d*, the process cartridge B does not go down any further because the first engaging portion 14*q* is in contact with the guide portion 2*a*.

Figure 63:
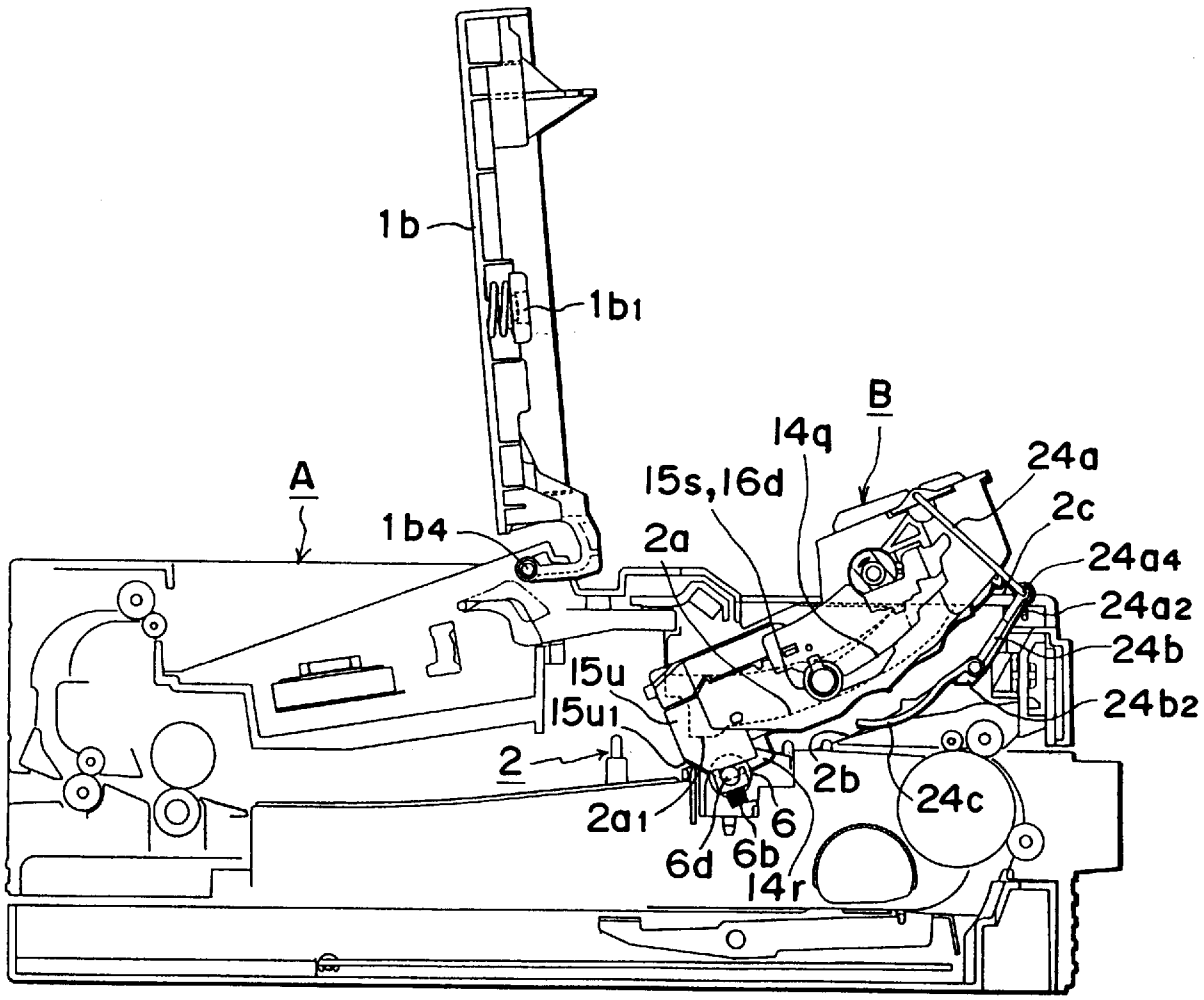
FIG. 63 depicts how the process cartridge is installed in the image forming apparatus.

Further, referring to FIG. 63, while the process cartridge B passes over the transferring roller 6, the second engaging portion 15*u* keeps the axle portion 6*d* attached to one end of the transferring roller 6, pressed down; therefore, the bottom-forward portion of the process cartridge B, relative to the installing direction, does not contact the transferring roller 6 or the like, eliminating concern about damaging these components. At this time, the second engaging portion 14*r* located at the other end is in contact with the guide member 3*b*. Then, as the process cartridge B is inserted further into the apparatus main assembly, the second engaging portion 15*u* becomes disengaged from the axle portion 6*d* of the transferring roller 6, whereby the transferring roller 6 is pushed upward by a spring 6*b* to be pressed upon the photosensitive drum 9.

Therefore, the process cartridge B is smoothly inserted as it is guided by the guide portions 2*a* and 2*b*, and as the top lid 1*b* is closed as shown in FIG. 1, the axle hole portion 15*s* and axle portion 16*d* are fitted into the approximately U-shaped groove portion 2*a*1 provided at the most downstream side of the first guide portion 2*a*, relative to the inserting direction, whereby the position of the process cartridge B is fixed.

(Shutter Mechanism Action during Cartridge Installation)

The process cartridge B is provided with a shutter mechanism 24 for protecting the surface of the photosensitive drum 9, wherein the shutter mechanism 24 in this embodiment is constructed to open automatically as the process cartridge B is installed into the image forming apparatus A. Hereinafter, the movement of the shutter mechanism 24 during the in cartridge installation will be described.

Figure 64:
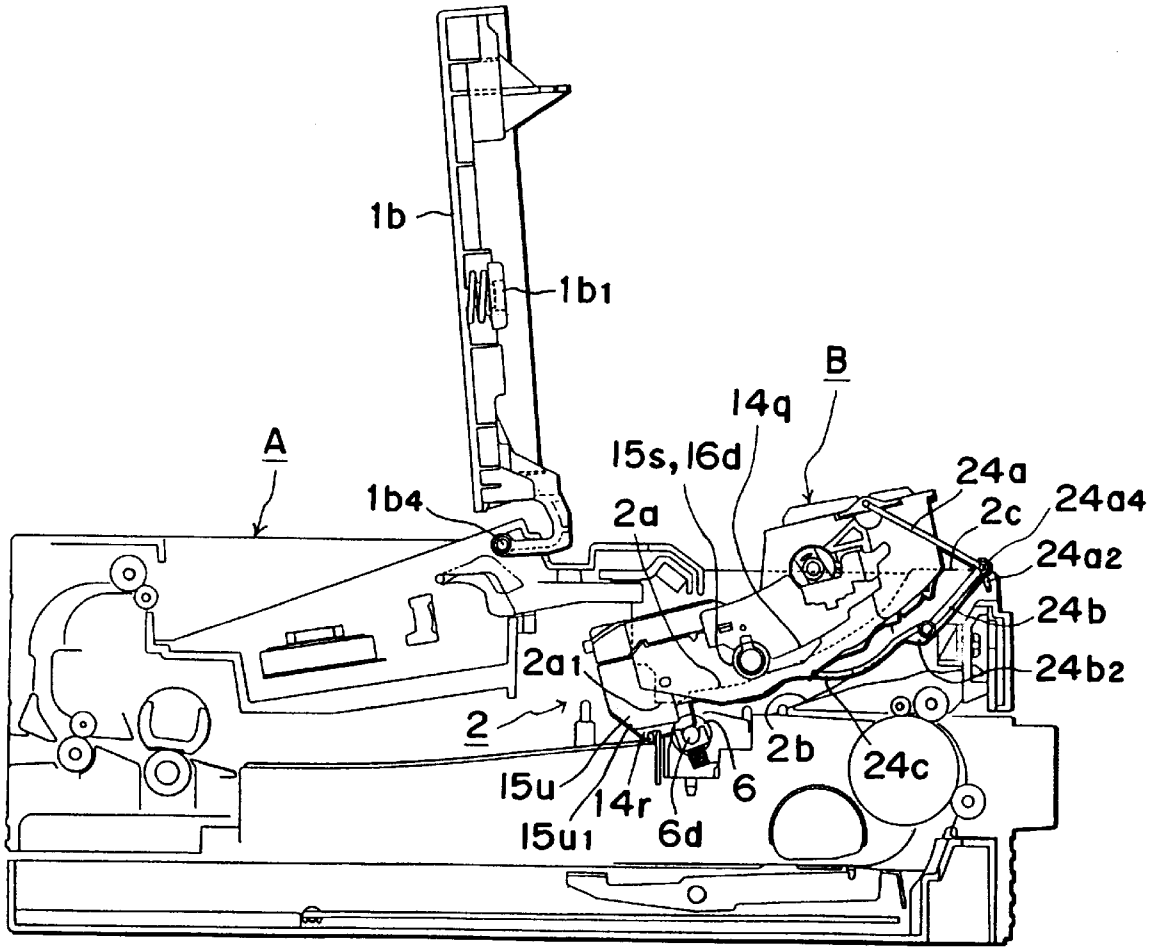
FIG. 64 depicts how the process cartridge is installed in the image forming apparatus.

As described hereinbefore, as the process cartridge B is inserted into the image forming apparatus A, the projecting portion 24*a*4 (FIG. 40) provided adjacent to the supporting portion 24*a*3 of the shutter arm 24*a* comes in contact with a shutter cam surface 2*c* located on the top surface of the apparatus main assembly, at a position illustrated in FIG. 62. As the process cartridge B is further inserted, the projection portion 24*a*4 of the shutter arm 24*a* moves to the right on the shutter cam surface 2*c*, whereby the shutter linkage 24*b* and shutter portion 24*c* also move to the right to be separated from the bottom portion of the bottom frame 15, thereby exposing the surface of the photosensitive drum 9, as shown in FIG. 64. At this time, having been freed from the rotational regulation imparted by the rotation regulating portion 24*a*2 of the shutter arm 24*a*, the shutter linkage 24*b* is hanging from the supporting portion 24*a*3 of the shutter arm 24*a*, by its own weight, and resting in contact with the internal surface of the apparatus main assembly, but the shutter portion 24*c* is located where it is yet to be relieved from the rotational regulation by the rotation regulating portion 24*b*2 of the shutter linkage 24*b*.

As the process cartridge B is further inserted, the projecting portion 24*a*4 of the shutter arm 24*a* keeps moving in the right direction on the shutter cam surface 2*c* to the dead end, and then begins to move in the left direction, whereby the shutter linkage 24*b* hanging from the supporting portion 24*a*3 of the shutter arm 24*b* by its own weight is caused to begin rotating in the counterclockwise direction about the point at which it contacts the internal surface of image forming apparatus A. As the shutter linkage 24*b* is rotated enough to become perpendicular, in loose terms, the shutter portion, which has been rotating together with the shutter linkage 24*b*, comes in contact with the internal surface of the apparatus main assembly, whereby it is freed from the rotational regulation by the rotation regulating portion 24*b*2 of the shutter linkage 24*b*. With the top lid 1*b* of the apparatus main assembly being closed after the installation of the process cartridge B, the shutter mechanism 24 looks as shown in FIG. 1, and the photosensitive drum 9 is in contact with the transferring roller 6.

As described in the foregoing, the shutter mechanism 24 in this embodiment not only automatically opens during the installation of the process cartridge B, but also, its shape and movement changes according to the contour of the internal surface of the apparatus main assembly. Further, it can be moved away from the drum while conserving space, thereby contributing to the overall downsizing of the image forming apparatus.

(Relation between Electrical Contact and Contact Pin)

The process cartridge B is provided with the electrically conductive drum ground contact 18*a* being in contact with the photosensitive drum 9, electrically conductive development bias contact 18*b* being in contact with the developing sleeve 12*d*, electrically conductive charge bias contact 18*c* being in contact with the charging roller 10, which are disposed to be exposed at the bottom surface of the bottom frame 15. As the process cartridge B is installed in the apparatus main assembly A in such a manner as described hereinbefore, the contacts 18*a*, 18*b*, and 18*c* are pressed on the drum ground pin 27*a*, development bias pin 27*b*, and charge bias pin 27*c*, respectively, which are located on the apparatus main assembly side as shown in FIG. 65.

Figure 65:
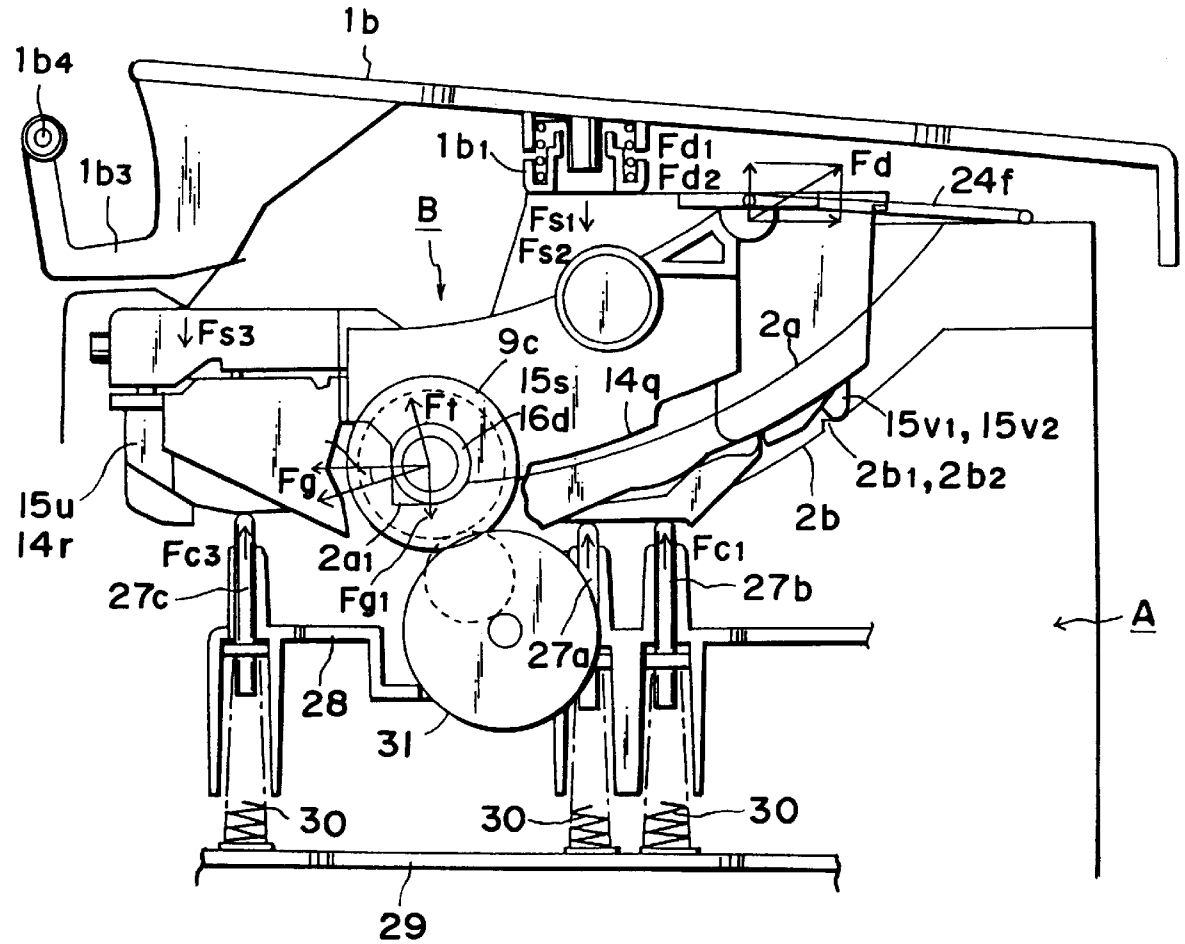
FIG. 65 depicts the positional state of the process cartridge in the image forming apparatus.

As for the structures of the contact pins 27*a*, 27*b*, and 27*c*, referring to FIG. 65, they are fitted within a holder cover 28 in such a manner that they can project but cannot come out all the way, and also, are electrically connected, with electrically conductive compression springs 30, to the wiring pattern of a circuit board 28 to which the holder cover 28 is mounted.

Figure 66:
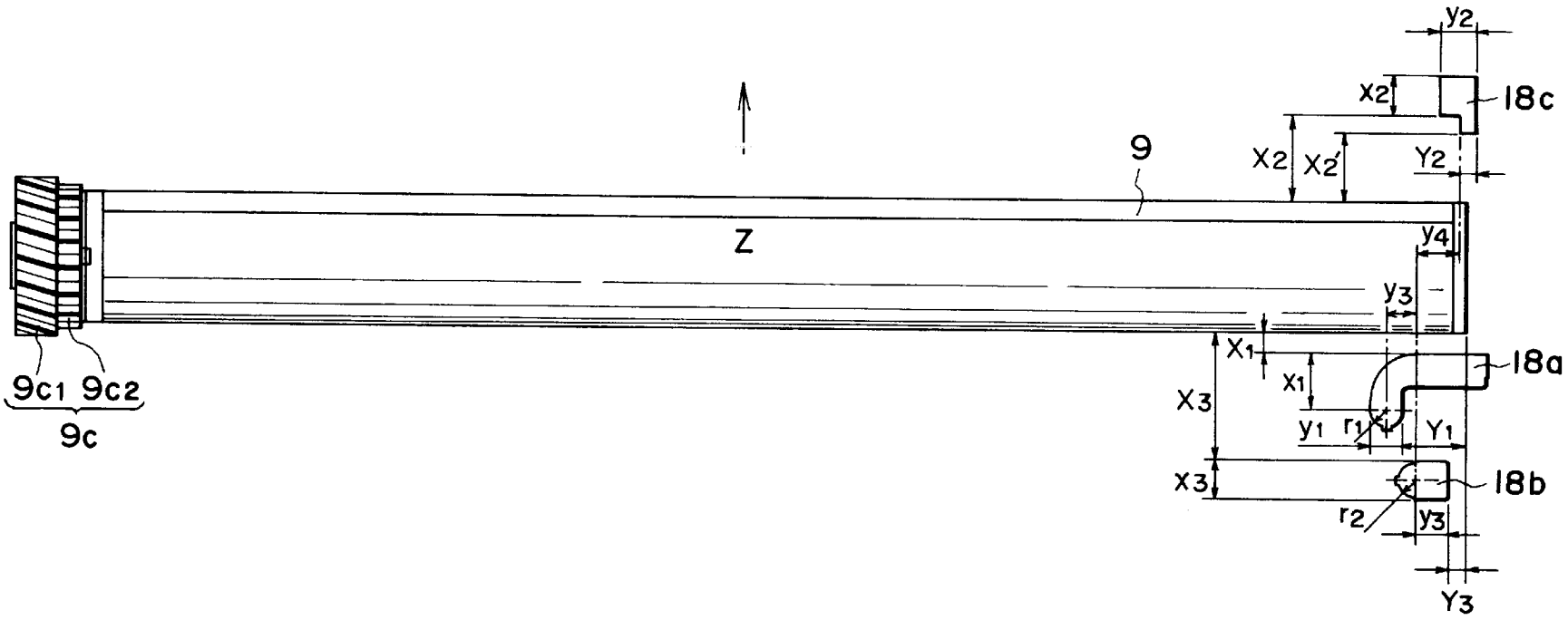
FIG. 66 is a positional diagram for the gear and electrical contacts, which are attached to the photosensitive drum.

Referring to FIG. 66, the positioning of the electrical contacts in the process cartridge B will be depicting, FIG. 66 is a plan view depicting schematically, the positional relation between the photosensitive drum 9 and each of the electrical contacts 18*a*, 18*b*, and 18*c*.

As shown in FIG. 66, the contact 18*a*, 18*b*, and 18*c* are located on the side opposite (non-driven side) to the one (driven side) where the flange gear 9*c* is attached, wherein the charge bias contact 18*c* is located on the downstream side of the photosensitive drum 9, relative to the recording medium conveying direction (cleaning means side), and the drum ground contact 18*a* and development bias contact 18*b* are located on the upstream side of the process cartridge B, relative to the recording medium conveying direction (the developing means side).

Further, the contact points between the contacts 18*a*, 18*b*, and 18*c* and the contact pins 27*a*, 27*b*, and 27*c* on the apparatus main assembly side are arranged not to align in the direction (the direction indicated by an arrow in the drawing) in which the process cartridge B is inserted (y3 and y4 in FIG. 66). In other words, these contacts enter the apparatus main assembly in the consecutive order of the charge bias contact 18*c*, drum ground contact 18*a*, and development bias 18*b*, wherein the charge bias contact 18*c* is positioned where it does not interfere with the drum ground contact pin 27*a* and development bias pin 27*b* located within the apparatus main assembly, and the drum ground contact 18*a* is positioned where it does not interfere with the development bias contact pin 27*b* located within the apparatus main assembly. This arrangement is made to prevent the contacts which enter deeper into the apparatus from coming in contact with the contact pins located closer to the entrance side of the apparatus from thereby being damaged or broken, and from causing contact failure.

As described in the foregoing, by arranging the contact points not to align in the direction in which the process cartridge B is inserted, an optimum condition can be set up to avoid the interferences which otherwise may occur between the contacts on the apparatus main assembly side and the contacts on the process cartridge B side during the installation or removal of the process cartridge B. Therefore, it becomes easier to downsize the apparatus main assembly and process cartridge.

Further, among the contacts, the drum ground contact 18*a* and development bias contact 18*b* are positioned on the developing means side, relative to the photosensitive drum 9, and the charge bias contact 18*c* is positioned on the cleaning means side; therefore, the shape of the electrode within the process cartridge B can be simplified, which allows the process cartridge B to be downsized.

More specifically, the development bias contact 18*b* is located further away from the photosensitive drum 9 than the drum ground contact 18*a*, and the exposed surface area of the drum ground contact 18*a* is larger than that of the development bias contact 18*b*. Further, the configuration of the exposed surface of the development bias contact 18*b* is such a shape that a semispherical portion projects from a part of a rectangular parallelepiped, and the configuration of the exposed surface of the drum ground contact 18*a* has a boot shape. The exposed portion of the drum ground contact 18*a* is extended outward towards the photosensitive drum 9 where it faces the photosensitive drum 9, and the exposed portion of the charge bias contact 18*c* is bent. The development bias contact 18*b* and drum ground contact 18*a* are located within the range in which the photosensitive drum 9 is coated with the photosensitive material (designated by Z in FIG. 66).

Further, by placing the electrical contact points of the process cartridge B within the process cartridge B rather than outside, adhesion of foreign matter to the contact, and resultant rust or deformation of the contact due to external force can be prevented.

Given below is an exemplary set of sizes for the electrical contacts according to this embodiment. The present invention, however, is not limited by this example and different sizes may be selected as fit.

(1) The distance between the photosensitive drum 9 and drum ground contact 18*a* in the direction perpendicular to the drum axis (X1): approx. 3.9 mm (2) The distance between the photosensitive drum 9 and charge bias contact 18*c* in the direction perpendicular to the drum axis (X2): approx. 15.5 mm (3) The distance between the photosensitive drum 9 and development bias contact 18*b* in the direction perpendicular to the drum axis (X3): approx. 23.5 mm (4) The distance between the photosensitive drum 9 and drum ground contact 18*a* in the direction of the drum axis (Y1): approx. 11.5 mm (5) The distance between the photosensitive drum 9 and charge bias contact 18*c* in the direction of the drum axis (Y2): approx. 1.5 mm (6) The distance between the photosensitive drum 9 and development bias contact 18*b* in the direction of the drum axis (Y3): approx. 3.1 mm (7) The distance between the lateral end of the drum ground contact 18*a* and the center of the contact (x1): approx. 10.3 mm (8) The vertical length of the drum ground contact 18*a* (yl): approx. 6.0 mm (9) The horizontal length of the charge bias contact 18*c* (x2): approx. 12.4 mm

(10) the vertical length of the charge bias contact 18*c* (y2): approx. 6.5 mm

(11) the horizontal length of the development bias contact 18*b* (x3): approx. 7.0 mm

(12) the distance between the vertical end of the development bias contact 18*b* and the center of the contact (y3): approx. 6.1 mm

(13) The external radius of the drum ground contact 18*a* (r1): approx. 3.0 mm

(14) The external radium of the development bias contact 18*b* (r2): approx. 3.0 mm

(15) The deviation between the contact point of the development bias contact 18*b* and the contact point of the drum ground contact 18*a* (y3): approx. 5.0 mm

(16) The deviation between the contact point of the development bias contact 18*b* and the contact point of the charge bias contact 18*c* (y4): approx. 7.5 mm {Structure-for Retaining Process Cartridge}

When the process cartridge B is inserted along the guide portions 2*a* and 2*b* following the procedure described hereinbefore, and the top lid 1*b* is closed, the process cartridge B must be positionally stabilized where it is. Therefore, in this embodiment, when the top lid 1*b* is closed, the process cartridge B is pressed on the internal surface of the cartridge installation space 2.

Referring to FIG. 65, the top lid 1*b* is provided with a pressure generating means 1*b*1 having shock absorbing springs, at a predetermined location on the inward surface, and a plate spring 1*b*2, adjacent to its rotational center, wherein when the top lid 1*b* is open, the plate spring 1*b*2 is not in contact with the process cartridge B being installed.

With such a structure in place, when the top lid 1*b* is closed after the top lid 1*b* has been opened and the process cartridge B has been inserted up to the predetermined point along the guide portions 2*a* and 2*b*, the pressure generating means 1*b*1 provided on the internal surface of the top lid 1*b* presses down the top surface of the process cartridge B, and at the same time, an arm portion 1*b*3 of the top lid presses down the plate spring 1*b*2, which in turn presses down the top surface of the process cartridge B.

As a result, the axle hole portion 15*s* and axle portion 16 of the process cartridge B are pressed in the groove portion 2*a*1, whereby the position of the process cartridge B is fixed, and at the same time, leg portions 15*v*1 and 15*v*2 come in contact with abutment portions 2*b*1 and 2*b*2, being positionally fixed. As a result, the rotation of the cartridge B is regulated.

The leg portions 15*v*1 and 15*v*2 of the bottom frame 15 of the process cartridge B are provided at two locations, one on the driven side and the other on the non-driven side, on the bottom-portion, relative to the cartridge inserting direction (FIG. 5), and the abutment portions 2*b*1 and 2*b*2 are provided on the second guide portions 2*b*, at predetermined locations corresponding to respective leg portions 15*v*1 and 15*v*2, wherein the two abutment portions 2*b*1 and 2*b*2 are of the same height, whereas the two leg portions 15*v*1 and 15*v*2 are made to be slightly different in height. More specifically, the leg portion 15*v*1 on the driven side is made to be taller, by approximately 0.1 mm–0.5 mm, than the leg portion 15*v*2 on the non-driven side; therefore, the leg portion 15*v*1 on the driven side is always in contact with the abutment portion 2*b*1, whereas the leg portion 15*v*2 on the non-driven side remains in a state of being slightly lifted from the abutment portion 12*b*2. Therefore, under normal conditions, the position of the process cartridge B in the apparatus main assembly is fixed at three locations, that is, the locations at the axle hole portion 15*s* of the process cartridge B, axle portion 16*d*, and leg portion 15*v*1 on the driven side, whereby the attitude change of the process cartridge B is prevented even when the entire body of the process cartridge B is subjected to a rotational moment in the clockwise direction during the operation of the apparatus. As for the leg portion 15*v*2 on the non-driven side, only when the process cartridge B is deformed by an external force, for example, vibrations or the like, does it come in contact with the abutment portion 12*b*2 and function as a stopper.

(Force Exerted on Process Cartridge)

When the top lid 1*b* is closed after the installation of the process cartridge B, an upward force is also exerted on the cartridge B in addition to the downward pressure imparted by the pressure generating means 1*b*1 or the like, as described hereinbefore. Therefore, in order to stabilize the installed process cartridge B, the downward pressure exerted on the process cartridge B must be set up to be larger than the upward pressure.

<Upward Force>

The upward force exerted on the process cartridge B is generated by the electrical contact pins 27*a*, 27*b*, and 27*c*, transferring roller 6, and shutter mechanism 24.

Figure 67:
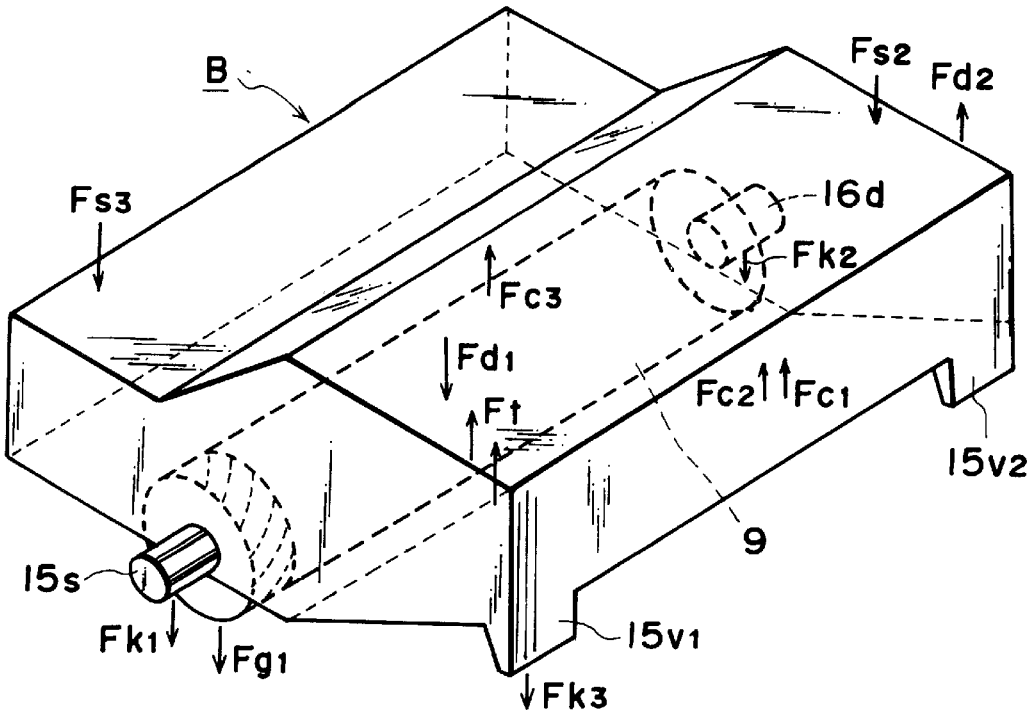
FIG. 67 depicts forces exerted on the process cartridge.

During the installation of the process cartridge B, the electrical contact pins 27*a*, 27*b*, and 27*c* come to press down on the electrical contacts 18*a*, 18*b*, and 18*c* being exposed at the bottom surface of the cartridge B, and the transferring roller 6 comes to press on the photosensitive drum 9. Therefore, the process cartridge B is pressured upward by the forces Fc1, Fc2, and Fc3 from the springs 30 of the respective contact pins as shown in FIGS. 65 and 67, as well as by the force Ft from the spring 6*b* of the transferring roller 6 (FIG. 1). Further, the shutter mechanism 24 opened by the installation of the process cartridge B remains pressured constantly in the closing direction by the torsional coil spring 24*f*. This force Fd is exerted on the process cartridge B in the same direction as that in which the process cartridge B is pulled when it is taken out, whereby the process cartridge B is pressured upward by the vertical components Fd1 and Fd2 of the force Fd.

<Downward Force>

On the other hand, the process cartridge B is pressured downward by the forces Fs1 and Fs2 from the pressure generating means 1*b*1, and the force Fs from the plate spring 1*b*2, as described previously. In addition, it is also pressured downward by the self weights Fk1, Fk2, and Fk3, and the rotation of the gear for transmitting the driving force to the photosensitive drum 9.

More specifically, referring to FIG. 65, when the process cartridge B is installed, the flange gear 9*c* attached to one of the longitudinal ends of the photosensitive drum 9 engages with a driving gear 31 provided in the apparatus main assembly A, for transmitting the driving force of the driving motor. At this time, the direction of the operating pressure angle between the both-gears 9*c* and 31 is set downward by an angle $\theta=1°–6°$ (approximately 4° in this embodiment), relative to the horizontal line. Therefore, during the image forming operation, a component Fg1 of the operating pressure Fg between the driving gear 31 and flange gear 9*c* works to pressure the process cartridge B downward. By directing the operating pressure Fg of the gears downward, relative to the horizontal line, the process cartridge B is prevented from being pushed up.

Further, having the operating pressure angle being directed downward relative to the horizontal line, even when the operator closes the top lid 1*b* without inserting the process cartridge B all the way (but enough to allow the top lid 1*b* to be closed), the process cartridge B is pulled in by the rotational force of the driving gear 31 as the driving motor rotates after the closing of the top lid 1*b* is detected, and the axle hole portion 15 and axle portion 16*d* engage into the groove portions 2*a*1, whereby the process cartridge B is properly installed.

When the process cartridge B is inserted so improperly that the flange gear 9*c* and driving gear fail to engage, the process cartridge B sticks out upward from the apparatus main assembly A and prevents the top lid 1*b* from being closed. Therefore, the operator will notice that the process cartridge B has been improperly inserted.

Further, even when the process cartridge B is subjected to a force directed in the diagonally left-downward direction in FIG. 65 during the image forming operation, the axle hole portion 15*s* and axle portion 16*d* abut in the grooves 2*a*1 because of the aforementioned operating pressure angle; therefore, the process cartridge B remains stable. However, when the operating pressure angle is set diagonally left-downward in relation to the horizontal line as described in the foregoing, the positional arrangement becomes such that the flange gear 9*c* has to ride over the driving gear 31. Therefore, when the downward operating pressure angle is increased, the flange gear 9*c* is liable to collide with the driving gear 31 during the installation of the process cartridge B. In addition, the process cartridge B must be lifted higher before it can be pulled, during removal; otherwise, both gears 9*c* and 31 are liable to collide with each other, thereby hampering their disengagement. Therefore, the aforementioned diagonally left-downward operating pressure angle θ is preferred to be in a range of approximately 1°–6°.

(Relation between Upward and Downward Forces)

As for the upward and downward forces exerted on the process cartridge B as described in the foregoing, they have to satisfy the following conditions in order for the process cartridge B to be properly installed and for each of the contact pins to come and remain reliably in contact with the counterparts of the process cartridge B.

(1) An overall pressure exerted on the process cartridge B manifests as a downward pressure.

(2) The leg portion 15*v*1 on the driven side is not allowed to be pivoted about an axis connecting the axle hole portion 15*s* and axle portion 16 and lifted up.

(3) The axle hole portion 15*s* and axle portion 16*d* are not allowed to be pivoted about an axis connecting both leg portions 15*v*1 and 15*v*2, and to be thereby lifted up.

(4) The axle hole portion 15*s* on the driven side and leg portion 15*v*1 on the driven side are not allowed to be pivoted about an axis connecting the axle portion 16*d* on the non-driven side and leg portion 15*v*2 on the non-driven side, and to be thereby lifted up.

(5) The axle portion 16*d* on the non-driven side and the leg portion 15*v*2 on the non-drive side are not allowed to be pivoted about an axis connecting the axle hole portion 15*s* on the driven side and the leg portion 15*v*1 on the driven side, and to be thereby lifted up.

(6) The axle hole portion 15*s* on the driven side is not allowed to be pivoted about an axis connecting the axle portion 16*d* on the non-driven side and leg portion 15*v*1 on the driven side and lifted up.

(7) The axle portion 16*d* on the non-driven side is not allowed to be pivoted about an axis connecting the axle hole portion 15*s* on the driven side and leg portion 15*v*2 on the non-driven side, and to be thereby lifted up.

However, in the case of this embodiment, since the leg portion 15*v*2 on the non-driven side is slightly lifted above the abutment portion 2*b*2 anyway, Condition (7) may be eliminated; therefore, it only necessary to satisfy Conditions (1)–(6).

More specifically, in order to meet Condition (1), for example, only the following relation has to be satisfied:

$$Fs1+Fs2+Fs3+FG1+Fk1+Fk2+Fk3>Fc1+Fc2+Fc3+Ft+Fd1+Fd2$$

Figure 68:
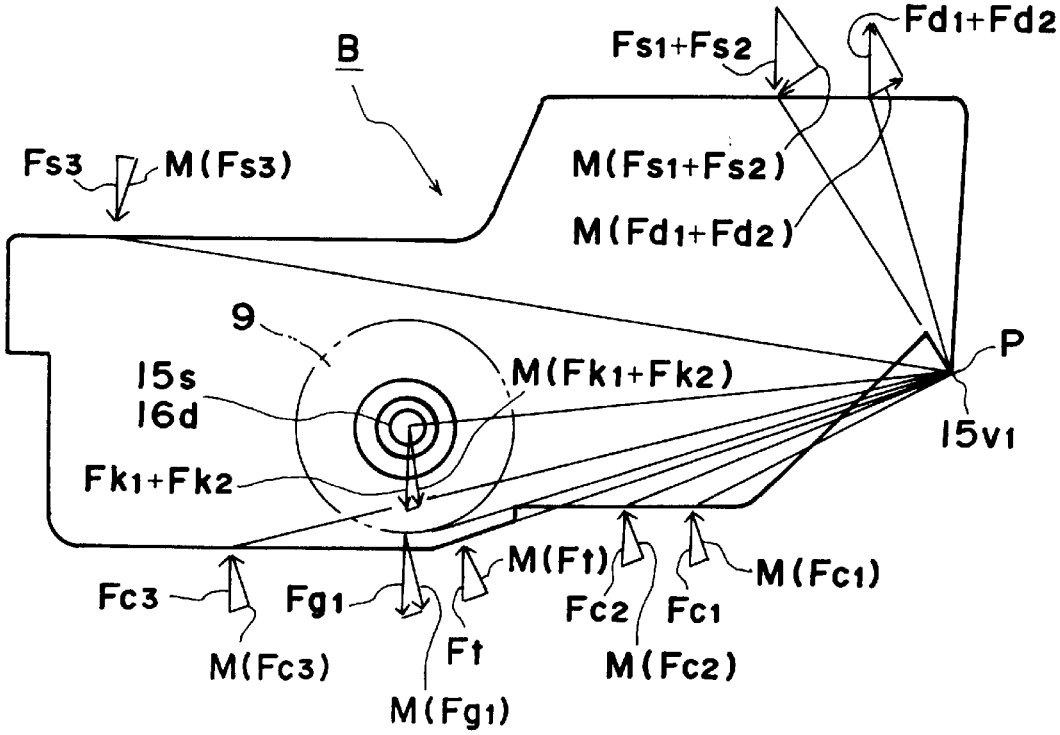
FIG. 68 depicts a rotational moment about a projection on the process cartridge side.

Further, referring to FIG. 68, in order to meet Condition (3), it suffices if necessary that a rotational moment about a point p of the leg portion 15*v*1 on the driven side satisfies the following mathematical expression, wherein M(T) in the expression is a reaction force generated by the cartridge torque, that is, a clockwise moment of the process cartridge B about the point p in the drawing.

$$M(Fs1+Fs2)+M(Fs3)+M(FG1)+M(k1+Fk2)>M(Fc1)+M(Fc2)+M(Fc3)+M(Ft)+M(Fd1+Fd2)+M(T)$$

where M( ) is a moment.

Similarly, expressions which satisfy Conditions (1)–(6) are obtained, and the pressures Fs1, Fs2, and Fs3 are determined so as to satisfy all the conditions. As a result, the process cartridge B remains stabilized at a predetermined location within the apparatus main assembly during the image forming operation.

{Image Forming Operation}

Next, referring to FIG. 1, a description will be given as to the image forming operation of the apparatus main assembly A in which the process cartridge B has been installed as described hereinbefore.

As the apparatus receives a recording start signal, a pickup roller 5*a* as well as a conveying roller 5*b* are driven, whereby the recording medium is separated and fed one by one out of the cassette 4 by a separating claw 4*e*, is reversed as it is guided along the guide 5*c* by the conveying roller 5*b*, and is delivered to the image forming station.

When the leading end of the recording medium is detected by an unshown sensor, an image is formed in the image forming station in synchronism with the conveying timing with which the leading end of the recording medium travels from the sensor to the transfer nip portion.

More specifically, the photosensitive drum 9 is rotated in the direction indicated by an arrow in FIG. 1 in a manner so as to synchronize with the recording medium conveying timing, and in response to this rotation, a charge bias is applied to the charging means 10, whereby the surface of the photosensitive drum 9 is uniformly charged. Then, a laser beam modulated by the imaging signal is projected from the optical system 3 onto the surface of the photosensitive drum 9, whereby a latent image is formed on the drum surface in response to the projected laser beam.

At the same time as when the latent image is formed, the developing means 12 of the process cartridge B is driven, whereby the toner feeding mechanism 12*b* is driven for feeding out the toner within the toner storage 12*g* toward the developing sleeve 12*b*, and the toner layer is formed on the rotating developing sleeve 12*d*. The latent image on the photosensitive drum 9 is developed by the toner by applying to the developing sleeve 12*d* a voltage having the same polarity and substantially the same amount of electric potential as those of the photosensitive drum 9. Then, the toner image on the photosensitive drum 9 is transferred onto the recording medium having been delivered to the transfer nip portion, by applying to the transferring roller 6 a voltage having the polarity opposite to that of the toner.

While the photosensitive drum 9 from which the toner image has been transferred onto the recording medium is further rotated in the arrow direction in FIG. 1, the residual toner on the photosensitive drum 9 is scraped off by the cleaning blade 13*a*. The scraped toner is collected in the waste toner storage 13*c*.

On the other hand, the recording medium on which the toner image has been transferred is guided by the cover guide 5*e*, being guided by the bottom surface, and is conveyed to the fixing means 7. In this fixing means 7, the toner image on the recording image is fixed by the application of heat and pressure. Next, the recording medium is reversed by the discharge relay roller 5*f* and the sheet path 5*g*, being thereby de-curled as it is reversely curved, and is discharged by the discharge roller 5*h* and 5*i* into the discharge tray 8.

<Procedure for Removing Process Cartridge>

When it is sensed by an unshown sensor or the like that the amount of toner in the developing means has become small during the image forming operation, this information is displayed on a display portion or the like of the apparatus main assembly A, whereby the operator is urged to replace the process cartridge B. Hereinafter, a process cartridge removal procedure for replacing the process cartridge B will be described.

Figure 69:
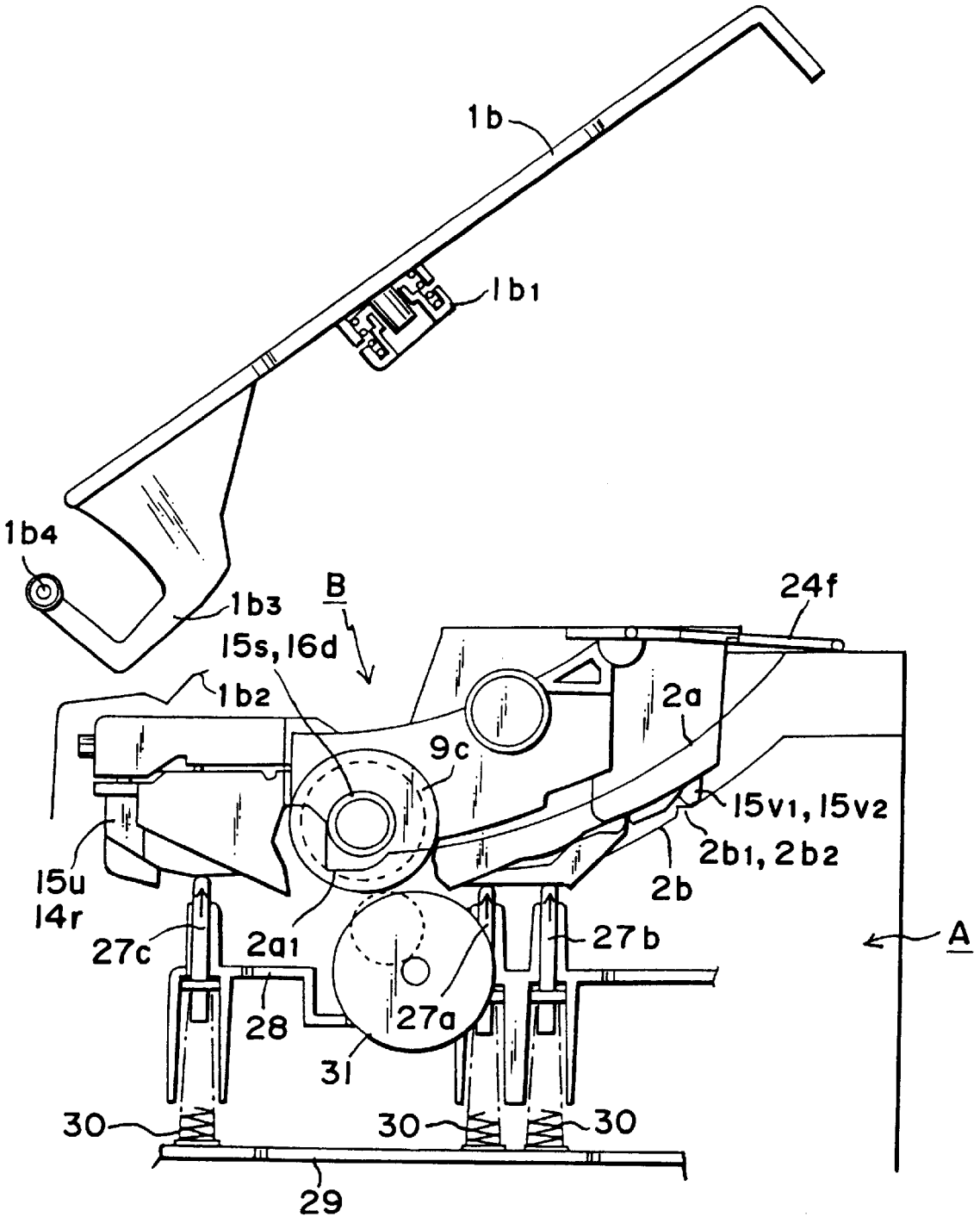
FIG. 69 depicts the state of the process cartridge when a top lid is open.

When the process cartridge B is taken out of the apparatus main assembly A, the top lid 1*b* is opened as shown in FIG. 69, to begin with. At this time, the pressure generating means 1*b*1 and plate spring 1*b*2 become separated from the process cartridge B, together with the top lid 1*b*, whereby the force Fs1+Fs2+Fs3 generated by the pressure generating means 1*b*1 and plate spring 1*b*2 is canceled. As a result, only the force Fk1+Fk2 generated by the weight of the process cartridge B itself remains as the downward force exerted upon the process cartridge B.

At this point in time, since it had been arranged so that the upward force Fc1+Fc2+Fc3 exerted on the process cartridge B by the contact pins 27*a*, 27*b*, and 27*c*, the upward force Ft generated by the transferring roller 6, and the upward force Fd coming from the shutter mechanism 24 are slightly larger than the downward pressure Fk1+Fk2 coming from the self weight of the process cartridge B, the process cartridge B is slightly lifted as the top lid 1*b* is opened, whereby the engagement between the flange gear 9*c* and driving gear 31 is broken, and the axle hole portion 15*s* and axle portion 16*d* are disengaged from the groove portion 2*a*1. As a result, even though the operating pressure angle between the flange gear 9*c* and driving gear 31 is directed diagonally downward in relation to the horizontal line, the process cartridge B can be smoothly pulled out.

On the contrary, in the case of the prior structure in which the process cartridge B is installed in the top lid 1*b* assembly, when the operating pressure angle is set diagonally downward relative to the horizontal line, the flange gear 9*c* and driving gear 31 remain engaged when the top lid 1*b* is opened. As a result, the process cartridge B cannot be smoothly pulled out. Therefore, the driving gear 31 must be provided with a one-way clutch or the like. However, in the case of this embodiment, when the top lid 1*b* is opened, the flange gear 9*c* is automatically disengaged from driving gear 31, which eliminates the need for the provision of the one-way clutch, allowing thereby the component count to be reduced.

Also, when the process cartridge B is lifted, and the axle hole portion 15*s* and axle portion 16*d* are disengaged from the groove portion 2*a*1, as described previously, the process cartridge B is pushed diagonally upward in the same direction as that in which the process cartridge B is pulled out from the cartridge installation space 2, by the pressure from the spring 24*f* exerting the pressure for closing the shutter mechanism 24. Therefore, it becomes easier to remove the process cartridge B.

As described in the foregoing, when the top lid 1*b* is opened, the process cartridge B is slightly lifted in the removal direction, by the upward force generated by the transferring roller 6, contact pins 27*a*, 27*b*, and 27*c*, and shutter mechanism 24; therefore, it can be smoothly and easily taken out.

{Recycling Procedure for Process Cartridge}

The process cartridge B, which can be removed as described in the foregoing, is constructed so as to be recyclable. Hereinafter, its recycling procedure will be described. After the toner in the toner storage 12*a* is depleted, the process cartridge B in this embodiment can be recycled to conserve global resources and protect the natural environment, wherein the top and bottom frames 14 and 15 are separated and the toner is refilled in the toner storage 12*a*.

Figure 70:
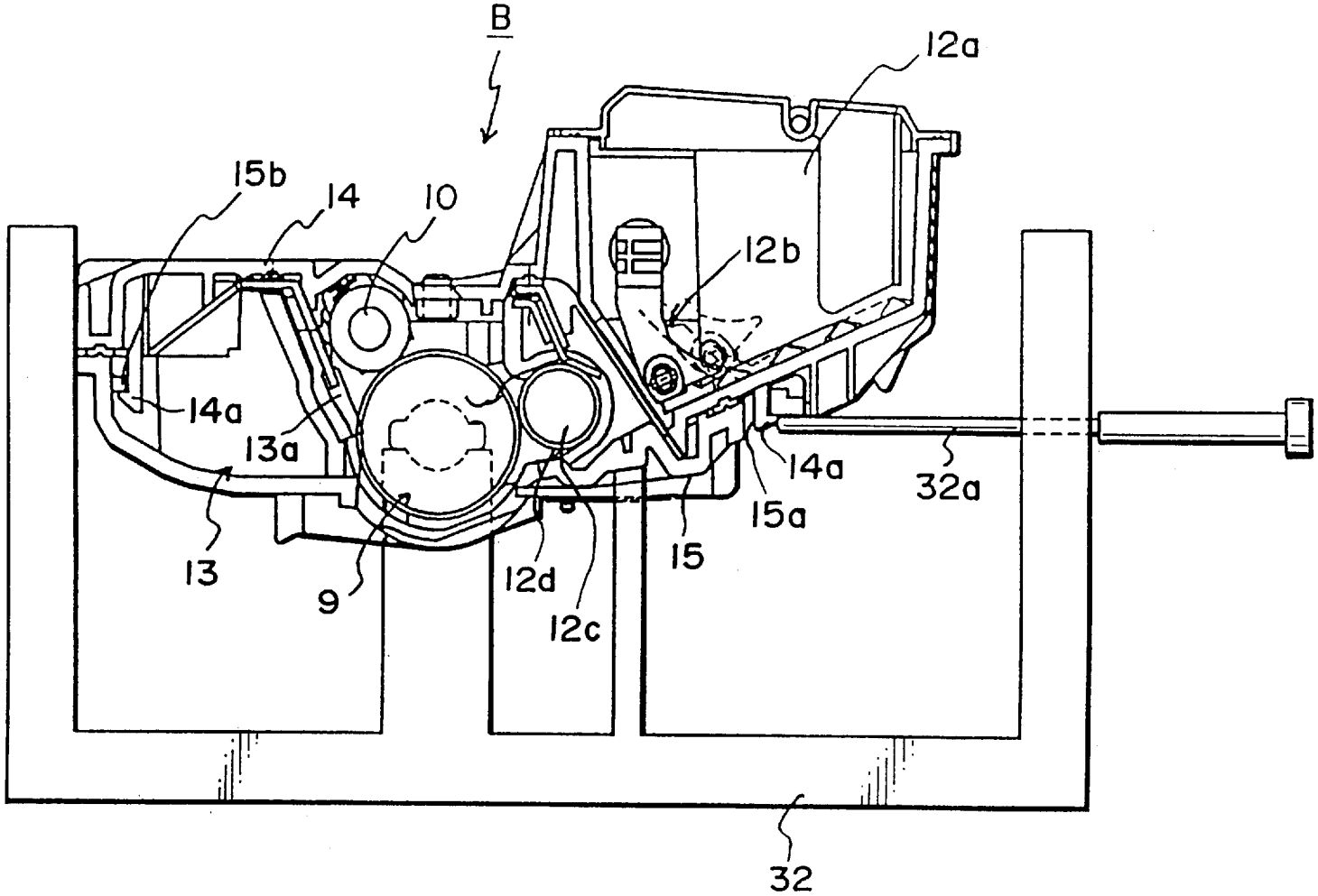
FIG. 70 depicts how the top and bottom frames are separated.

More specifically, referring to FIGS. 7, 8, 37, and 38, the top and bottom frames 14 and 15 can be separated by disengaging the engagement claw 14*a* and engagement opening 15*a*, engagement claw 14*a* and engagement projection 15*b*, engagement claw 14*c* and engagement opening 15*d*, engagement claw 15*c* and engagement opening 14*b*, and engagement claw 14*e*3 and engagement opening 15*f*3. Referring to FIG. 70, this disengagement procedure can be easily carried out by placing the spent process cartridge in a disassembling tool 32 and pushing the engagement claw 14*a* by sticking out a rod 32*a*. Also, the process cartridge B can be disassembled by pressing the engagement claws 14*a*, 14*c*, 15*c*, and 14*e*3, instead of using the disassembling tool 32.

After the process cartridge B is disassembled into the top frame 14 assembly and bottom frames 15 assembly as shown in FIGS. 7 and 8, the components are cleaned by blasting air or the like upon them for removing the waste toner adhering to the interior of the cartridge, wherein a relatively large amount of waste toner will be found adhering on the photosensitive drum 9, developing sleeve 12, and cleaning means since they are the members which directly come in contact with the toner, whereas the degree of waste toner adhesion is less on the charging roller 10 since it is the member which does not directly come in contact with the toner. Therefore, the charging roller 10 can be easily cleaned compared to the photosensitive drum 9, the cleaning means, or the like. In addition, in this embodiment, the charging roller 10 is disposed in the top frame 14 which can be separated from the bottom frame 15 in which the photosensitive drum 9, developing sleeve 12*d*, and cleaning means 13 are disposed; therefore, the top frame 14 separated from the bottom frame 15 can be easily cleaned.

Figure 60A:
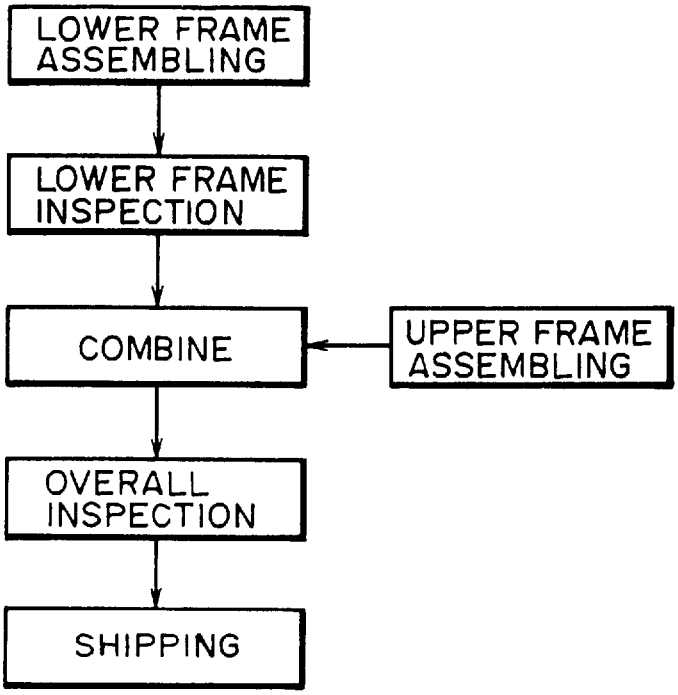
FIGS. 60(*a*) and 60(*b*) are a diagram for a process cartridge assembly-shipment line (a), and a diagram for a process cartridge disassembly-cleaning line (b), respectively.
Figure 60B:
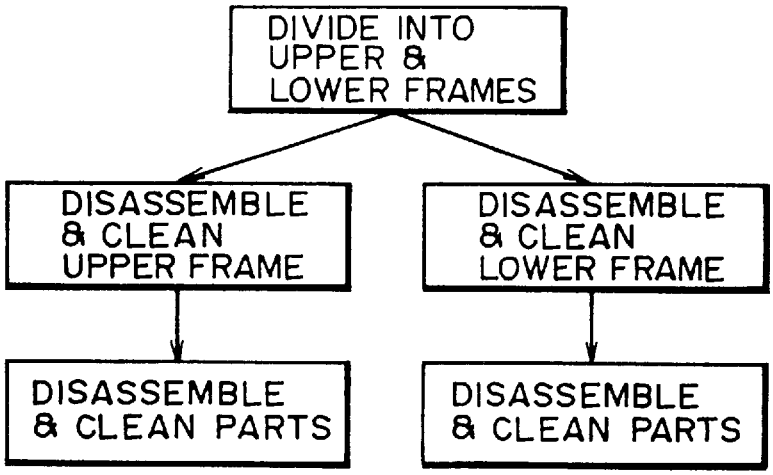

Referring to FIG. 60(*b*), the process cartridge B is separated into the top frame 14 assembly and bottom frame 15 assembly, and each assembly is further disassembled for more cleaning. More specifically, the top frame 14 assembly is disassembled into the top frame 14, charging roller 10, and the like, and the bottom frame 15 assembly is disassembled into the photosensitive drum 9, developing sleeve 12*d*, developing blade 12*e*, the cleaning blade, and the like. In other words, the process cartridge B is disassembled to the level of individual components to be cleaned; therefore, the cleaning line becomes a simple one.

After the cleaning of the waste toner or the like, the opening 12*a*2 is sealed by pasting the cover film 26 with a tear tape 25 over the opening 12*a*2; a new supply of toner is filled through a toner filling mouth 12*a*4 provided on the side surface of the toner storage 12*a*; and the toner filling mouth 12*a*4 is covered with the cover 12*a*3. Then, the top and bottom frames 14 and 15 are joined by engaging the engagement claw 14*a* and engagement opening 15*a*, engagement claw 14*a* and engagement projection 15*b*, engagement claw 14*c* and engagement opening 15*d*, engagement claw 15*c* and engagement opening 14*b*, and engagement claw 14*e*3 and engagement opening 15*f*3, re-finishing thus the process cartridge B for another round of use.

When the top and bottom frames 14 and 15 are joined, the engagement claw 14*a* is engaged with the engagement opening 15*a;* the engagement claw 14*a*, with the engagement projection 15*b*; and so on. However, it is conceivable that as the recycling count of the process cartridge B increases, the engagement claws and engagement openings eventually fail to engage. Therefore, in this embodiment, screw holes are provided at locations adjacent to respective engagement claws and engagement openings or locations where effects equivalent to those of the engagement claws and engagement openings can be obtained, so that the top and bottom frames can be screwed together. For example, the screw holes 14*a*1 are provided adjacent to the corresponding engagement claws 14*a* of the developing means 12 disposed in the top frame 14, and the screw holes 15*a*1 are provided adjacent to the engagement openings 15*a* provided in the bottom frame 15, that is, at locations which correspond to those of the screws 14*a*1. In addition to these screw holes, through holes are also provided adjacent to respective corners of the frames, being drilled through the engagement projection 14*d* and engagement concavity 15*e* (on the cleaning means side), and through the engagement projections 15*f*1 and 14*e*2 and the engagement concavity 14*e*1 (on the developing means side). Therefore, even when these engagement claws do not effectively engage, the top and bottom frames 14 and 15 can be tightly joined by screwing them together with screws fitted through these screw holes.

ANOTHER EMBODIMENT

Next, alternative embodiments of various portions in the image forming apparatus and process cartridge will be described referring to drawings, wherein the portions having the same functions as those in the first embodiment described hereinbefore will be designated by the same reference symbols.

(Image Bearing Member)

In the first embodiment, organic semiconductor (OPC) is used as the material for the photosensitive layer of the image bearing member, but the material is not limited by this example. For example, the material may be amorphous silicon (A-Si), selenium (Se), zinc oxide (ZnO), cadmium sulfide (CdS), or the like.

<Flange Gear>

Figure 71A:
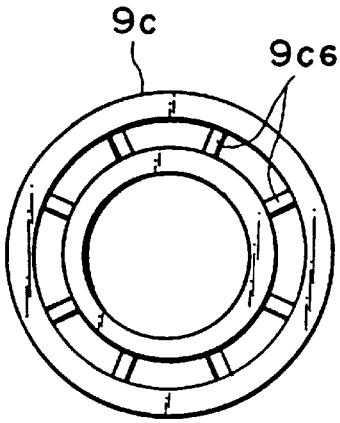
FIGS. 71(*a*) and 71(*b*) are a plan view and a sectional view, of an alternative embodiment of the flange gear attached to one end of the photosensitive drum, respectively.
Figure 71B:
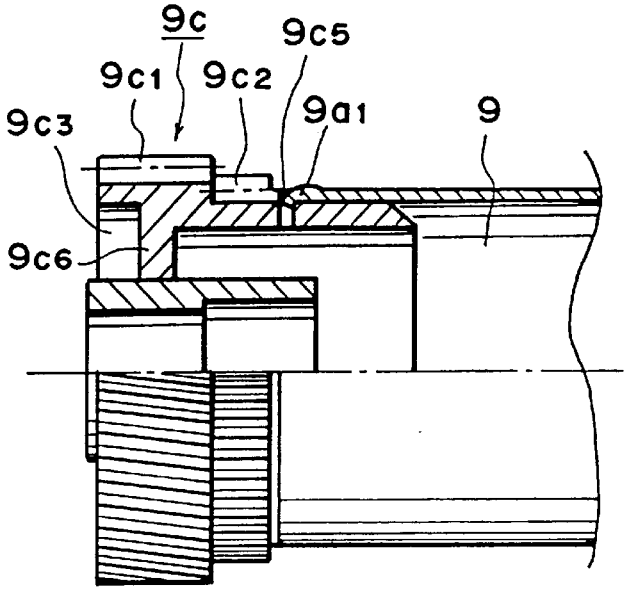

In the first embodiment, the reinforcing member 9*c*4 is press-fitted into the hollowed portion 9*c*3 of the flange gear 9*c* as shown in FIG. 9, as a means for preventing the flange gear 9*c* from being deformed by the load exerted on as the driving force is transmitted, but the present invention is not limited by this example. Just adding ribs or the likes to the flange gear itself, instead of press-fitting the reinforcing member 9*c*4, will do as long as satisfactory strength can be obtained. For example, a flange gear structured as shown in FIGS. 71(*a*) and 71(*b*) is one of such gears.

It has been stated previously that because the flange gear 9*c* is made of plastic material by ejection molding, it is hollowed below the bottom land of the gear portion. When the ribs are provided within this hollowed portion 9*c*3 shown in FIG. 9, it is liable to invite the deterioration of the gear accuracy. Therefore, in the case of the flange gear 9*c* in this embodiment, the hollowed portion 9*c* is molded narrower so that the walls 9*c*6 are disposed below the bottom land of the gear portion, and at the same time a large number of ribs 9*c*7 are provided in the hollowed portion 9*c*. With this arrangement, the strength of the flange gear 9*c* can be increased without inviting deterioration of the gear accuracy.

<Drum Axle>

In the first embodiment, the screw hole 9*d*1 is provided on the end surface of the drum axle 9*d*, as an exemplary means for simplifying the operation for disassembling the drum axle 9*d* having been press-fitted in the axle hole portion 15*s* of the bottom frame 15, but the present invention is not limited by this example. Any means will do as long as it is structured to make it easier to extract the drum axle 9*d*.

Figure 72A:
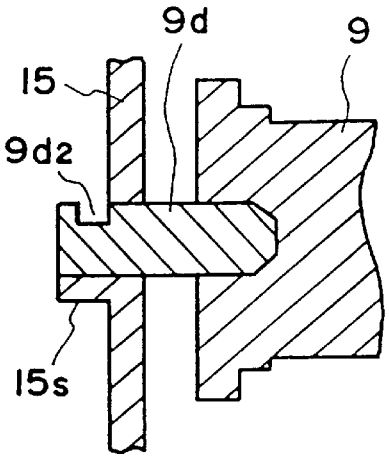
FIGS. 72(*a*) and 72(*b*) are schematic sectional views of alternative embodiments of the drum axle according to the present invention.
Figure 72B:
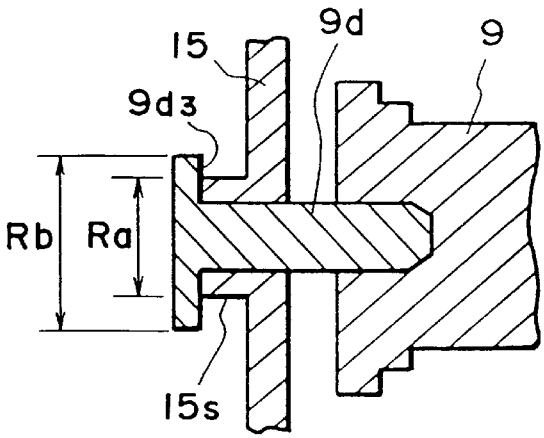

For example, a notch 9*d*2 may be provided on the drum axle 9*d* and axle hole portion 15*s* of the bottom frame 15 as shown in FIG. 72(*a*), or an external diameter Rb of the flange portion 9*d*3 may be made larger than an external diameter Ra of the axle hole portion 15*s* of the bottom frame 15 as shown in FIG. 72(*b*), whereby the drum axle 9*d* can be easily extracted. Further, in this embodiment, the thread cutting cost can be eliminated, reducing thereby the manufacturing cost.

(Charging Means)

<Sliding Bearing)

In the first embodiment, the hook-shaped stopper portion 10*c*1 is integrally formed on the sliding bearing 10*c*, as the thrust regulating means for regulating the force in the thrust direction of the charging roller 10, as shown in FIGS. 18 and 19, but the present invention is not limited by this arrangement. All that is needed is to have the thrust regulating portion integrally formed on the sliding bearing.

Figure 73A:
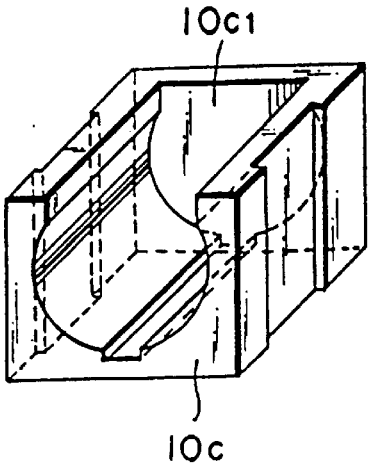
FIGS. 73(*a*) and 73(*b*) are oblique views of alternative embodiments of the sliding bearing according to the present invention.
Figure 73B:
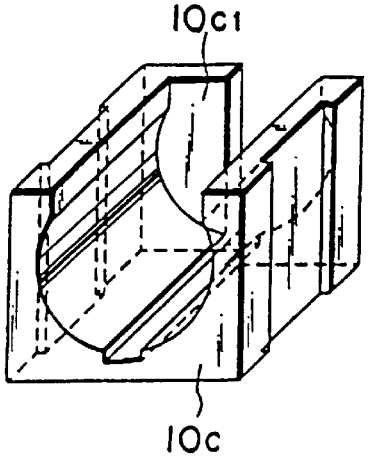
Figure 74A:
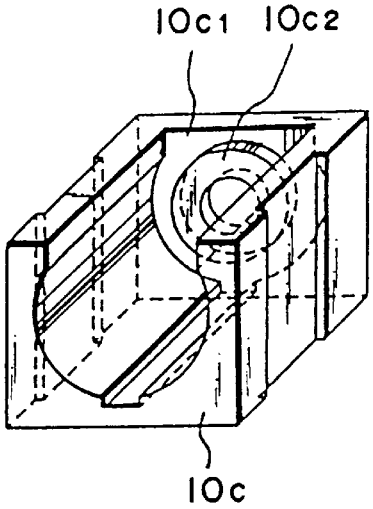
FIGS. 74(*a*) and 74(*b*) are oblique views of alternative embodiments of the sliding bearing according to the present invention.
Figure 74B:
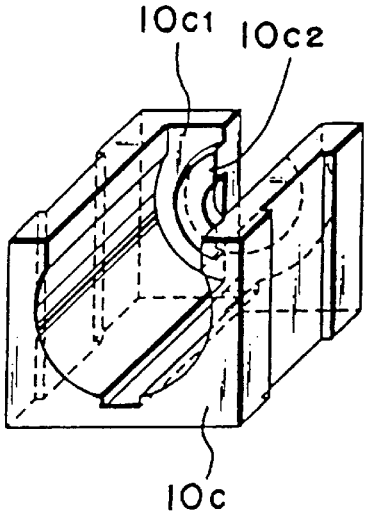

For example, a wall may be integrally molded, covering completely one end of the sliding bearing 10*c* as shown in FIG. 73(*a*), to be used as the stopper portion 10*c*1, or instead, a projecting rib 10*c*2 may be provided on the interior wall of the stopper portion 10*c*1, as shown in FIG. 73(*b*), so that the frictional resistance can be reduced when the end of the roller shaft of the charging roller 10 rotates while remaining in contact with the stopper portion.

Further, in the embodiment described in the foregoing, the stopper portion 10*c*1 is integrally formed, as an exemplary thrust regulating means, on the sliding bearing 10*c* which rotatably supports the charging roller 10, but the present invention is not restricted by this example. The same effects can be obtained when the thrust regulating means is provided for the transferring roller or the like.

As for the structure of the charging means, the so-called contact type charging method is employed in the first embodiment, but it is needless to say that the drum surface may be uniformly charged by employing such a charging method that a metallic shield, such as aluminum shield or the like, is placed adjacent to a tungsten wire in a manner to shield it on three sides, and the positive or negative ions generated by applying a high voltage to the tungsten wire are transferred onto the surface of the photosensitive drum.

Further, the contact type charging means may be of a blade type, (charging blade), a pad type, a black type, a rod type, a wire type, or the like, in addition to the roller type described in the foregoing.

(Developing Means)

As for the developing method, it is possible to use various known developing methods, such as the two-component magnetic brush developing method, the cascade developing method, the touch-down developing method, the cloud developing method, or the like.

(Cleaning Means)

<Cleaning Blade>

In the first embodiment, the rib 14*j* is provided, as a means for suppressing the noise generated by the vibration of the cleaning blade, at a predetermined location on the internal surface of the top frame 14 as shown in FIGS. 31 and 32(*a*) and 32(*b*), and this rib 14*j* is abutted on the upper surface of the blade supporting member 13*a*1, with the seal member S1 being interposed, but the present invention is not limited by this example. For example, the rib 14*j* may be abutted on the slanted surface of the blade supporting member 13*a*1 supporting the blade 13*a* as long as such an arrangement can suppress the vibration of the blade 13*a*.

Figure 75:
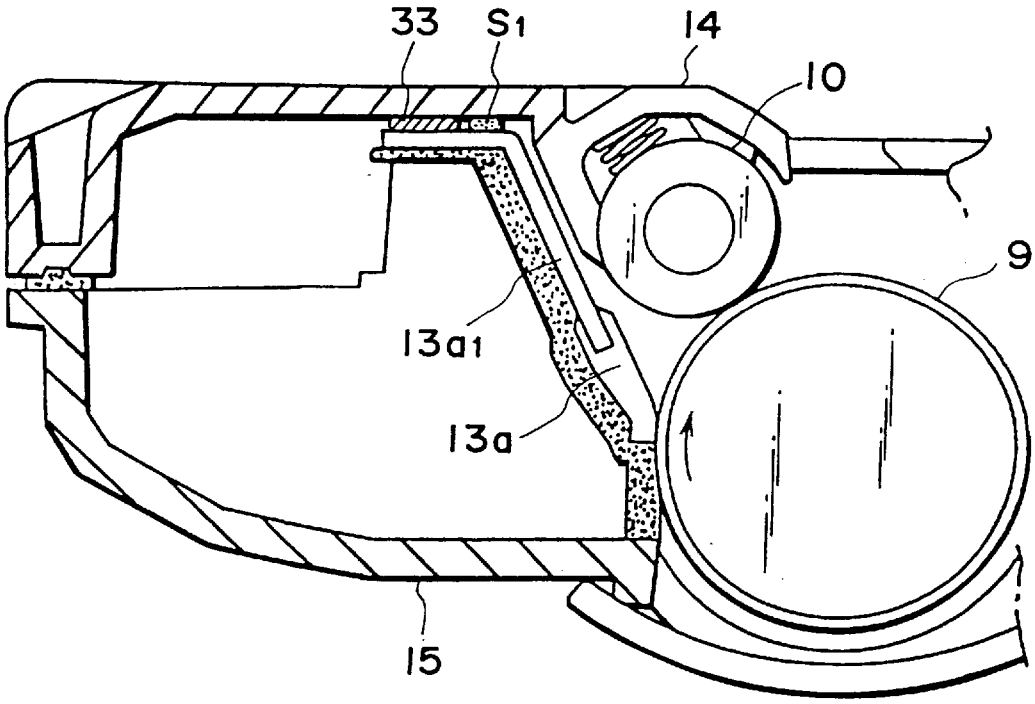
FIG. 75 depicts an alternative embodiment of the cleaning means according to the present invention.

Further, a shock absorbing member 33, made of chloroprene rubber or the like, may be sandwiched between the blade supporting member 13*a*1 to which the cleaning blade 13 is affixed and the top frame 14, as shown in FIG. 75, wherein the seal member S1 is placed next to the shock absorbing member 33, to prevent waste toner leak. The thickness measurement of the shock absorbing member 33 used in this example is approximately 0.5 mm–1.5 mm larger than that of the gap between the upper surface of the blade supporting member 13*a*1 and the internal surface of the top frame 14, and its measurement in the longitudinal direction is approximately 150 mm–220 mm. The interposition of this shock absorbing member 33 flexes the top frame 14 by approximately 0.5 mm–1.0 mm. In other words, the shock absorbing member 33 presses upon the blade supporting member 13*a*1 by a force strong enough to flex the top frame 14, whereby the vibration generated by the stick-slip of the cleaning blade is suppressed to reduce the noise which comes out of the process cartridge.

Figure 76:
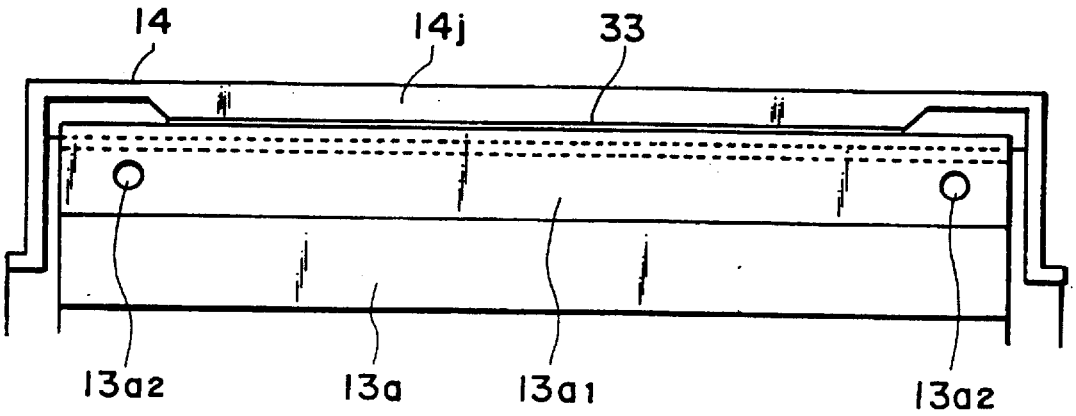
FIG. 76 depicts an alternative embodiment of the cleaning means according to the present invention.

Also, the shock absorbing member 33 may be disposed in a manner so as to be interposed between the rib 14*j* of the top frame 14 and the blade supporting member 13*a*1, as shown in FIG. 76, wherein the shock absorbing member 33 used in this embodiment is of urethane rubber having a thickness of 0.5 mm or less, and is compressed between the rib 14*j* and blade supporting member 13*a*1 during the cartridge assembly process, so that its thickness is reduced to approximately 0.3 mm and its hardness reaches approximately 60°. Therefore, the micro-vibration with a frequency of several tens of Hz or more generated by the stick-slip of the cleaning blade 13*a* can be suppressed. As a result, the generation of noise can be prevented, and also, images of good quality can be produced.

Figure 78:
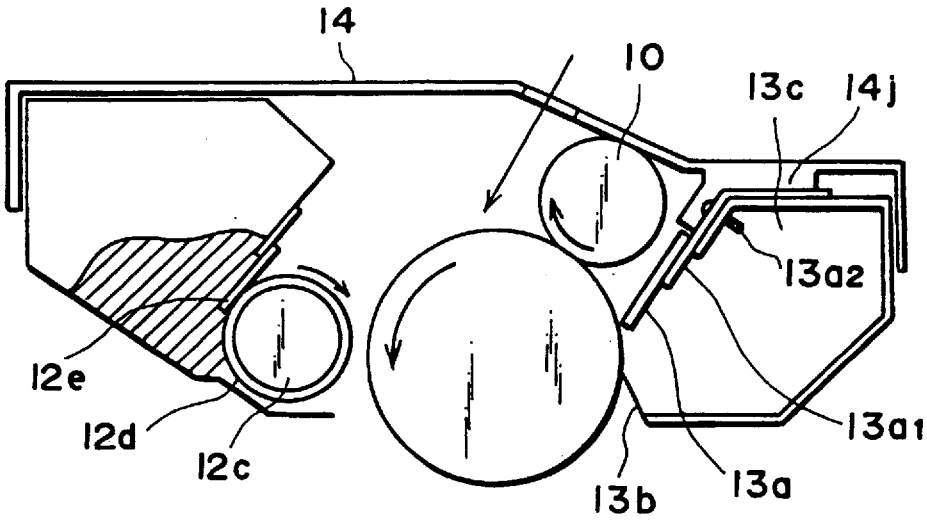
FIG. 78 depicts an alternative embodiment of the cleaning means according to the present invention.
Figure 77A:
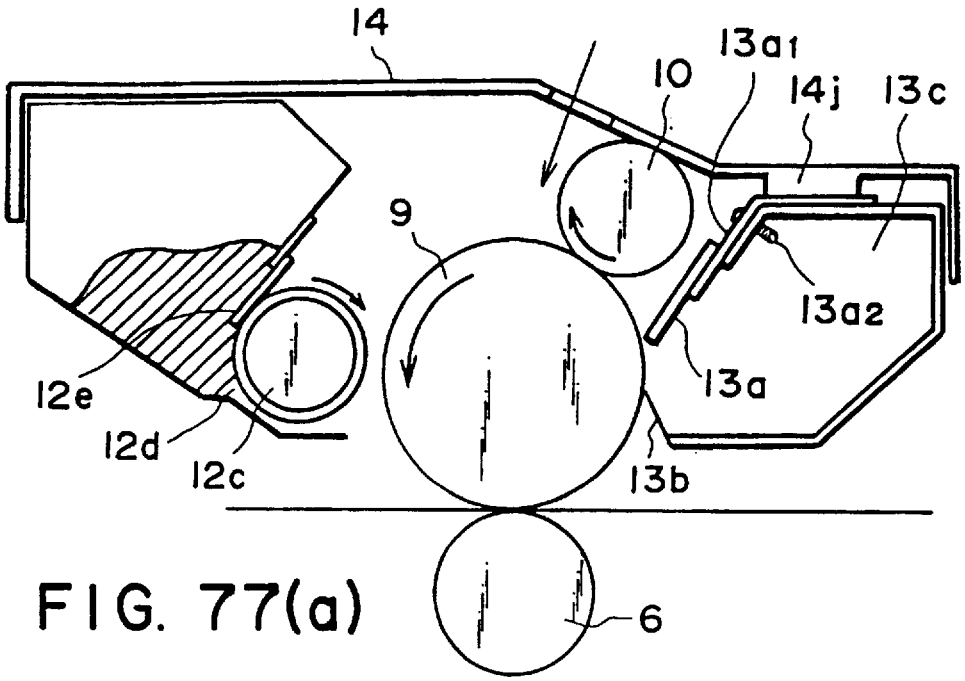
FIGS. 77(*a*) and 77(*b*) depict an alternative embodiment of the cleaning means according to the present invention.
Figure 77B:
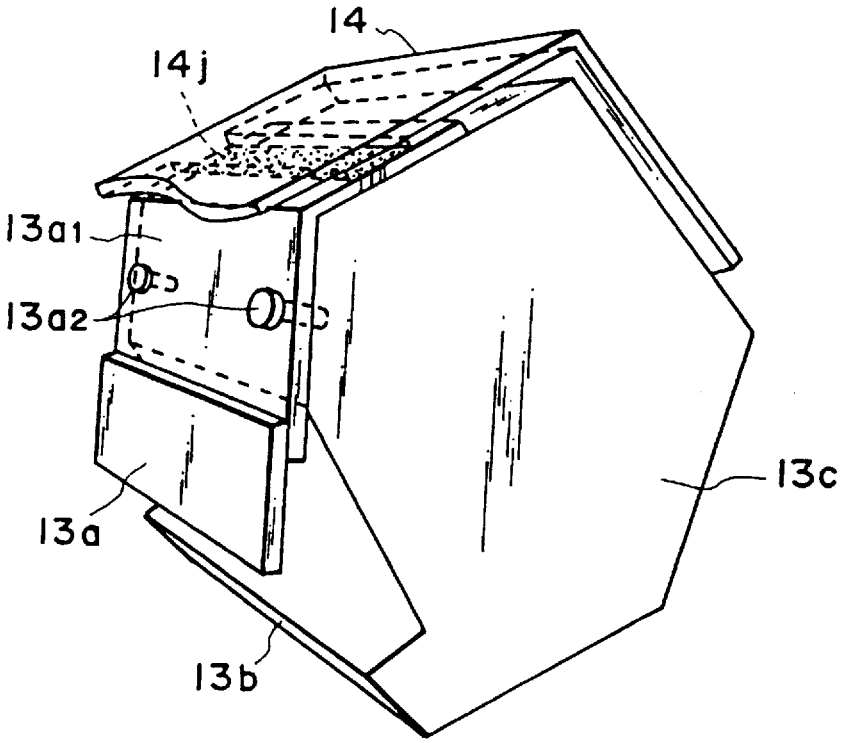

Further, the rib 14*j* provided at a predetermined location of the top frame member 14 may be placed directly in contact with the blade supporting member 13*a* as shown in FIGS. 77 and 78. The rib 14*j* shown in FIG. 77 is placed so as to contact substantially across the entire upper surface of the blade supporting member 13*a*1, and the rib 14*j* shown in FIG. 78 is placed so as to contact substantially the entire surface area (upper and angled surface) of the blade supporting member 13*a*1. This arrangement increases the rate of vibration transmission from the cleaning blade 13*a* to the cartridge frame through the rib 14*j*, but it also increases the mass of the vibrating object itself (mass of the cartridge frame), whereby the vibration from the cleaning blade 13*a* is dissipated throughout the cartridge frame, that is, the larger mass. Therefore, the vibration of the blade 13*a* can be reduced, and subsequently, the noise generated by the vibration is reduced.

Figure 79A:
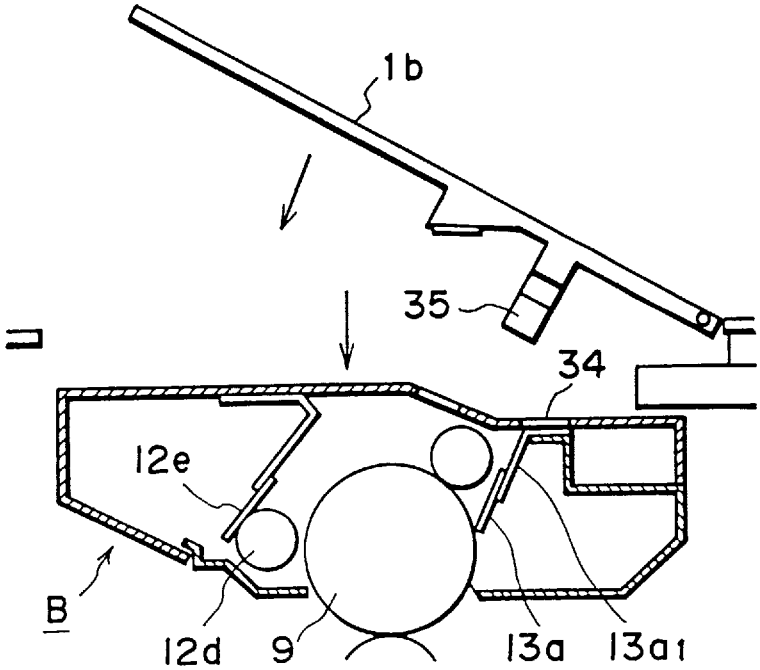
FIGS. 79(*a*) and 79(*b*) depict an alternative embodiment of the cleaning means according to the present invention.
Figure 79B:
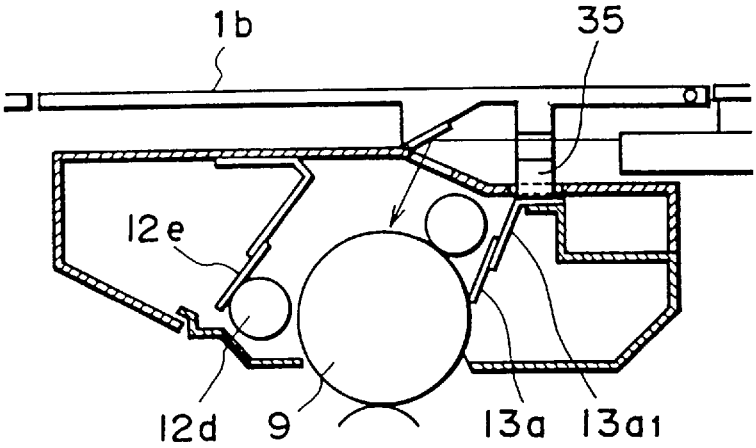

Further, such an arrangement as shown in FIG. 79 may be made so that the top frame 14 is provided with an opening 34 which extends in the longitudinal direction of the cartridge, right next to where the cleaning blade 13*a* is (where the rib 14*j* could have been), and the top lid 1*b* on the apparatus main assembly side is provided with an abutment member 35, which is disposed at a predetermined location and comes to abut the upper surface of the blade supporting member 13*a*1 through the opening 34 as the top lid 1*b* is closed. This arrangement causes the vibration of the cleaning blade to be transmitted throughout the entire apparatus by way of the abutment member 35, wherein the mass of the object itself to be vibrated is further increased (mass of the entire apparatus) and the vibration from the cleaning blade 13*a* is dissipated throughout the increased mass, that is, the mass of the entire apparatus, whereby the vibration of the blade 13*a* is reduced, and subsequently, the noise generated by the vibration is reduced. In addition, in order to improve the tightness of the contact, thin and soft shock absorbing material, such as a rubber sheet, may be interposed between the blade supporting member 13*a*1 and abutment member 23.

Figure 80:
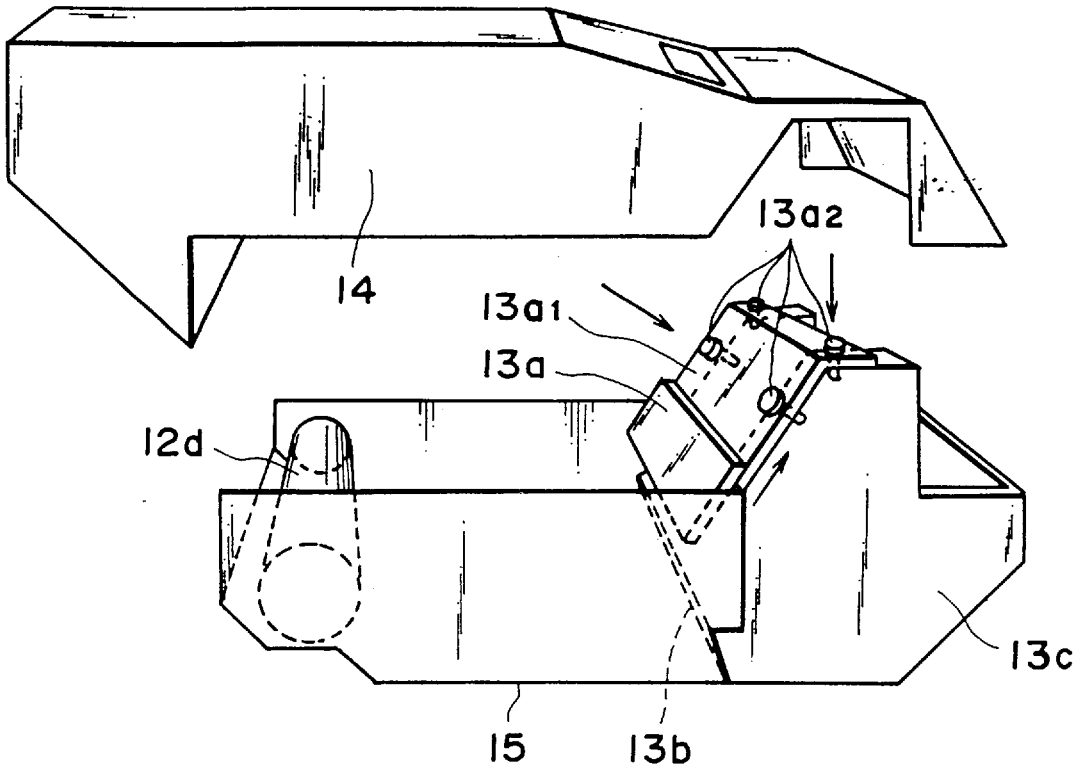
FIG. 80 depicts an alternative embodiment of the cleaning means according to the present invention.

Referring to FIG. 80, when the blade supporting member 13*a*1 is fixedly screwed onto the cartridge frame, it may be screwed not only at both longitudinal ends of the angled surface but also at both longitudinal ends of the upper surface. Just like the preceding embodiment, this arrangement can. suppress the micro-vibration with a frequency of several tens of Hz or more, generated from the frictional force between the photosensitive member 9 and cleaning blade 13*a*, whereby the generation of the noise is eliminated, and also, images of good quality can be produced.

Figure 81:
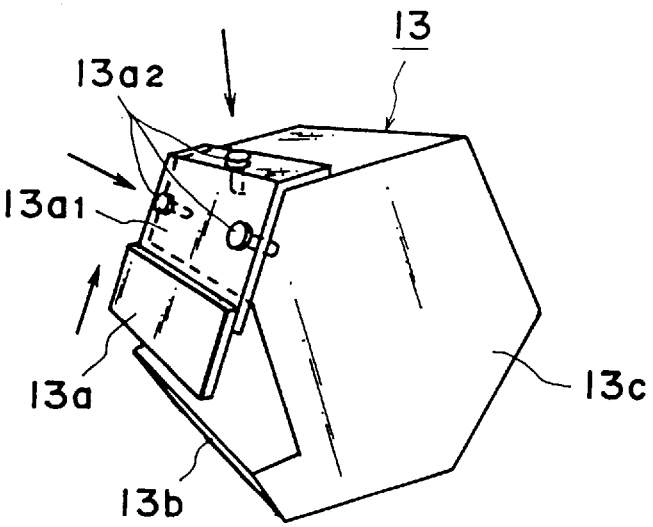
FIG. 81 depicts an alternative embodiment of the cleaning means according to the present invention.
Figure 82:
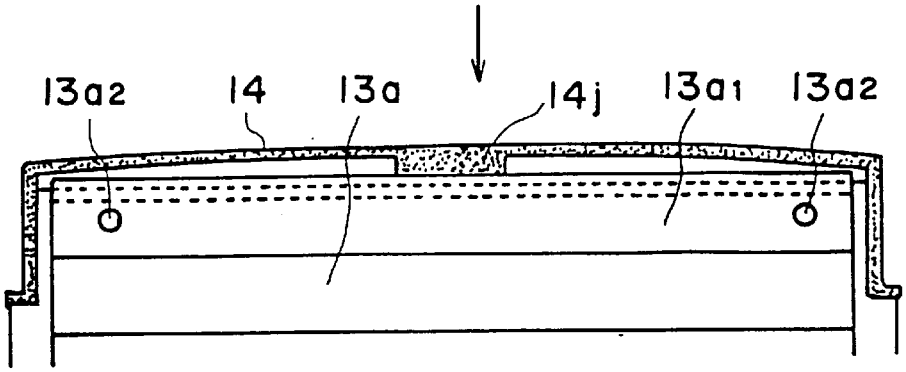
FIG. 82 depicts an alternative embodiment of the cleaning means according to the present invention.
Figure 83A:
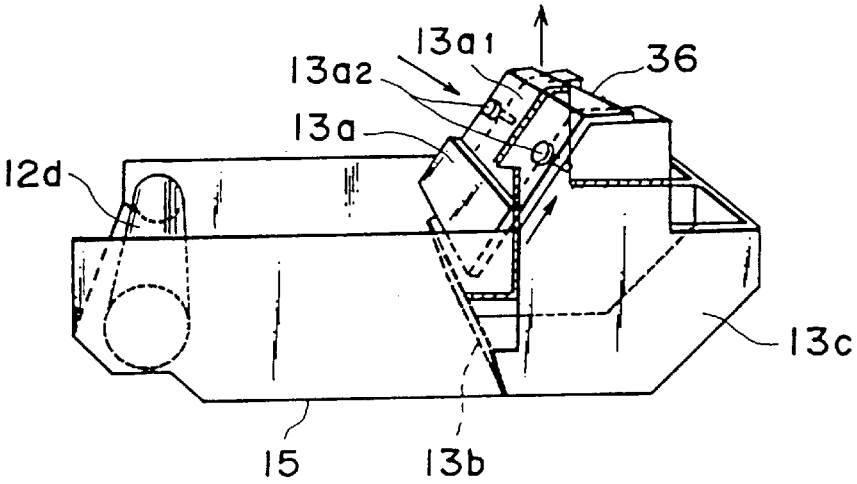
FIGS. 83(*a*) and 83(*b*) depict an alternative embodiment of the cleaning means according to the present invention.
Figure 83B:
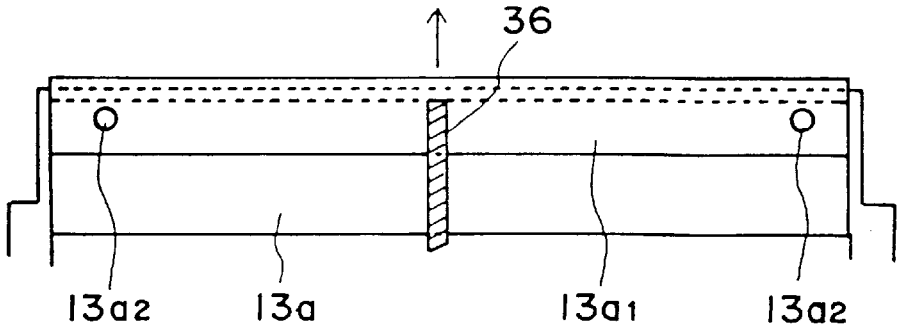

Further, in the case of a single-piece cleaning means, such as is shown in FIG. 81, the same effects as that of the preceding embodiment can be obtained by screwing fixedly the blade supporting member 13*a*1, at the center portion of the upper surface.

Further, a rib 14*j*, which is slightly taller than the gap between the internal surface of the top frame 14 and the upper surface of the blade supporting member 13*a*1 and extends in the longitudinal direction of the cartridge, may be provided at the middle of the internal surface of the top frame 14, so that the elastic deformation, which occurs as the rib 14*j* is pressed upon the blade supporting member 13*a*1, can be used to press the upper surface of the blade supporting member 13*a*1. By this arrangement, the rib 14*j* is pressed upon the upper surface of the blade supporting member 13*a*1 by the elastic deformation of the top frame 14, and by this pressure, the vibration of the cleaning blade 13 can be suppressed, whereby the noise from the vibration is reduced.

Further, the same effects as that of the preceding embodiment can be obtained by providing a partitioning wall 36, which is slightly taller than the gap between the bottom portion of the waste toner storage 13*c* and the upper portion of the blade supporting member 13*a*1, within the waste toner storage 13*c* of the bottom frame 15, at the center portion in the longitudinal direction of the cartridge. In this case, the strength of the bottom frame 15 is also improved by the provision of this partitioning wall 36.

By implementing one or more of these embodiments described hereinbefore, the micro-vibration with a frequency of several tens of Hz or more, generated by the friction force between the photosensitive drum 9 and cleaning blade 13*a* can be suppressed, wherein after the implementation of the embodiment, the amplitudes of vibrations of both photosensitive drum 9 and cleaning blade 13*a* drop to 0.01 μm or below, which are within the measurement error, whereby the noise generated by the vibration is eliminated, and images of good quality are produced, whereas before the implementation of the embodiment, they are approximately 4 μm–5 μm, respectively.

As regards a method for cleaning the residual toner on the photosensitive drum 9, the cleaning means may be constituted by a blade, a fur brush, a magnetic brush, or the like.

(Top and Bottom Frames)

In the first embodiment, the driving portion on the development side of the bottom frame 15 is molded substantially in a box shape, and in addition, ribs are provided for increasing the local strength of the frame. The same method can be applied to increase other portions of the top and bottom frames.

(Shutter Mechanism)

In the first embodiment, the shutter mechanism 24 is designed to be automatically opened as he process cartridge B is installed, and to be automatically closed by the torsional coil spring as the cartridge B is pulled out. Therefore, when the process cartridge B is in the image forming apparatus, the shutter mechanism 24 is pressured in the closing direction by the spring 24, whereby the process cartridge B is pressured in the direction in which the process cartridge B is to be lifted out of the cartridge installation space 2 of the apparatus main assembly, which is one of the advantages of such a design. However, when the pressure from the torsional spring 24 is too strong, the process cartridge B becomes positionally unstable. Therefore, a locking mechanism may be provided for locking the shutter mechanism 24 when the shutter mechanism 24 is opened.

Figure 84:
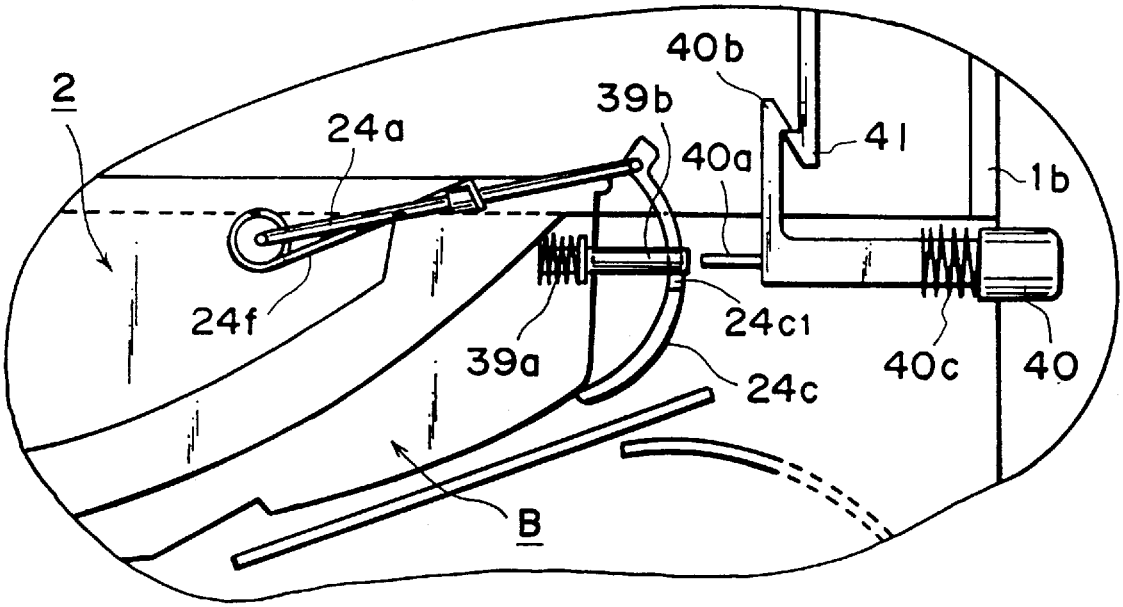
FIG. 84 depicts an alternative embodiment comprising a locking mechanism for locking the shutter mechanism in the open state.

As for the locking mechanism, referring to FIG. 84, a lever 39*b* pressured by a compression spring 39*a* is provided at a predetermined location of the process cartridge B, wherein this lever engages an engagement hole 24*c*2 provided on the shutter portion 24*c* when the shutter mechanism opens all the way. By this arrangement, the shutter mechanism 24 is locked in the open state; therefore, the pressure from the torsional spring 24*f* is prevented from working to lift the process cartridge B.

The locked shutter mechanism is released by an eject button 40 shown in FIG. 84. More specifically, the apparatus main assembly is provided with the eject button 40, which is pressured by a compression spring 40*c* in the direction to stick out of the apparatus main assembly. As this ejection button 40 is pressed, a pressing projection 40*a* located at the end of the button pushes in the lever 39*b*, whereby the lever 39*b* is disengaged from the engagement hole 24*c*2, thereby releasing the shutter mechanism from the locked state.

The eject button 40 is provided with an engagement claw 40*b*. When the top lid 1*b* is closed, this engagement claw 40*b* engages with the engagement hook 41 provided on the top lid 1*b*, thereby locking the top lid 1*b* in the closed state. On the other side, when the eject button 40 is pressed, the engagement is broken and the top lid 1*b* is opened by the pressure from the torsion coil spring provided at the rotational center of the top lid 1*b*. In other words, as the ejection button 40 is pressed, the top lid 1*b* is automatically opened, and at the same time, the process cartridge B is lifted, as if floating out of the cartridge installation space 2, by the pressure from the spring 24*f*, which makes it easier to take out the process cartridge B.

Referring to FIGS. 85–89, the pressure which is provided by the drum shutter in the first embodiment can be provided by an alternative structure, which is totally different from that in the first embodiment. Hereinafter, the structure of the alternative structure shown in FIGS. 85–89 will be described.

Figure 85:
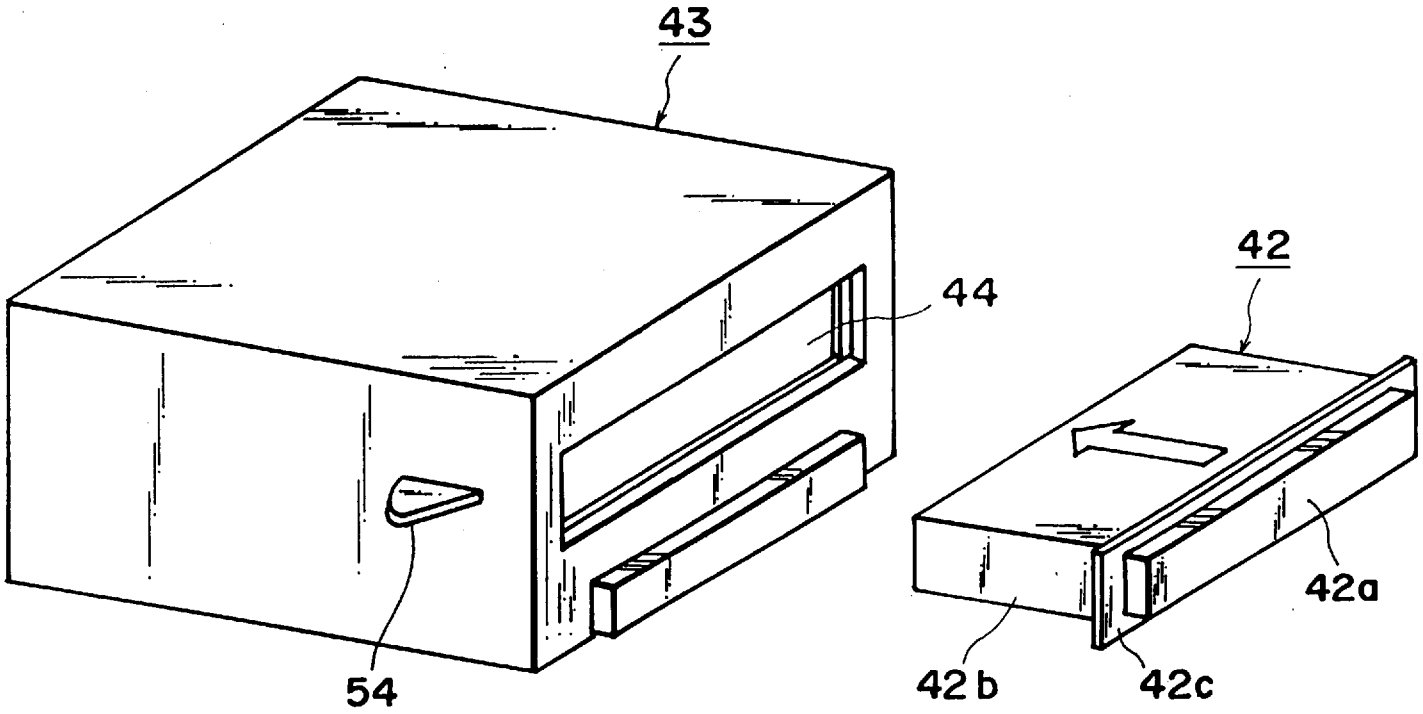
FIG. 85 is an oblique view of an image forming apparatus comprising an alternative embodiment of a pressuring structure based on the shutter mechanism, and a process cartridge for such an apparatus.
Figure 86:
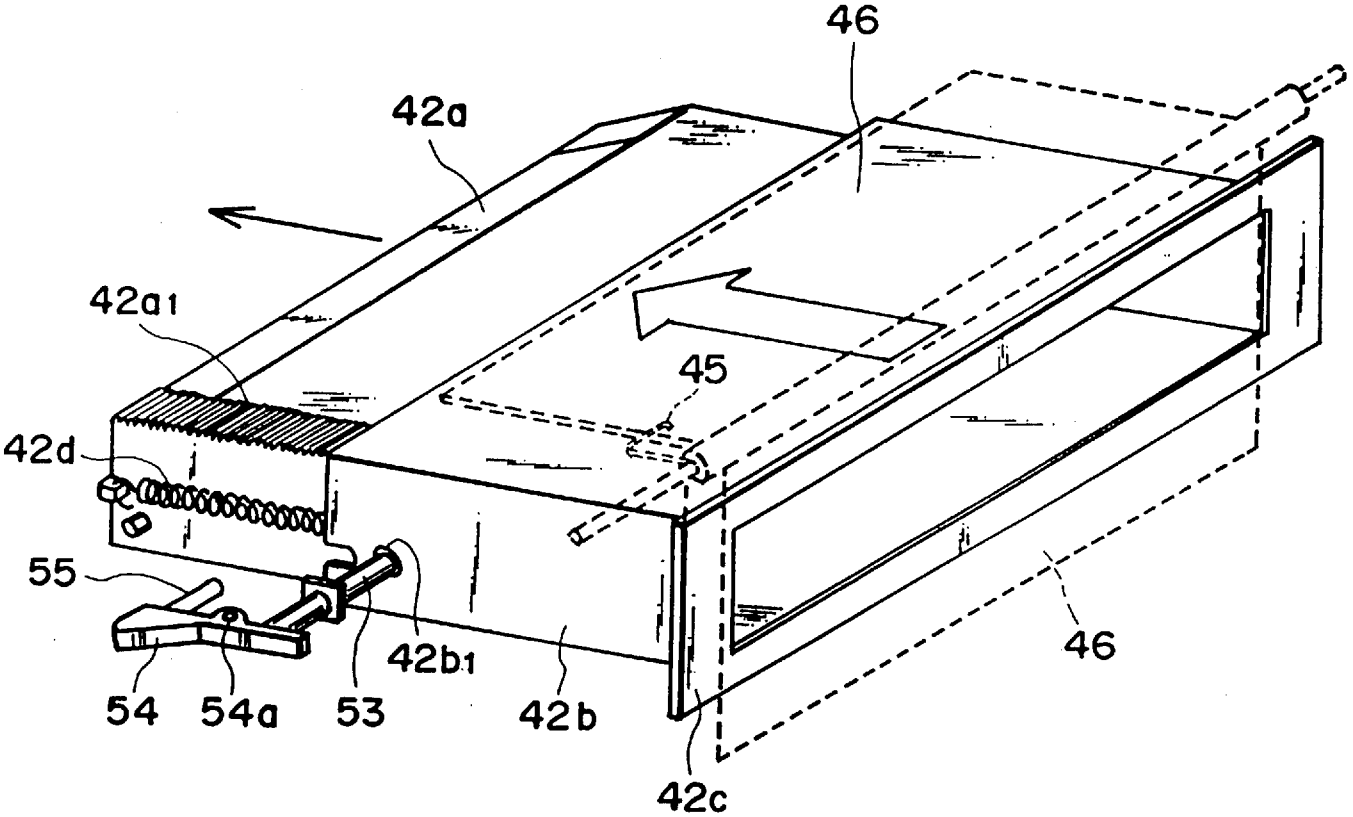
FIG. 86 is an oblique view of an image forming apparatus comprising an alternative embodiment of a pressuring structure based on the shutter mechanism, and a process cartridge for such an apparatus.

In this embodiment, a process cartridge 42 shown in FIG. 85 is installed in the image forming apparatus 43 by inserting it through an inserting window 44 provided in front of the apparatus. The process cartridge 42 and image forming apparatus 43 have the same functions as those of the first embodiment, and the process cartridge 42 comprises a cartridge main assembly 42*a* and a case 42*b* which functions as the shutter mechanism.

The cartridge inserting window 44 is blocked with a thin plate 46 imparted with the pressure from a spring 45 in the closing direction, and this thin plate 46 is pushed open by the process cartridge 42 to be inserted. The process cartridge 42 is inserted until its flange portion 42*c* becomes substantially level with the front surface of the image forming apparatus main assembly. As the cartridge main assembly 42*a* is pushed in further, the case 42*b* remains where it is. As a result, a forward portion of the cartridge main assembly 42*a* is projected out of the process cartridge 42. Then, the projected cartridge main assembly 42*a* is detected by an unshown sensor, and a gear 47 engaged with an unshown motor begins to rotate.

The gear 47 engages with a rack 42*a*1 provided on the top surface of the cartridge main assembly 42*a*, and the cartridge main assembly 42*a* is pulled out further from the case 42*b* by the rotation of the gear 47. At this time, an axle 48 that is the extension of the axle of the photosensitive drum contained in this cartridge main assembly engages a guide groove 49 provided within the image forming apparatus 43, being thereby guided forward by this guide groove 49.

Figure 88A:
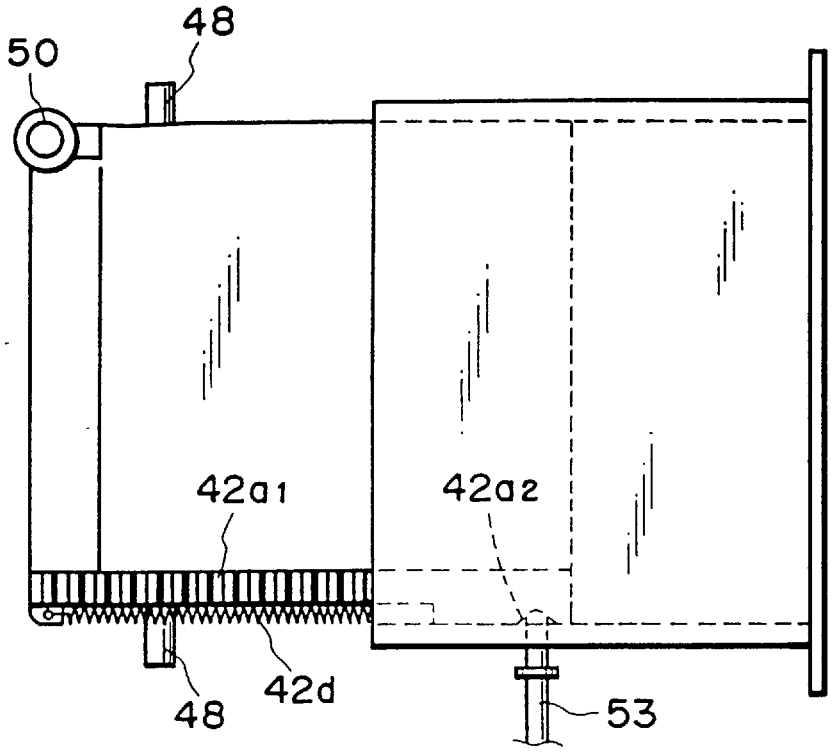
FIGS. 88(*a*) and 88(*b*) are a plan view and a side view of the alternative embodiment of the pressuring structure based on the shutter mechanism, depicting the stage at which the cartridge mains assembly has been pulled out of the case.
Figure 88B:
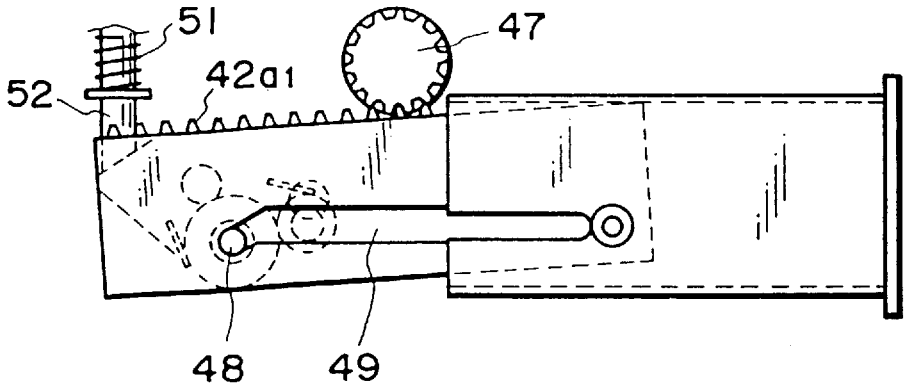

Referring to FIG. 88, a contact 50 for making an electrical contact is provided at the rear (left side in FIG. 88) of the cartridge main assembly 42*a*. As the cartridge main assembly 42*a* is further pulled out, the contact 50 comes in contact with a contact pin 52 which is provided on the image forming apparatus 43 side and is under downward pressure from a spring 51. At this time, the cartridge main assembly 42*a* is subjected to the downward pressure from the contact pin 52, and as a result, the rear portion of the cartridge main assembly 42*a* slightly drops down along the guide groove 49.

Also, as the process cartridge 42 is inserted, a shaft 53 provided on the image forming apparatus 43 side is projected into a hole 24*b*1 of the case 42*b*. This shaft 53 is pressured by a compression spring 55, by way of a lever 54, in the direction to be projected into the hole 42*b*1, wherein the lever 54 is exposed outward from the image forming apparatus 43. When the cartridge main assembly 42*a* is further pulled out to a predetermined point, the shaft 53 drops into a concave 42*a*2 provided on the side surface of the cartridge main assembly 42*a*, whereby the cartridge main assembly 42*a* is locked at this location against the pressure of a tension spring 42*d* working to pull the cartridge main assembly 42*a* back into the case 42*b*. In other words, in this locked state, the force of the tension spring 42*d* is prevented from working to move the cartridge main assembly 42*a* out of the normal position; therefore, the process cartridge 42 is positionally stabilized in the image forming apparatus.

Figure 89:
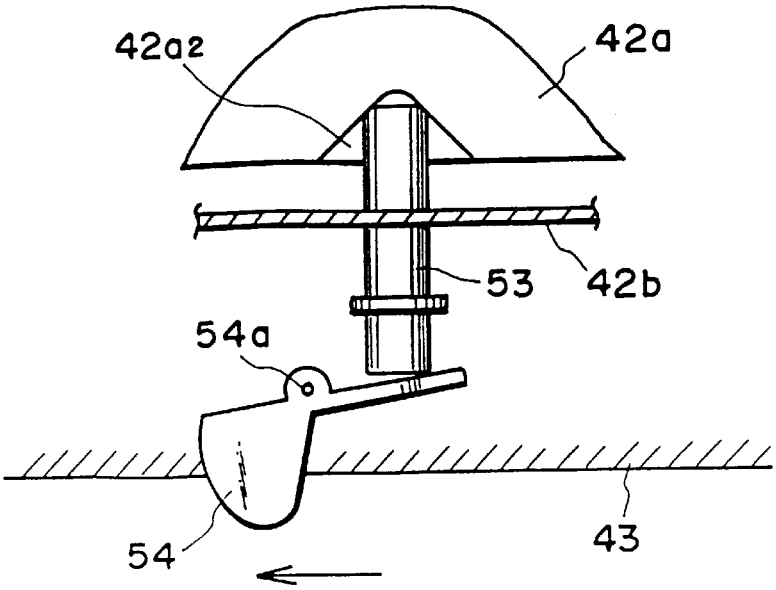
FIG. 89 is a plan view of a locking lever mechanism of the alternative embodiment of the pressuring structure based on the shutter mechanism.

The lever 54 is pivotable about an axis 54*a*, and when a force is exerted in the direction of an arrow in FIG. 89, the shaft 53 is pushed out of the concave 42*a*2 by the pressure from the tension spring 42*d*, and the cartridge main assembly 42*a* is pulled back into the case 42*b*. During this pull-back, since the gear 47 and rack 42*a*1 remain engaged, the gear 47 serves as a damper to prevent the cartridge main assembly 42*a* from being snappingly pulled back into the case 42*b*.

Figure 87A:
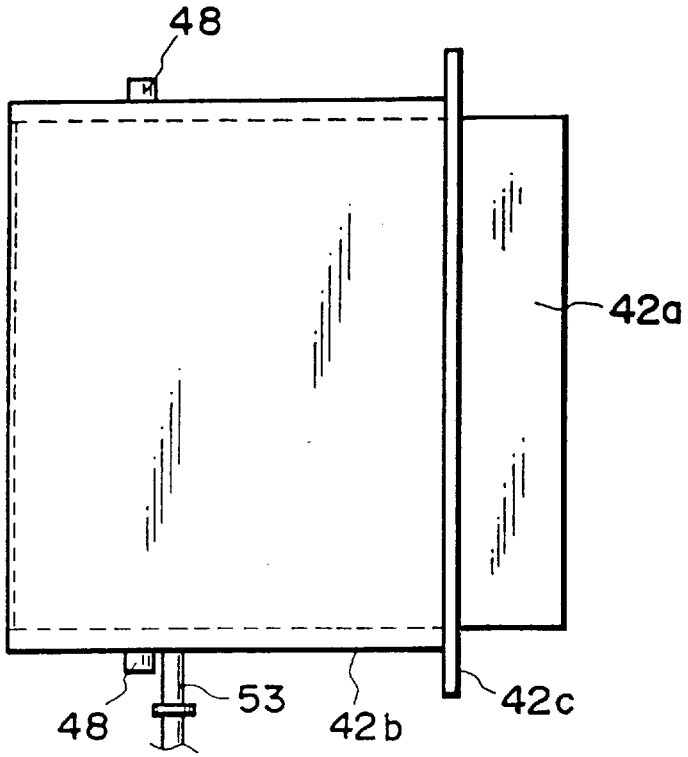
FIGS. 87(*a*) and 87(*b*) are a plan view and a side view of the alternative embodiment of the pressuring structure based on the shutter mechanism, depicting the initial stage of the cartridge installation into the image forming apparatus, respectively.
Figure 87B:
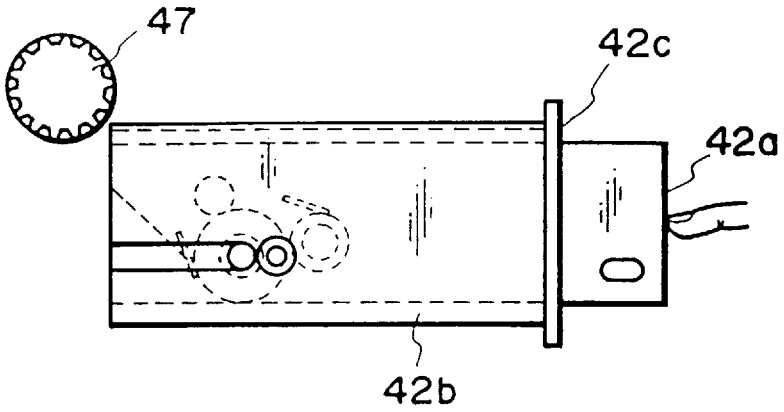

After the cartridge main assembly 42*a* has been pulled back into the case 42*b*, the cartridge main assembly 42*a* protrudes a predetermined amount from the image forming apparatus 43 as shown in FIGS. 87(*a*) and 87(*b*), making it easy to pull it out.

As described in the foregoing, the provision of the tension spring 42*d* with an adequate force for pulling back the cartridge main assembly 42*a* into the case 42*b*, as well as the provision of the locking mechanism, make it extremely easy to take out the cartridge 42.

Figure 90A:
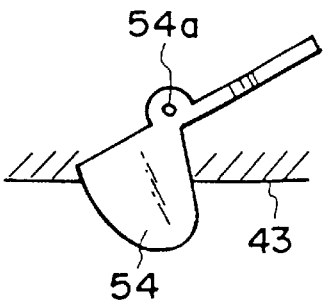
FIGS. 90(*a*), 90(*b*) and 90(*c*) depict positions of the locking lever in the alternative embodiment of the pressuring structure based on the shutter mechanism.
Figure 90B:
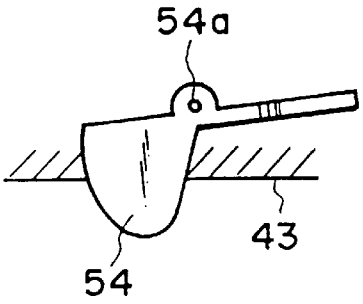
Figure 90C:
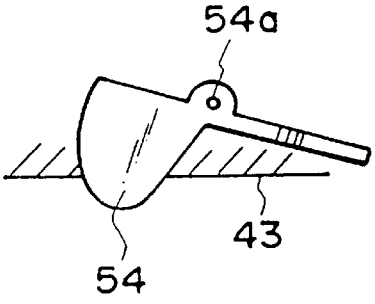

Further, with this arrangement in place, the installation related status of the cartridge 43 can be monitored by observing the condition of the lever 54. More specifically, referring to FIG. 90, when the process cartridge 42 is not in the image forming apparatus 43, the lever 54 looks as shown in FIG. 90(*a*); when the process cartridge 42 has been properly installed and the shaft 53 has dropped into the concavity 42*a*2, it looks as shown in FIG. 90(*b*); and when the cartridge 42 has been improperly installed in the image forming apparatus 43, it looks as shown in FIG. 90(*c*). Therefore, the installation related status of the cartridge can be determined just by observing externally the position of the lever 54.

{Process Cartridge Structure and Assembly Process}

<Seal at End of Cleaning Blade>

Figure 50:
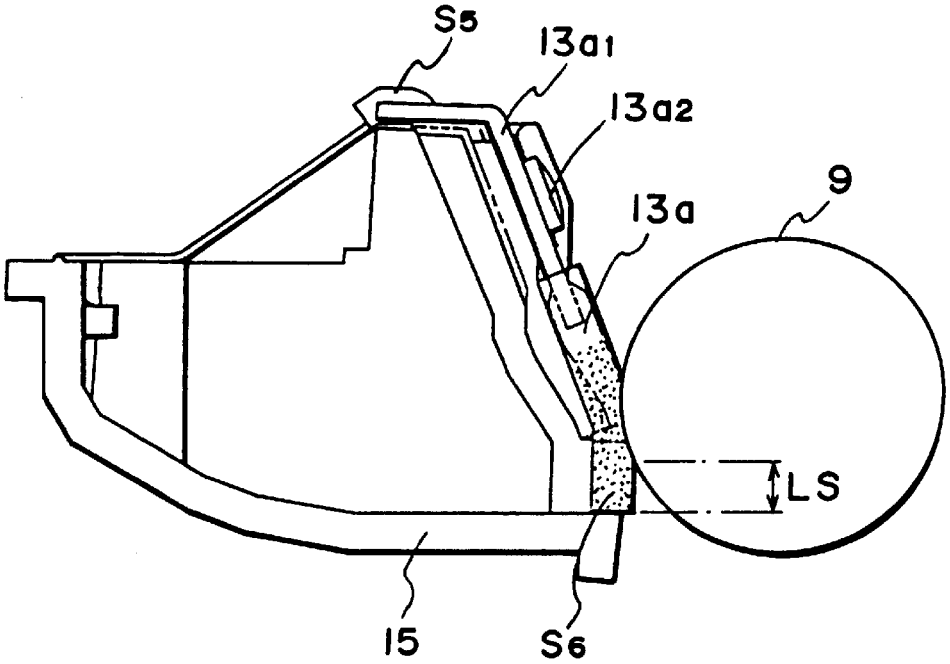
FIG. 50 depicts the relationship between the seal member disposed at the end portions of the cleaning blade, and the photosensitive drum.

In the first embodiment, as a means for educing the frictional force between the end portion of the photosensitive drum 9 and the seal member S6 pasted on the bottom portion of the blade attachment surface 15*j*, which corresponds to the end portion of the cleaning blade 13*a*, the high density polyethylene seal 37 is pasted on the seal member S6, as shown in FIG. 49, or lubricant 38, such as microparticle of silicon, is coated on the seal member S6 as shown in FIG. 50, but the present invention is not limited by this example. Powder material, such as polyfluorovinylidene particles, or the like, may be used as the lubricant 38.

As for a method for adhering the powder lubricant 38 onto the seal member S6, the lubricant 38 may be just sprinkled on the seal member S6 when the frictional force between the seal member S6 and the end portion of the photosensitive drum 9 is not relatively large. This is because when the drum 9 is in the early stage of its usage, the surface of the seal member S6 is rough and its friction is large, whereas after a certain period of usage, the roughness of the surface of the seal member S6 is reduced and the friction is also reduced.

Further, the powder lubricant 38 may be dispersed throughout the seal member 38, by such a method that powder lubricant 38 is mixed in volatile liquid; this mixture is soaked into the seal member 37; and then, the liquid is evaporated. This method allows the lubricant 38 having been dispersed throughout the seal member 37 to be exposed little by little at the contact surface between the photosensitive drum 9 and the seal member 37. As a result, the friction between the photosensitive drum 9 and seal member 38 is reduced for a long period of time, whereby the seal member 37 is prevented from being dragged and torn off by the photosensitive drum.

<Method for Installing Photosensitive Drum>

During the description of the first embodiment, one of the methods for installing the photosensitive drum 9 was introduced, in which in order to interpose the lubricant 38 throughout the contact surface between the photosensitive drum 9 and cleaning blade 13 at the beginning of the cartridge assembly process, the photosensitive drum 9 was inserted while being guided in the direction which formed an angle $\gamma$, which was less than 45°, relative to the contact surface of the blade 13*a*. This drum installation method may be adopted also for the recycling assembly process.

It is conceivable that the service lives of the various components used in the process cartridge are different. Let it be assumed that the service life of the photosensitive drum 9 is inferior to that of the cleaning blade 13*a*. In such a case, a spent process cartridge can be recycled by replacing only the cartridge main assembly 42*a*. When the photosensitive drum 9 is removed during the drum replacing operation, the residual developer is still adhering to the contact surface of the blade 13*a*, and this residual developer can serve as the aforementioned lubricant 38. However, generally speaking, when the photosensitive drum 9 is removed, this residual developer is divided between the surface of the photosensitive drum 9 and the contact surface of the blade 13*a*; therefore, the amount of the residual developer adhering to the blade 13*a* is not enough to cover the entire contact surface of the blade 13*a*.

Therefore, the drum installation method according to the present invention may be adopted, whereby, as a fresh photosensitive drum 9 is inserted into the process cartridge B, the residual developer on the blade 13*a* can be distributed to cover the entire contact surface between the blade 13*a* and photosensitive drum 9. In other words, the residual developer can be interposed as the lubricant between two components.

Further, the present invention can be preferably applied not only to a process cartridge for monocolor image formation such as the one described hereinbefore, but also to a process cartridge in which two or more developing means 12 are provided for forming multicolor images (for example, dual-color images, triple-color images, full-color images, or the like).

The process cartridge B described hereinbefore refers to a process cartridge comprising an electrophotographic photosensitive member or the like as the image bearing member and at least one processing means. However, many other cartridge designs are possible beside those of the embodiments described hereinbefore. For example, the process cartridge B is available in the form of an exchangeable process cartridge in which: an image bearing member and a charging means are integrally assembled; an image bearing member and a developing means are integrally assembled; or an image bearing member and a cleaning means are integrally assembled. Further, the process cartridge B is also available in the form of an exchangeable process cartridge in which an image bearing member and two or more processing means are integrally assembled.

In other words, the process cartridge described hereinbefore refers to an exchangeable process cartridge for an image forming apparatus, comprising a charging means, developing means, and cleaning means, which are integrally assembled with an electrophotographic photosensitive member, in the form of a cartridge; comprising at least one of a charging means, developing means, and cleaning means, which are integrally assembled with an electrophotographic photosensitive member, in the form of a cartridge; or comprising at least a developing means, which is integrally assembled with an electrophotographic photosensitive member, in the form of a cartridge.

During the descriptions of the embodiments of the present invention, a laser beam printer is selected as an example of the image forming apparatus, but the present invention does not need to be limited by this choice. It is needless to say that the present invention is applicable to many other image forming apparatuses such as an electrophotographic copying machine, facsimile apparatus, LED printer, word processor, or the like.

As described in the foregoing, according to the foregoing embodiments, the photosensitive drum is provided with both of the helical gear and the spur gear, and the photosensitive drum is contributable to constituting two drive transmission trains. Therefore, the size of the apparatus is reduced, and the number of parts is reduced, thus permitting reduction of the cost. In addition, by press-fitting reinforcing member into a hollowed portion of the root of the teeth of the gear member having the helical gear and the spur gear, a pitch-non-uniformity appearing at every pitch of the gear can be avoided. By using the helical gear having a larger diameter, a larger width and a larger number of teeth than those of the spur gear, the drive transmissions are further assured.

According to the embodiments, a plurality of drive transmission trains can capable of correctly transmitting the driving force, can be constituted, as desired, when the photosensitive drum is mounted to a frame of a process cartridge or a frame of an image forming apparatus, or the like.

As described in the foregoing, according to the present invention, the operativity during the manufacturing can be improved. In addition, the operativity is improved when the photosensitive drum is mounted to a process cartridge or an image forming apparatus Additionally, where the helical gear and spur gear are uniformly molded, sufficient mechanical strength can be provided even if the gear diameter is reduced, and furthermore, the pitch non-uniformity can be avoided beforehand. Therefore, the high image quality is assured.

While the invention has been described with reference to the structures disclosed herein, it is not confined to the details set forth and this application is intended to cover such modifications or changes as may come within the purposes of the improvements or the scope of the following claims.

What is claimed is:

1. A photosensitive drum usable with an electrophotographic image forming apparatus to which a process cartridge, containing said photosensitive drum and a developing roller for developing a latent image formed on said photosensitive drum, is detachably mountable, said photosensitive drum comprising:

a cylindrical member;

a photosensitive material disposed on an outer periphery of said cylindrical member; and a juxtaposed helical gear and spur gear at a longitudinal end of said cylindrical member, wherein said helical gear has a larger diameter than said spur gear, and said helical gear has a larger width than said spur gear, and wherein, when said process cartridge is mounted to a main assembly of the image forming apparatus, said helical gear receives a driving force from the main assembly for rotating said photosensitive drum and transmits the driving force received from the main assembly to the developing roller, and said spur gear transmits the driving force received from the main assembly to a transfer roller provided in the main assembly, wherein the transfer roller transfers a toner image formed on said photosensitive drum onto a recording material.

2. A photosensitive drum according to claim 1, wherein said helical gear has a greater number of teeth than that of said spur gear.

3. A photosensitive drum according to claim 1, wherein said helical gear has a larger width than said spur gear.

4. A photosensitive drum according to claim 1, wherein said helical gear has a larger diameter than said spur gear, and is disposed outside of said spur gear in a longitudinal direction of said photosensitive drum.

5. A photosensitive drum according to any one of claims 1 and 2–4, wherein said helical gear and said spur gear are integrally molded.

6. A photosensitive drum according to claim 5, wherein said helical gear and said spur gear are integrally molded through injection molding.

7. A photosensitive drum according to claim 1, wherein said helical gear and said spur gear are made of a plastic resin material.

8. A photosensitive drum according to claim 7, wherein the plastic resin material is polyacetal resin material.

9. A photosensitive drum according to claim 1, wherein said helical gear is meshable with a driving gear of the image forming apparatus and receives a driving force for rotating said photosensitive drum.

10. A photosensitive drum according to claim 9, wherein said helical gear is engageable with a developing sleeve gear and transmits a driving force for rotating a developing sleeve.

11. A photosensitive drum according to claim 1, wherein said spur gear is meshable with a gear of the image forming apparatus and transmits the driving force to rotate the transfer roller.

12. A photosensitive drum according to claim 1, wherein said cylindrical member is made of aluminum.

13. A photosensitive drum according to claim 1, wherein said photosensitive material constitutes an organic photosensitive member.

14. A photosensitive drum according to claim 1, wherein a toner image is formed on a surface of said photosensitive material.

15. A photosensitive drum according to claim 1, wherein said helical gear has a diameter of approx. 28.9 mm and said spur gear has a diameter of approx. 26.1 mm.

16. A photosensitive drum according to claim 1, wherein a number of teeth of said helical gear is 33, and a number of teeth of said spur gear is 30.

17. A photosensitive drum according to claim 1, wherein said helical gear has a width of approx. 7.7 mm, and said spur gear has a width of approx. 4.3 mm.

18. A photosensitive drum according to claim 1, wherein said cylindrical member has an outer diameter of approx. 24 mm.

19. A photosensitive drum according to claim 1, wherein said cylindrical member has a thickness of approx. 0.8 mm, and is made of cylindrical aluminum.

20. A photosensitive drum according to claim 1, wherein said helical gear and said spur gear are integrally molded, and a reinforcing member is press-fitted into a hollowed portion of a gear portion of said helical gear and said spur gear.

21. A process cartridge detachably mountable relative to an electrophotographic image forming apparatus, said process cartridge comprising:

a photosensitive drum including a cylindrical member and a photosensitive material disposed on an outer periphery of said cylindrical member;

a juxtaposed helical gear and spur gear at a longitudinal end of said cylindrical member; and a developing roller for developing a latent image formed on said photosensitive drum, wherein said helical gear has a larger diameter than said spur gear, and said helical gear has a larger width than said spur gear, and wherein, when said process cartridge is mounted to a main assembly of the image forming apparatus, said helical gear receives a driving force from the main assembly for rotating said photosensitive drum and transmits the driving force received from the main assembly to the developing roller, and said spur gear transmits the driving force received from the main assembly to a transfer roller provided in the main assembly, wherein the transfer roller transfers a toner image formed on said photosensitive drum onto a recording material.

22. A process cartridge according to claim 21, further comprising a frame for supporting said photosensitive drum and said developing roller.

23. A process cartridge according to claim 22, wherein said frame comprises a cover for protecting said photosensitive drum, said cover being opened and closed upon mounting and demounting respectively relative to the image forming apparatus.

24. A process cartridge according to claim 21, wherein said helical gear is meshable with a driving gear of the image forming apparatus to receive the driving force for rotating said photosensitive drum.

25. A process cartridge according to claim 21, wherein said helical gear is engageable with a developing sleeve gear and transmits a driving force for rotating a developing sleeve.

26. A process cartridge according to claim 21, wherein said spur gear is meshable with a gear of the image forming apparatus and transmits the driving force to rotate the transfer roller.

27. A process cartridge according to claim 21, wherein said helical gear and said spur gear are partly exposed out of a frame of said process cartridge.

28. A process cartridge according to claim 27, wherein said helical gear and said spur gear are exposed out at portions engageable with gears of the image forming apparatus.

29. A process cartridge according to claim 21, wherein said process cartridge integrally contains charging means, developing means or cleaning means, as a process means, and an electrophotographic photosensitive member, and wherein said process cartridge is detachably mountable relative to the image forming apparatus.

30. A process cartridge according to claim 21, wherein said process cartridge integrally comprises at least one of charging means, developing means and cleaning means as a process means, and an electrophotographic photosensitive member, and wherein the process cartridge is detachably mountable relative to said image forming apparatus.

31. A process cartridge according to claim 21, wherein said process cartridge integrally comprises at least developing means and an electrophotographic photosensitive member, and said process cartridge is detachably mountable relative to the image forming apparatus.

32. A process cartridge according to claim 21, wherein said helical gear has a greater number of teeth than that of said spur gear.

33. A process cartridge according to claim 21, wherein said helical gear is disposed outside of said spur gear in a longitudinal direction of said photosensitive drum.

34. A process cartridge according to claim 21, wherein said helical gear and said spur gear are integrally molded.

35. A process cartridge according to claim 34, wherein said helical gear and said spur gear are integrally molded through injection molding.

36. A process cartridge according to claim 21, wherein said helical gear and said spur gear are made of a plastic resin material.

37. A process cartridge according to claim 36, wherein the plastic resin material is polyacetal resin material.

38. A process cartridge according to claim 21, wherein said helical gear is meshable with a driving gear of the image forming apparatus and receives the driving force for rotating said photosensitive drum.

39. A process cartridge according to claim 21, wherein said helical gear is engageable with a developing sleeve gear and transmits a driving force for rotating a developing sleeve.

40. A process cartridge according to claim 21, wherein said spur gear is meshable with a gear of the image forming apparatus and transmits the driving force to rotate the transfer roller.

41. A process cartridge according to claim 21, wherein said cylindrical member is made of aluminum.

42. An electrophotographic image forming apparatus for forming an image on a recording material, to which a process cartridge is detachably mountable, said apparatus comprising:

mounting means for mounting the process cartridge which contains a photosensitive drum having a cylindrical member, a photosensitive material disposed on an outer periphery of the cylindrical member, a developing roller, and a juxtaposed driven helical gear and spur gear at a longitudinal end of the cylindrical member, wherein the driven helical gear has a larger diameter than the spur sear, and the driven helical gear has a larger width than the spur rear, and wherein, when the process cartridge is mounted to a main assembly of said image forming apparatus, the driven helical rear receives a driving force from said main assembly for rotating the photosensitive drum and transmits the driving force received from said main assembly to the developing roller, and the spur gear transmits the driving force received from said main assembly to a transfer roller provided in said main assembly, wherein said transfer roller transfers a toner image formed on the photosensitive drum onto a recording material; and a helical gear meshable with the driven helical gear of the process cartridge to transmit a driving force for rotating the photosensitive drum when the process cartridge is mounted to said mounting means.

43. An apparatus according to claim 42, wherein the driven helical gear and the spur gear are partly exposed out of a frame of the process cartridge.

44. An apparatus according to claim 43, wherein the driven helical gear and the spur gear are exposed out at portions engageable with gears of said image forming apparatus.

45. An apparatus according to claim 42, wherein said apparatus is an electrophotographic copying machine.

46. An apparatus according to claim 42, wherein said apparatus is a laser beam printer.

47. An apparatus according to claim 42, wherein said apparatus is a facsimile machine.

48. A manufacturing method for a photosensitive drum usable with an electrophotographic image forming apparatus to which a process cartridge having the photosensitive drum and a developing roller is removably mountable, said method comprising the steps of:

preparing a cylindrical member having a photosensitive material disposed on an outer periphery thereof;

preparing an integrally molded helical gear and spur gear; and coupling the integrally molded helical gear and spur gear to a longitudinal end of the cylindrical member, wherein the helical gear has a larger diameter than the spur gear, and the helical gear has a larger width than the spur gear, and wherein, when the process cartridge is mounted to a main assembly of the image forming apparatus, the helical gear receives a driving force from the main assembly for rotating the photosensitive drum and transmits the driving force received from the main assembly to the developing roller, and the spur gear transmits the driving force received from the main assembly to a transfer roller provided in the main assembly, wherein the transfer roller transfers a toner image formed on the photosensitive drum onto a recording material.

49. A method according to claim 48, wherein said integrally molded helical gear and spur gear are crimped to a longitudinal end of the cylindrical member.

50. A method according to claim 48, wherein a hollowed portion of said integrally molded helical gear and spur gear, is filled with a reinforcing material.

51. A photosensitive drum usable with an electrophotographic image forming apparatus to which a process cartridge, containing said photosensitive drum and a developing roller for developing a latent image formed on said photosensitive drum is detachably mountable, said photosensitive drum comprising:

a cylindrical member;

a photosensitive material disposed on an outer periphery of said cylindrical member; and a juxtaposed helical gear and spur gear disposed at a longitudinal end of said cylindrical member, wherein said helical gear has a larger diameter than that of said spur gear, wherein said helical gear has a greater number of teeth than that of said spur gear, wherein said helical gear has a larger width than that of said spur gear, wherein said helical gear is disposed outside of said spur gear in a longitudinal direction of said photosensitive drum, wherein said helical gear and said spur gear are integrally molded, and wherein, when said process cartridge is mounted to a main assembly of the image forming apparatus, said helical gear receives a driving force from the main assembly for rotating said photosensitive drum and transmits the driving force received from the main assembly to the developing roller, and said spur gear transmits the driving force received from the main assembly to a transfer roller provided in the main assembly, wherein the transfer roller transfers a toner image formed on said photosensitive drum onto a recording material.

52. A photosensitive drum according to claim 51, wherein said helical gear and said spur gear are integrally molded through injection molding.

53. A photosensitive drum according to claim 51, wherein said helical gear and said spur gear are made of a plastic resin material.

54. A photosensitive drum according to claim 53, wherein the plastic resin material is polyacetal resin material.

55. A photosensitive drum according to claim 51, wherein said helical gear is meshable with a driving gear of the image forming apparatus and receives a driving force for rotating said photosensitive drum.

56. A photosensitive drum according to claim 55, wherein said helical gear is engageable with a developing sleeve gear and transmits a driving force for rotating a developing sleeve.

57. A photosensitive drum according to claim 51, wherein said spur gear is meshable with a gear of the image forming apparatus and transmits the driving force to rotate the transfer roller.

58. A photosensitive drum according to claim 51, wherein said cylindrical member is made of aluminum.

59. A photosensitive drum according to claim 51, wherein said photosensitive material constitutes an organic photosensitive member.

60. A photosensitive drum according to claim 51, wherein a toner image is formed on a surface of said photosensitive material.

61. A photosensitive drum according to claim 51, wherein said helical gear has a diameter of approximately 28.9 mm and said spur gear has a diameter of approximately 26.1 mm.

62. A photosensitive drum according to claim 51, wherein the number of teeth of said helical gear is 33, and the number of teeth of said spur gear is 30.

63. A photosensitive drum according to claim 51, wherein said helical gear has a width of approximately 7.7 mm, and said spur gear has a width of approximately 4.3 mm.

64. A photosensitive drum according to claim 51, wherein said cylindrical member has an outer diameter of approximately 24 mm.

65. A photosensitive drum according to claim 51, wherein said cylindrical member has a thickness of approximately 0.8 mm, and is made of cylindrical aluminum.

66. A photosensitive drum according to claim 51, wherein a reinforcing member is press-fitted into a hollowed portion of a gear portion of said helical gear and said spur gear.

67. A process cartridge detachably mountable relative to an electrophotographic image forming apparatus, said process cartridge comprising:

a photosensitive drum including a cylindrical member and a photosensitive material disposed on a periphery of said cylindrical member;

a charging roller for charging said photosensitive drum;

a developing roller for developing a latent image formed on said photosensitive drum;

a cleaning blade for removing toner remaining on said photosensitive drum; and a juxtaposed helical gear and spur gear disposed at a longitudinal end of said cylindrical member, wherein said helical gear has a larger diameter than that of said spur gear, wherein said helical gear has a greater number of teeth than that of said spur gear, wherein said helical gear has a larger width than that of said spur gear, wherein said helical gear is disposed outside of said spur gear in a longitudinal direction of said photosensitive drum, and wherein said helical gear and said spur gear are integrally molded, wherein, when said process cartridge is mounted to a main assembly of the image forming apparatus, said helical gear receives a driving force from the main assembly for rotating said photosensitive drum and transmits the driving force received from the main assembly to said developing roller, and said spur gear transmits the driving force received from the main assembly to a transfer roller provided in the main assembly, wherein the transfer roller transfers a toner image formed on said photosensitive drum onto a recording material.

68. A process cartridge according to claim 67, wherein said helical gear and said spur gear are integrally molded through injection molding.

69. A process cartridge according to claim 67, wherein said helical gear and said spur gear are made of a plastic resin material.

70. A process cartridge according to claim 69, wherein the plastic resin material is polyacetal resin material.

71. A process cartridge according to claim 67, wherein said helical gear is meshable with a driving gear of the image forming apparatus and receives the driving force for rotating said photosensitive drum.

72. A process cartridge according to claim 71, wherein said helical gear is engageable with a developing sleeve gear and transmits a driving force for rotating a developing sleeve.

73. A process cartridge according to claim 67, wherein said spur gear is meshable with a gear of the image forming apparatus and transmits the driving force to rotate the transfer roller.

74. A process cartridge according to claim 67, wherein said cylindrical member is made of aluminum.

75. A process cartridge according to claim 67, wherein said photosensitive material constitutes an organic photosensitive member.

76. A process cartridge according to claim 67, wherein a toner image is formed on a surface of said photosensitive material.

77. A process cartridge according to claim 67, wherein said helical gear has a diameter of approximately 28.9 mm and said spur gear has a diameter of approximately 26.1 mm.

78. A process cartridge according to claim 67, wherein the number of teeth of the helical gear is 33, and the number of teeth of said spur gear is 30.

79. A process cartridge according to claim 67, wherein said helical gear has a width of approximately 7.7 mm, and said spur gear has a width of approximately 4.3 mm.

80. A process cartridge according to claim 67, wherein said cylindrical member has an outer diameter of approximately 24 mm.

81. A process cartridge according to claim 67, wherein said cylindrical member has a thickness of approximately 0.8 mm, and is of cylindrical aluminum.

82. A process cartridge according to claim 67, wherein a reinforcing member is press-fitted into a hollowed portion of a gear portion of said helical gear and said spur gear.

83. An image forming apparatus for forming an image on a recording material, to which a process cartridge is detachably mountable, said apparatus comprising:

mounting means for mounting a process cartridge having a photosensitive drum including a cylindrical member and a photosensitive material disposed on a periphery of the cylindrical member; a charging roller for charging the photosensitive drum; a developing roller for developing a latent image formed on the photosensitive drum; a cleaning blade for removing toner remaining on the photosensitive drum; and a juxtaposed helical gear and spur gear at a longitudinal end of the cylindrical member, wherein the helical gear has a larger diameter than that of the spur gear, wherein the helical gear has a greater number of teeth than that of the spur gear, wherein the helical gear has a larger width than that of the spur gear, wherein the helical gear is disposed outside of the spur gear in a longitudinal direction of the photosensitive drum, and wherein the helical gear and the spur gear are integrally molded; wherein, when the process cartridge is mounted to a main assembly of said image forming apparatus, the helical gear receives a driving force from said main assembly for rotating the photosensitive drum and transmits the driving force received from said main assembly to the developing roller, and the spur gear transmits the driving force received from said main assembly to a transfer roller provided in said main assembly, wherein the transfer roller transfers a toner image formed on the photosensitive drum onto the recording material; and convey means for conveying the recording material.

84. An image forming apparatus according to claim 83, wherein the helical gear and the spur gear are integrally molded through injection molding.

85. An image forming apparatus according to claim 83, wherein the helical gear and the spur gear are made of a plastic resin material.

86. An image forming apparatus according to claim 85, wherein the plastic resin material is polyacetal resin material.

87. An image forming apparatus according to claim 83, wherein the helical gear is meshable with the driving gear of said image forming apparatus and receives a driving force for rotating the photosensitive drum.

88. An image forming apparatus according to claim 87, wherein the helical gear is engageable with a developing sleeve gear and transmits a driving force for rotating a developing sleeve.

89. An image forming apparatus according to claim 83, wherein the spur gear is meshable with a gear of said image forming apparatus and transmits the driving force to rotate the transfer roller.

90. An image forming apparatus according to claim 83, wherein the cylindrical member is made of aluminum.

91. An image forming apparatus according to claim 83, wherein the photosensitive material constitutes an organic photosensitive member.

92. An image forming apparatus according to claim 83, wherein a toner image is formed on a surface of the photosensitive material.

93. An image forming apparatus according to claim 83, wherein the helical gear has a diameter of approximately 28.9 mm and the spur gear has a diameter of approximately 26.1 mm.

94. An image forming apparatus according to claim 83, wherein the number of teeth of the helical gear is 33, and the number of teeth of the spur gear is 30.

95. An image forming apparatus according to claim 83, wherein the helical gear has a width of approximately 7.7 mm, and the spur gear has a width of approximately 4.3 mm.

96. An image forming apparatus according to claim 83, wherein the cylindrical member has an outer diameter of approximately 24 mm.

97. An image forming apparatus according to claim 83, wherein the cylindrical member has a thickness of approximately 0.8 mm, and is made of cylindrical aluminum.

98. An image forming apparatus according to claim 83, wherein a reinforcing member is press-fitted into a hollowed portion of a gear portion of the helical gear and the spur gear.

99. An image forming apparatus comprising:

a main assembly;

a driving gear disposed in said main assembly;

a transfer roller disposed in said main assembly;

a process cartridge mounting structure disposed in said main assembly to which a process cartridge is removably mountable, the process cartridge having a photosensitive drum including a cylindrical member and a photosensitive material disposed on a periphery of the cylindrical member; a charging roller disposed so as to contact the photosensitive drum; a developing roller disposed adjacent to the photosensitive drum; a cleaning blade disposed adjacent to the photosensitive drum; and a juxtaposed helical gear and spur gear disposed at a longitudinal end of the cylindrical member, wherein the helical gear has a larger diameter than that of the spur gear, the helical gear has a greater number of teeth than that of the spur gear, the helical gear has a larger width than that of the spur gear, the helical gear is disposed outside of the spur gear in a longitudinal direction of the photosensitive drum, and the helical gear and the spur gear are integrally molded; wherein, when the process cartridge is mounted to said process cartridge mounting structure, the helical gear receives a driving force from said driving gear and rotates the photosensitive drum and transmits the driving force received from said driving gear to the developing roller, and the spur gear transmits the driving force to said transfer roller, wherein said transfer roller transfers a toner image formed on the photosensitive drum onto a recording material; and a recording material conveying device disposed in said main assembly.

100. An image forming apparatus according to claim 99, wherein the helical gear and the spur gear are integrally molded through injection molding.

101. An image forming apparatus according to claim 99, wherein the helical gear and the spur gear are made of a plastic resin material.

102. An image forming apparatus according to claim 101, wherein the plastic resin material is polyacetal resin material.

103. An image forming apparatus according to claim 99, wherein said driving gear is a helical gear and the helical gear of the process cartridge is meshable with said driving gear of said image forming apparatus and receives the driving force for rotating the photosensitive drum.

104. An image forming apparatus according to claim 103, wherein the helical gear is engageable with a developing sleeve gear and transmits a driving force for rotating a developing sleeve.

105. An image forming apparatus according to claim 99, wherein the spur gear is meshable with a gear of said image forming apparatus and transmits the driving force to rotate said transfer roller.

106. An image forming apparatus according to claim 99, wherein the cylindrical member is made of aluminum.

107. An image forming apparatus according to claim 99, wherein the photosensitive material constitutes an organic photosensitive member.

108. An image forming apparatus according to claim 99, wherein a toner image is formed on a surface of the photosensitive material.

109. An image forming apparatus according to claim 99, wherein the helical gear has a diameter of approximately 28.9 mm and the spur gear has a diameter of approximately 26.1 mm.

110. An image forming apparatus according to claim 99, wherein the number of teeth of the helical gear is 33, and the number of teeth of the spur gear is 30.

111. An image forming apparatus according to claim 99, wherein the helical gear has a width of approximately 7.7 mm, and the spur gear has a width of approximately 4.3 mm.

112. An image forming apparatus according to claim 99, wherein the cylindrical member has an outer diameter of approximately 24 mm.

113. An image forming apparatus according to claim 99, wherein the cylindrical member has a thickness of approximately 0.8 mm, and is made of cylindrical aluminum.

114. An image forming apparatus according to claim 99, wherein a reinforcing member is press-fitted into a hollowed portion of a gear portion of the helical gear and the spur gear.

* * * * *

UNITED STATES PATENT AND TRADEMARK OFFICE

CERTIFICATE OF CORRECTION

PATENT NO. : 5,825,472

DATED : October 20, 1998

INVENTOR(S) : RYUJI ARAKI ET AL.

It is certified that error appears in the above-identified patent and that said Letters Patent is hereby corrected as shown below:

Drawing:

SHEET 28

Figure 35:
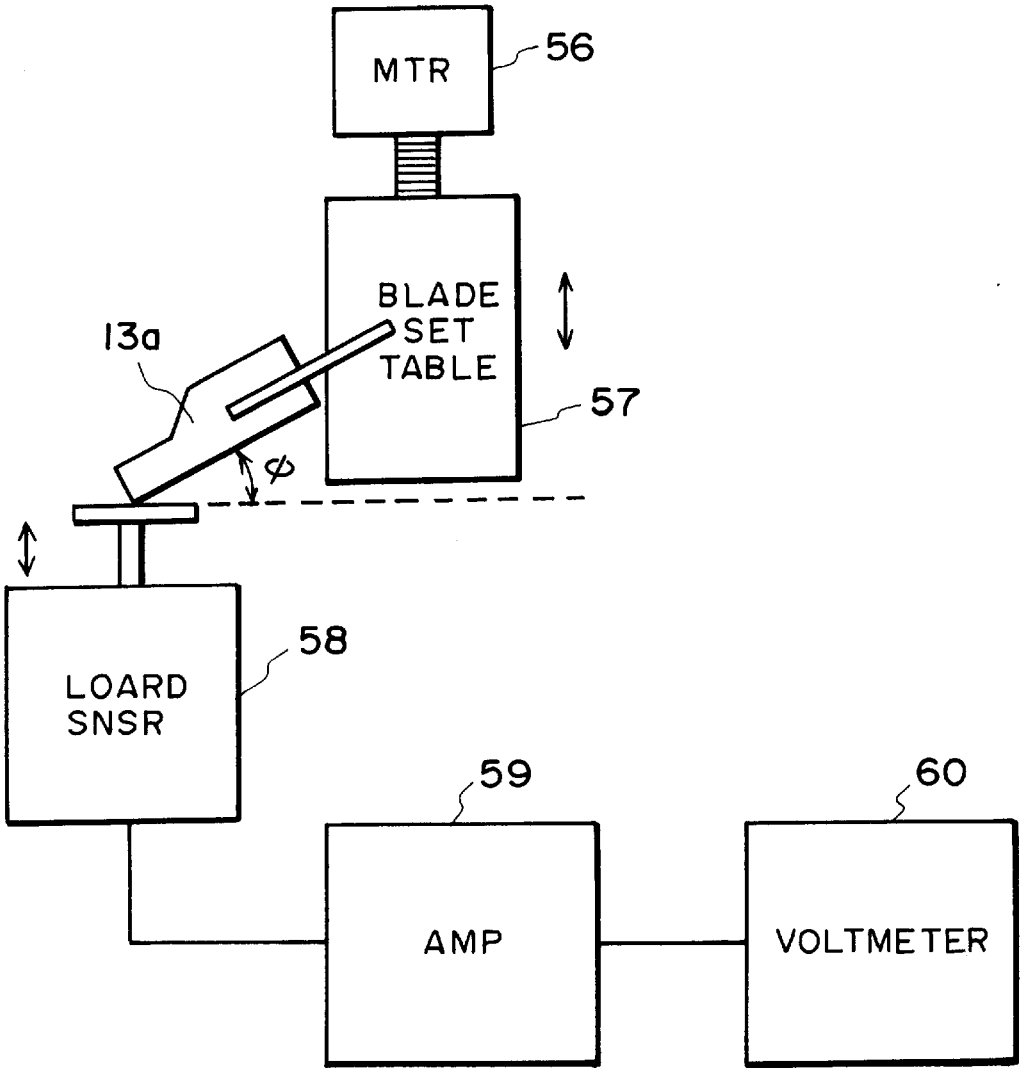
FIG. 35 is a diagrammatic depiction of a method for measuring the blade contact pressure.

Fig. 35, "LOARD" should read --LOAD--.

Title page, item

[56] REFERENCES CITED

Foreign Patent Documents
"4-280266 10/1995 Japan" should read
--4-280266 10/1992 Japan--.

COLUMN 1

Line 44, "No. 5,126,800" should read --No. 5,126,800,--.

COLUMN 2

Line 45, "is" should read --is an--.

COLUMN 3

Line 65, "in last." should be deleted.

COLUMN 5

Line 43, "mains" should read --main--.

UNITED STATES PATENT AND TRADEMARK OFFICE

CERTIFICATE OF CORRECTION

PATENT NO. : 5,825,472

DATED : October 20, 1998

INVENTOR(S) : RYUJI ARAKI ET AL.

It is certified that error appears in the above-identified patent and that said Letters Patent is hereby corrected as shown below:

COLUMN 6

Line 53, "leans 3d" should read --lens 3d--.
Line 59, "a" should read --an--.

COLUMN 8

Line 25, "he" should read --the--.

COLUMN 9

Line 18, "a" should read --an--.
Line 40, "Drum)" should read --Drum>--.

COLUMN 13

Line 29, "rotatably" should read --rotatably supported--.

COLUMN 16

Line 18, "rubber" should read --rubber,--.

COLUMN 18

Line 54, "cross-section" should read --cross-sectional--.

COLUMN 19

Line 36, "gear 9c1" should read --gear 9c1 and the--.

UNITED STATES PATENT AND TRADEMARK OFFICE

CERTIFICATE OF CORRECTION

PATENT NO. : 5,825,472

DATED : October 20, 1998

INVENTOR(S) : RYUJI ARAKI ET AL.

It is certified that error appears in the above-identified patent and that said Letters Patent is hereby corrected as shown below:

COLUMN 22

Line 67, "wast" should read --waste--.

COLUMN 23

Line 40, "foregoing" should read --foregoing,--.

COLUMN 26

Line 18, "of" should be deleted.
Line 66, "4,000th" should read --4,000--.

COLUMN 27

Line 8, "4,000th" should read --4,000--.

COLUMN 28

Line 34, "hose" should read --those--.
Line 57, "sleeve 12b" should read --sleeve 12d--.
Line 58, "sleeve 12b," should read --sleeve 12d,--.

COLUMN 29

Line 3, "receptor" should read --the receptor--.
Line 5, "a location having" should read --in a location having
Line 14, "embodiment." should read --embodiment).--
Line 22, "deteriorated" should read --deteriorates--.

UNITED STATES PATENT AND TRADEMARK OFFICE

CERTIFICATE OF CORRECTION

PATENT NO. : 5,825,472

DATED : October 20, 1998

INVENTOR(S) : RYUJI ARAKI ET AL.

It is certified that error appears in the above-identified patent and that said Letters Patent is hereby corrected as shown below:

COLUMN 30

Line 44, "mount" should read --amount--.
Line 51, "the-engagement" should read --the engagement--.

COLUMN 33

Line 24, "sleeve 12b," should read --sleeve 12d,--.
Line 28, "sleeve 12b," should read --sleeve 12d,--.
Line 67, "sleeve 12b" should read --sleeve 12d--.

COLUMN 34

Line 6, "can-" should read --can--.
Line 13, "on a" should read --on the--.
Line 36, "in the" should read --in a--.
Line 39, "surface" should read --surface,--.
Line 66, "sleeve 12b," should read --sleeve 12d,--.

COLUMN 36

Line 7, "is or" should read --or is--.
Line 26, "sleeve 12b," should read --sleeve 12d,--.

COLUMN 40

Line 23, "in" should be deleted.

UNITED STATES PATENT AND TRADEMARK OFFICE

CERTIFICATE OF CORRECTION

PATENT NO. : 5,825,472

DATED : October 20, 1998

INVENTOR(S) : RYUJI ARAKI ET AL.

It is certified that error appears in the above-identified patent and that said Letters Patent is hereby corrected as shown below:

COLUMN 41

Line 26, "depicting," should be --described.--.
Line 27, "depicting" should read --depicting,--.
Line 30, "contact" should read --contacts--.

COLUMN 42

Line 60, "the vertical" should read --The vertical--.
Line 62, "the horizontal" should read --The horizontal--.
Line 65, "the distance" should read --The distance--.

COLUMN 43

Line 11, "{Structure-for" should read --{Structure for--.
Line 64, "moment" should read --movement--.

COLUMN 44

Line 1, "vibrations" should read --by vibrations--.

COLUMN 45

Line 46, "non-drive" should read --non-driven--.
Line 61, "it" should read --it is--.

UNITED STATES PATENT AND TRADEMARK OFFICE

CERTIFICATE OF CORRECTION

PATENT NO. : 5,825,472

DATED : October 20, 1998

INVENTOR(S) : RYUJI ARAKI ET AL.

It is certified that error appears in the above-identified patent and that said Letters Patent is hereby corrected as shown below:

COLUMN 49

Line 45, "on" should read --on it--.
Line 47, "likes" should read like--.

COLUMN 50

Line 15, "Bearing)" should read --Bearing>--.

COLUMN 52

Line 13, "can." should read --can--.

COLUMN 53

Line 2, "he" should read --the--.

COLUMN 55

Line 11, "educing" should read --reducing--.

COLUMN 56

Line 67, "can" should be deleted.

COLUMN 57

Line 9, "apparatus" should read --apparatus.--

UNITED STATES PATENT AND TRADEMARK OFFICE

CERTIFICATE OF CORRECTION

PATENT NO. : 5,825,472

DATED : October 20, 1998

INVENTOR(S) : RYUJI ARAKI ET AL.

It is certified that error appears in the above-identified patent and that said Letters Patent is hereby corrected as shown below:

COLUMN 59

Line 1, "demounting respectively" should read --demounting, respectively,--.
Line 31, "the" should read --said--.
Line 32, "said" should read --the--.

COLUMN 60

Line 12,"rear," should read --gear,--.
Line 15, "rear" should read --gear--.

COLUMN 63

Line 16, "the helical" should read --said helical--.
Line 25, "is" should read --is made--.

UNITED STATES PATENT AND TRADEMARK OFFICE

CERTIFICATE OF CORRECTION

PATENT NO. : 5,825,472

DATED : October 20, 1998

INVENTOR(S) : RYUJI ARAKI ET AL.

It is certified that error appears in the above-identified patent and that said Letters Patent is hereby corrected as shown below:

COLUMN 64

Line 5, "the driving" should read --a driving--.
Line 6, "a driving" should read --the driving--.

Signed and Sealed this

Twenty-seventh Day of June, 2000

*Attest:*

Q. TODD DICKINSON

*Attesting Officer*

*Director of Patents and Trademarks*